US009997342B2

(12) United States Patent
Jackson et al.

(10) Patent No.: US 9,997,342 B2
(45) Date of Patent: Jun. 12, 2018

(54) METHOD AND DEVICE FOR MASS SPECTROMETRIC ANALYSIS OF BIOMOLECULES USING CHARGE TRANSFER DISSOCIATION (CTD)

(71) Applicant: West Virginia University, Morgantown, WV (US)

(72) Inventors: Glen P. Jackson, Morgantown, WV (US); William D. Hoffmann, Morgantown, WV (US)

(73) Assignee: West Virginia University, Morgantown, WV (US)

( * ) Notice: Subject to any disclaimer, the term of this patent is extended or adjusted under 35 U.S.C. 154(b) by 0 days. days.

(21) Appl. No.: 15/269,573

(22) Filed: Sep. 19, 2016

(65) Prior Publication Data

US 2017/0084437 A1 Mar. 23, 2017

Related U.S. Application Data

(60) Provisional application No. 62/220,305, filed on Sep. 18, 2015.

(51) Int. Cl.
*H01J 49/26* (2006.01)
*H01J 49/00* (2006.01)

(52) U.S. Cl.
CPC ..... *H01J 49/0072* (2013.01)

(58) Field of Classification Search
CPC ..... H01J 49/00; H01J 49/0031; H01J 49/02; H01J 49/04
USPC ..... 250/281, 282, 283, 288
See application file for complete search history.

(56) References Cited

U.S. PATENT DOCUMENTS 9,188,564 B2 * 11/2015 Sulzer ..... H01J 49/145
2008/0048107 A1 * 2/2008 McEwen ..... H01J 49/0422 250/282
2009/0032700 A1 * 2/2009 Park ..... H01J 49/424 250/282

OTHER PUBLICATIONS

Bari, et al., Peptide fragmentation by keV ion-induced dissociation, Phys. Chem. Chem. Phys., 2010, 12, 3376-3383.
Bari, et al., Fast side-chain losses in keV ion-induced dissociation of protonated peptides, Int. J. of Mass Spec., 2011, 299, 64-70.

* cited by examiner

*Primary Examiner* — Nicole Ippolito
(74) *Attorney, Agent, or Firm* — Thomas | Horstemeyer, LLP

(57) ABSTRACT

Provided herein are devices, systems, and methods of CTD mass spectrometry analysis of biomolecules.

20 Claims, 107 Drawing Sheets

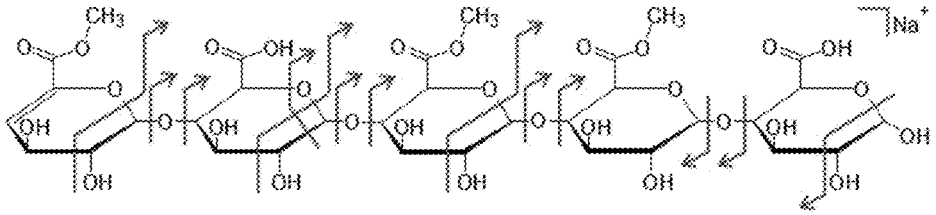
LE-CAD
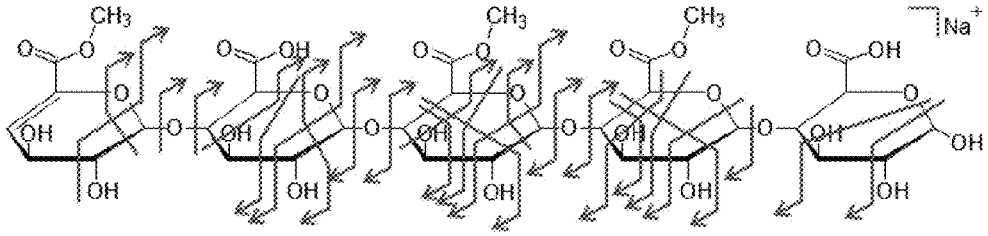
XUVPD
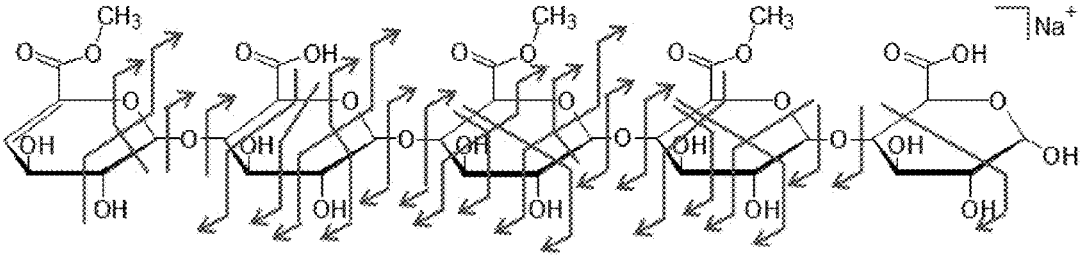
CTD
FIG. 19D

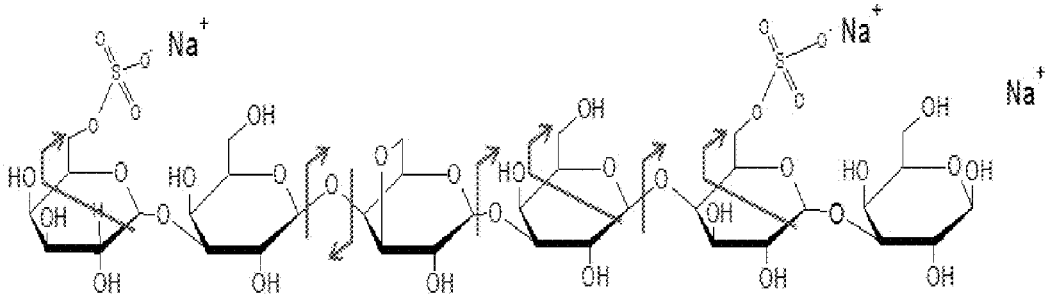
LE-CAD
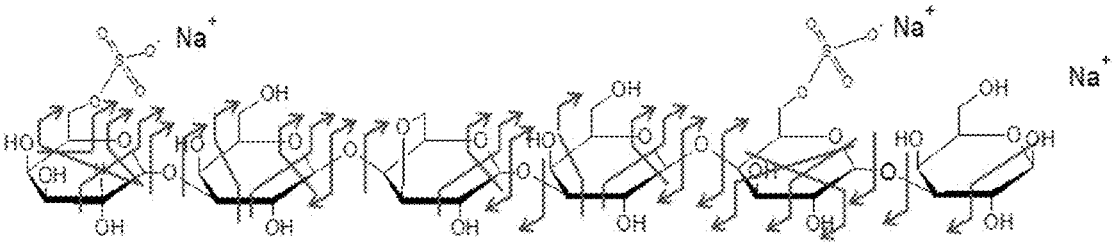
XUVPD
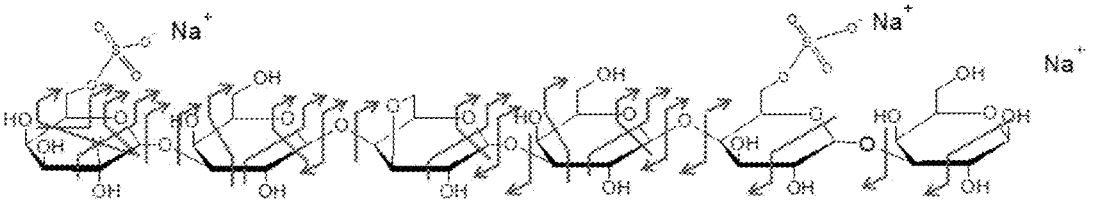
CTD
FIG. 20D

CTD of $[M+4H]^{4+}$
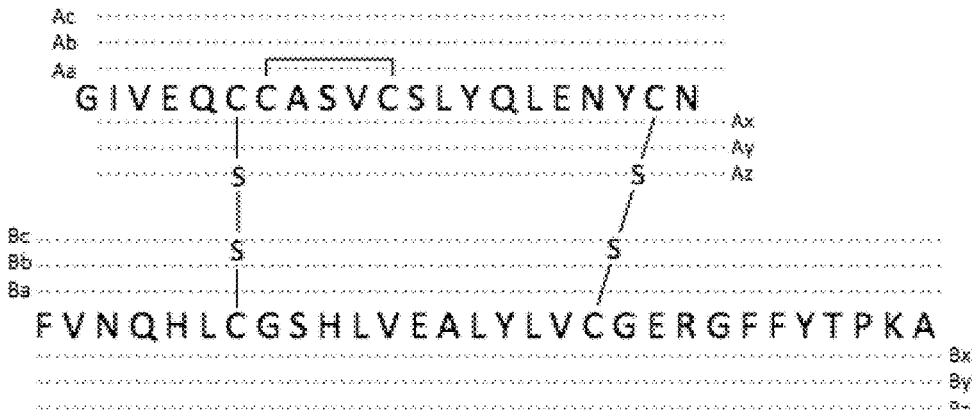
CTD of $[Insulin+5H]^{5+}$
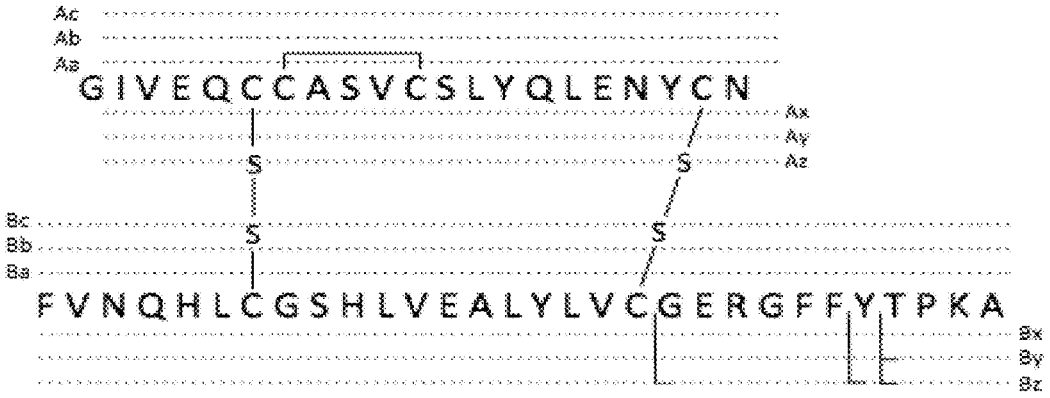
CTD of $[Insulin+6H]^{6+}$
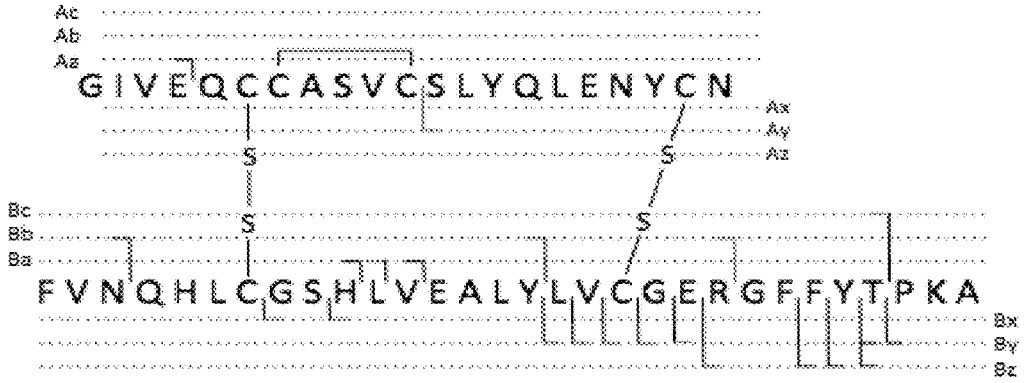
FIG. 22

CTD of $[M+4H]^{4+}$
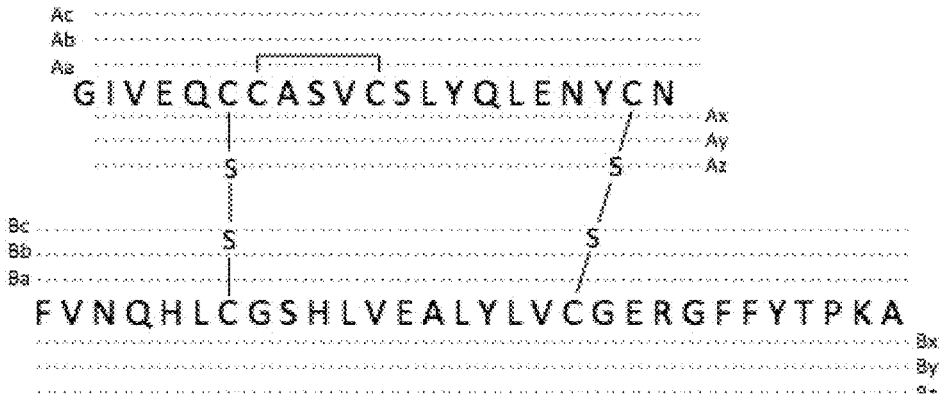
CTD of $[Insulin+5H]^{5+}$
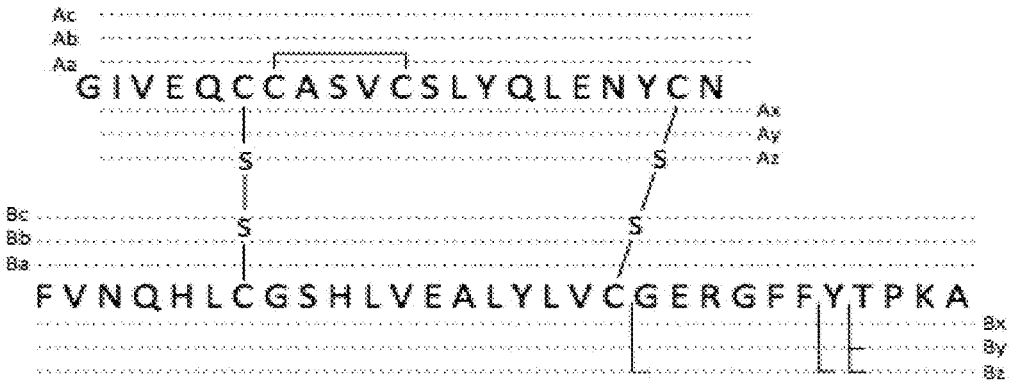
CTD of $[Insulin+6H]^{6+}$
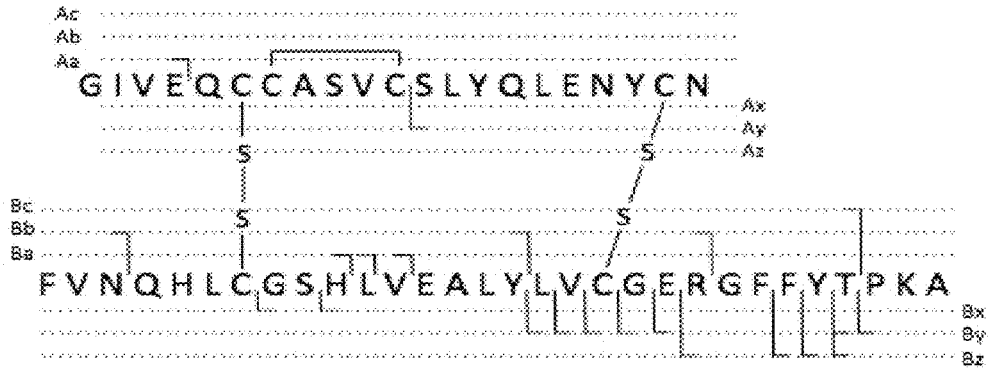
FIG. 23

MS$^3$ CID of [Insulin+4H]$^{5+\bullet}$

MS$^3$ CID of [Insulin+5H]$^{6+\bullet}$

MS$^3$ CID of [Insulin +6H]$^{7+*}$

Deuterium content obtained for various fragment ions

| Residue[a] | Residue number | Theoretical 100 % Scrambling[c] | Theoretical 0 % scrambling[c] | ETD Experimental[d] | ETD CV[e] | CTD Experimental (c-ion)[d] | CTD CV (c-ion)[e] | CTD Experimental (a-ion)[f] | CTD CV (a-ion)[e] |
|---|---|---|---|---|---|---|---|---|---|
| K | *1* | na | na | nd | na | na | na | nd | na |
| K | *2* | 1.32 | 0.61 | nd | na | nd | na | nd | na |
| D | *3* | 2.07 | 0.96 | 0.92 | 5.6 | nd | na | 1.18 | 6.9 |
| D | *4* | 2.44 | 1.14 | 1.22 | 5.3 | nd | na | 1.38 | 1.9 |
| D | *5* | 2.82 | 1.31 | 1.33 | 3.2 | nd | na | nd | na |
| D | *6* | 3.19 | 1.49 | 1.51 | 4.8 | 1.48 | 6.4 | nd | na |
| D | *7* | 3.57 | 1.66 | 1.58 | 6.1 | 1.81 | 20.2 | 1.81 | 0.6 |
| I | *8* | 3.95 | 2.39 | 2.46 | 3.3 | 2.78 | 4.5 | 2.54 | 3.1 |
| I | *9* | 4.13 | 3.03 | 3.18 | 4.1 | 3.12 | 4.9 | 3.03 | 4.8 |
| K | *10* | 4.32 | 3.67 | 3.57 | 2.7 | 3.75 | 2.9 | 3.35 | 0.8 |
| I | *11* | 5.07 | 4.57 | 4.58 | 3.2 | 4.82 | 3.2 | 4.07 | 0.6 |
| I | *12* | 5.26 | 5.21 | 5.57 | 1.5 | 5.51 | 1.2 | 5.01 | 0.4 |
| K | *13* | 5.45 | 6.00 | 6.22 | 0.4 | 5.97[g] | 0.7 | 5.91 | 0.6 |

a. Primary Sequence from model peptide (KKDDDDDIIKIIK).

b. Assigned amide backbone number from the model peptide (KKDDDDDIIKIIK). Note the first amide heteroatom begins at Residue 2.

c. Theoretical deuterium content values for *c*-ions generated from ETD-MS of $[KKDDDDDIIKIIK+3H]^{3+}$ precursor ions.

d. Average experimental deuterium content obtained by subtracting the average *m/z* of the labeled fragment ion from that of the unlabeled fragment ion. Deuterium content for the $n^{th}$ residue has been calculated from the $c_{n-1}$ fragment ion. Data was collected from at least 3 replicates.

e. Coefficient of variation expressed as a percentage.

f. Average experimental deuterium content obtained by subtracting the average m/z of the labeled fragment ion from that of the unlabeled fragment ion. Deuterium content for the $n^{th}$ residue has been calculated from the $a_n$ fragment ion. Data was collected from at least 3 replicates.

g. Deuterium content value was calculated from CTD-MS of $[KKDDDDDIIKIIK+2H]^{2+}$ precursor ions.

FIG. 43

$c_{11}$
$c_{12}$
$[M+H]^+/[M+2H]^{++}$
$[M+H]^+/[M+2H]^{++}/[M+3H]^{+++}$
Intensity (arbitrary)
m/z
1200
1205
1210
1215
1220
1430
1435
1440
1445
1560
1565
1570
1575
1580

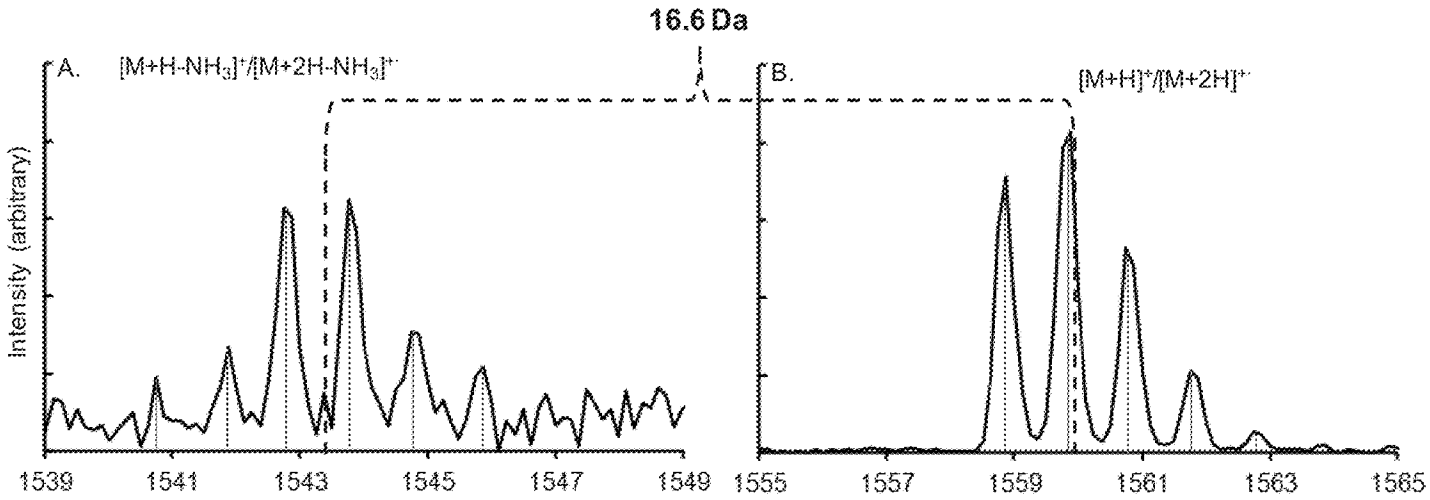
FIG. 47A
FIG. 47B
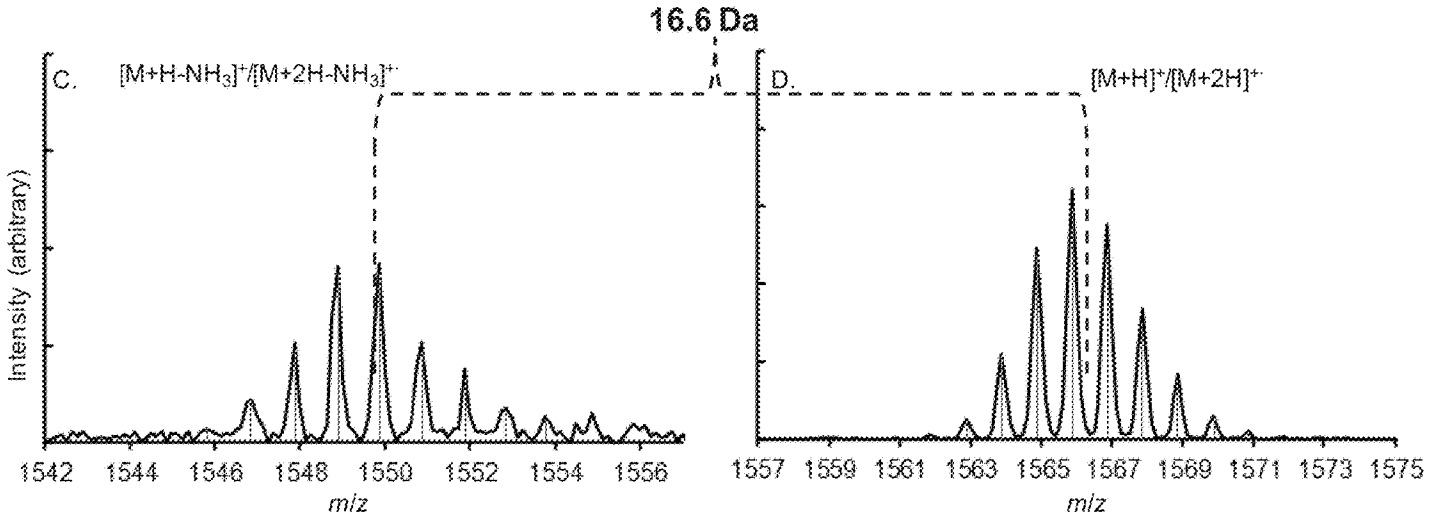
FIG. 47C
FIG. 47D

MQI F V K T L T G K T I T L deuterium content
residue number

V K T L T G K T I T L deuterium content
residue number

CTD ($MS^2$), with ESI off

Isolation of ion at *m/z* 184 ($MS^3$)

300 ms trap confinement of ion at *m/z* 184 ($MS^3$)
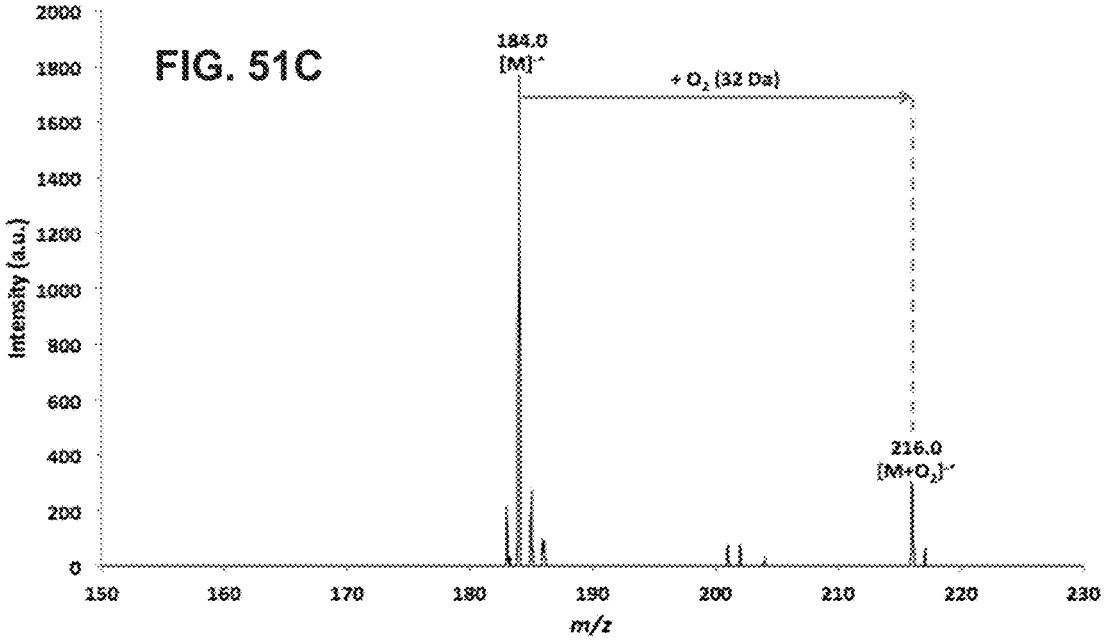
Isolation of ion at *m/z* 216 ($MS^4$)
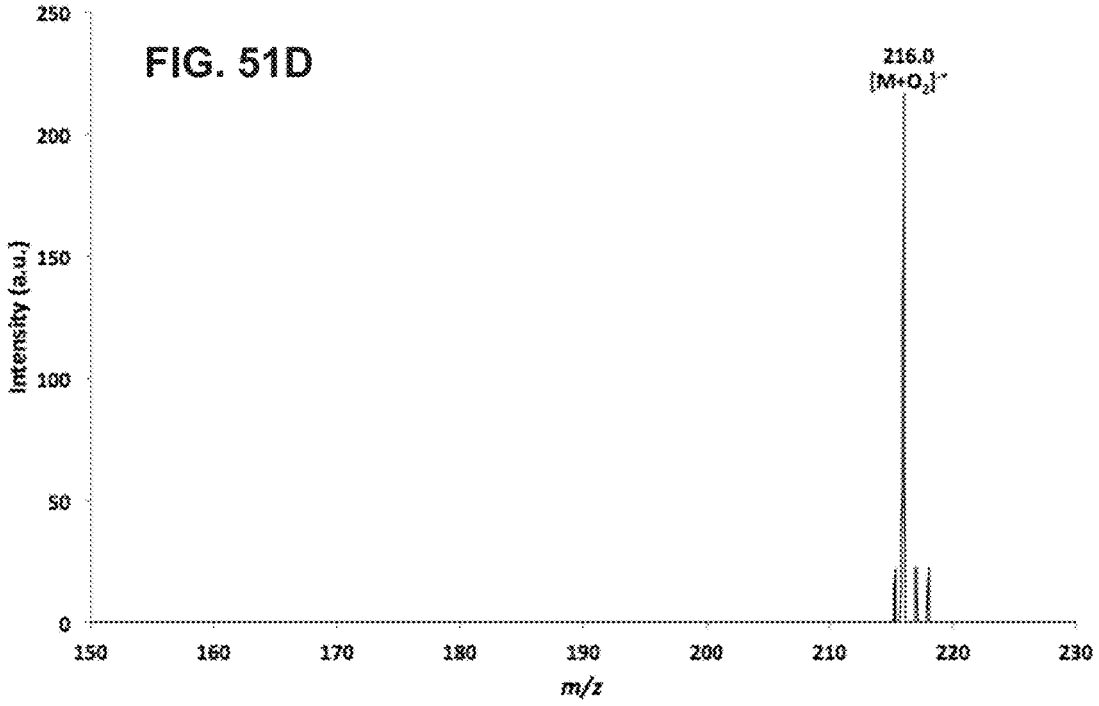

CID of ion at *m/z* 216 ($MS^4$)

Isolation of ion at *m/z* 184 ($MS^3$)

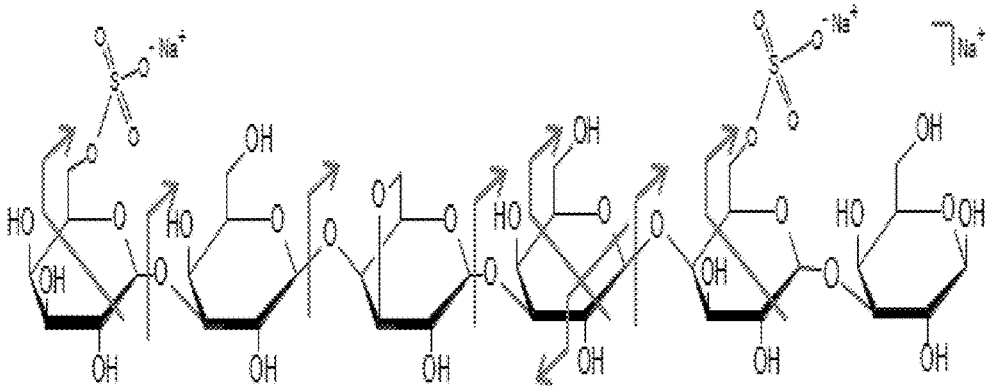
LE-CID
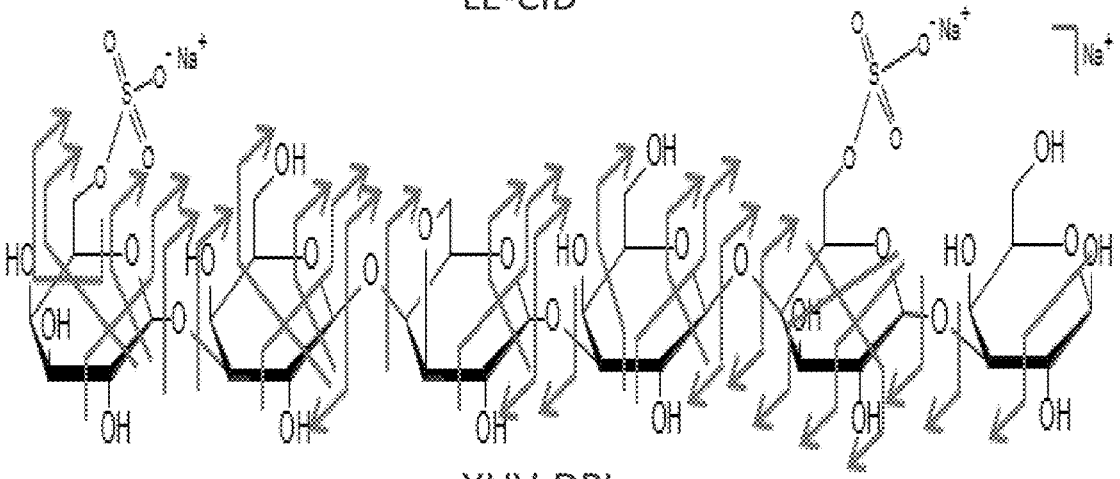
XUV-DPI
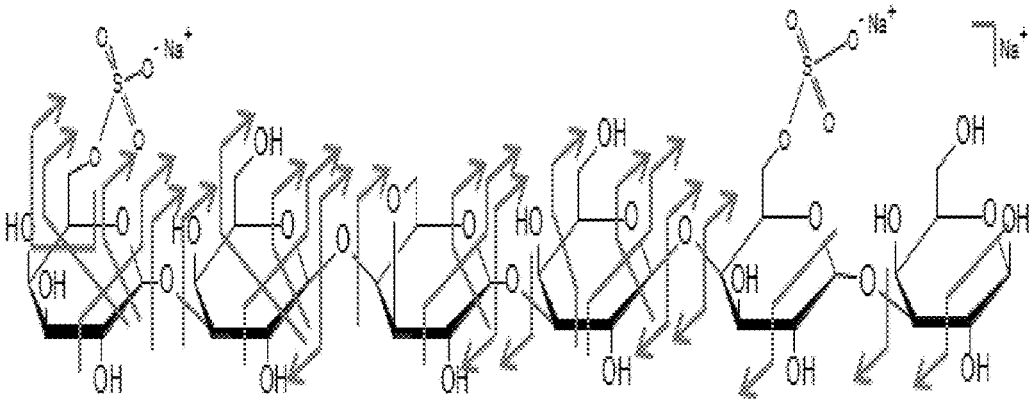
He-CTD
FIG. 54D

METHOD AND DEVICE FOR MASS SPECTROMETRIC ANALYSIS OF BIOMOLECULES USING CHARGE TRANSFER DISSOCIATION (CTD)

This application claims the benefit of and priority to U.S. Provisional Patent Application No. 62/220,305, filed on Sep. 18, 2015, entitled "METHOD AND DEVICE FOR MASS SPECTROMETRIC ANALYSIS OF BIOMOLECULES USING CHARGE TRANSFER DISSOCIATION (CTD)," the contents of which is incorporated by reference herein in its entirety.

STATEMENT REGARDING FEDERALLY SPONSORED RESEARCH OR DEVELOPMENT

This invention was made with government support under grant number 1R01GM114494-01 awarded by the National Institutes of Health. The government has certain rights in the invention.

BRIEF DESCRIPTION OF THE DRAWINGS

Further aspects of the present disclosure will be readily appreciated upon review of the detailed description of its various embodiments, described below, when taken in conjunction with the accompanying drawings.

FIGS. 16A-16C show head-to-tail zoomed-in spectra of reduced (charge-decreased) product ions of: (FIG. 16A) He-CTD versus ETD of 2+ substance P, (FIG. 16B) He-CTD versus), ETD of 3+ substance P, and (FIG. 16C) 1+ product ions from ETD of 3+ substance P. Each spectrum is normalized to the tallest peak within the ($M^{\square}$-X) range of charge-reduced product ions.

FIGS. 19A-19D show the fragmentation spectra of the homogalacturonan DP5DM3 isolated as a $[M+Na]^+$ obtained using (FIG. 19A) LE-CID, (FIG. 19B) XUV-PD and (FIG. 19C) CTD and corresponding structures (FIG. 19D). For schematic annotation, peaks labeled with: (●) represent reducing-end containing fragments, as evidenced by the $^{18}O$ labeling, (○) represent non reducing-end containing fragments; some fragments arise from both ends and are labeled with (◐). (⚲) are $H_2O$ losses, (⚲) are $CO_2$ losses, (⚲) are MeOH losses and (‡) correspond to double fragmentations (details about the double fragmentation are provided in Table 1). Doubly charged fragments are annotated with $^{2+}$/. label. Unambiguous fragments for each tandem MS approach were reported on the corresponding structures above (Underlined on the LE-CID spectra). For XUV-PD and CTD, specific fragments of each technic were highlighted with a box on the spectra.

FIGS. 20A-20D show fragmentation spectra of the DP6 hybrid Agar/Porphyran L6S-G-LA-G-L6S-G isolated as a $[M+3Na-2H]^+$ obtained using (FIG. 20A) LE-CID, (FIG. 20B) XUV-PD and (FIG. 20C) CTD and corresponding structures (FIG. 20D). For schematic annotation, peaks labeled with: (●) represent reducing-end containing fragments, as evidenced by the $^{18}O$ labeling, (○) represent non reducing-end containing fragments; some fragments arise from both ends and are labeled with (◐). (∇) are $H_2O$ losses, (†) correspond to sulfate losses and (‡) correspond to double fragmentations. Doubly charged fragments are annotated with $^{2+/}$. label. Unambiguous fragments for each tandem MS approach were reported on the corresponding structures above (Underlined on the LE-CID spectra). For XUV-PD and CTD, specific fragments of each technique were highlighted with a box on the spectra.

FIG. 22 shows reaction Scheme 1, which shows dissociation channels observed in CTD of insulin 4+, 5+ and 6+ charge states. Key for peptide sequencing: black line, product ions observed in charge state 1+; red line, product ions observed in charge state 2+; blue line observed in charge state 3+; fragment ion with another chain attached are marked a whole green line.

FIG. 23 shows CTD spectrum of insulin 5+.

(FIG. 32B) aMAD spectrum of [POPC+Na]+ (16:0/18:1); and (FIG. 32C) a CID spectrum of [POPC+Na]+ (16:0/18:1).

(FIG. 33A) MAD spectrum of $[POPC+H]^+$ (16:0/18:1); (FIG. 33B) CTD spectrum of $[POPC+H]^+$ (16:0/18:1); (FIG. 33C) CTD spectrum of $[PSPC+H]^+$ (16:0/18:0) with a precursor isolation window width=4.0; (FIG. 33D) CTD spectrum of $[PSPC+H]^+$ (16:0/18:0) with a precursor isolation window width=1.0.

(FIG. 36A) MAD spectrum of $[POPC+H]^+$ (16:0/18:1); CTD spectra of (FIG. 36B) $[POPC+H]^+$ (16:0/18:1) and (FIG. 36C) $[PSPC+H]^+$ (16:0/18:0). The green font shows the $C_nH_{2n+1}$-type losses.

(FIG. 37C) CID spectrum of $[9E-DOPC+H]^+$ (18:1/18:1); (FIG. 37D) CTD spectrum of $[9E-DOPC+H]^+$ (18:1/18:1); (FIG. 37E) CID spectrum of $[9Z-DOPC+H]^+$ (18:1/18:1); (FIG. 37F) CTD spectrum of $[9Z-DOPC+H]^+$ (18:1/18:1). The orange font in panel (FIG. 37D) and (FIG. 37F) shows the $C_nH_{2n-2}$-type losses and their tentative assignments.

(FIG. 38B) $[9Z-DOPC+H]^+$ (18:1/18:1). The light gray font shows the $C_nH_{2n-2}$-type losses and their tentative assignments.

FIGS. 39A-39B show zoomed-in regions from m/z 265-380 of CTD spectra of: (FIG. 39A) $[9E-DOPC+H]^+$ (18:1/18:1); (FIG. 39B) $[9Z-DOPC+H]^+$ (18:1/18:1).

(FIG. 41B) CTD spectrum of $[DAPC+H]^+$ (20:4/20:4); and (FIG. 41C) a zoomed-in region of CTD spectrum of $[DAPC+H]^+$ (20:4/20:4).

(FIG. 42C) The electronic components for pulsed operation during CTD-MS experiments.

FIG. 43 shows a table, which shows the theoretical limits (100% and 0%) for scrambling values calculated for the c-ion series of the model peptide.

(FIG. 44B) MS/MS (CTD) spectrum of $[KKDDDDDIIKIIK+2H]^{2+}$ precursor ions. Identified product ions resulting from CTD are labeled. FIGS. 44A-44B have been normalized to the respective precursor ion intensities and displayed as a percentage.

FIGS. 47A-47D show the isotopic distributions for (FIG. 47A) $[M+H—NH_3]^+/[M+2H—NH_3]^+$. ions and (FIG. 47B) $[M+H]^+/[M+2H]^+$. ions originating after MS/MS (CTD) of unlabeled $[M+2H]^{2+}$ model peptide precursor ions. Isotopic distributions for (FIG. 47C) $[M+H—NH_3]^+/[M+2H—NH_3]^+$. ions and (FIG. 47D) $[M+H]^+/[M+2H]^+$. ions generated from HDX-CTD-MS of $[M+2H]^{2+}$ model peptide precursor ions. The red lines show the centroid for each isotopologue used to calculate the average m/z values. Black dashed lines represent the average m/z determined from the isotopologues. The difference in the average m/z values between FIGS. 47A-47B and FIGS. 47C-47D) were used for determining HD-scrambling (see text for details). In each adjacent panel the mass difference was calculated as the loss of ammonia.

(FIG. 49B) Total fragment ion deuterium content plot for residues $V^5$-$L^{15}$ generated by ETD (*) and CTD (+) of labeled $[VKTLTGKTITL+3H]^{3+}$ ions. Sections of the beta-stranded region and the second beta strand across residues $V^5$-$T^7$ and $G^{10}$-$L^{15}$, respectively, are also shown. The error was calculated from triplicate measurements of respective fragment ions.

FIGS. 51A-51E show (FIG. 51A) CTD spectrum of pump oil residue at $MS^2$; (FIG. 51B) Isolation spectrum of ion at m/z 184 at $MS^3$; (FIG. 51C) Product ion spectrum after 300 ms trap confinement at $MS^3$; (FIG. 51D) Isolation spectrum of ion at m/z 216 at $MS^4$; and (FIG. 51E) CID spectrum of ion at m/z 216 at $MS^4$ with an activation voltage of about 0.5 V.

FIGS. 54A-54D show fragmentation spectra of the DP6 hybrid oligoporphyran isolated as a $[M+3Na-2H]^+$, obtained by: (FIG. 54A) LE-CID, (FIG. 54B) XUV-DPI and (FIG. 54C) He-CTD and corresponding structures (FIG. 54D). Spectra correspond to a 1-mn registration. Schematic annotation of ions: (●) reducing-end containing fragments, as evidenced by the $^{18}O$ labeling, (○) non-labeled fragments; (a) ions encompassing both $^{18}O$-labeled fragments and non-labeled fragments; (Δ) $H_2O$ losses; (†) sulfate losses; (‡) ions arising from a double fragmentation. Doubly charged fragments are annotated with $^{2+}$/. label. Unambiguous fragments for each tandem MS approach are reported on the corresponding structures on the left. Fragments are further detailed in Table 2.

DETAILED DESCRIPTION

Figure 1:
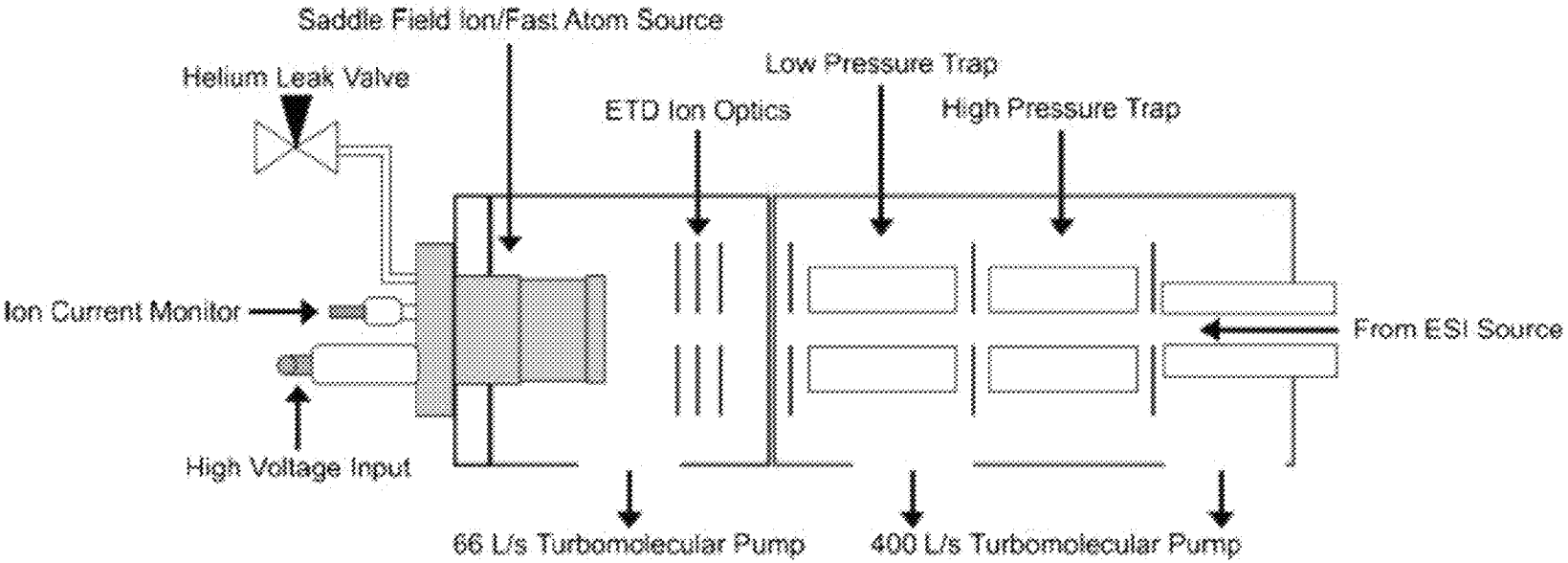
FIG. 1 shows one embodiment of a mass spectrometer configured to separate sample ions via charge transfer dissociation using helium cations.

Before the present disclosure is described in greater detail, it is to be understood that this disclosure is not limited to particular embodiments described, and as such may, of course, vary. It is also to be understood that the terminology used herein is for the purpose of describing particular embodiments only, and is not intended to be limiting.

Where a range of values is provided, it is understood that each intervening value, to the tenth of the unit of the lower limit unless the context clearly dictates otherwise, between the upper and lower limit of that range and any other stated or intervening value in that stated range, is encompassed within the disclosure. The upper and lower limits of these smaller ranges may independently be included in the smaller ranges and are also encompassed within the disclosure, subject to any specifically excluded limit in the stated range. Where the stated range includes one or both of the limits, ranges excluding either or both of those included limits are also included in the disclosure.

Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, the preferred methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present disclosure is not entitled to antedate such publication by virtue of prior disclosure. Further, the dates of publication provided could be different from the actual publication dates that may need to be independently confirmed.

As will be apparent to those of skill in the art upon reading this disclosure, each of the individual embodiments described and illustrated herein has discrete components and features which may be readily separated from or combined with the features of any of the other several embodiments without departing from the scope or spirit of the present disclosure. Any recited method can be carried out in the order of events recited or in any other order that is logically possible.

Embodiments of the present disclosure will employ, unless otherwise indicated, techniques of chemistry, physics, protein chemistry, molecular biology, organic chemistry, biochemistry, and the like, which are within the skill of the art. Such techniques are explained fully in the literature.

DISCUSSION

Tandem mass spectrometry (MS/MS) has been a core technology in the development of proteomics, metabolomics, and other branches of biomedical research (Aebersold and Mann; Nature. 422:198-207 (2003)). MS/MS is most commonly accomplished through collision-induced dissociation (CID), which relies on the conversion of kinetic to internal energy through ion/molecule collisions (McLuckey. J. Am. Mass Spectrom. 3:599-614 (1992) and Cooks. J. Mass Spectrom. 30:1215-1221 (1995)). Oftentimes, CID does not provide complete fragmentation of the peptide backbone and results in significant side-chain losses, including the loss of post-translational modifications. This complicates the interpretation of tandem mass spectra (Sleno and Volmer. J. Mass Spectrom. 39:1091-1112 (2004) and Palumbo and Reid. Anal. Chem. 80: 9735-9747 (2008)). These limitations have fueled a significant investment in alternative fragmentation techniques, including electron transfer dissociation (ETD) with cationic (Coon et al. J. Am. Soc. Mass Spectrom. 16:880-882 (2005); Shaw et al. Anal. Chem. 85:4721-4728; Xia et al., J. Am. Chem. Soc. 128: 11792-11798. (2006); Zhurov et al. Chem. Soc. Rev. 42:5014-5030 (2013)) or anionic (Coon et al (2005) and Stephenson and McLuckey. Rapid Comm. Mass Spectrom. 11:875-880 (1998)) precursor ions, electron capture dissociation (ECD) with cationic (Zhurov et al. (2013) and Zubarev et al. J. Am. Chem. soc. 120: 3265-3266 (1998)), or anionic precursor ions (Yoo et al. Anal. Chem. 80:4807-4819 (2008)), photodissociation (Gardner et al. Anal. Chem. 80:4807-4819 (2008); Madsen et al. J. Proteome Res. 9:4205-4214 (2010); Zhang et al. J. Am. Soc. Mass Spectrom. 17:1315-1321 (2006); He et al. J. Am. Soc. Mass Spectrom. 23: 1182-1190 (2012); He et al. J. Am. Soc. Mass Spectrom. 24:675-683 (2013); Webber et al. J. Am. Soc. Mass Spectrom. 25:196-2013 (2014); Kalcic et al. J. am. Chem. Soc. 131: 940-942 (2009); and Dunbar. Mass Spectrom. Rev. 23:127-158 (2004)), metastable atom-activated dissociation (MAD) (Misharin et al. Rapid Comm. Mass spectrom. 19:2163-2171 (2005); Berkout. Anal. Chem. 81:725-731 (2009); Berkout. Anal. Chem. 78: 3055-3061 (2006); Berkout. Intl. J. Mass Spectrom. 278: 150-157 (2008); cook et al. J. Mass Spectrom. 44:1211-1223 (2009); Cook and Jackson. J. Am. Soc. Mass Spectrom. 22:1088-1099 (2011); Cook and Jackson; J. Am. Soc. mass Spectrom. 22:221-232 (2011); and Cook et al. J. Mass Spectrom. 47: 786-794 (2012)), electron ionization dissociation (EID) (Fung et al. J. Am. Chem. Soc. 131:9977-9985 (2009)), and electron detachment dissociation (EDD) (Budnik et al. Chem. Phys. Lett. 342: 299-302 (2001)).

Each technique has its merits and limitations. Photodissociation techniques require a chromophore that can absorb at the incident wavelength to initiate fragmentation, and such chromophores can be relatively nonselective amide bonds (Gardner et al. (2008); Masden et al. (2010); Zhang et al. (2006); He et al. (2012); He et al. (2013); Webber et al. (2014); Kalcic et al. (2009); and Dunbar (2004)) or highly site-selective (Ly and Julian. J. Am. Chem. Soc. 132:8602-8609 (2010); Oh et al. Rapid Commun. Mass Spectrom. 18:2706-2712 (2004); and Hodyss et al. J. Chem. Soc. 127:12436-12437 (2005)). Chromophores can also include specific and native chromophores like disulfide bonds (Soorkia et al. J. Phys. Chem. Lett. 5:1110-1116 (2014)) but non-native chromophores are dependent on the ability to chemically modify the peptides or proteins of interest.

Although ETD/ECD fragmentation occurs on a timescale fast enough to prevent hydrogen scrambling, these techniques are typically limited to the fragmentation of multiply charged precursor ions ($z \geq 2+$). For example, non-dissociative electron/ion recombination becomes the dominant process as charge state decreases (Pitteri et al. Anal. Chem. 77:1831-1839 (2005); Pitteri et al. Anal. Chem. 77:5662-5669 (2005); and Liu and McLuckey. Int. J. mass. Spectrom. 330/332:174-181 (2012)). Because ETD/ECD requires multiply charged precursor ions, the 1+ and 2+ charge states will have the least efficient fragmentation (Liu and McLuckey. 2012). Although activated ion ETD (aiETD) (Ledvina et al. Angew. Chem. Int. ed. 48:8526-8528 (2009)) and electron transfer collisional activated dissociation (ETcaD) (Swaney et al. Anal. Chem. 79: 477-485 (2007)) provide better sequencing results for 2+ precursor ions, there remains a relative dearth in fragmentation methods available to dissociate 1+ and 2+ ions, which tend to dominate tryptic digests (Smith et al. Anal. Chem. 62: 882-899 (1990); Covey et al. Anal. Chem.: 63:1193-1200 (1991); Tang et al. Anal. Cham. 65: 2824-2834 (1993); and Tsaprailis et al. J. Am. Chem. Soc. 121:5142-5154 (1999)).

To date, the majority of ion/ion dissociation techniques have relied on cation/anion interactions because of their favorable cross-sections, as described by the Landau-Zener equation (Xia et al. 2006 and McLuckey and Mentinova. J. Am. Soc. Mass Spectrom. 22: 3-12 (2011)). Cation/cation reactions lie behind a Coulombic repulsion barrier of a few eV and are therefore difficult to achieve in quadrupole and linear ion traps (Chingin et al. Anal. Chem. 86:372-379 (2014). However, the use of a microwave air plasma to produce a variety of charged and neutral species for the dissociation of multiply charged angiotensin I and ubiquitin precursor ions has been demonstrated (Chingin et al. 2014). The beam emerging from the microwave plasma chamber was accelerated to 1-2 keV to overcome the Coulombic barrier between the cationic reagents. The results showed a combination of charge reduction, charge increase, and dissociation with ions characteristic to CID and ECD reactions. Chingin et al. 2014 used an unknown mixture of reagent air cations such as $O_2^+$. and $N_2^+$..

With that said, described herein are mass spectrometric methods and devices that can utilize a helium-based ion gun to generate a beam of He cations that generate radical fragmentation of an ionized sample via charge transfer dissociation. Other compositions, compounds, methods, features, and advantages of the present disclosure will be or become apparent to one having ordinary skill in the art upon examination of the following drawings, detailed description, and examples. It is intended that all such additional compositions, compounds, methods, features, and advantages be included within this description, and be within the scope of the present disclosure.

Charge Transfer Dissociation Mass Spectrometry

Mass spectrometry (MS) is an analytical method that employs ionization and mass analysis of compounds to determine the mass, formula, and structure of the compound being analyzed. In a typical MS procedure, a sample is ionized and fragmented. As previously discussed, current methods of ionization/fragmentation are not very effective at dissociating 1+ and 2+ ions present in the ionized sample, thus resulting in poor structural information for these molecules. Many activation methods are also not applicable or beneficial towards negatively charged precursor ions.

In mass spectrometry, fragmentation is the dissociation of energetically unstable molecular ions formed by ionizing the sample molecule within the mass spectrometer. Fragmentation is a type of chemical dissociation that can take place by homolytic or heterolytic bond cleavages and can occur via radical- and non-radical mediated methods. The fragmentation methods described herein can be a radical mediated fragmentation. Fragmentation can be used to interrogate the structural, conformational and stereoisomer (epimer) composition regarding a samples analyzed by mass spectrometry.

Described herein are methods of mass spectrometry and devices that can generate radical fragmentation via charge transfer dissociation induced via $He^+$. As previously mentioned, cation/cation reactions lie behind a Coulombic repulsion barrier of a few eV and are therefore difficult to achieve in quadrupole and linear ion traps. The methods described herein can use a helium-based ion gun to generate a beam of He cations. The beam of He cations can have a well-defined electron affinity (EA) of about 24.6 eV. The EA can be larger than that of $O_2^+$. and 1) $N_2^+$.. The methods described herein can drive reactions that are intractable through the use of reagents having smaller EAs.

Given sufficient kinetic energy to overcome the Coulombic barrier, one would expect a reaction between a target protonated peptide and helium cation to be:

$$[M+H]^+ + He^+ \rightarrow [M+H]^{2+} + He \rightarrow \text{fragments} \qquad \text{(Eq. 1 or Reaction 1)}$$

where the abstraction of an electron by the helium ion can create a hole on the analyte precursor ion, which drives radical fragmentation. Helium cations have an electron affinity of 24.6 eV. When the target precursor in Reaction 1 is a neutral, the analogous reaction is called dissociative charge transfer and has been extensively studied for small organic neutrals (McMahon. J. Mass. Spectrom. 200: 187-199 (2000)). The term charge transfer dissociation (CTD) was adopted and is used herein to describe this class of reactions. CTD of peptide anions was expected to be similar to negative nETD (Coon et al. 2005 and Stephenson and McLuckey 1997), except that additional translation energy is expected to be available for reaction in CTD. Another difference between nETD and CTD is that in CTD, the reagent cations do not have to be co-stored with the analyte ions in an electrodynamic trap (e.g. 2D or 3D ion trap), so CTD can more-easily utilize the beneficial $He^+$ cation as a reagent ion. Trapping devises like 2D and 3D ion traps typically struggle to co-store low mass ions ($m/z<25$) with high mass ions $m/z>500$, so are restricted to heavier noble gas cations like argon and xenon (Coon et al. 2005 and Stephenson and McLuckey 1997).

In some embodiments, mass spectrometry analysis of a sample can contain the steps of contacting a sample with high energy cations and fragmenting the ionized sample via CTD. In some embodiments, the methods described herein can take place within a device described herein. In some embodiments, a high energy (1 keV or greater, e.g. 1-15 keV) ion source can be used to introduce high energy ions into a mass spectrometer capable of ion storage. In some embodiments, the ion source can be an ion gun configured to generate and deliver high energy ions to the mass spectrometer. High energy ions can be generated from an ion precursor. The high energy ions can be cations. In some embodiments, the high energy ions can be noble gas cations. In some embodiments, the high energy ions are helium cations ($He^+$), neon cations ($Ne^+$), argon cations ($Ar^+$), or krypton cations ($Kr^+$), which may have additional or complementary benefits because of their different ionization potentials, reaction cross-sections and center-of-mass collision energies.

The mass spectrometer can be configured to contain a reagent ion source and a sample or analyte ion source. The reagent ion source can be an ion gun as shown in FIG. 1. Analyte ion sources are generally known in the art. The flux and kinetic energy of the noble gas reagent ions can be controlled through the flow (pressure) of reagent gas, electrical potentials in the source, and ion optics between the source and the ion trap, where the analyte ions are stored. Flow of the ion precursor can be a noble gas, such as He, Ne, Ar or Kr. The reagent ion source can be operatively coupled to a high voltage energy input source (see e.g. FIG. 1).

The mass spectrometer can also contain an ion reagent device. The ion reagent device of the mass spectrometer can contain an analyte, an analyte precursor ion, an analyte fragment ion, a reagent ion, and combinations thereof. The ion reagent device can contain an analyte and or various ions for any amount of time. In some embodiments, the ion reagent device can be used to store ions. The ion reagent device can be any device that is configured to contain ions as described herein. In some embodiments, the ion reagent device can be a linear ion trap (see e.g. FIG. 1), a 3D quadrupole ion trap, a toroidal ion trap, a rectilinear ion trap, or any other rf/dc trapping device. The ion reaction device can contain stored ions, such as ionized analyte ions, that can be produced, for example, by any ambient or sub-ambient ion source, including variations of electrospray ionization, matrix-assisted laser desorption ionization (MALDI). In some embodiments, the ion reaction device can selectively store ions based on their m/z values, cross-sectional diameters, and/or differential mobilites.

The mass spectrometer can also contain one or more ion selection devices. The ion selection device can be operatively coupled to the reagent ion source, the analyte ion source, and/or the ion reaction device. The ion selection device can be configured to separate or select ions based on their mass to charge (m/z) ratios, collision cross sections or differential mobilities. The mass spectrometer can be configured such that analyte or reagent ion selection can occur before, after, or simultaneously with CTD.

When the mass spectrometer is configured such that the analyte precursor ion or other ion is passed through the ion selection device prior to interacting with or contacting the reagent ion, the specific analyte precursor ion or other ion or ion conformers that can react with the reagent ion can be controlled. In other words, the ion selection device can be coupled to the mass spectrometer such that specific ions or conformers can be selectively exposed to CTD. In the same way, the ion reaction device can be configured to selectively contain specific ions or conformers and thus control which ions or conformers are exposed to CTD. In these embodiments, the ion reaction device can also be the ion selection device.

In some embodiments, the ion reaction device or the ion selection device can be a 2D or 3D ion trap (suitable ion traps are described elsewhere herein) or ion mobility device, such as a conventional ion mobility spectrometer (IMS), differential mobility spectrometer (DMS), overtone mobility spectrometer (OMS), field asymmetric ion mobility spectrometer (FAIMS) and travelling wave mobility spectrometer (TWMS).

Electrical potentials applied to the reagent ion source and ion optics facilitate the movement of the reagent ions into the ion reaction device of the mass spectrometer, which is operatively coupled to the reagent and analyte ion sources. The kinetic energy applied to the reagent ions can be greater than about 1 keV. In some embodiments, the kinetic energy applied to the reagent ions can range from about 0.1 to about 15 keV. In further embodiments, the energy applied to the ion source can be about 6 keV. The energy can be applied constantly or in shaped pulses. In some embodiments, the shaped energy pulse can be a square wave. In other embodiments the shaped energy pulse can be any desired waveform, including a triangular or rectangular waveform. The pulse of ions can be timed to coincide with a storage period of the isolated precursor ions within the mass spectrometer. One of skill in the art will appreciate that this timing will depend on inter alia the exact configuration of the spectrometer, the ion storage method, ion energy, and analyte. In some embodiments, the ions can be pulsed into the ion reaction device of the mass spectrometer for durations of about 1 to about 10,000 ms. It will be appreciated that the reaction times can be varied due to, inter alia, the conditions and nature of the experiment. In other embodiments, it may be desirable to react the reagent ions and analyte in crossed beams.

Ions generated by the reagent ion source (i.e., reagent ions) can optionally pass through one or more ion focusing elements prior to entering the ion reaction device of the mass spectrometer. The ion focusing element can contain one or more ion focusing lenses configured to focus or otherwise shape the ion beam. In some embodiments, the ion focusing element can be an existing ion focusing element on a mass spectrometer, such as electron transfer dissociation (ETD) optics. In some embodiments, the ion focusing element can be contained within the ion reaction device of the mass spectrometer. Although CTD can be achieved by passing high energy ions through pre-existing ion focusing elements not specific for CTD, a greater effective flux of high energy ions can be achieved by passing through an ion focusing element configured to increase the overlap between the high energy ion beam and the stored precursor ions present in the ion reaction device of the mass spectrometer. This ion focusing element can be in addition to any existing ion focusing elements already existing on the mass spectrometer and can be internal to the mass spectrometer or ion source, or can be external to the ion source or mass spectrometer. In some embodiments, an external power supply(ies) can be added to existing ion focusing elements to improve the focusing and utilization of the high energy ion beam. The power supply(ies) can be configured to apply selected voltages with appropriate magnitudes to focus the 0.1-15 keV reagent ions.

The ion optics can have sufficiently high electrical potentials applied to them to focus or shape the high-energy reagent ion beam. In general, the better the degree of spatial and temporal overlap between the reagent and precursor ion clouds, the better will be the reaction efficiency. Reaction efficiency will also be influenced by kinetic energy of the reacting partners. Optical systems that achieve optimal efficiency will therefore vary depending on the storage device, ion source, precursor ions and reagent ions.

In the ion reaction device, the analyte, which can be ionized (i.e., analyte ions), can come in contact with and interact with the high-energy ions. In some embodiments, the analyte can have a charge state of +1, +2 or greater. In some embodiments, the analyte can be negatively charged. Upon interaction of the analyte ions and the high energy reagent ions, CTD can occur and result in fragmentation of the analyte. In some embodiments, the CTD reaction times can occur in about 1 second or less. In other words, the reaction time can be about 1 second or less. In some embodiments, the reaction time can be about 1 to about 100 ms. Reaction times can vary depending on the efficiency of the CTD reactions in a given application.

CTD can be preceded by, followed by, and/or be conducted concurrently with a method ion selection or separation, including but not limited to, separation/selection based on ion m/z ratio, collisional cross section, and/or differential mobility. Ion selection can be carried out by an ion selection device configured to separate or select ions based upon their m/z ratios, collisional cross sections, and/or differential mobilities. Suitable ion selection devices are generally known in the art. Any ion present in the mass spectrometer, including but not limited to, the analyte precursor ions, the analyte fragment ions, conformers thereof, and combinations thereof can be selected for or against by the ion selection device.

In some embodiments, precursor or product (e.g. fragment) ion selection can be conducted by passing the ionized and fragmented sample through a magnetic or electric field to affect the velocity of the charged particles in some way that allow the analyzer to distinguish between different fragments. For example, in methods based on a sector instrument, the electric and/or magnetic field can affect the path of the ionized fragments according to their m/z ratios.

In some embodiments, precursor or product ion selection can be based on time-of-flight, where the ionized fragment is passed through an electric field that can accelerate ions through the same potential and the time taken to reach the detector is measured. Fragments can be separated on charge and where fragments have the same charge (i.e. the kinetic energy will be the same between particles) the lighter ions will reach the detector first. In other words, the velocities of the fragments with the same charge will be solely dependent on the masses of the fragments. In further embodiments, ion selection can be achieved by passing the ionized fragments through a quadrupole mass filter, which uses oscillating electrical fields to selectively stabilize or destabilize the paths of ions passing through a radio frequency (RF) quadrupole field created between 4 parallel rods. In other embodiments, ion selection can be achieved by passing the ionized fragments through an ion trap. Suitable ion traps include, but are not limited to a three dimensional quadrupole ion trap, rectilinear ion trap, toroidal ion trap, cylindrical ion trap, linear quadrupole ion trap, or an Orbitrap.

In some embodiments, it may be desirable to separate product ions of CTD based on their collision cross sections through the use of an ion mobility device. Such capabilities would enable another dimension of analytical capability and would be beneficial for structural analyses. Examples of ion mobility devices that might be coupled with CTD could include high field or low field, and high pressure or reduced pressure devices, including IMS, FAIMS, OMS, TWMS, and DMS.

Other mass selection techniques of ionized fragments will be appreciated by one of ordinary skill in the art without undue experimentation. In some embodiments, the ion traps used for separation can be the same as the ion reaction device of the mass spectrometer. In some embodiments, these ion traps are in addition to the ion trap(s) that can be used for ion storage and the CTD reaction.

After final ion selection, CTD, or additional activation, the ionized fragments pass by or come in contact with a surface of a detector. The detector can convert the charge induced or the current produced when the ionized fragments pass by or come in contact with the surface of the detector into a signal or digital output or recording. Where a scanning method is utilized, the output produced by the detector during the time of the scan versus when the instrument is in the scan (at what m/z) will produce a mass spectrum, a record of ions as a function of m/z. In some embodiments, the detector can contain an electron multiplier. Suitable electron multipliers are generally known in the art.

Optionally, the sample can be fractionated prior to being introduced into the mass spectrometer. Suitable fractionation techniques include, without limitation, liquid chromatography and high-performance liquid chromatography. Other suitable fractionation techniques will be appreciated by those of skill in the art.

In addition to activation by CTD, analyte precursor ions and/or analyte ion fragments can be additionally activated via a collisional, photo, and/or electron-based activation method(s). Such methods are generally known in the art, and they can be helpful for manipulating the charge state, presence of radicals, internal energy and conformation of precursor or product ions to achieve desirable outcomes. This additional activation can be carried out by an activation device that is secondary to the components that carry out CTD. The secondary activation device can be operatively coupled to the reagent ion source, the analyte ion source, and/or the ion reaction device. Suitable additional activation devices are generally known in the art.

EXAMPLES

Now having described the embodiments of the present disclosure, in general, the following Examples describe some additional embodiments of the present disclosure. While embodiments of the present disclosure are described in connection with the following examples and the corresponding text and figures, there is no intent to limit embodiments of the present disclosure to this description. On the contrary, the intent is to cover all alternatives, modifications, and equivalents included within the spirit and scope of embodiments of the present disclosure.

Example 1

Figure 2:
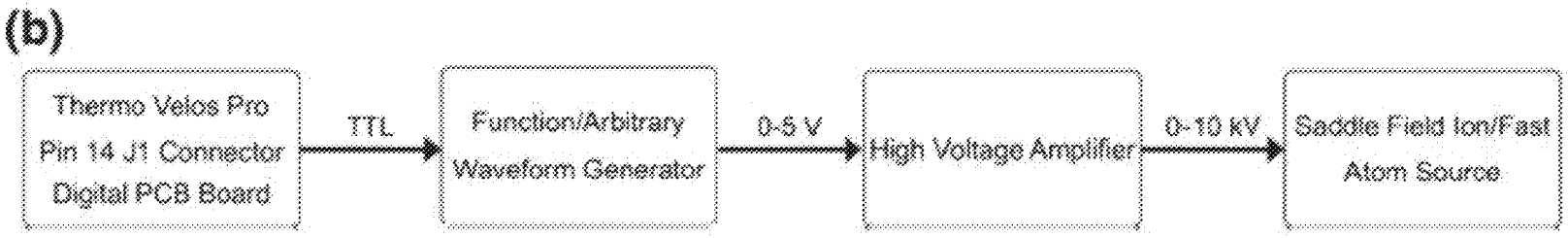
FIG. 2 shows a box diagram of the signal flow and electronic components used to time and pulse the saddle field source of the mass spectrometer of FIG. 1.
Figure 7:
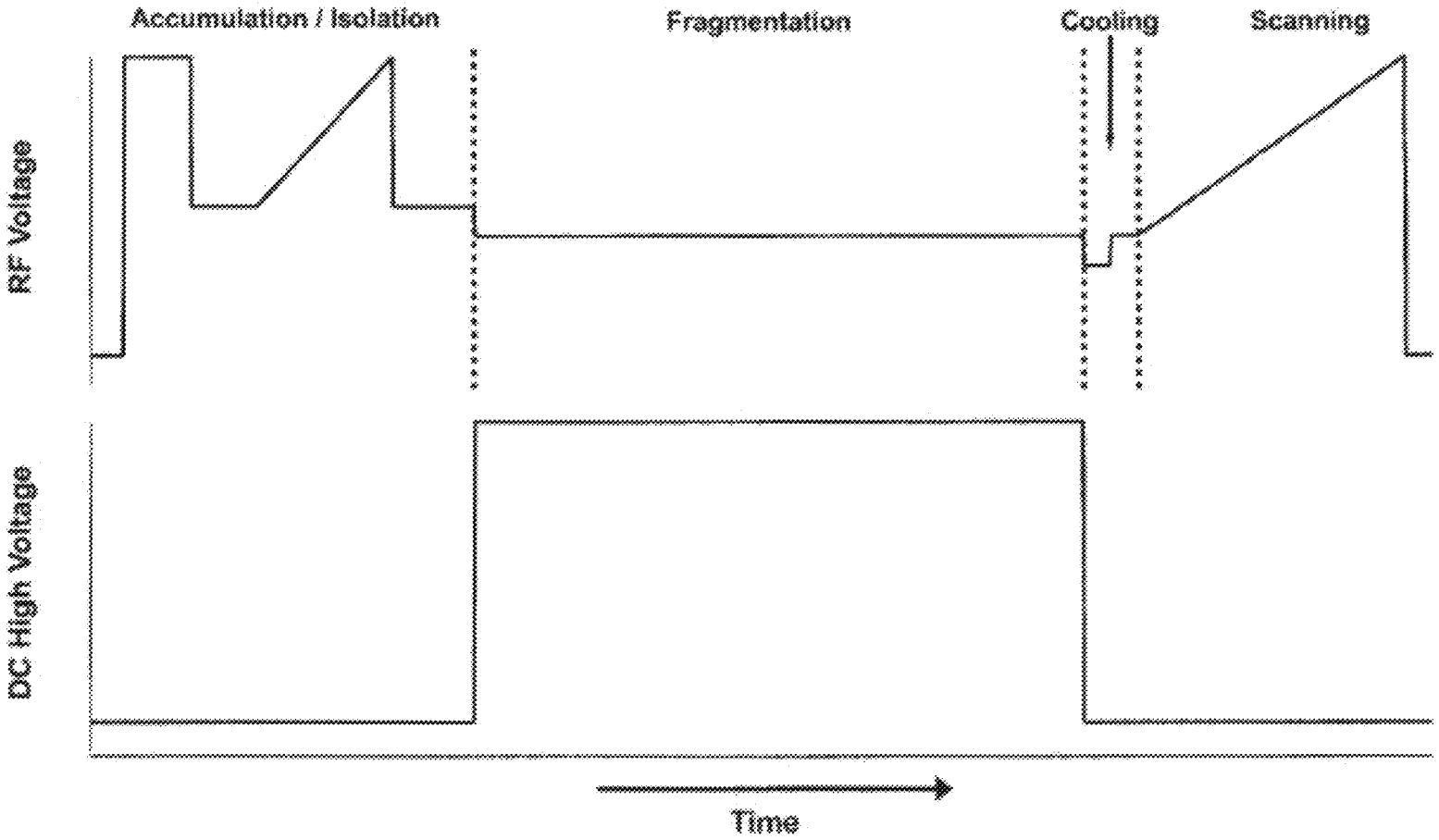
FIG. 7 shows a schematic representation of the alignment of the analytical radio frequency (RF) waveform from a mass spectrometer and the high voltage DC output from the high voltage amplifier.
Figure 8:
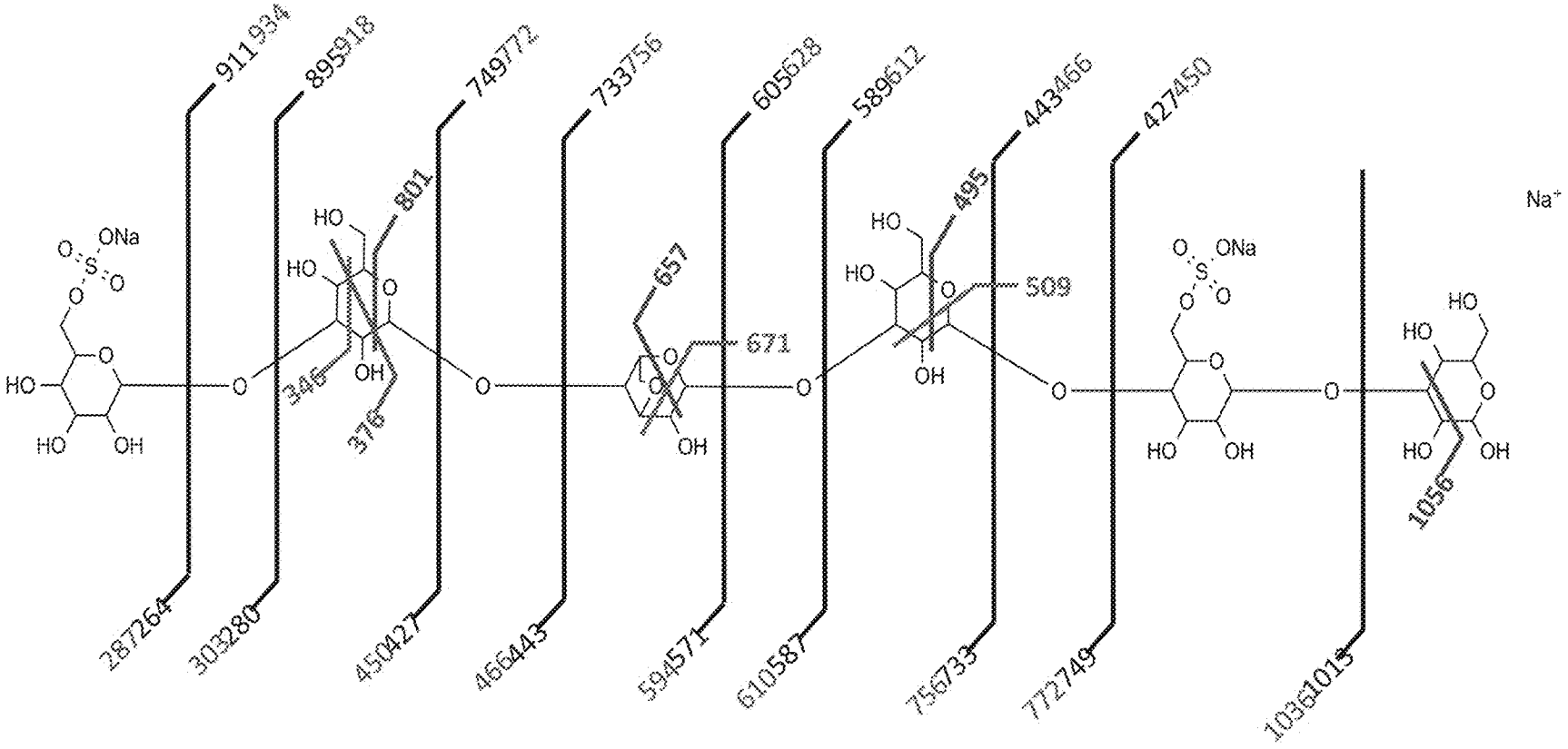
FIG. 8 shows the fragments identified following CTD of isolated m/z 1199.20 1+ saccharide PorA DP6.
Figure 9:
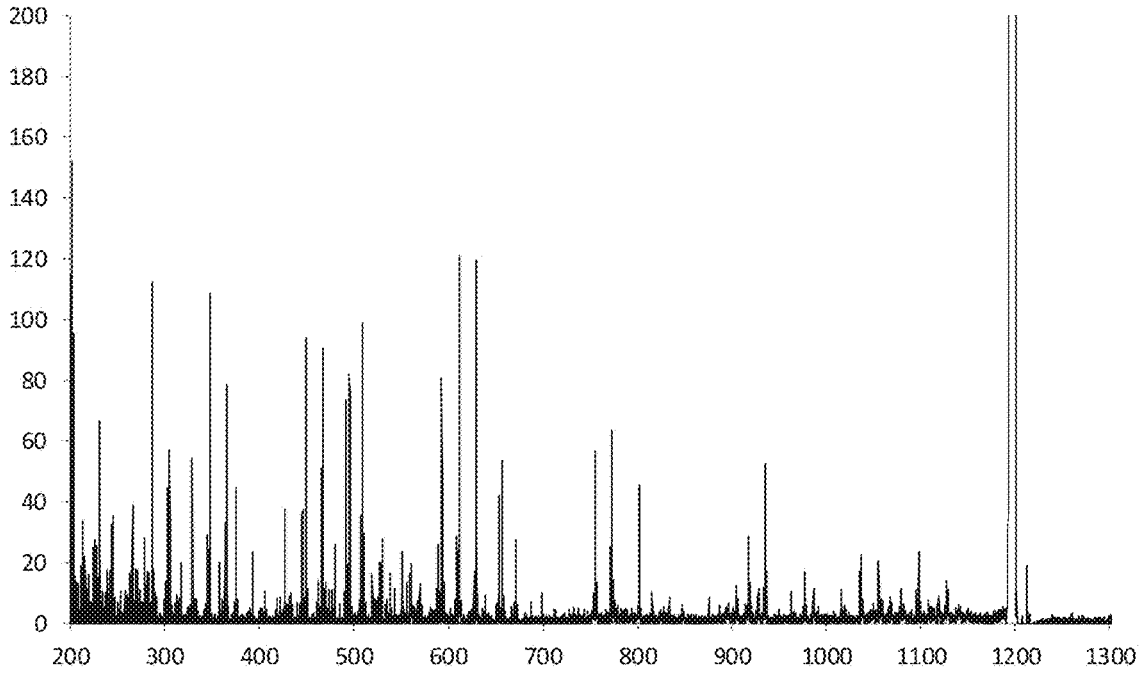
FIG. 9 shows the mass spectrum produced from CTD fragmentation of m/z 1199.20 1+ saccharide from PorA DP6.
Figure 10:
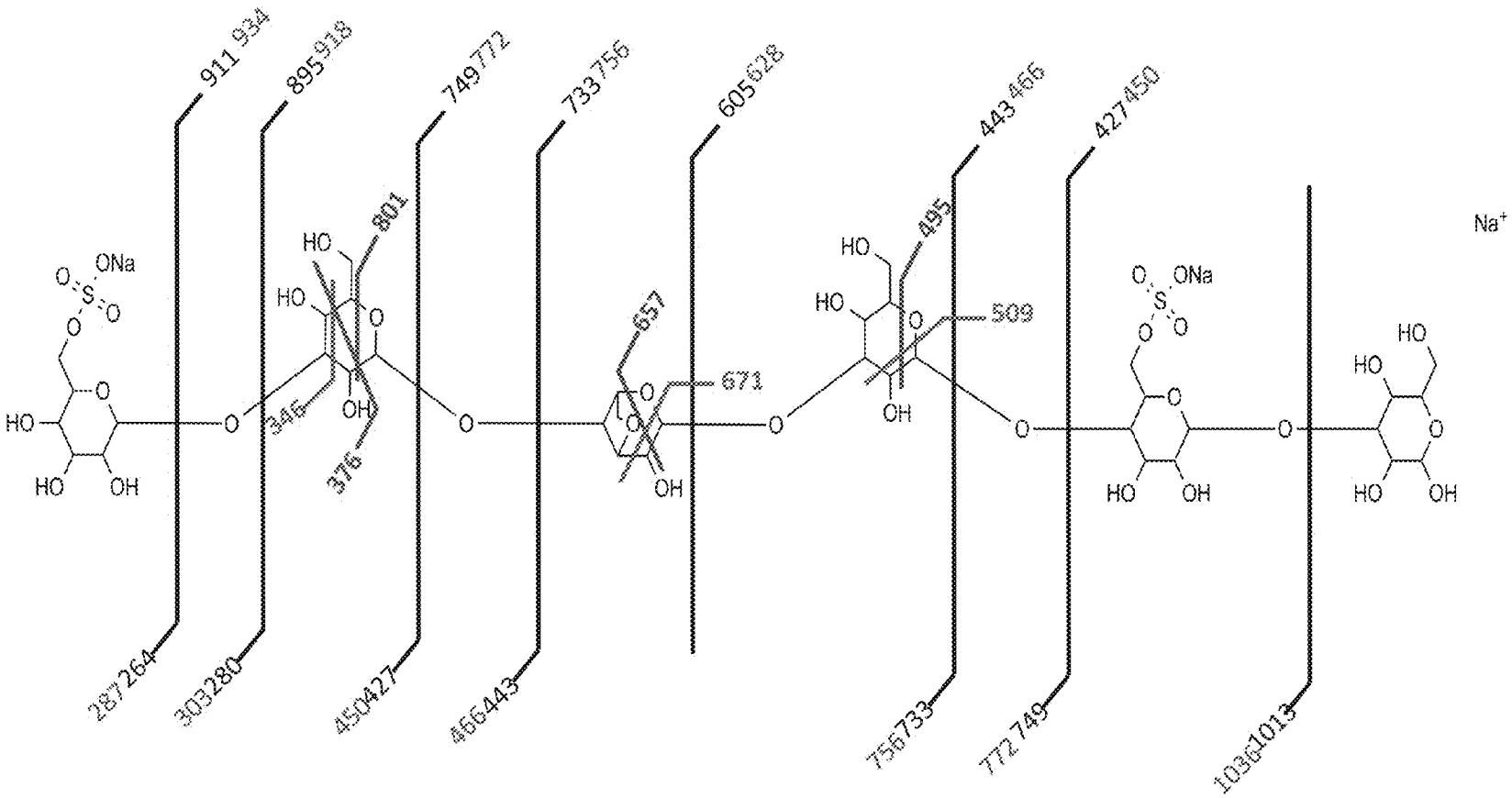
FIG. 10 shows the fragments identified following CTD of isolated m/z 611 2+ saccharide from PorA DP6.
Figure 11:
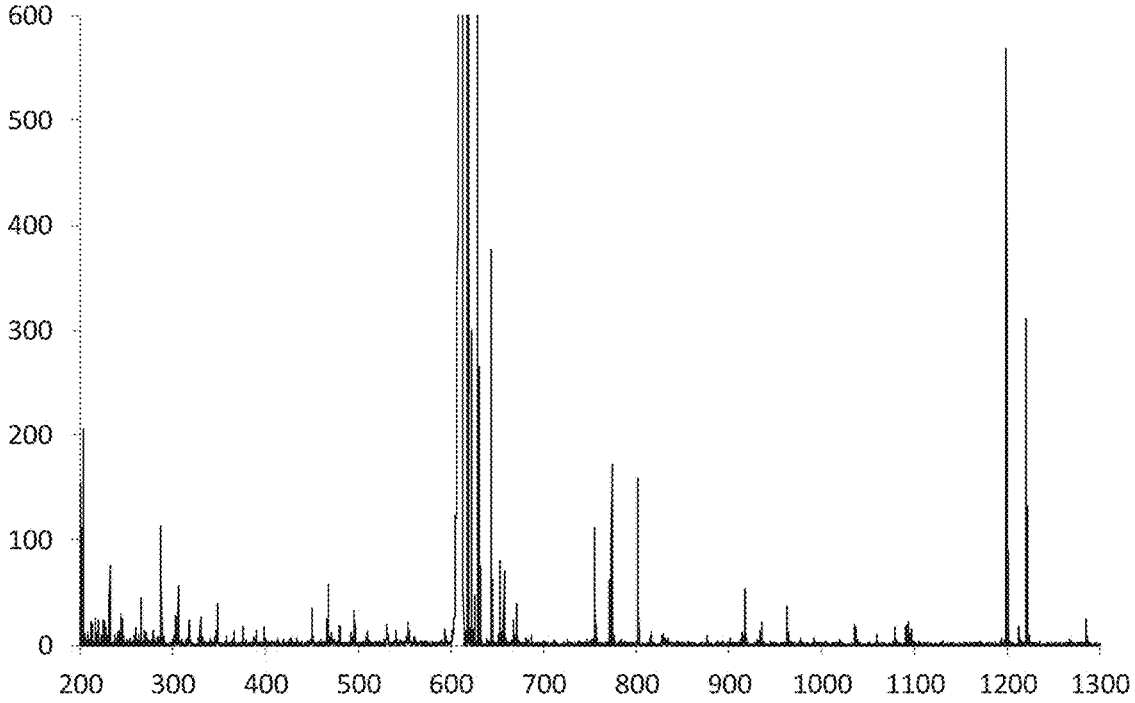
FIG. 11 shows the mass spectrum produced from CTD fragmentation of m/z 611 2+ saccharide from PorA DP6.
Figure 12:
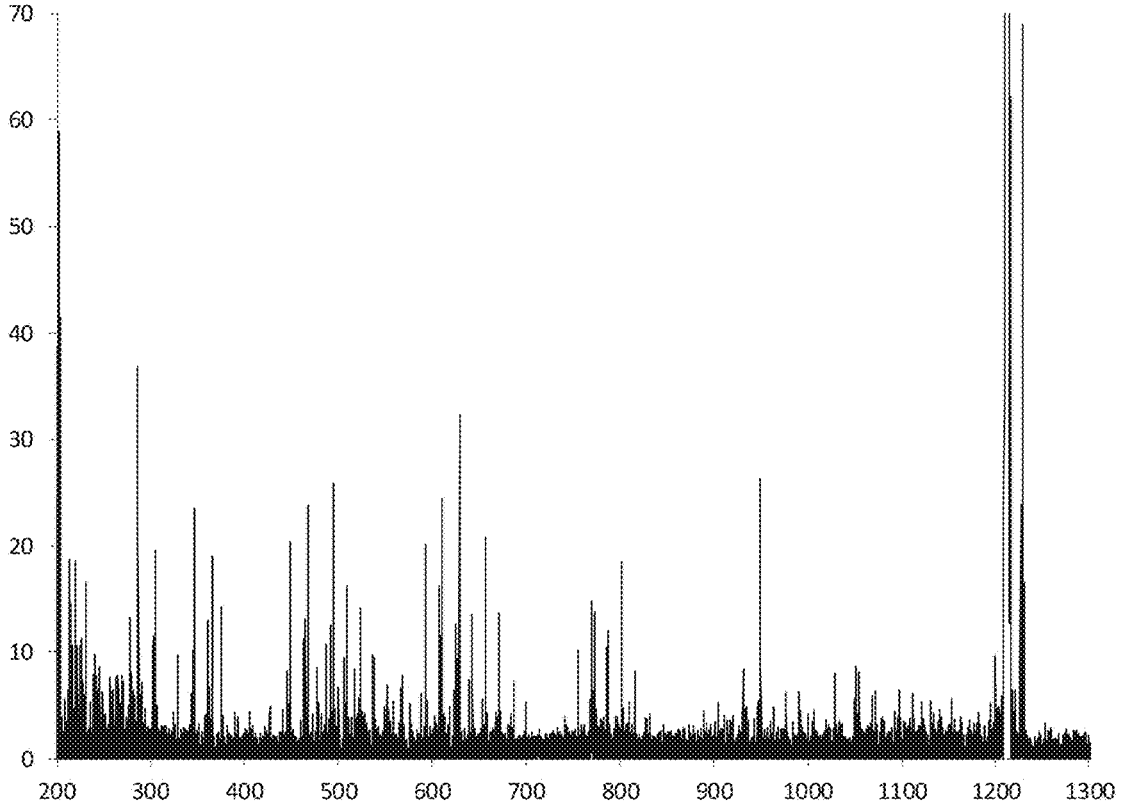
FIG. 12 shows the mass spectrum obtained following CTD fragmentation of m/z 1213 (methylated form of DP6) 1+ precursor of saccharide DP6.

The Experimental setup is shown schematically in FIG. 1. A custom fabricated rear cover was mounted to the saddle field source along the axis of the ETD source ion optics. Briefly, a saddle field fast ion/fast atom source with an ion gun cathode in place, was interfaced to the ETD chamber of an LQT Velos Pro (Thermo Electron Corporation, San Jose, Calif., USA) mass spectrometer using a home built vacuum chamber cover. A variable leak valve was used to control the flow of helium through the addle field source. A 6 kV waveform from a high voltage amplifier was applied to the reagent ion source during the scan function normally reserved for CID, which was similar to previous MAD-MS experiments. FIG. 2 shows the routing of signals from the mass spectrometer to the saddle field ion/fast atom source (VSW/Atomtech, Inc. Macclesfield, UK). The trigger source was taken from pin 14 on the J1 connector of the Digital PCB board. This TTL signal was used to trigger an arbitrary waveform generator (AFG3252, Tektronix Beaverton, Oreg.). The arbitrary waveform generator produced a 0-5 V square wave, which was timed to coincide with the fragmentation portion of the scan function. The alignment of these signals is demonstrated in FIG. 7. The square wave pulse was amplified by a factor of 2000 by a fast high voltage amplifier (ANT 10B10, Matsusada Precision Inc., Shiga, Japan) in the rage of 1-10 kV.

Ultra-high purity helium (PHEN30050, 99.999%, Matheson Gas, Basking Ridge N.J.) was additionally purified through a GC triple filter (22020, Restek, Bellefonte, Pa.) to remove any residual contamination. The purified helium was introduced through a precision leak valve and the pressure was set at about 6-8×$10^{-5}$ Torr, as monitored by the on-board ion gage in the differentially-pumped ETD source region. Experiments were conducted after pressures had sufficient time to equilibrate, which was typically about five minutes.

Substance P (acetate salt, S6773) was acquired from Sigma Aldrich (St. Louis, Mo.). LC/MS grade methanol and glacial acetic acid were obtained from Fischer Scientific (Waltham, Mass.). Water was obtained from an in-house Milli-Q purification system with >18 MΩ salt content. All reagents were used without further purification. 60 μM solutions of substance P were made 1:1 (V:V) solutions of MeOH and $H_2O$. All solutions were acidified to 1% with HOAc.

Figure 5:
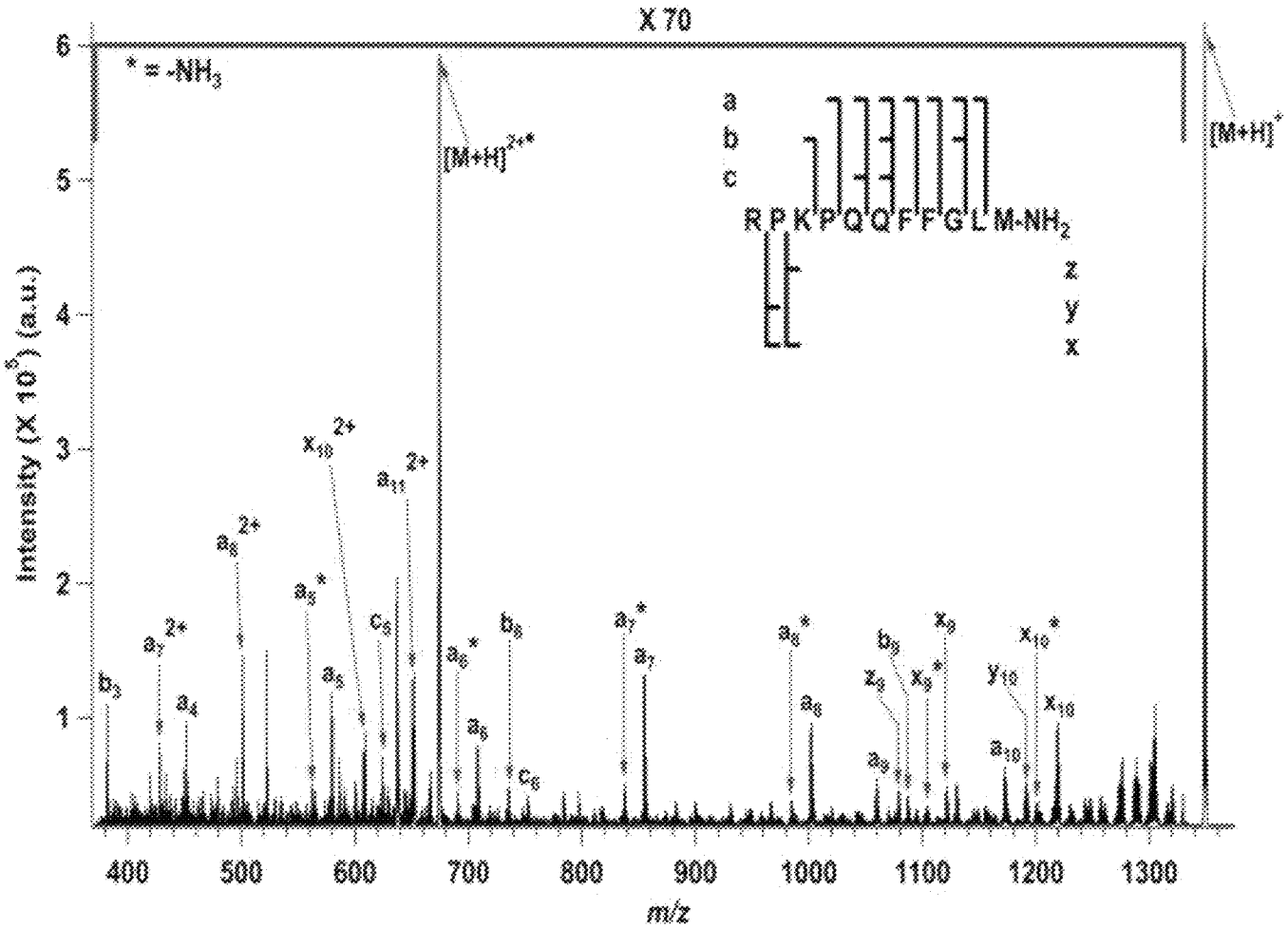
FIG. 5 shows a $He^+$ CTD spectrum of substance P with an expanded isolation window of 4.0 m/z. At least one ion from each major fragmentation pathway is identified. The isotopic envelope afforded by the expanded isolation window helped confirm the identification of the doubly charged ions.

All spectra were collected in positive mode with an ESI voltage of 4.5 kV, an ion transfer capillary temperature of 250° C., and a heated ESI source temperature of 60° C. Solutions were directly infused from the on-board syringe pump at a rate of about 5 μL/min and the singly protonated precursor ion was isolated with different isolation windows at m/z 1347.9 and subjected to CTD. A typical experimental run involved collecting the full mass spectrum for a period of about 30 seconds, followed by 30 seconds of the isolated precursor, then 2.5 minutes of the CTD reaction (with the helium ion source pulsed on for about 1 second per scan) and then about 2.5 minutes with the electrospray source off and the $He^+$ source on, as background. Fragmentation time was set to 1 second, and the saddle field ion/fast source was on for about 980 ms of this time. In all the spectra presented the saddle field source was operated at 6 kV. All spectra presented are time-averaged over the 2.5-minute collection interval and subsequently background subtracted. Initial experiments used an isolation window of m/z 4 to ensure adequate precursor signal, the initial spectrum of substance P is shown in FIG. 5.

Initial experiments used Substance P because it provided a well-characterized benchmark for the fragmentation of N—$C_\alpha$ bonds (Berkout et al. Int. J. Mass. Spectrom. 325-327, 113-120 (2012)). Helium cations have an electron affinity (24.6 eV) that greatly exceeds the ionization energy of singly protonated Substance P cations, which is approximately 10.6 eV [46]. Therefore, given sufficient energy to overcome the Coulombic barrier, the electron affinity helium cations should have at least 13 eV of excess energy above the ionization potential of protonated or doubly protonated Substance P (Budnik et al. J. Mass Spectrom. 22:3-12 (2011)), which is sufficient to fragment even the strongest covalent bonds. When the target precursor in Reaction 1 is a neutral, the analogous reaction is called dissociative charge transfer and has been extensively studied for small organic neutrals (McMahon. J. Mass. Spectrom. 200: 187-199 (2000)). The term charge transfer dissociation (CTD) was adopted to describe this class of reactions. CTD of peptide anions was expected to be similar to negative nETD (Coon et al. 2005 and Stephenson and McLuckey 1997), except that additional translation energy is expected to be available for reaction in CTD. The initial spectrum of substance P with the expanded isotopic envelop, the spectrum of substance P (FIG. 5) was observed to be very similar to that demonstrated in FIG. 3. A dominant product peak representing the $[M+H]^{2+}$ radical species was observed along with a near complete series of a-ions. The greater precursor intensity demonstrated in FIG. 5 relative to FIG. 3 provides better signal to noise and more peak identifications, but the expanded isotopic envelope somewhat obscures the identification of a+1 ions.

To determine the amount of energy available for reaction and to verify the presence of low mass $He^+$ ions with an electron affinity of at least 24 eV, appearance potential experiments were conducted using the He+ beam to conduct CTD (dissociative charge transfer) of a well-characterized volatile organic, trichloromethane. Briefly, chloroform was introduced by placing a small beaker of chloroform near the standard atmospheric pressure interface (API) capillary entrance of the mass spectrometer. The mass spectrometer was operated in MS/MS mode with a 'ghost' precursor of m/z 100 because there was no sample being infused or ionized in the electrospray source. Mass spectra were collected using the low mass range mode from m/z 15-150.

Figure 3:
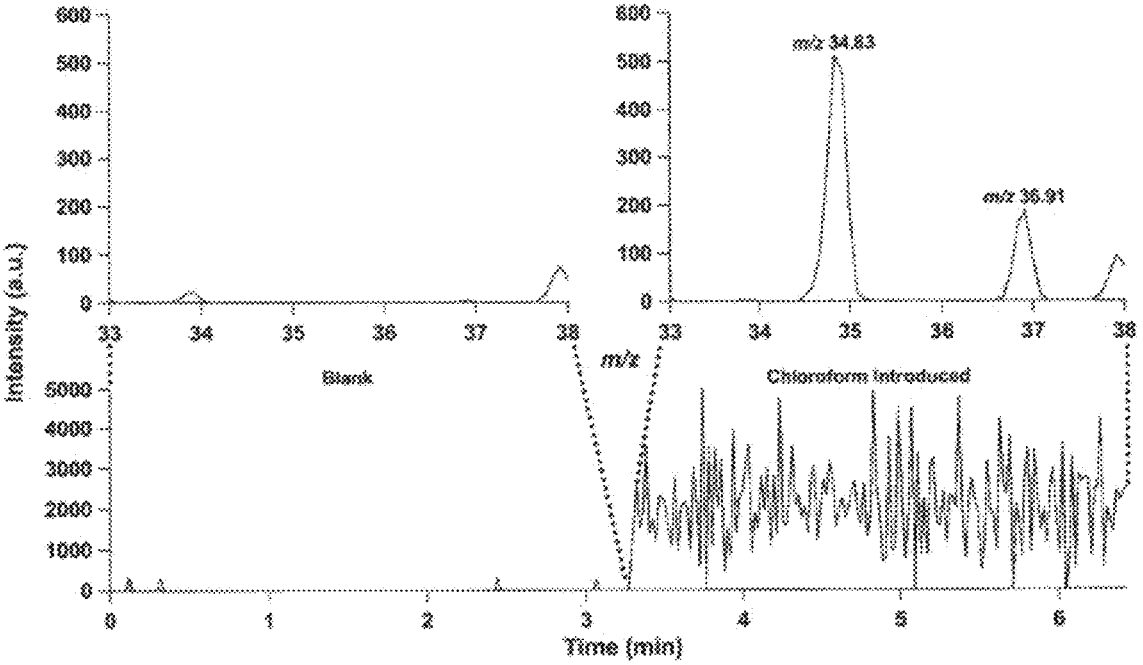
FIG. 3 shows experimental results of an appearance-potential experiment using $He^+$ charge transfer reaction with neutral chloroform. The first 3 minutes represent the blank (background) charge transfer spectrum. Chloroform was introduced at about 3.2 minutes. The bottom panel of FIG. 3 demonstrates the extracted ion chromatogram for mass to charge (m/z) 35 and 37 while the top panels show the time-averaged mass spectra from the blank and chloroform respectively. When chloroform was introduced, signals representing the expected isotropic distribution of chloride ions were produced. The results indicate the large activation energies available through the interaction with ~6 keV $He^+$ ions.

The extracted ion chromatogram for m/z 35 and 37 is shown in FIG. 3, bottom panel. The first three minutes show charge transfer background signals prior to chloroform introduction. Between 3.2 and 6.4 minutes, chloroform vapors were introduced to the high-pressure-trapping region via the API inlet and several charge transfer reaction products were observed. The time-averaged mass spectra are seen in the panels of FIG. 3 positioned above each time domain. Clear signals representing the chlorine ions at m/z 34.83 and m/z 36.91 were observed when chloroform was introduced, but were noticeably absent from the background. Previous work demonstrated the appearance potential of chlorine cations from chloroform to be 22.0+0.3 eV (Hobrock and Kiser. J. Phys. Chem. 68: 575-579 (1964). The metastable states of helium lie at about 20 eV (Siska. Rev. Mod. Phys. 65:337-412 (1993), so the presence of chlorine cations can provide good experimental evidence that the species emitting from the saddle field source are helium cations. Beyond the appearance potential, the intensity of halogen ions from the dissociation of halogenated hydrocarbons increases approximately linearly with increasing electron energy (Fiegele, et al. J. Phys. B: At. Mol. Opt. Phys. 33:4263 (2000) and Torres et al. J. Phys. B: At. Mol. Opt. Phys. 33: 3615 (2000)). Based on a linear fit of Hobrock and Kiser's EI data (Hobrock and Keiser, 1964)—from the appearance potential at 22 eV to the common EI energy at 70 eV—the average energy of the system was calculated to be about 39 eV. Using the same method based on data for x-ray induced dissociation of trichloromethane (Lago et al. J. Chem. Phys. 120:9547-9555 (2004)), the average CTD energy is approximately 33 eV. The results of these two calculations provided the confidence that the typical activation energy using 6 keV $He^+$ ions lies between 22 and 40 eV, and more likely between 30-40 eV. The maximum energy that can be transferred from the lab frame to the center of mass frame for trichloromethane and 6 keV $He^+$ ions is approximately 197 eV, but 100% conversion is unlikely (McLuckey. J. Am. Soc. Mass. Spectrom. 3:599-614 (1992)). Conversion efficiencies on the order of 1-10% are much more common, which would provide between 2-20 eV to the activation energy and was in agreement with the observed results. When the mass of the reacting partner ($He^+$) is much less than the mass of the target ion (substance P), inelastic energy transfer becomes a minor pathway and a much smaller fraction of the available center-of-mass energy will be converted to internal energy (Goeringer and McLuckey. J. Chem. Phys. 104:2214-2221 (1996)).

The biggest factor limiting the acquisition rate is the effective flux of helium ions through the trap. The saddle-field source has no onboard ion focusing elements, so the beam exiting the source is divergent (about 5 degrees, according to the manufacturer) all the way through the linear ion traps. This decreases the degree of overlap or effective flux between the trapped bio-ions and the transmitting helium ions and necessitates 1-s-long reactions times to achieve reasonable signal-to-noise levels. At present, the effective ion cloud overlap between the $He^+$ reagent ions and the stored precursor ions in the LIT is approximately 8%. The overlap estimate was based on the approximate precursor ion cloud volume in the LIT (about 100 $mm^3$) (Schwartz et al. J. Am. Soc. Mass. Spectrom. 13: 659-669 (2002)) and the divergent ion beam volume (about 1200 $mm^3$)—as calculated using the 5 degree divergent beam passing through the 2 mm diameter center ion lens over the length of high pressure LIT. Based on this 8% overlap in ion clouds, the $He^+$ flux passing through the high-pressure LIT (about 10 nA), and the reduction in precursor abundance following CTD ($2\times10^5$ counts), it can be estimated a CTD reaction efficiency of about 0.004% per helium ion. The measured CTD efficiencies at 1-s reaction time with the current ion flux of about 10 nA through the high pressure LIT (where the reactions take place) were on the order of 4%.

Figure 4:
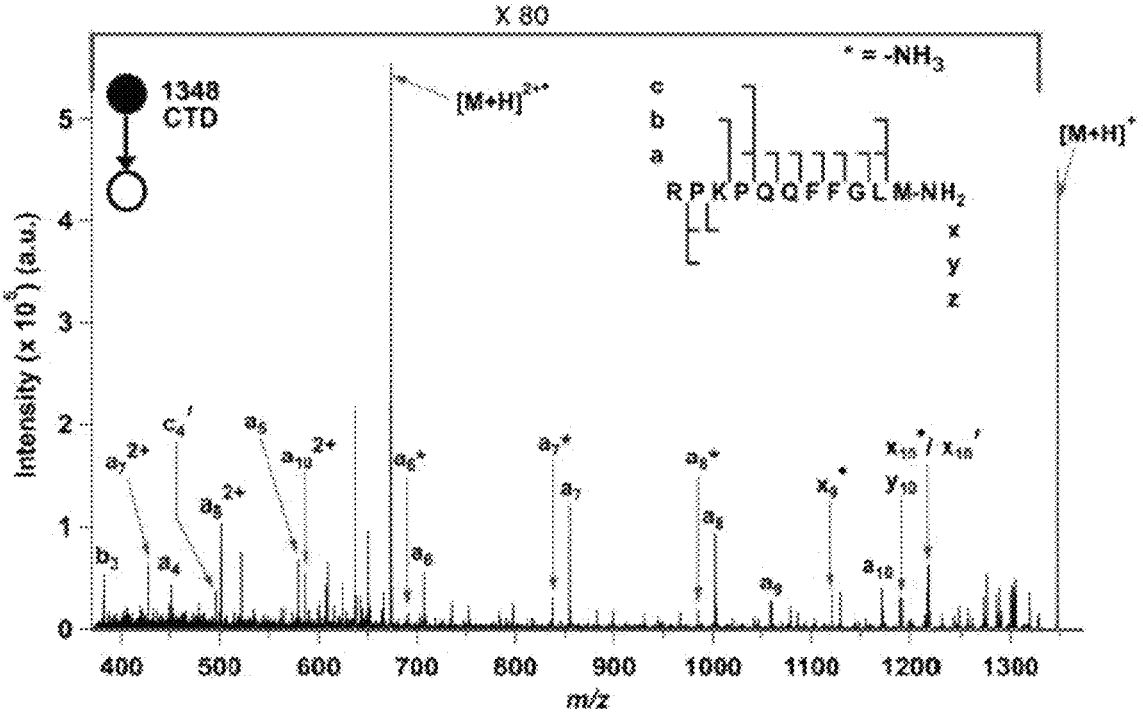
FIG. 4 shows a graph demonstrating the CTD spectrum of 1+ Substance P. The 2+ radical was observed to be the major product with a dominant sequence of a-ions and less abundant b-, c-, x-, and y-ions. The region between m/z 370-1330 was multiplied by 80 for clarity.

FIG. 4 shows the CTD spectrum of 1+ Substance P averaged across 52 scans and activated with 6 keV $He^+$ ions for about 980 ms. For clarity, the intensity from m/z 370-1330 has been multiplied by a factor of 80. A dominant peak at m/z 674.34 represents the expected charge transfer product shown in Reaction 1, $[M+H]^{2+}$. Fragments were dominated by a-ions, which result from the cleavage of the $C—C_\alpha$ bond with charge retention on the N terminus. The series of a-ions was also accompanied by a series of a-$NH_3$ ions. Reilly et al., observed similar fragmentation of singly protonated Substance P when using photodissociation and CID, but notated that the ammonia losses were most substantial when using post-source decay and low energy CID (Cui et al. J. Am. Soc. Mass Spectrom. 16:1384-1398 (2005)). The predominance of a-type ions is not unusual when a peptide contains a basic residue at the N-terminus (Cui et al. (2005)) and the fragmentation pathways observed for CTD were similar to ultraviolet photodissociation (UVPD) and other high energy fragmentation pathways (Papayannopoulos. Mass Spectrom. Rev. 14:49-73 (1995)), including femtosecond laser induced dissociation (Kalcic et al. J. Am. Chem. Soc. 131:940-942 (2009)) and EID (Fung et al., J. Am. Chem. Soc. 131:9977-9985 (2009)). Although the current experiment was performed at $q_z$=0.25 as the precursor trapping parameter, mass spec using CTD with $He^+$ need not be limited in $q_z$ because the reagent ions are not stored or expected to be affected by RF amplitude in the ion trap. Insofar as the reagent helium ions are not stored or trapped, the $q_z$ value can be reduced to effectively trap smaller mass/charge fragments.

In addition to the near-complete series of singly charged a ions, several doubly charged ions were observed to be produced. Widening the precursor isolation window and looking for the presence of the expected isotropic envelope assured the identifications of these doubly charged ions despite not performing mass measurements. The full CTD mass spectrum is shown in FIG. 5 and further described with reference thereto.

Figure 6:
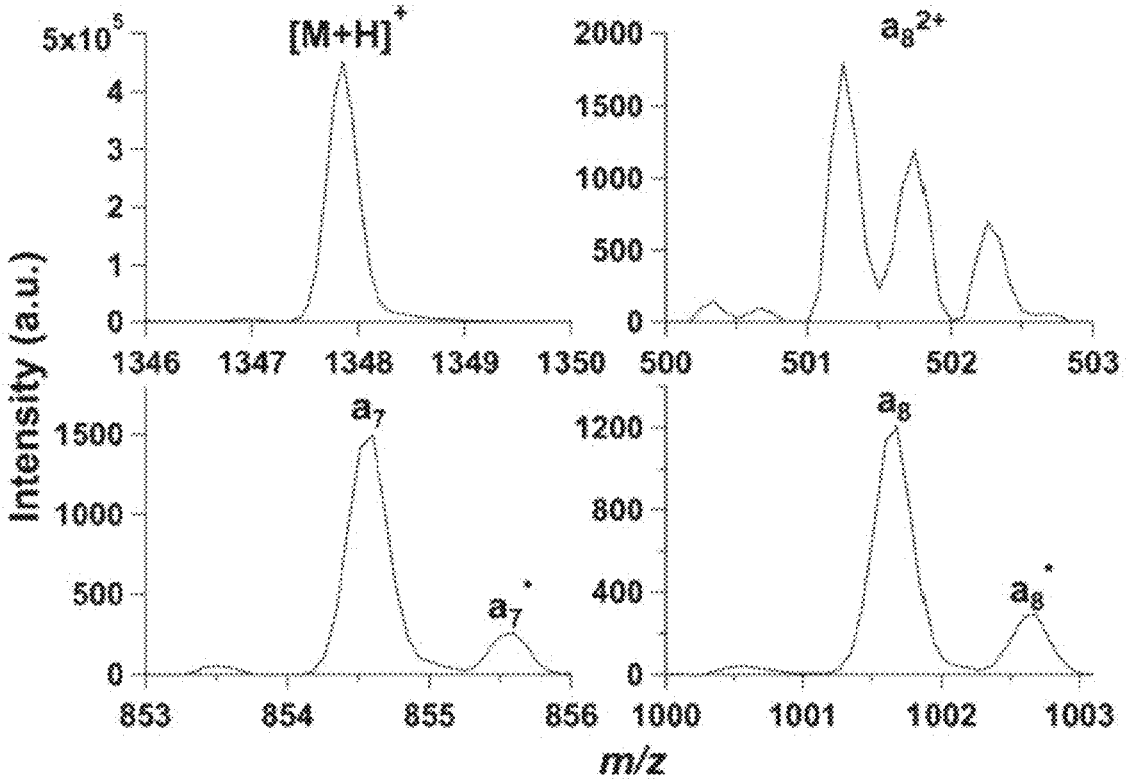
FIG. 6 show graphs demonstrating isolated mass spectra showing the monoisotopic $[M+H]^+$ precursor along with the associated $a_7$ and $a_8$ ions. In both cases $a_n+1$ (n=7, 8) ion was observed stemming from hemolytic cleavage of $C—C_\alpha$. Subsequent loss of a hydrogen radical results in the even electron a-ions. The upper right panel of FIG. 6 shows the $a_8^{2+}$ ion observed using a precursor isolation window of m/z 4.

Following CTD of the monoisotropic precursor, the singly charged a series ions are also accompanied by a+1 ions. The a+1 ions are thought to arise from the homolytic cleavage of the $C—C_\alpha$ bond along the backbone (Cui et al. (2005)). Subsequent elimination of a hydrogen radical results in the formation of even electron a-type ions (Zhang et al. J. Am. Soc. Mass Spectrom. 17:1315-1321 (2006) and Webber et al. J. Am. Soc. Mass Spectrom. 25:196-203 (2014)). FIG. 6 demonstrates the isolated monoisotropic precursor along with the $a_7$ and $a_8$ ions with the a+1 ions marked. The same a+1 ions have been observed with UVPD (Webber et al., 2014 and Robinson et al. Anal. Chem. 84:2433-2439 (2012)), and metastable atom activated dissociation (Cook et al. J. Mass Spectrom. 44:1211-1223 (2009)), when the peptide contains a basic residue at the N terminus conventional (low energy) CID of peptides containing a lysine residue at the N terminus demonstrated poor yields of a ions (Robinson et al., 2012), but UVPD was able to improve the production.

It will also be apparent to those skilled in the art of tandem mass spectrometry, that many different ways to implement complementary ion activation methods and ion isolation events to achieve specific desired outcomes. Examples include simultaneous or consecutive uses of photons, collisions and electron or charge transfers. Along similar lines, it will be obvious to those skilled in the art that consecutive or simultaneous application of collisional activation, electron transfer, electron capture or photo activation (IRMPD or UVPD, for example) may provide additional advantages for CTD reactions. For example, precursor analyte ions may be collisionally activated before, during, or after CTD reactions to help promote certain fragmentation pathways.

Example 2

CTD mass spectrometry analysis of carbohydrates was also performed. Briefly, CTD mass spectrometric analysis was performed on oligosaccharides (carbohydrates) using mass spectrometric methods described in Example 1. The results are demonstrated in FIGS. 8-12. The results demonstrate that CTD can be used to sequence modified oligosaccharides and identify the location of the modifications.

Example 3. CTD Mass Spectrometry of Peptide Cations: Charge State Dependence and Side-Chain Losses Introduction. In recent years, mass spectrometry (MS) has become an indispensable tool for the study of biological molecules such as lipids [1], oligosaccharides [2], peptides [3, 4], proteins [5], and DNA [6]. With the development of soft ionization methods such as fast atom bombardment (FAB), matrix-assisted laser desorption/ionization (MALDI) and electrospray ionization (ESI), single-stage MS plays an important role in the molecular weight determinations of an intact molecule of interest [7]. However, interrogation of detailed structural information of a gas-phase molecule usually requires multiple stages of MS or tandem mass spectrometry (MS/MS) [8].

A variety of MS/MS fragmentation methods have been developed and implemented on modern mass spectrometric instruments, the most common of which is collision-induced dissociation (CID) [9]. Collisional activation tends to break the weakest bonds of peptides and proteins—such as amide bonds—and produces b/y ions for the deduction of peptide sequence information. However, CID can also result in the loss of weakly bound post-translational modifications (PTMs), which has been shown to limit its usefulness [10, 11].

Electron capture and electron transfer dissociation (ECD/ETD or ExD) are two alternative MS/MS techniques that can overcome the aforementioned limitations [12]. Unlike CID, ExD cleaves peptide backbone N—Cα bonds to produce c/z ions with a more extensive peptide/protein sequence coverage than CID [13]. In addition, ExD retains PTMs to a much greater extent than CID, which facilitates the elucidation of PTMs site information [12]. However, the fact that ExD relies on charge reduction makes it incompatible with 1+ precursor ions, and its performance is compromised for 2+ precursor ions [14]. The inefficiency with peptide dications can be problematic for implementing ExD when with enzymatic digestion workflows, because many tryptically digested peptides are doubly charged [15].

To combat these issues, significant interest has been placed in the development of new ion activation methods, such as electron excitation dissociation (EED) [16], electron ionization dissociation (EID) [17], ultraviolet photodissociation (UVPD) [18, 19], femtosecond laser-induced ionization/dissociation (fs-LID) [20], action spectroscopy (synchrotron radiation) [21], and metastable atom-activated dissociation (MAD) [22, 23]. These fragmentation methods all possess a common feature—the capability of dissociating low charge state (1+& 2+) precursor ions, thus providing complementary structural information to ETD/ECD. Some methods (e.g. EID) even show almost equal fragmentation efficiency and sequence coverage between the dissociation of 1+, 2+ and multiply-charged precursor ions [17], which makes them promising for a proteomic workflow.

Charge transfer dissociation (CTD) is another alternative ion activation method for MS/MS experiments [24]. Contrary to the common ion/ion dissociation methods, CTD utilizes the interaction between homo-polarity ions such as peptide cations and helium cations, which, in the case of 1+ substance P, results in a dominant series of a ions. Here, we present results on the He-CTD fragmentation of substance P and bradykinin at different charge states (1+, 2+ and 3+) in a 3D ion trap. In the resulting mass spectra, the backbone fragmentation pattern shows certain dependence on the charge state of precursor ions. The type of fragment ions reveals the involvement of high-energy, CID-like and ETD-like fragmentation channels in the process of CTD. In addition to backbone cleavages, side-chain losses from both charge-increased species ($[M+nH]^{(n+1)+}$.) and charge-reduced species ($[M+nH]^{(n-1)+}$.) were also observed. Although our preliminary studies were conducted on a 2D ion trap [24], the current work was accomplished on a 3D ion trap, which shows considerably better fragmentation efficiencies.

EXPERIMENTAL

Figure 13:
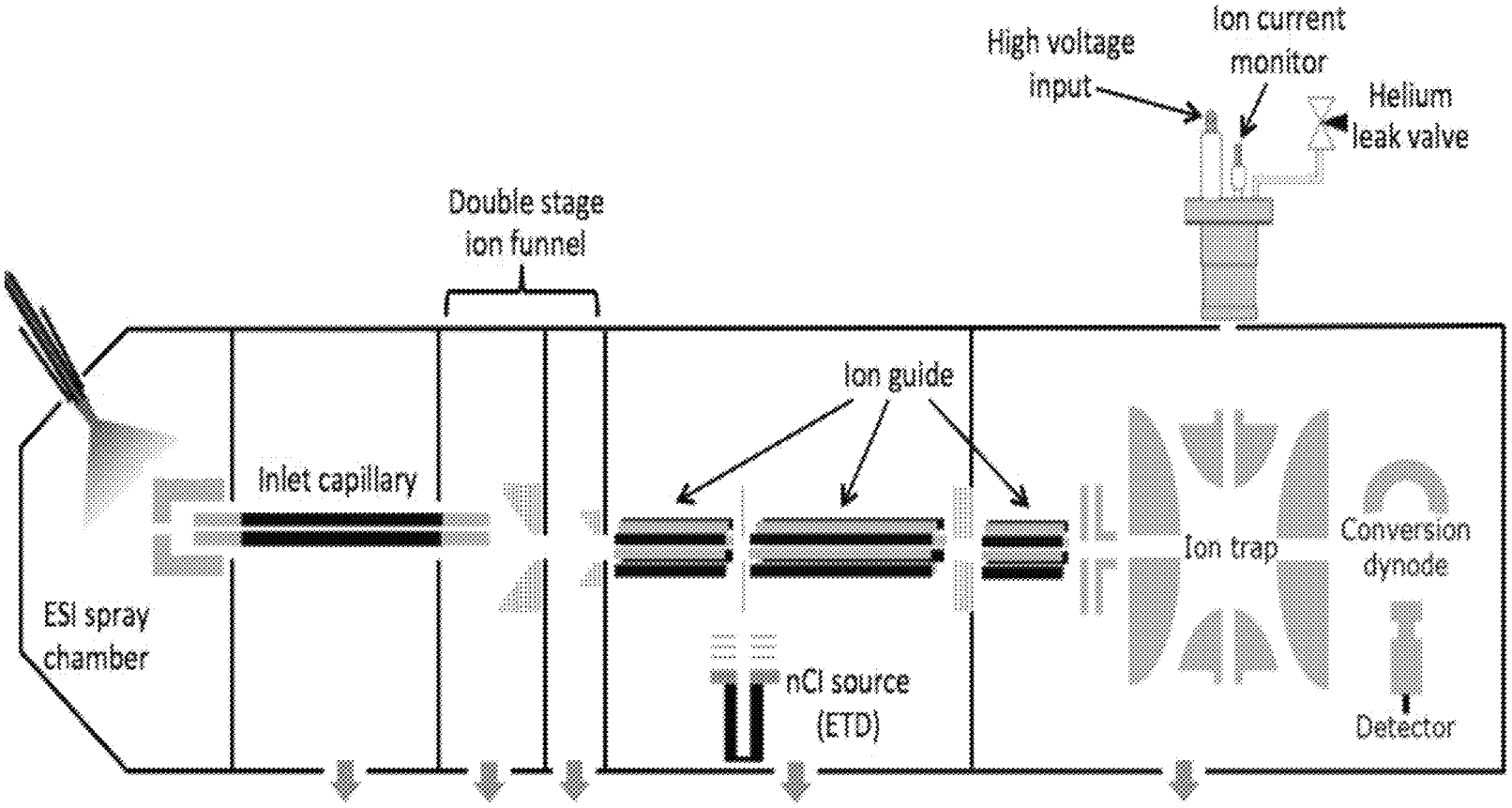
FIG. 13 shows a schematic of installation of saddle field ion source onto Bruker amaZon ETD mass spectrometer.

Instrumentation:

The experimental instrumentation is shown in FIG. 13, which shows a schematic of installation of saddle field ion source onto Bruker amaZon ETD mass spectrometer. He-CTD fragmentations of substance P and bradykinin were carried out using a modified Bruker amaZon ETD mass spectrometer (BrukerDaltronics, Bremen, Germany). A saddle field ion/fast atom source (VSW/Atomtech, Macclesfield, UK) installed with the ion gun anode lens was interfaced onto the top cover of 3D ion trap via a home-built metal cover [24]. The source installation, connection between electronic components and working principle are similar to our previous instrumental setup on LTQ Velos Pro and experimental setup of MAD-MS [9, 24].

Reagents:

Substance P and bradykinin were purchased from Sigma-Aldrich (St Louis, Mo.) and used without further purification. The peptides were reconstituted into a water/methanol/acetic acid mixture (49.5:49.5:1 v/v/v), aiming for a final concentration of 60 μM and were electrosprayed using a standard Bruker Apollo source [9].

Method:

Experiments were performed in the MS/MS mode on the 3D ion trap instrument, and the saddle field ion source was switched on during the section of scan function that is typically reserved for CID. The peptide solutions were infused using an electronic syringe pump (#1725, Hamilton Company Reno, Nev., NV) at a flow rate of 160 μL/h. Precursor ions were isolated using an isolation window of 2 Da, after which they were irradiated with the helium cation beam. The low mass cut-off (LMCO) value was typically set to be m/z 150 for the removal of ionized pump oil fragments. A +6 kV square wave with a pulse width of 25 ms was supplied to the saddle field ion source anode for the generation of reagent helium cations. The helium gas flow was controlled via a variable leak valve and the pressure read-out was obtained from the ion trap gauge in the main vacuum region. Using this indirect measurement, the helium gas supply was adjusted to provide a main vacuum pressure of ~$1.20\times10^{-5}$ mbar for all the experiments, which is only slightly above the base pressure around $8\times10^{-6}$ mbar. All the CTD mass spectra presented in this work were time-averaged for 0.5-2 minutes to improve the signal-to-noise ratio (S/N).

Figure 14A:
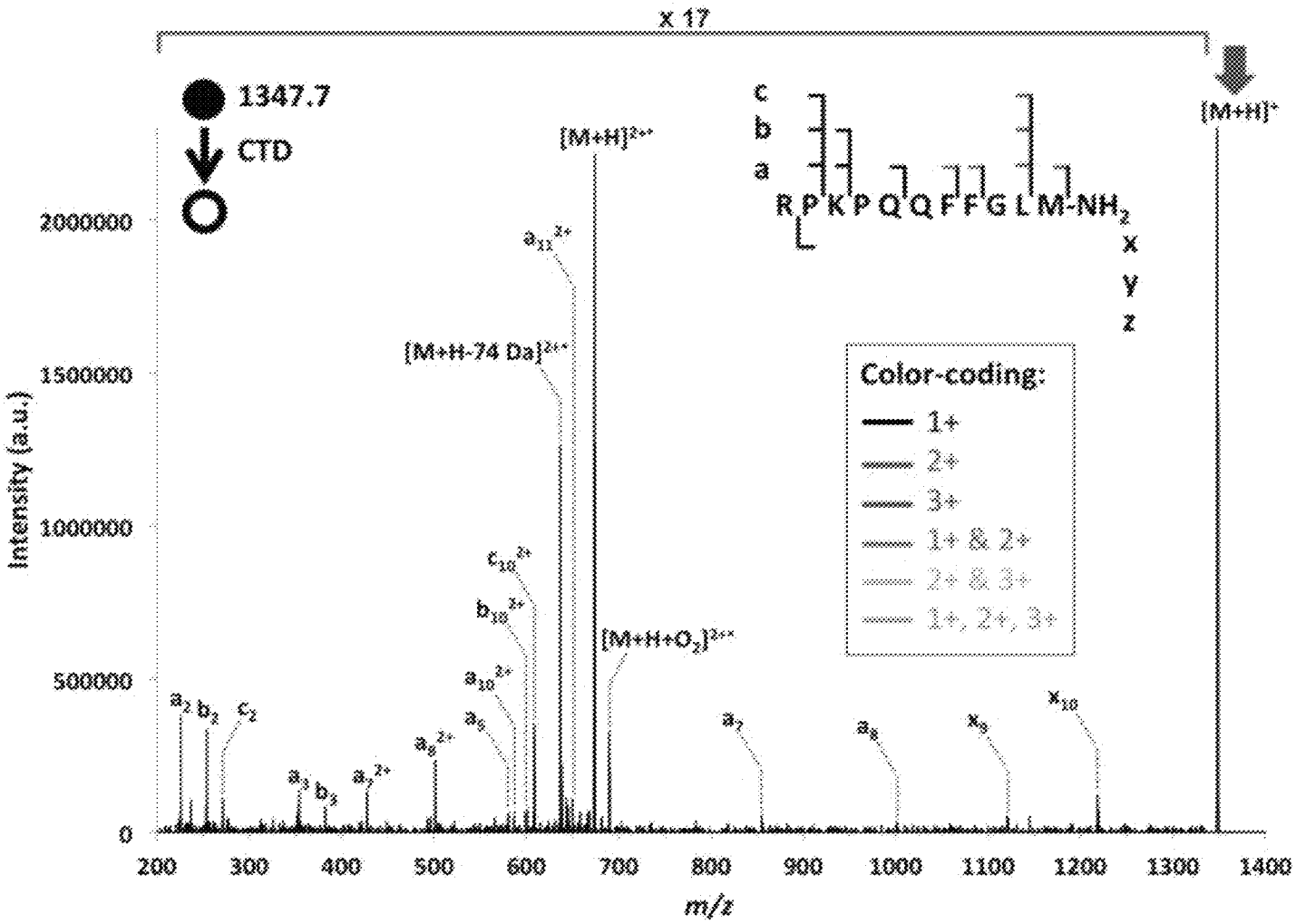
FIGS. 14A-14C show the He-CTD spectrum of (FIG. 14A) singly, (FIG. 14B) doubly, and (FIG. 14C) triply protonated substance P. The m/z ranges of interested have been multiplied by factors of 17, 50 and 6, respectively, for clarity. Precursor ions are indicated by blue arrows. The inset in panel (FIG. 14A) shows the color-coding scheme of peptide sequencing used throughout example 3.
Figure 14B:
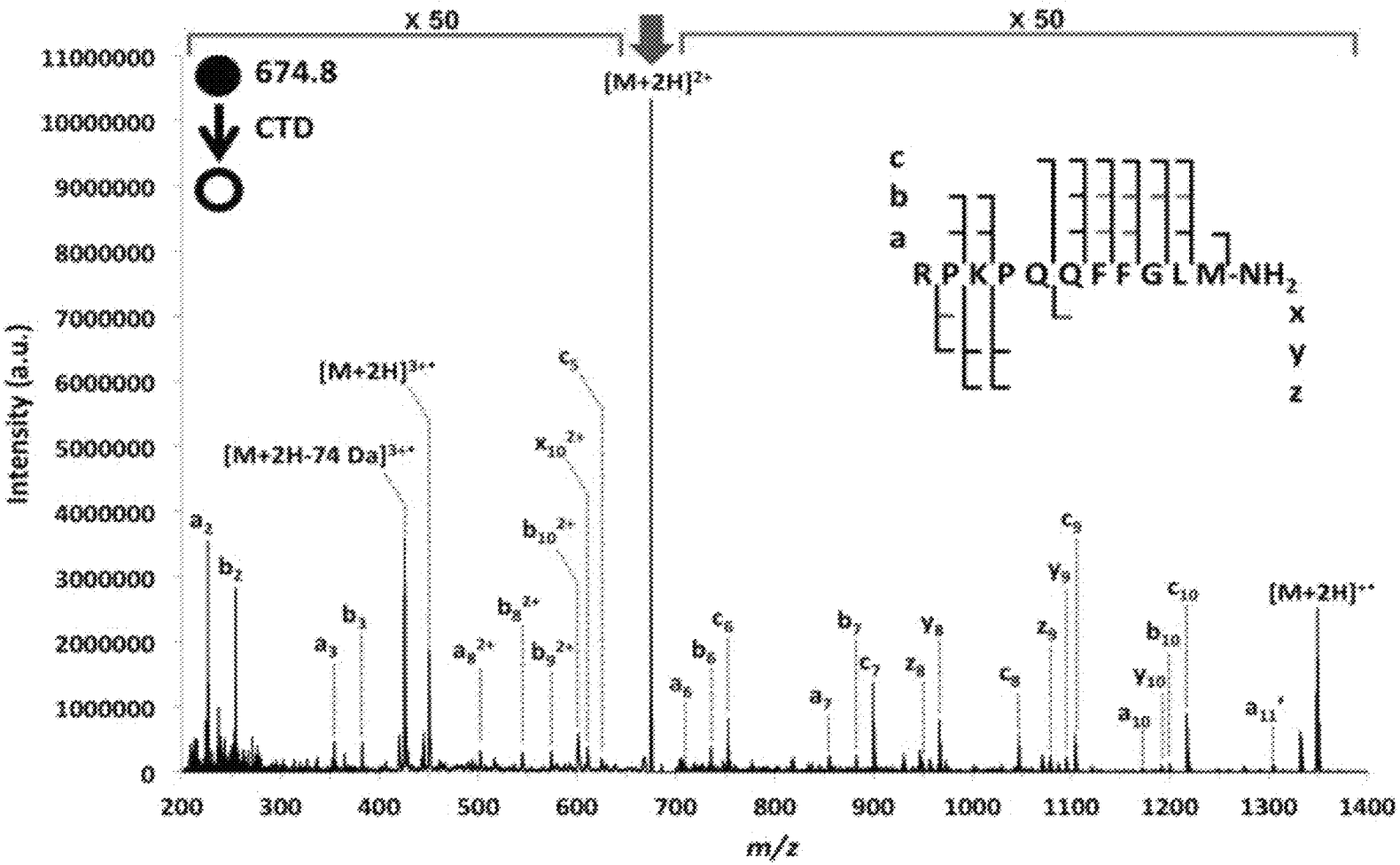
Figure 14C:
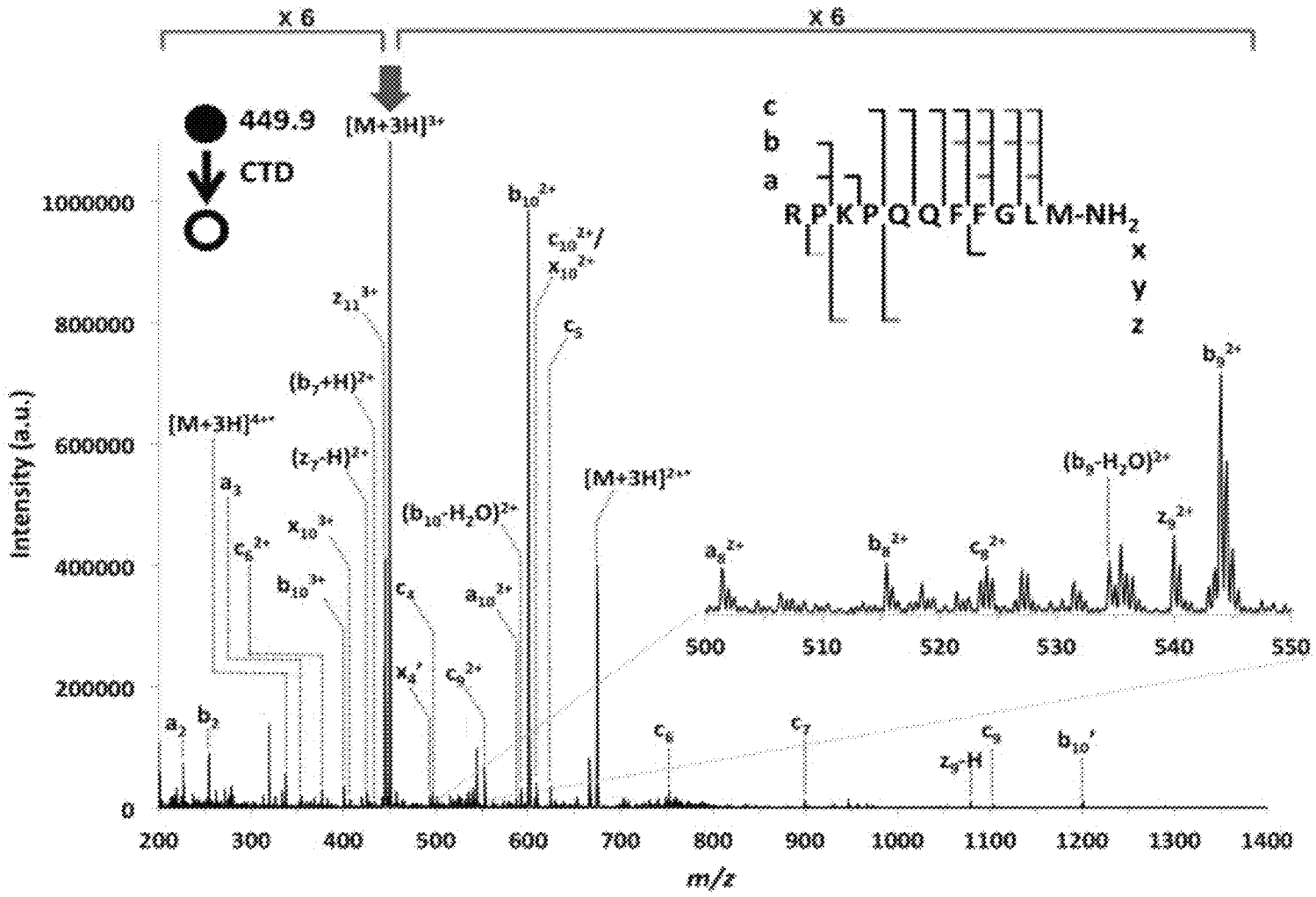

Results and Discussion:

Helium charge transfer dissociation (He-CTD) was performed on singly, doubly and triply protonated substance P respectively, as shown in FIGS. 14A-14C. Upon the interaction with helium cations, the 1+, 2+ and 3+ precursors of substance P gave oxidized product ions (charge-increased species) at m/z 673.9, m/z 450.4 and m/z 337.8, corresponding to corresponding to product ions $[M+H]^{2+}$., $[M+2H]^{3+}$., and $[M+3H]^{4+}$. respectively. Gas-phase oxidation, or increasing the charge state of a gas-phase ions has been observed in a variety of fragmentation methods, including He-MAD [9, 25], EID and EED [16, 17], and photon-based dissociation methods [20, 21].

FIGS. 14A-14C show the He-CTD spectrum of (FIG. 14A) singly, (FIG. 14B) doubly, and (FIG. 14C) triply protonated substance P. The m/z ranges of interested have been multiplied by factors of 17, 50 and 6, respectively, for clarity. Precursor ions are indicated by blue arrows. The inset in panel (FIG. 14A) shows the color-coding scheme of peptide sequencing used throughout example 3. Charge-increased species mainly originate from the electron detachment of precursor ions, i.e. charge transfer. Helium cations have an electron affinity of ~24.6 eV, and given that they are generated from a 6 kV saddle field ion source, there is more than enough energy to overcome the Coulombic repulsion barrier to enable charge transfer to occur [8, 21, 24-26]. In addition to charge-increased species, charge-reduced product ions were also observed in He-CTD spectra of 2+ and 3+ substance P cations. These hydrogen-rich charge-reduced species correspond to m/z 1349.8 ($[M+2H]^{+}$. and m/z 675.0 ($[M+3H]^{2+}$.) respectively, which are commonly observed in electron-based methods (e.g., ECD/ETD). It seems unreasonable for $He^{+}$ to serve as an electron transfer reagent for such charge reduction reactions, so we performed several experiments to investigate the source of the electron-donating reagents.

Despite the fact that the CTD source is designed to operate as an efficient cation source, a wide range of negative ions are observed in the background CTD spectrum when the trap is operated in negative ion mode (see supplemental material for details). Although we are unsure of the exact mechanism(s) of negative ion formation, the CTD source is apparently able to form negative ions from background impurities in the trap, and these anions can be trapped and used as reagent anions for ETD. One of the more abundant background ions has a mass-to-charge ratio of 184 (see FIGS. 51A-51E, for example), does not fragment using CID and reacts with residual oxygen to form adducts at M+16 (m/z 200) and M+32 (m/z 216). CID of the M+16 and M+32 adducts at re-forms the original reagent anion at m/z 184, indicating that the reagent is probably polycyclic/aromatic and almost certainly a radical.

Further, FIG. 51C shows the oxygen ($O_2$) attachment to the ion at m/z 184. Upon collisional activation, a reverse process-oxygen ($O_2$) detachment was observed in FIG. 51E. This "reversible" process proves the occurrence of oxygen attachment, which indicates the radical nature of the ion at m/z 184 (i.e. $[M]^{-}$.). Accordingly, the ion at m/z 216 was assigned to be $[M+O_2]^{-}$.. To explore the identity/chemical composition of M (m/z 184), this ion was further isolated and subjected to collisional activation (vide infra).

FIG. 14C shows that these reagent anions are reasonably effective at forming c and z ions from the 3+ precursor of substance P. Fortunately, this charge reduction mechanism can be minimized by raising the LMCO during CTD activation to prevent the co-accumulation of reagent anion, with the caveat that increasing the LMCO also limits the observable range of product ions for CTD.

A series of a ions was observed in the He-CTD spectrum of singly protonated substance P, which is consistent with our previous experimental results on a 2D ion trap [24]. The current work shows additional low-mass fragment ions (e.g. $a_2$, $b_2$ and $c_2$) that were not observed on the 2D ion trap, but weaker signal-to-noise (S/N) for fragments in the range from m/z 700 to m/z 1300. Reilly et al. [19] have reported that the fragmentation of ions observed in UV photodissociation can be affected by the type of mass analyzer, and we suspect that the observed differences between the 2D trap results and 3D trap results are cause by experimental differences. These differences could be minimized by raising the LMCO value and increasing the CTD time on the 3D ion trap to make the conditions more similar to the experiments on the 2D ion trap.

Similar to electron-based fragmentation methods [14, 27], CTD of substance P also shows certain charge state-dependence on fragmentation. Product ion spectra of He-CTD of 2+ and 3+ substance P produced more than twice the number of fragment ions than the 1+ precursor, mainly because of the addition of c and z ions. Additional doubly- and triply-charged fragment ions were also observed from the higher-charge-state precursor ions. For example, the He-CTD spectrum of 2+ substance P (FIG. 14B) is dominated by both a and b ions, with a few c, y and z ions, but the He-CTD spectrum of 3+ substance P is dominated by c ions. The near-complete series of a ions for the 1+ precursor is commonly observed in high-energy dissociation methods, and suggests the involvement of a high-energy fragmentation channel [24]. The existence of b/y and c/z fragment ion series mainly originates from vibrational excitation (e.g. CID) and charge-reduction processes, respectively, which clearly become more dominant than oxidation as the charge state of the precursor increases.

Figure 50A:
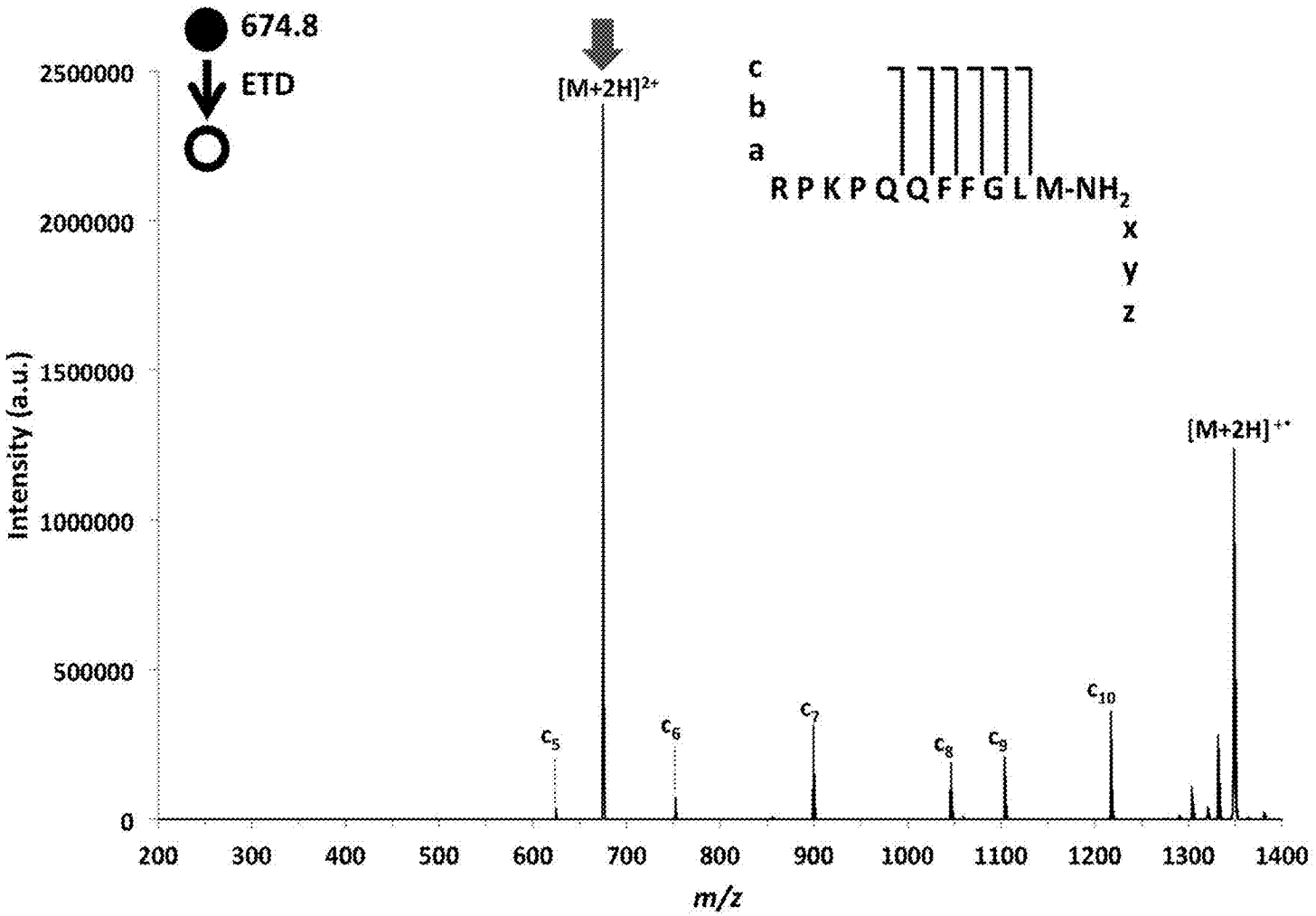
FIGS. 50A-50B show ETD spectra of (FIG. 50A) doubly and (FIG. 50B) triply protonated substance P.
Figure 50B:
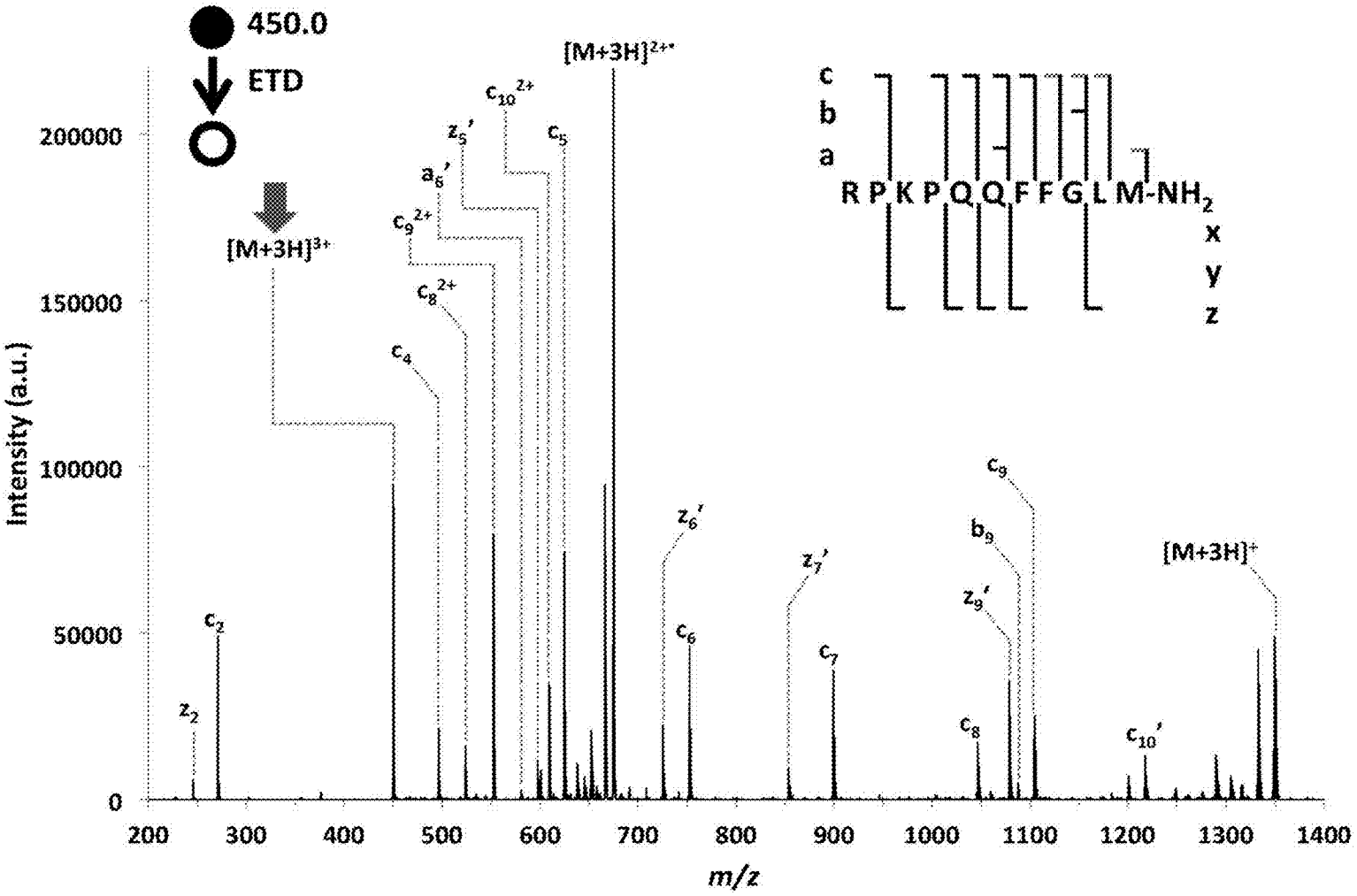
Figure 51A:
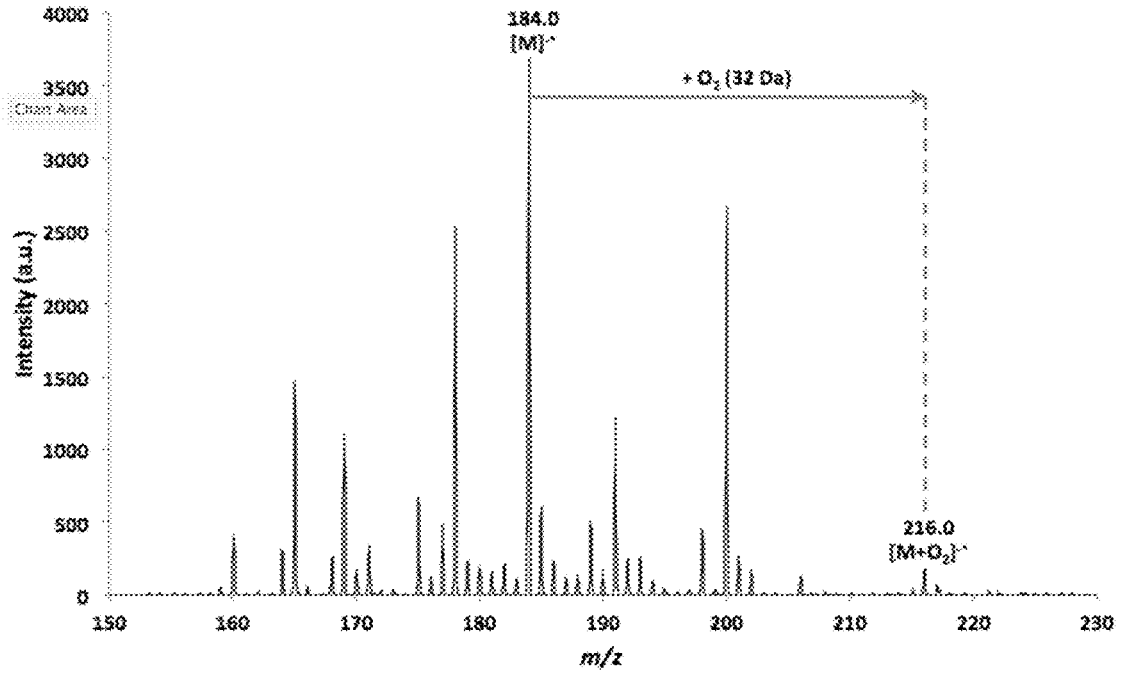
Figure 51B:
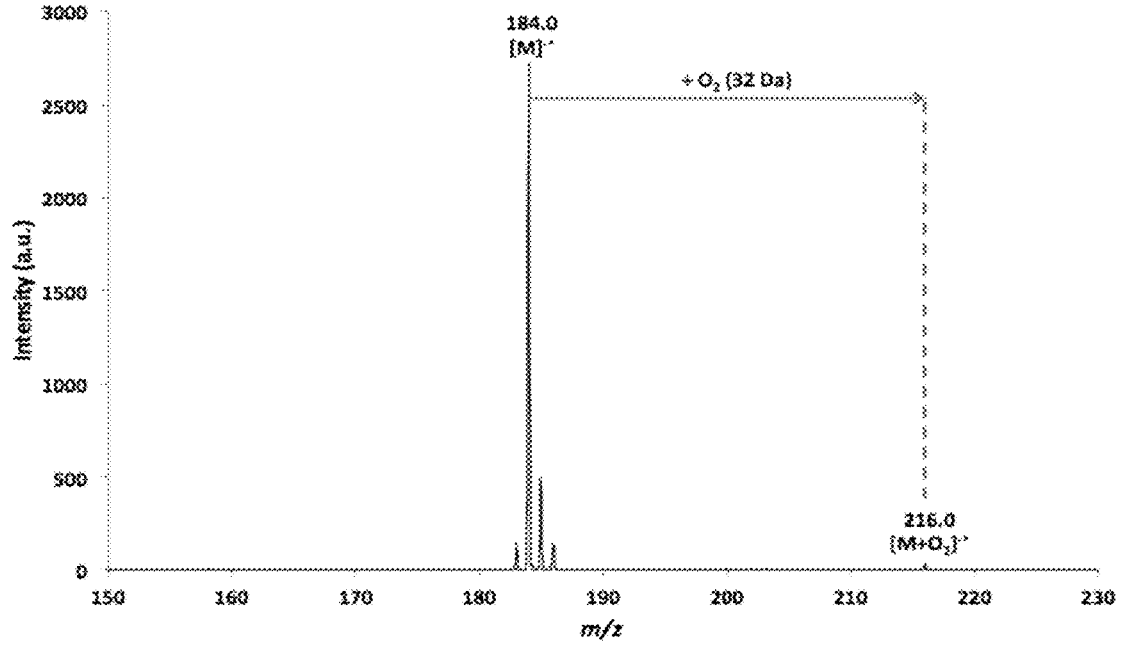
Figure 51E:
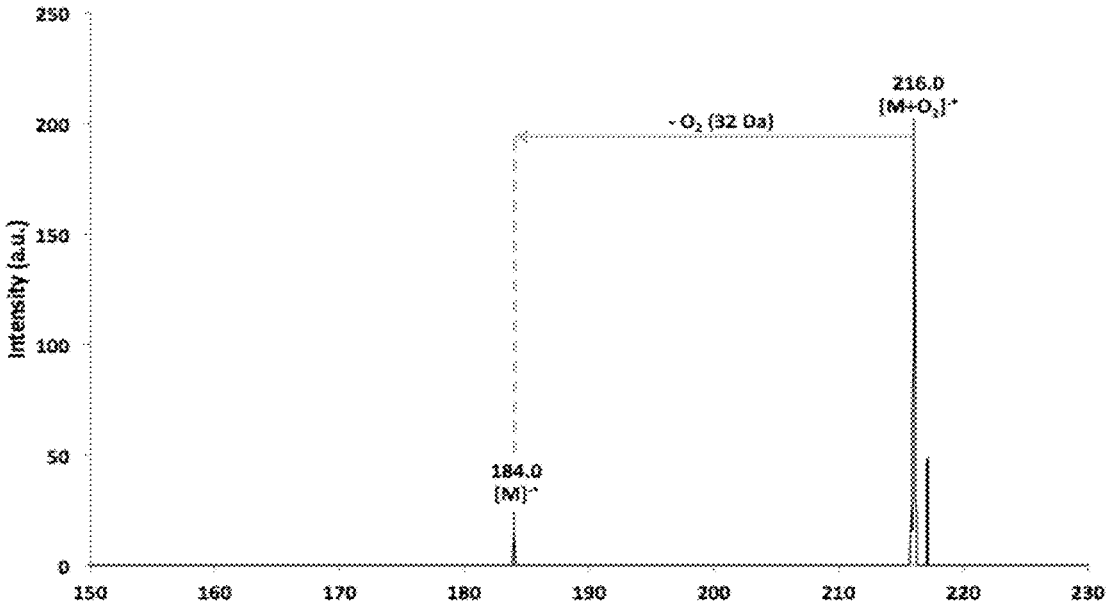

To probe the relationship between CTD and ETD, ETD fragmentation of 2+ and 3+ substance P was conducted on the same instrument. Results are provided in the supplemental material (FIGS. 50A-50B) ETD of 2+ substance P produced only six c ions, covering half of the peptide sequence. In contrast, ETD of 3+ substance P produced almost complete sequence coverage of c ions, along with some a, b and z ions.

In addition to the aforementioned backbone fragmentation, side-chain cleavages were also observed for substance P, as shown in FIGS. 15A-15C and 16A-16C. Amino acid side-chain losses have been well-noted and referred to as (M.-X) regions in variety of tandem MS approaches, including UVPD [18, 19], action spectroscopy [21], fs-LID [20], EID [17], EED [16], ECD [28-35], ETD [36], CID [37] and MAD [9].

Figure 15A:
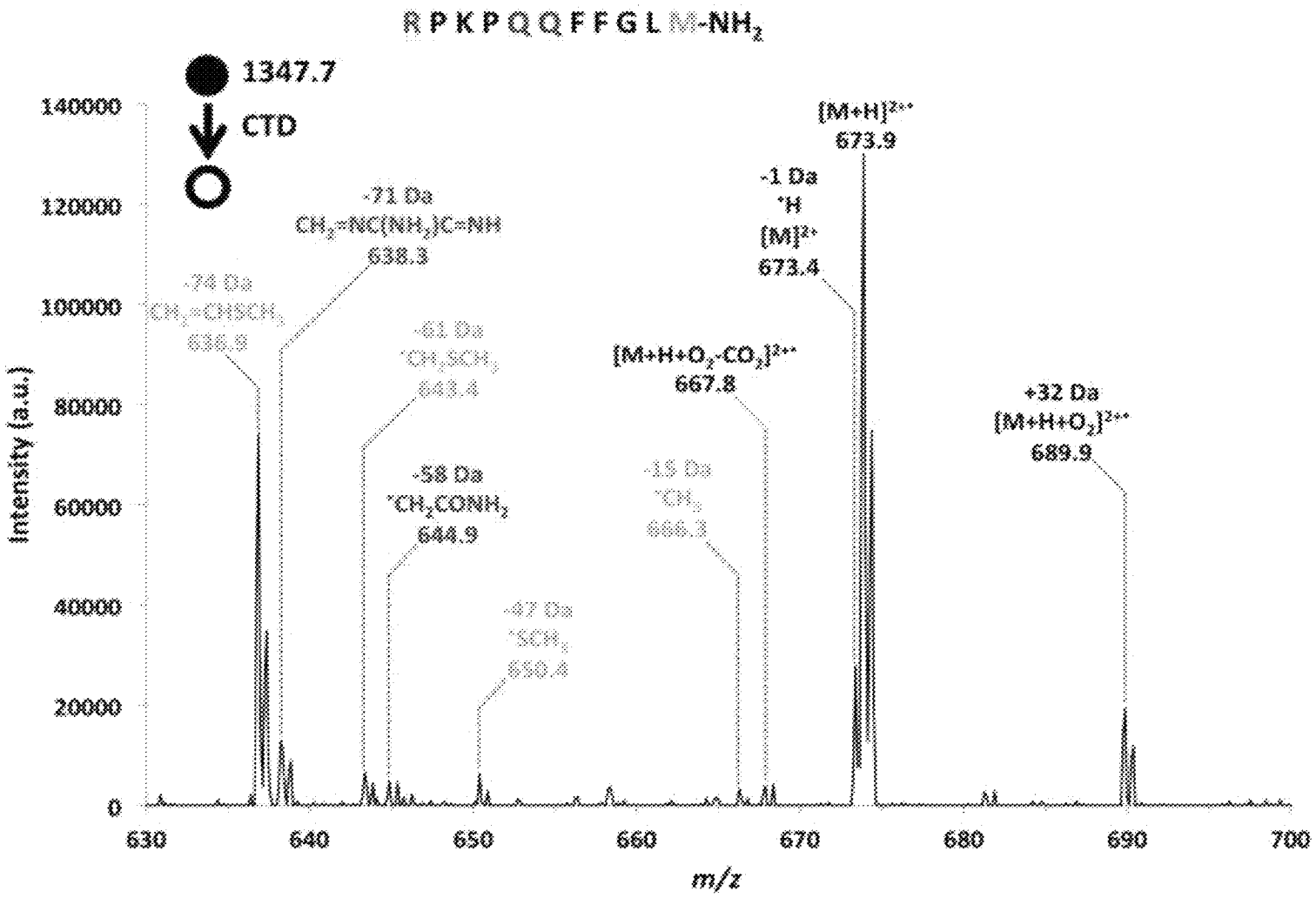
FIGS. 15A-15C show the Zoomed-in He-CTD spectra of (FIG. 15A) 1+, (FIG. 15B) 2+ and (FIG. 15C) 3+ precursor ions of substance P, showing m/z ranges corresponding to the ($M^{\square}$-X) ranges of oxidized (charge-increased) product ions.
Figure 15B:
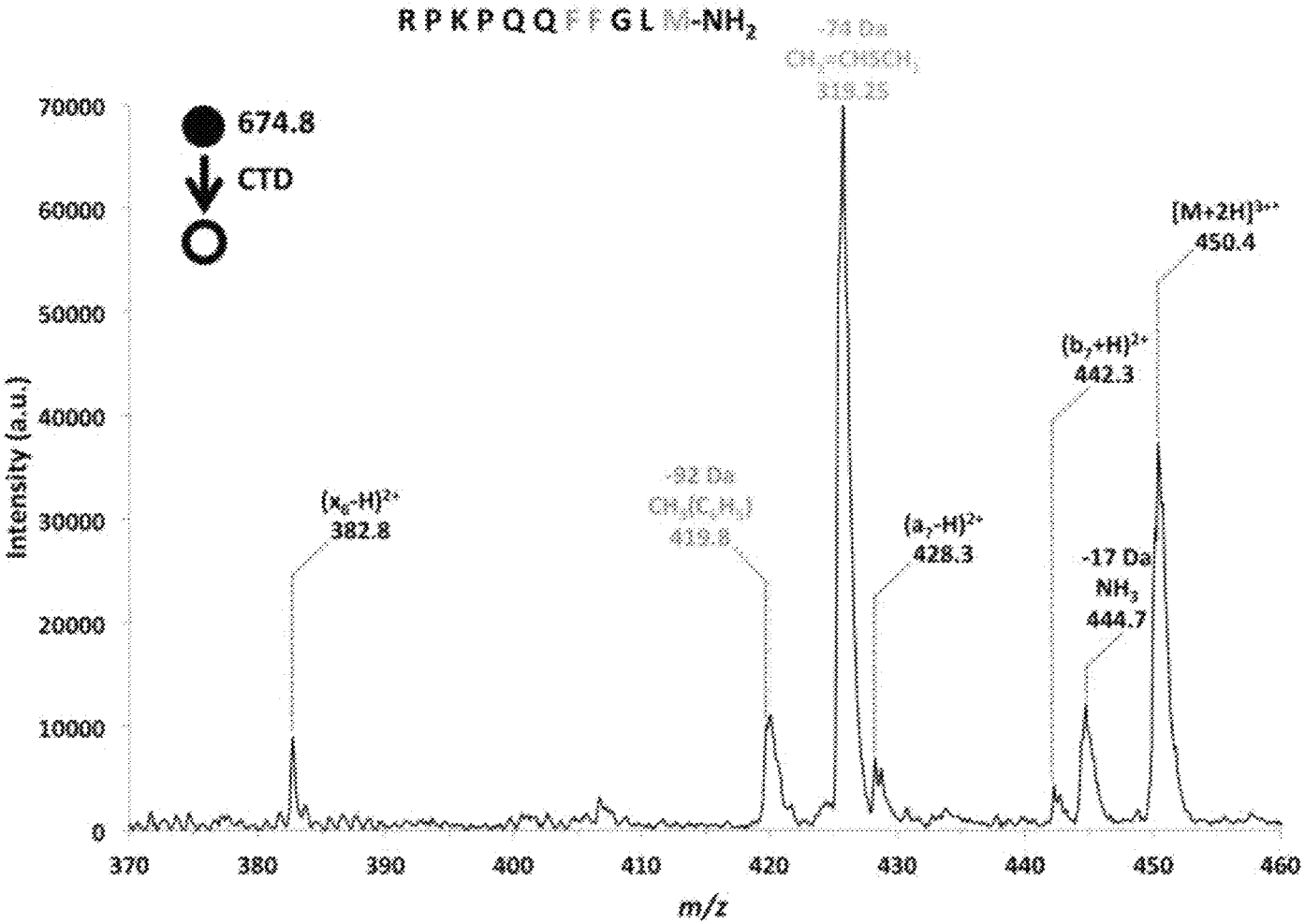
Figure 15C:
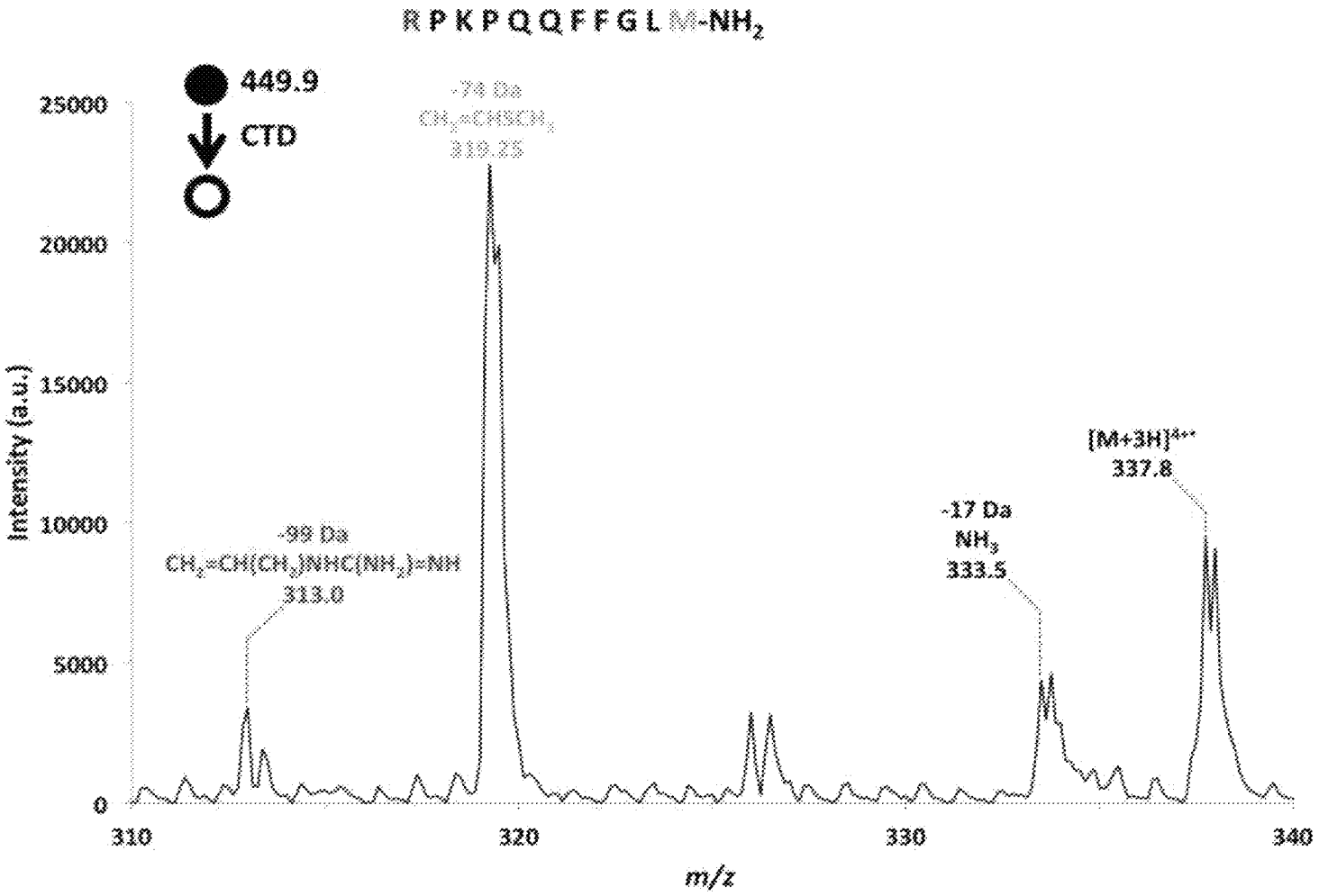

FIGS. 15A-15C show the zoomed-in He-CTD spectra of (FIG. 15A) 1+, (FIG. 15B) 2+ and (FIG. 15C) 3+ precursor ions of substance P, showing m/z ranges corresponding to the (M.-X) ranges of oxidized (charge-increased) product ions. FIGS. 15A-15B provide zoomed-in regions of the same spectra from FIGS. 14A-14C to show more clearly the side-chain losses from the ionized product ions. The oxidized cations are often referred to as hydrogen-deficient species in other studies [17]. For the He-CTD spectrum of 1+ substance P, diagnostic side-chain losses from $[M+H]^{2}$. were observed, including even-electron rearrangements and radical losses. These observations are consistent with commonly-observed neutral losses from $[M+H]^{2+}$., including: 1 Da (.H) [17], 15 Da (.$CH_3$ from Met) [21], 47 Da (.$SCH_3$ from Met) [21], 58 Da (.$CH_2CONH_2$ from Glu) [21, 37], 61 Da (.$CH_2SCH_3$ from Met) [8], 71 Da ($CH_2{=}CHCONH_2$ from Gln) [37], and 74 Da ($CH_2{=}CHSCH_3$ from Met) [8, 16].

An interesting ion at m/z 689.9 was also observed and is tentatively assigned as an oxygen adduct of the oxidized product ion, i.e. $[M+H+O_2]^{2+}$.). This ion is accompanied by an ion 44 Da less at m/z 667.8, which probably corresponds to $[M+H{-}CO_2+O_2]^{2+}$. probably forms from the oxidation of the $[M\text{-}CO_2]^{2}$+. product [8, 17]. Radical ions have been observed to react with residual oxygen during their confinement in electrodynamic ion traps, which was also noted for the ETD-generated z. ions [38, 39] and MAD-generated [POPC]. radical ions [40].

When the charge state of substance P precursor increases to 2+ and 3+, fewer side-chain losses from ionized species were observed. Observed losses include: 17 Da ($NH_3$) [21], 74 Da ($CH_2{=}CHSCH_3$ from Met) [16] and 92 Da ($CH_3$ ($C_6H_5$) from Phe) [21] were lost from $[M+2H]^{3+}$.. 17 Da ($NH_3$) [21], 74 Da ($CH_2{=}CHSCH_3$ from Met) [16] and 99 Da ($CH_2{=}CH(CH_2)NHC(CH_2){=}NH$ from Arg) [37] were lost from $[M+3H]^{4+}$..

Figure 16A:
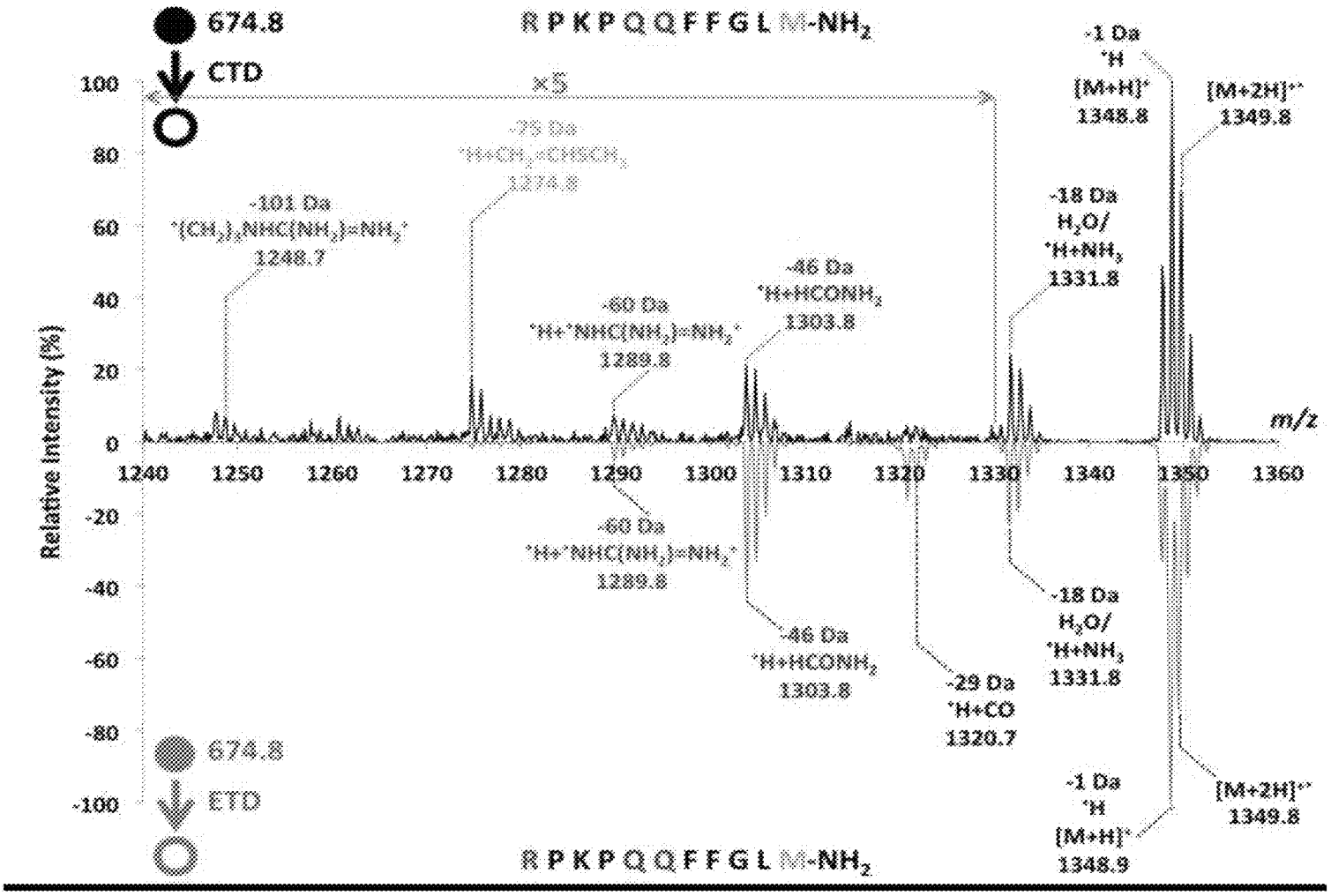
Figure 16B:
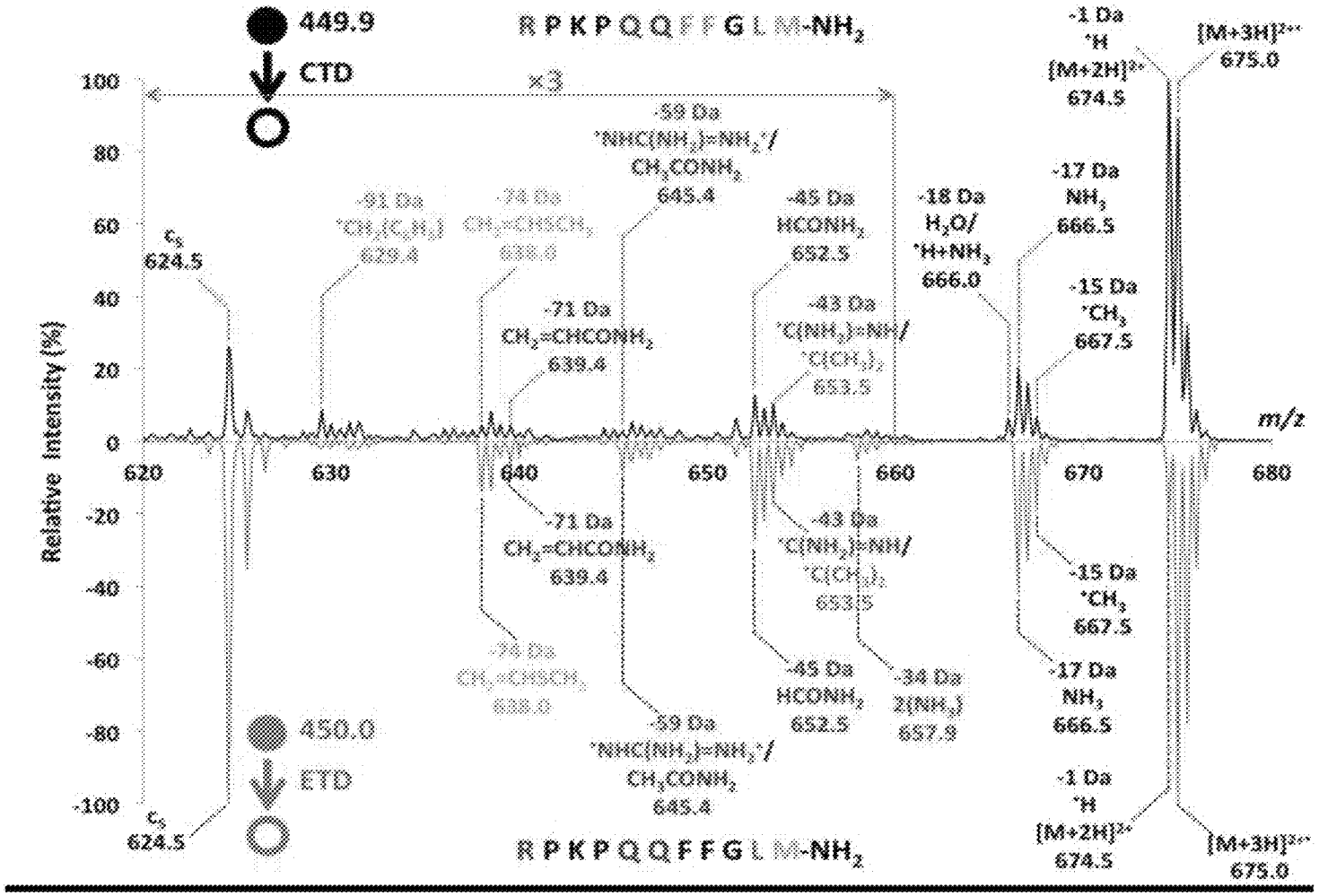
Figure 16C:
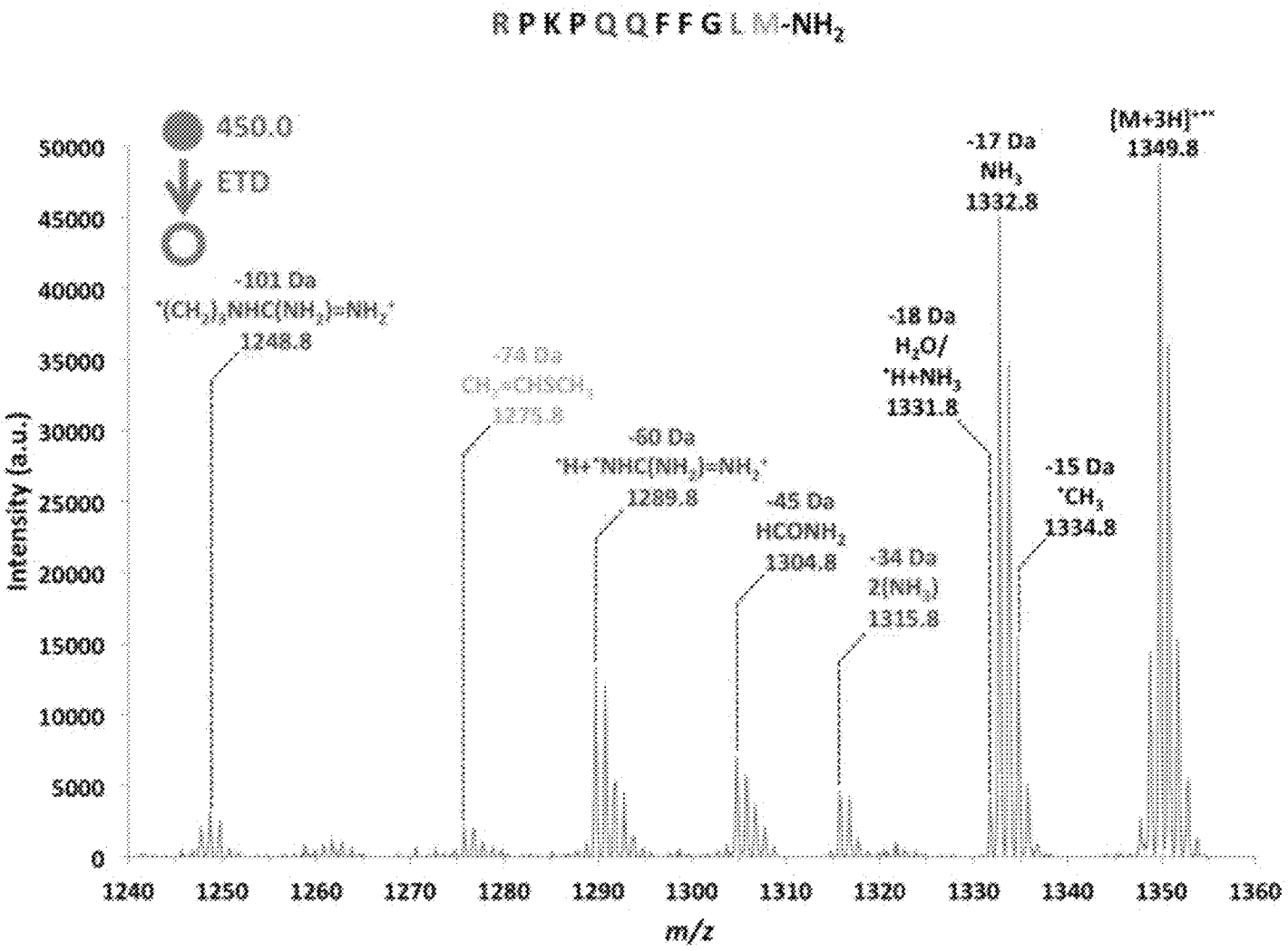

FIGS. 16A-16C show head-to-tail zoomed-in spectra of reduced (charge-decreased) product ions of: (FIG. 16A) He-CTD versus ETD of 2+ substance P, (FIG. 16B) He-CTD versus ETD of 3+ substance P, and (FIG. 16C) 1+ product ions from ETD of 3+ substance P. Each spectrum is normalized to the tallest peak within the (M.-X) range of charge-reduced product ions. Zoomed-in m/z regions of charge-reduced species from He-CTD spectra of 2+ and 3+ substance P precursors are shown in top panels of FIGS. 16A-16B. ETD spectra of 2+ and 3+ substance P are magnified to show the (M.-X) regions, which are listed as bottom panels in FIGS. 16A and 16B and an individual panel in FIG. 16C.

The CTD spectrum in top panel of FIG. 16A shows several neutral losses from $[M+2H]^{+}$., including 1 Da (.H) [17], 18 Da ($H_2O$ or .H+$NH_3$) [17, 41-43], 46 Da (.H+$HCONH_2$ from Gln) [41, 42], 60 Da (.H+.$NHC(NH_2){=}NH_2^{+}$ from Arg) [28, 41-43], 75 Da (.H+$CH_2{=}CHSCH_3$ from Met) [31, 43] and 101 Da (.$(CH_2)_3NHC(NH_2){=}NH_2^{+}$ from Arg) [31]. Similar neutral losses from the ETD product $[M+2H]^{+}$. are also observed [36]. Two exceptions are the 75 Da side-chain loss, which is unique to CTD, and the 29 Da loss, which is only observed in the ETD product ion spectrum. In the absence of high mass accuracy, the 29 Da loss is tentatively assigned as .H+CO [41].

Compared to the low abundance and small neutral losses from the $[M+2H]^{+}$. product ion, neutral losses from the $[M+3H]^{2+}$. product ion are more abundant for both CTD and ETD. Moreover, the types of neutral losses from the radical dication $[M+3H]^{2+}$. are also different from that of $[M+2H]^{+}$.. The observed neutral losses in the CTD spectrum and their tentative assignments are: 15 Da (.$CH_3$) [43], 18 Da ($H_2O$ or .H+$NH_3$) [17, 41, 43], 43 Da (.$C(NH_2){=}NH$ from Arg or .$C(CH_3)_2$ from Leu) [17, 37], 45 Da (.H+$HCONH_2$ from Gln) [41, 42], 59 Da (.$NHC(NH_2){=}NH_2^{+}$ from Arg or $CH_3CONH_2$ from Gln) [28, 41-43], 71 Da ($CH_2{=}CHCONH_2$ from Gln) [37, 43], 74 Da ($CH_2{=}CHSCH_3$ from Met) [37, 43] and 91 Da (.$CH_2$ ($C_6H_5$)) [21]. Interestingly, the CTD spectrum has a unique small loss of 91 Da, and the ETD spectrum has a unique loss of 34 Da (2($NH_3$) from Arg) [36].

Unlike CTD, ETD of 3+ substance P precursor also produced the singly charged ETnoD product ($[M+3H]^{+}$..), whose (M.-X) region shows the same small losses as those observed for $[M+2H]^{+}$. and $[M+3H]^{2+}$.. Similar neutral losses have also been observed in ECD experiments [41].

In general, the CTD and ETD spectra show many similarities in the (M.-X) regions of both $[M+2H]^{+}$. and $[M+3H]^{2+}$.. The similar neutral losses between the two activation methods are indicative of similar fragmentation mechanism, which adds more confidence of our previous hypothesis that electron-based fragmentation mainly accounts for the fragments located in the high mass end of CTD spectrum. The similarity in CTD and ETD spectra of multiply-charged precursor ions suggests that the ExD-like fragments in CTD experiments originate from the interaction with ETD-like reagent anions, such as negative ions derived from vacuum pump oil or other common contaminants.

For the investigation of the origin of charge-reduced species, the ESI source was switched to negative mode, so the detector only picks up signals from possible product anions. The ESI voltages were set to be +800 V and −500 V. All the following mass spectra were collected under "enhanced resolution mode". The low mass cut off (LMCO) value was set to be m/z 70. The saddle field ion source conditions and data acquisition times are the same as described in main manuscript.

With the ESI source off, saddle field ion source was turned on, so the "empty" electrodynamic quadrupole ion trap was irradiated with helium cations. Aside from the generation of helium cations, a high flux of electrons was also produced in the saddle field ion source. Hypothetically, the "unremoved" electron beam sputters on the pump oil deposited on the inside surface of the quadrupole ion trap, which would then undergo a desorption process, generating aromatic anions. As electron carriers, these aromatic anions would transfer electrons to the isolated precursor cations to generate ETD-like product ions.

By operating the trap in negative ion mode, the CTD source and trap conditions can be shown to produce multiple anions in the region m/z 180-220 (FIGS. 51A-51E). One particularly abundant anion exists at m/z 184. Isolation of this abundant background anion showed two interesting properties: 1) the anion could reversibly add O and $O_2$, which indicates the anion is a radical; and 2) the anion is resistant to collisional activation, which indicates it may contain fused ring systems. The supplemental materials provide more details about the interrogation of the background anion in CTD. Background anions generated by the CTD gun are present at most m/z values below m/z 200, and they can be easily excluded from the trap to prevent electron transfer reactions by raising the LMCO value >220 Da. Charge reduction (e.g. ETD-like activation) is still observed, even when the co-storage of anions and cations is minimized, which indicates that a second mechanism must also exist to explain the charge reduction of multiply-protonated peptide cations. It is possible that the He cation beam contains a fraction of helium metastable atoms, which have relatively low ionization potentials and could serve as an electron transfer reagents.

Figure 17A:
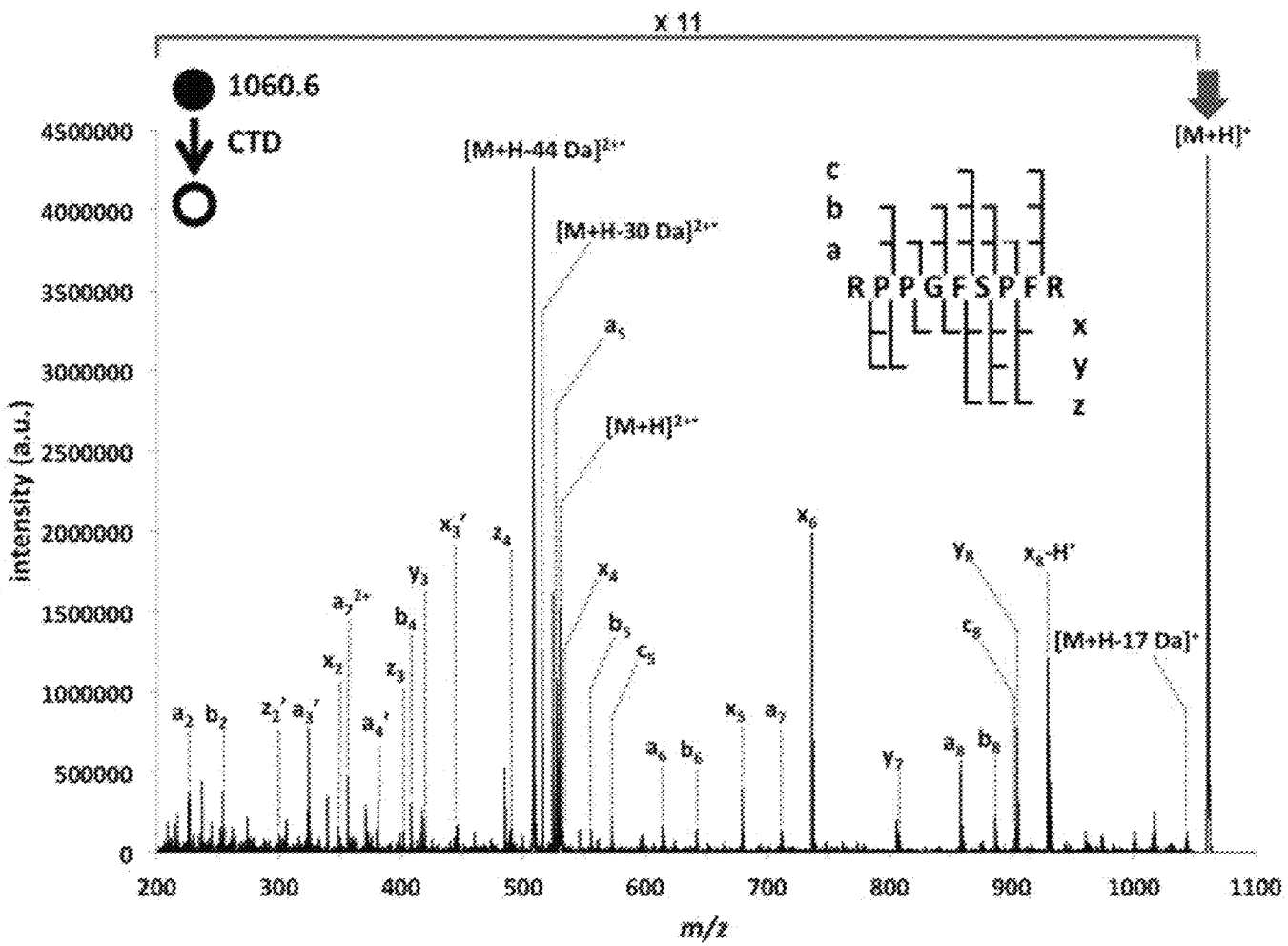
FIGS. 17A-17C each respectively show a He-CTD spectrum of (FIG. 17A) singly, (FIG. 17B) doubly and (FIG. 17C) triply protonated bradykinin. Different m/z ranges of interested have been multiplied by a factor of 11, 200 and 8, respectively, for clarity.
Figure 17B:
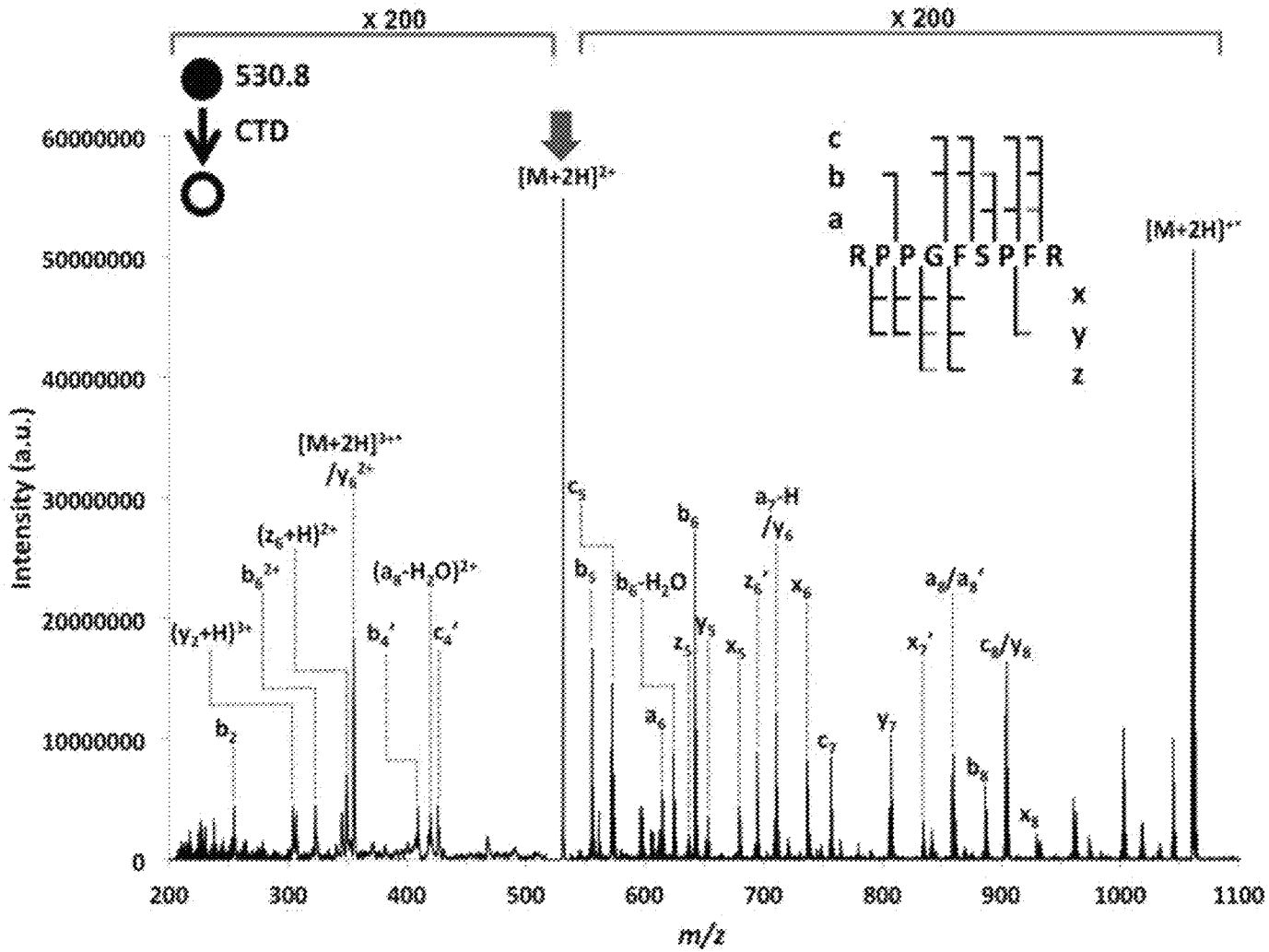
Figure 17C:
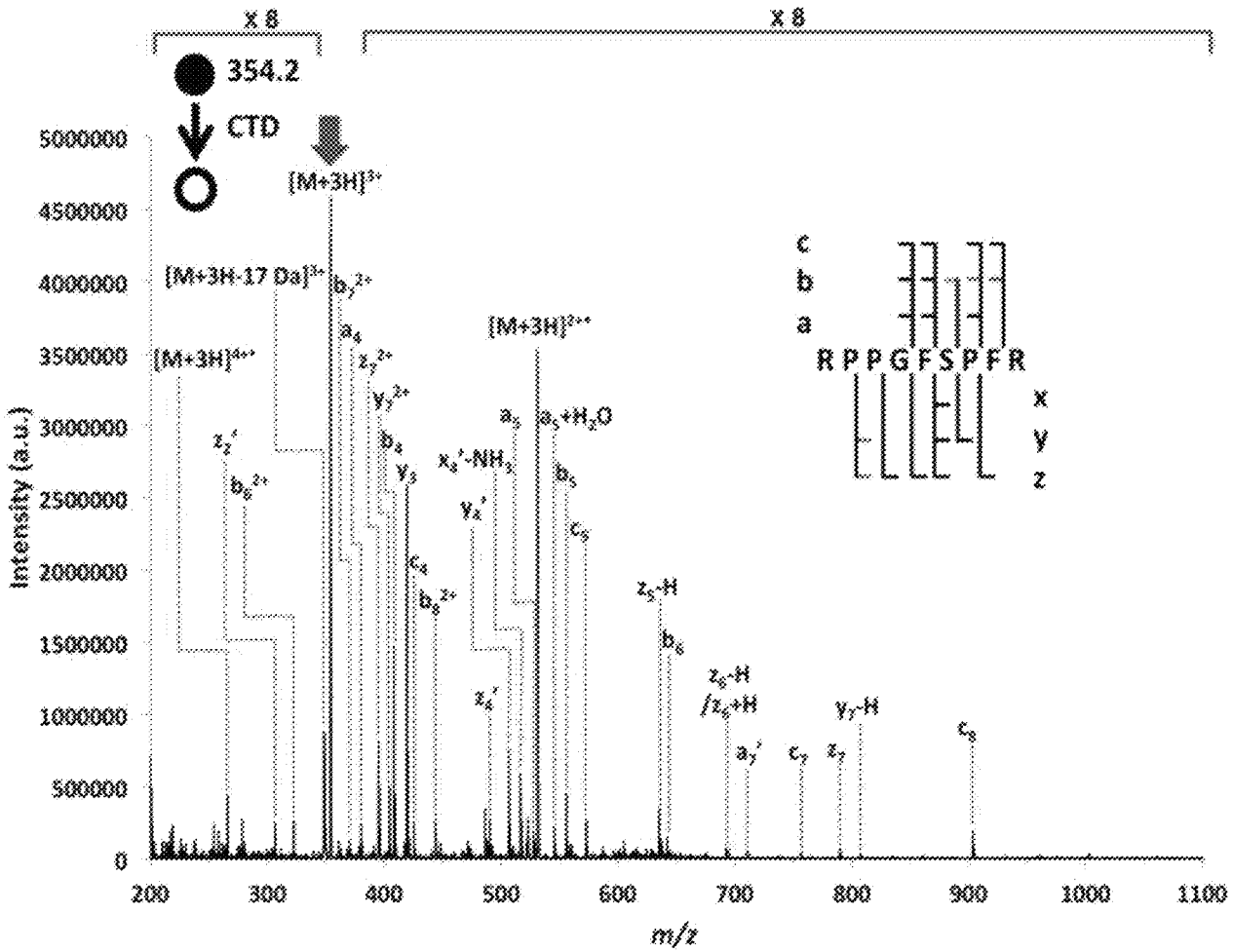

FIGS. 17A-17C each respectively show a He-CTD spectrum of (FIG. 17A) singly, (FIG. 17B) doubly and (FIG. 17C) triply protonated bradykinin. Different m/z ranges of interested have been multiplied by a factor of 11, 200 and 8, respectively, for clarity. He-CTD was also conducted on 1+, 2+ and 3+ bradykinin cations, and the results are shown in FIGS. 17A-17C.

Upon irradiation with helium cations, charge-increased product ions were observed for all three charge states. Charge-reduced product ions could only be observed for 2+ and 3+ precursors of bradykinin, as expected. These observations are in good agreement with the observations for CTD of substance P [24], and the previous study by Zubarev and coworkers [25]. Unlike CTD of 1+ substance P, CTD of 1+ bradykinin produces an abundant series of x ions in addition to the previously observed a ions. CTD of 1+ bradykinin also produces more b, y, c and z ions. The coexistence of a/x ion pairs provides greater confidence in sequencing and more confidence that the a ions are formed via direct C—CO cleavage and not from CO losses from intermediate b ions.

Consistent with He-CTD results of 2+ and 3+ substance P, fewer a/x ions and more b/y and c/z ions are observed for 2+ and 3+ bradykinin. And similar to CTD of 3+ substance P, the product ion spectrum for CTD of 3+ of bradykinin is dominated by c/z ions. The abundant c/z ions again point to the domination of an ETD-like mechanism for the higher charge state precursors in CTD.

Figure 18A:
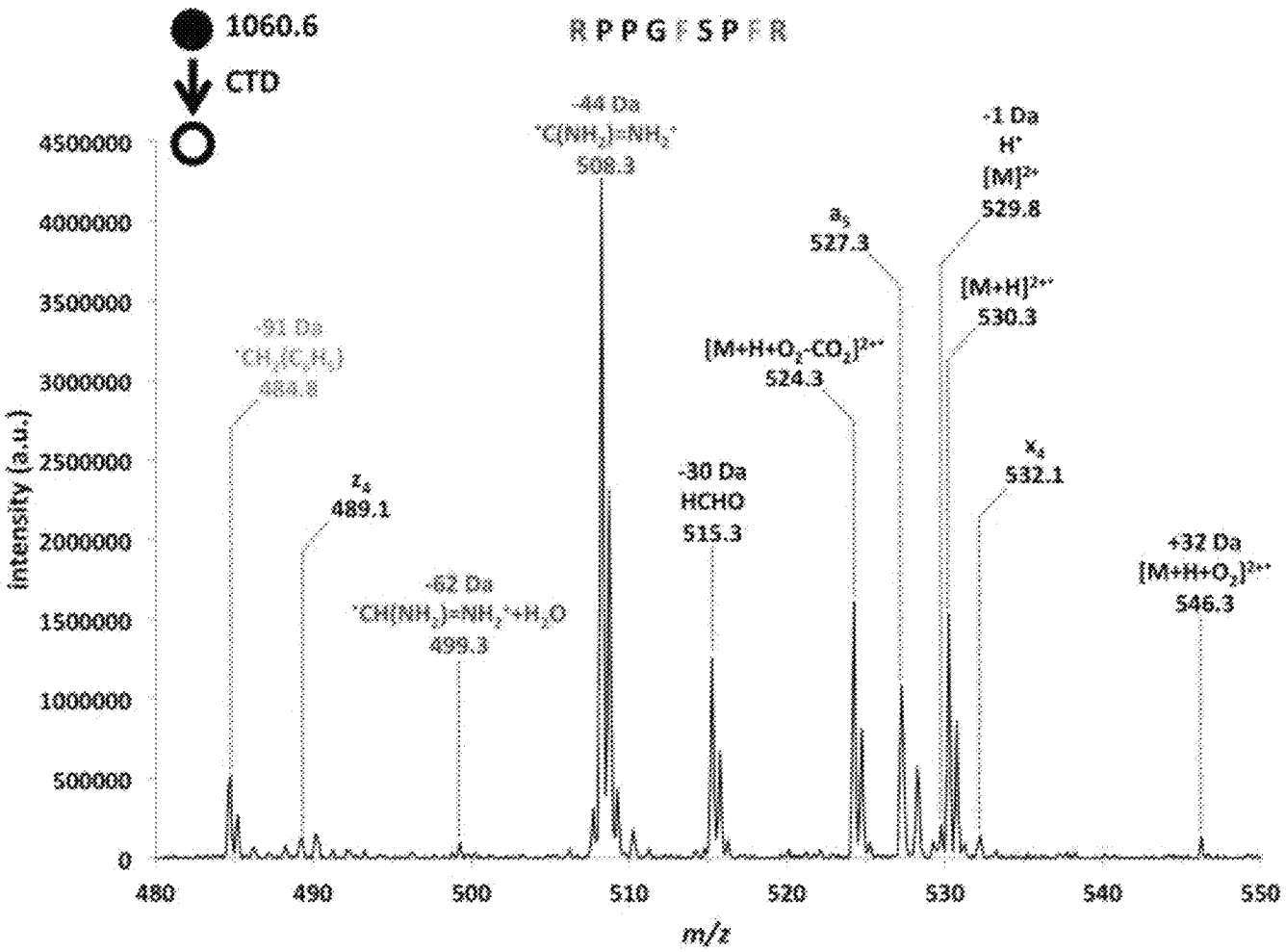
FIGS. 18A-18C show zoomed-in He-CTD spectra of (FIG. 18A) singly protonated bradykinin showing (M.-X) regions of $[M+H]^{2+}$. (oxidized product ion), (FIG. 18B) doubly and (FIG. 18C) triply protonated bradykinin showing (M.-X) regions of $[M+2H]^+$. and $[M+3H]^{2+}$. (charge-reduced product ions) respectively.
Figure 18B:
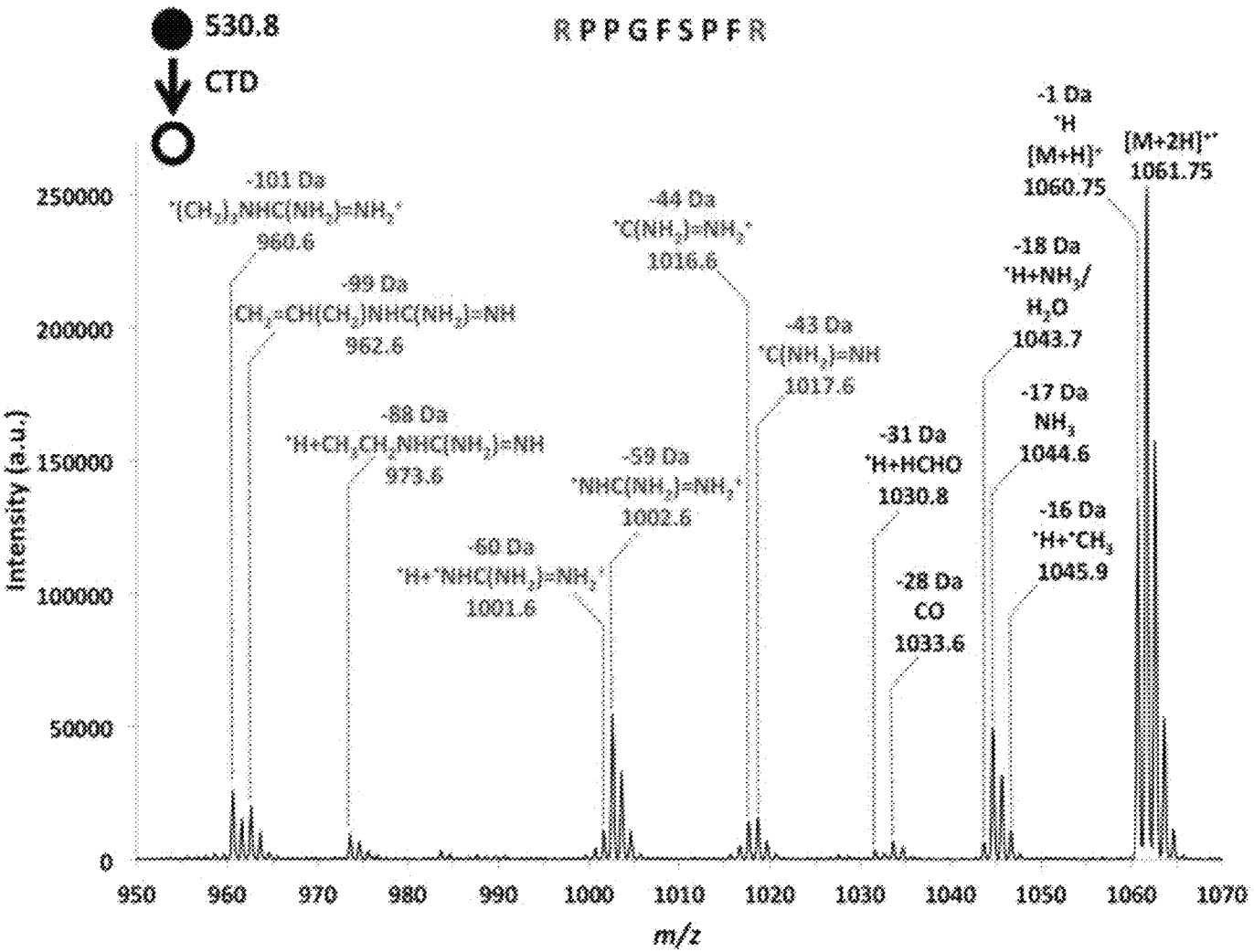
Figure 18C:
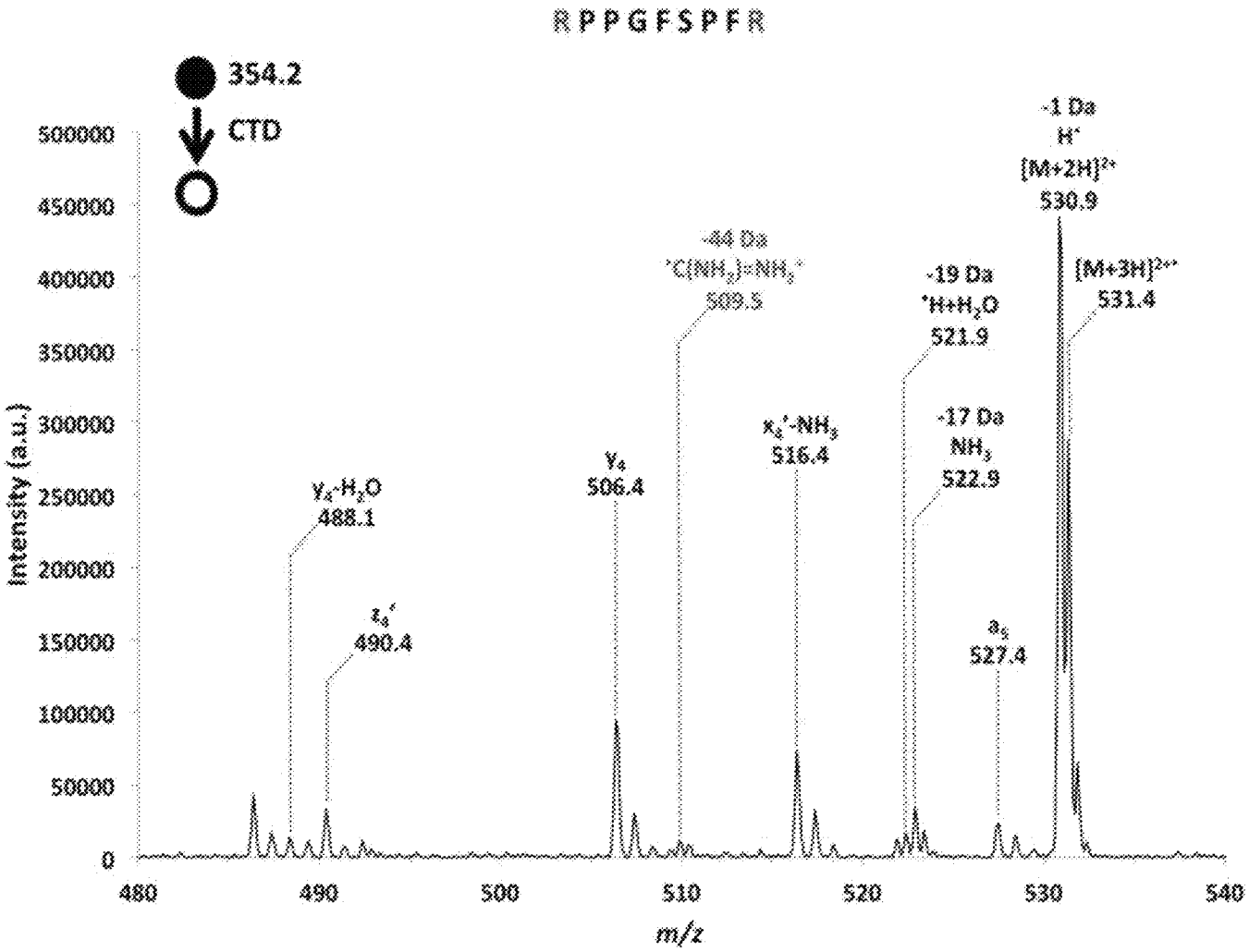

FIGS. 18A-18C show zoomed-in He-CTD spectra of (FIG. 18A) singly protonated bradykinin showing (M.-X) regions of $[M+H]^{2+}$. (oxidized product ion), (FIG. 18B) doubly and (FIG. 18C) triply protonated bradykinin showing (M.-X) regions of $[M+2H]^{+}$. and $[M+3H]^{2+}$. (charge-reduced product ions) respectively. As shown in FIG. 18A, He-CTD of 1+ bradykinin precursor produced five significant fragments corresponding to small neutral losses from $[M+H]^{2+}$.. Similar to the (M.-X) regions of substance P, an oxygen adduct ion at m/z 546.3 as well as an accompanying ion at m/z 524.3 (formed through $CO_2$ loss) are observed. Furthermore, the formation of $[M]^{2+}$ through the loss of a 1 Da neutral (.H) is also observed.

Significant differences in small neutral losses of bradykinin and substance P were observed. For example, bradykinin in FIG. 18A shows four different small losses: 30 Da (HCHO) [17], 44 Da (.$C(NH_2)$=$NH_2$ from Arg) [21], 62 Da (.$C(NH_2)$=$NH_2^{+}$+$H_2O$) [21] and 91 Da (.$CH_2(C_6H_5)$ from Phe) [21], two of which are of significantly higher intensity compared to that in CTD experiment of 1+ substance P. The appearance of fragments corresponding to side-chain losses from Phenylalanine and Arginine in the (M.-X) region of $[M+H]^{2+}$. is consistent with the fact that bradykinin possesses twice the amount of phenylalanine and arginine residues, and that these residues are at or adjacent to the C-terminus in bradykinin.

Helium-CTD of 2+ and 3+ bradykinin cations produced many small losses within the (M.-X) region of $[M+2H]^{+}$. (FIG. 18B), and a few small losses within the (M.-X) region of $[M+3H]^{2+}$. (FIG. 18C). Most of the small losses for bradykinin are similar to those observed in the same (M.-X) region of charge-reduced species from CTD of 2+ and 3+ of substance P. The similar neutral losses include: 1 Da (.H), 16 Da (.H+.$CH_3$), 17 Da ($NH_3$), 18 Da ($H_2O$ or .H+$NH_3$), 28 Da (CO), 43 Da (.$C(NH_2)$=NH from Arg), 59 Da (.NHC$(NH_2)$=$NH_2$ from Arg), 101 Da (.$(CH_2)_3NHC(NH_2)$=$NH_2$ from Arg). Different small losses are observed as well. For example, bradykinin shows losses corresponding of: 19 Da (.H+$H_2O$) [43], 31 Da (.H+HCHO) [17], 44 Da (.$C(NH_2)$=$NH_2^{+}$ from Arg) [43], 60 Da (.H+.NHC$(NH_2)$=$NH_2^{+}$ from Arg) [36], 88 Da (.H+$CH_3CH_2NHC(NH_2)$=NH from Arg) [43] and 99 Da ($CH_2$=$CH(CH_2)NHC(NH_2)$=NH from Arg) [41]. Compared to substance P (RPKPQQFFGLM), bradykinin (RPPGFSPFR) has a higher composition of arginine residues, which could possibly account for the more frequent observation of arginine side-chain losses in bradykinin. A similar observation was observed in the ECD study of bradykinin methyl ester (RPPGFSPFR$OCH_3$) [41]. Upon ECD, bradykinin with a C-terminal methylester showed a predominance of arginine-specific losses in the (M.-X) region of $[M+2H]^{+}$..

Figure 52A:
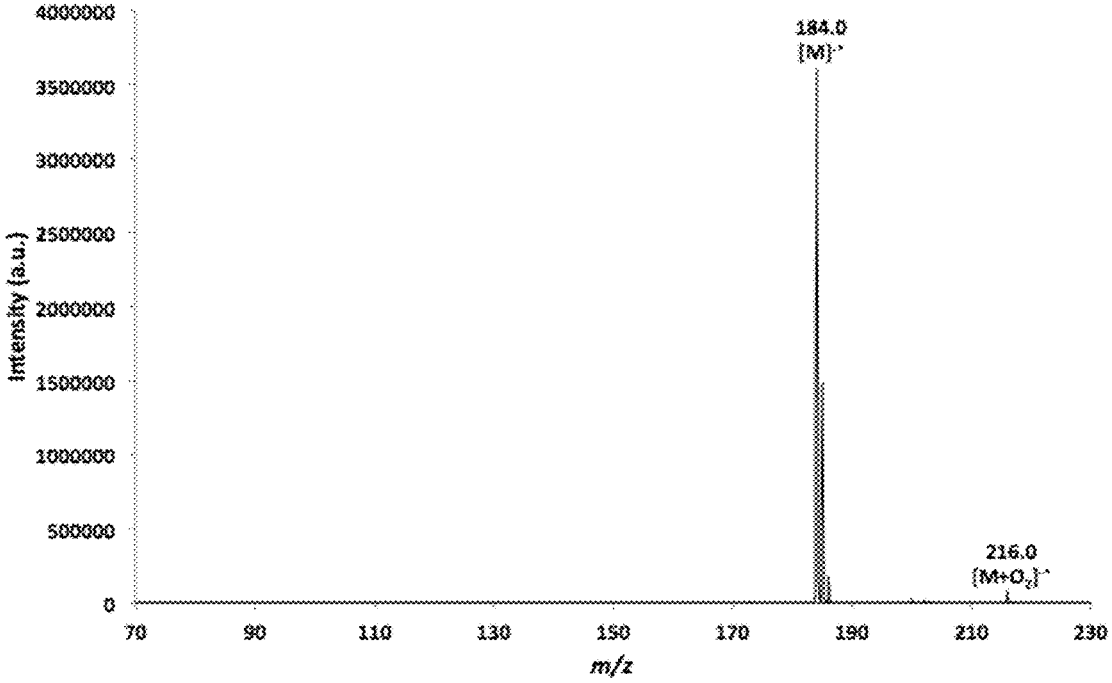
FIGS. 52A-52B show (FIG. 52A) Isolation spectrum of ion at m/z 184 at $MS^3$ and (FIG. 52B) CID spectrum of ion at m/z 184 at $MS^3$ with an activation voltage of about 1.0 V.
Figure 52B:
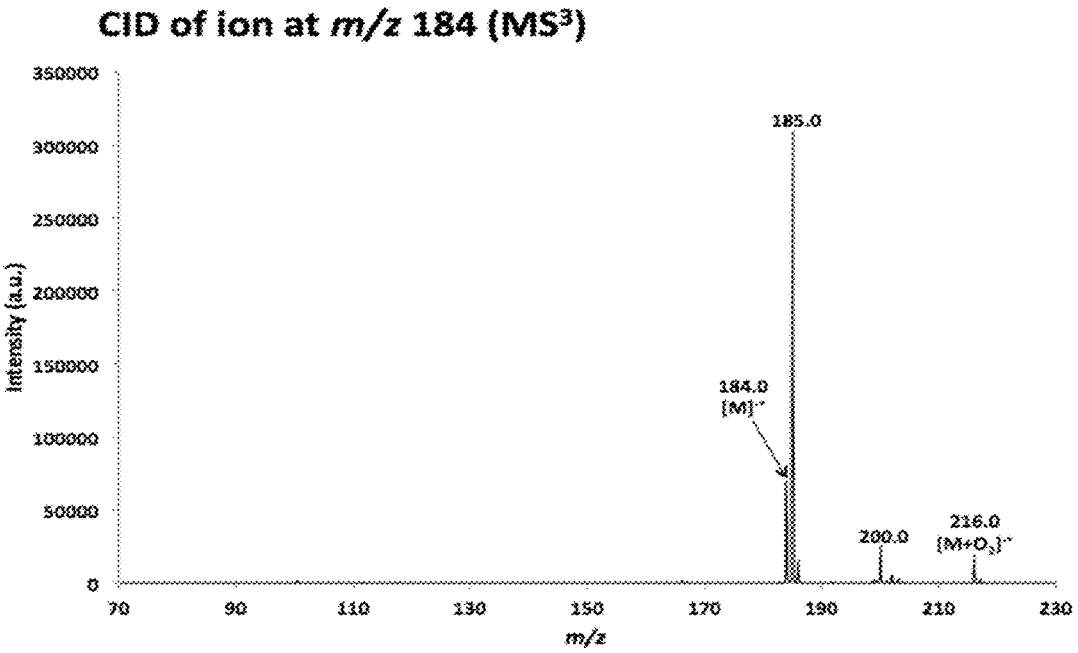

Further, FIGS. 52A-52B show the isolation spectrum of ion at m/z of 184 at $MS^3$ and the CID spectrum of ion at m/z of 184 at $MS^3$ with an activation voltage of about 1.0 V. In FIG. 52B, the ion at m/z 184 ($[M]^{-}$.) was subjected to a CID activation voltage of about 1.0 V, but it still didn't fragment. This fact further suggests the highly stable structure of M, which could be a polycyclic/aromatic hydrocarbon.

Figure 53:
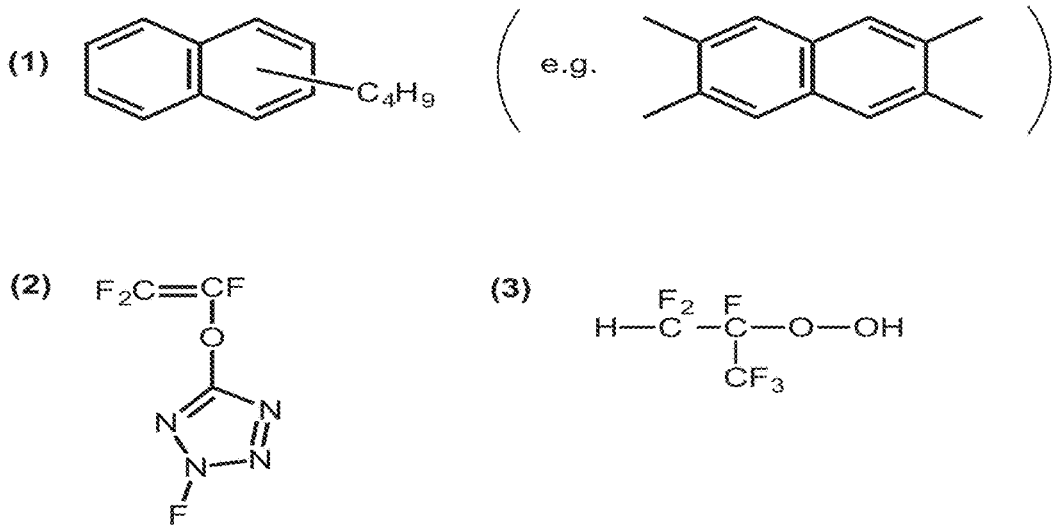
FIG. 53 shows a Scheme demonstrating examples of possible structures of the ion at m/z 184.

With the structural details that can be drawn from the above data, the most likely candidate at present is a naphthalene derivative at m/z 184 ([M]-.). Vacuum pump oil contains a large proportion of saturated hydrocarbons, but because hydrodreated paraffinic oils are derived from medium/heavy petroleum distillates, they also contain polycyclic and aromatic constituents. The ion at m/z 184 seems to have eight double bond equivalents, so could be a negatively-charged substituted naphthalene radical, [C14H16]-., as shown in FIG. 53. This structure is consistent with the apparent resistance to collisional activation. Based on the expected elemental composition of the precursor anion at m/z 184, it must have fewer double-bond equivalents than the popular reagent anion fluoranthene.

Another, less likely possibility, is that the background anions are fluorinated compounds. Fluorinated compounds could originate from the decomposition of fluoroelastomer from Viton, which is used in most LC systems in the pumps. The Scheme shown in FIG. 53 shows hypothetical chemical structure of the ion at m/z 184; (2), derived from ref. [44], or; (3), derived from ref. [45]. However, we expect that thee fluorinated compounds would provide some observable product ions under collisional activation, but none were observed.

The formation of adducts with O2-. has been well noted for polyaromatics [46, 47] and halogenated compounds [48]. And a resonance electron capture mechanism was proposed for the generation of such adducts [47].

SUMMARY

Charge transfer dissociation of singly, doubly and triply protonated substance P and bradykinin was conducted in a 3D ion trap mass spectrometer. The charge state of the precursor ions significantly impacted the number and the types of ions produced—a/x versus c/z—correlates with the relative contributions of oxidative versus reductive mechanisms, respectively. Consistent with our previous experimental results, CTD of singly charged precursors produces an abundance of a/x fragments, and the distribution of charge between complementary a/x ion pairs is dependent on the relative basicity of the peptide termini. CTD of doubly and triply charged precursors produced additional b/y ions and c/z ions. The type of fragment ions provides helpful hints on possible fragmentation channels that CTD adopts: high-energy, and ETD-like (i.e. radical) pathways. Accompanying side-chain losses were also observed in CTD spectra, which are in good agreement with the previous results from photo-activated, collisionally activated, and electron-based dissociation experiments. The side chain losses can provide valuable diagnostic information about amino acid composition to support the backbone-sequencing ions. The enriched structural information obtainable via CTD, along with the relative low-cost of 3D ion instrument platform, makes this approach a promising tool for the interrogation of gas-phase biomolecules.

REFERENCES FOR EXAMPLE 3

1. Lee, H.; An, H. J.; Lerno, L. A.; German, J. B.; Lebrilla, C. B.: Rapid profiling of bovine and human milk gangliosides by matrix-assisted laser desorption/ionization fourier transform ion cyclotron resonance mass spectrometry. *International Journal of Mass Spectrometry* 305, 138-150 (2011)
2. Ko, B. J.; Brodbelt, J. S.: 193 nm ultraviolet photodissociation of deprotonated sialylated oligosaccharides. *Analytical Chemistry* 83, 8192-8200 (2011)
3. Lopez-Clavijo, A. F.; Duque-Daza, C. A.; Creese, A. J.; Cooper, H. J.: Electron capture dissociation mass spectrometry of phosphopeptides: Arginine and phosphoserine. *International Journal of Mass Spectrometry* 390, 63-70 (2015)
4. Voinov, V. G.; Hoffman, P. D.; Bennett, S. E.; Beckman, J. S.; Barofsky, D. F.: Electron capture dissociation of sodium-adducted peptides on a modified quadrupole/time-of-flight mass spectrometer. *Journal of the American Society for Mass Spectrometry* 26, 2096-2104 (2015)
5. Lu, J.; Trnka, M. J.; Roh, S. H.; Robinson, P. J. J.; Shiau, C.; Fujimori, D. G.; Chiu, W.; Burlingame, A. L.; Guan, S. H.: Improved peak detection and deconvolution of native electrospray mass spectra from large protein complexes. *Journal of the American Society for Mass Spectrometry* 26, 2141-2151 (2015)
6. Flett, F. J.; Walton, J. G. A.; Mackay, C. L.; Interthal, H.: Click chemistry generated model DNA-peptide heteroconjugates as tools for mass spectrometry. *Analytical Chemistry* 87, 9595-9599 (2015)
7. Sleno, L.; Volmer, D. A.: Ion activation methods for tandem mass spectrometry. *Journal of Mass Spectrometry* 39, 1091-1112 (2004)
8. Kalcic, C. L.; Reid, G. E.; Lozovoy, V. V.; Dantus, M.: Mechanism elucidation for nonstochastic femtosecond laser-induced ionization/dissociation: From amino acids to peptides. *Journal of Physical Chemistry A* 116, 2764-2774 (2012)
9. Cook, S. L.; Collin, O. L.; Jackson, G. P.: Metastable atom-activated dissociation mass spectrometry: Leucine/isoleucine differentiation and ring cleavage of proline residues. *Journal of Mass Spectrometry* 44, 1211-1223 (2009)
10. Cook, S. L.; Jackson, G. P.: Characterization of tyrosine nitration and cysteine nitrosylation modifications by metastable atom-activation dissociation mass spectrometry. *Journal of the American Society for Mass Spectrometry* 22, 221-232 (2011)
11. Cook, S. L.; Jackson, G. P.: Metastable atom-activated dissociation mass spectrometry of phosphorylated and sulfonated peptides in negative ion mode. *Journal of the American Society for Mass Spectrometry* 22, 1088-1099 (2011)
12. Zhurov, K. O.; Fornelli, L.; Wodrich, M. D.; Laskay, U. A.; Tsybin, Y. O.: Principles of electron capture and transfer dissociation mass spectrometry applied to peptide and protein structure analysis. *Chemical Society Reviews* 42, 5014-5030 (2013)
13. Yoo, H. J.; Wang, N.; Zhuang, S. Y.; Song, H. T.; Hakansson, K.: Negative-ion electron capture dissociation: Radical-driven fragmentation of charge-increased gaseous peptide anions. *Journal of the American Chemical Society* 133, 16790-16793 (2011)
14. Liu, J.; McLuckey, S. A.: Electron transfer dissociation: Effects of cation charge state on product partitioning in ion/ion electron transfer to multiply protonated polypeptides. *International Journal of Mass Spectrometry* 330, 174-181 (2012)
15. Kjeldsen, F.; Giessing, A. M. B.; Ingrell, C. R.; Jensen, O. N.: Peptide sequencing and characterization of post-translational modifications by enhanced ion-charging and liquid chromatography electron-transfer dissociation tandem mass spectrometry. *Analytical Chemistry* 79, 9243-9252 (2007)
16. Nielsen, M. L.; Budnik, B. A.; Haselmann, K. F.; Zubarev, R. A.: Tandem maldi/el ionization for tandem fourier transform ion cyclotron resonance mass spectrometry of polypeptides. *International Journal of Mass Spectrometry* 226, 181-187 (2003)
17. Fung, Y. M. E.; Adams, C. M.; Zubarev, R. A.: Electron ionization dissociation of singly and multiply charged peptides. *Journal of the American Chemical Society* 131, 9977-9985 (2009)
18. Barbacci, D. C.; Russell, D. H.: Sequence and side-chain specific photofragment (193 nm) ions from protonated substance p by matrix-assisted laser desorption ionization time-of-flight mass spectrometry. *Journal of the American Society for Mass Spectrometry* 10, 1038-1040 (1999)
19. Thompson, M. S.; Cui, W.; Reilly, J. P.: Factors that impact the vacuum ultraviolet photofragmentation of peptide ions. *Journal of the American Society for Mass Spectrometry* 18, 1439-1452 (2007)
20. Kalcic, C. L.; Gunaratne, T. C.; Jonest, A. D.; Dantus, M.; Reid, G. E.: Femtosecond laser-induced ionization/dissociation of protonated peptides. *Journal of the American Chemical Society* 131, 940-942 (2009)
21. Canon, F.; Milosavljevic, A. R.; Nahon, L.; Giuliani, A.: Action spectroscopy of a protonated peptide in the ultraviolet range. *Physical Chemistry Chemical Physics* 17, 25725-25733 (2015)
22. Misharin, A. S.; Silivra, O. A.; Kjeldsen, F.; Zubarev, R. A.: Dissociation of peptide ions by fast atom bombardment in a quadrupole ion trap. *Rapid Communications in Mass Spectrometry* 19, 2163-2171 (2005)
23. Berkout, V. D.: Fragmentation of protonated peptide ions via interaction with metastable atoms. *Analytical Chemistry* 78, 3055-3061 (2006)
24. Hoffmann, W. D.; Jackson, G. P.: Charge transfer dissociation (ctd) mass spectrometry of peptide cations using kiloelectronvolt helium cations. *Journal of the American Society for Mass Spectrometry* 25, 1939-1943 (2014)
25. Chingin, K.; Makarov, A.; Denisov, E.; Rebrov, O.; Zubarev, R. A.: Fragmentation of positively-charged biological ions activated with a beam of high-energy cations. *Analytical Chemistry* 86, 372-379 (2014)
26. Budnik, B. A.; Tsybin, Y. O.; Hakansson, P.; Zubarev, R. A.: Ionization energies of multiply protonated polypeptides obtained by tandem ionization in fourier transform mass spectrometers. *Journal of Mass Spectrometry* 37, 1141-1144 (2002)

27. Pitteri, S. J.; Chrisman, P. A.; Hogan, J. M.; McLuckey, S. A.: Electron transfer ion/ion reactions in a three-dimensional quadrupole ion trap: Reactions of doubly and triply protonated peptides with so2 center dot-. *Analytical Chemistry* 77, 1831-1839 (2005)
28. Zubarev, R. A.; Kelleher, N. L.; McLafferty, F. W.: Electron capture dissociation of multiply charged protein cations. A nonergodic process. *Journal of the American Chemical Society* 120, 3265-3266 (1998)
29. Axelsson, J.; Palmblad, M.; Hakansson, K.; Hakansson, P.: Electron capture dissociation of substance p using a commercially available fourier transform ion cyclotron resonance mass spectrometer. *Rapid Communications in Mass Spectrometry* 13, 474-477 (1999)
30. Leymarie, N.; Costello, C. E.; O'Connor, P. B.: Electron capture dissociation initiates a free radical reaction cascade. *Journal of the American Chemical Society* 125, 8949-8958 (2003)
31. Chalkley, R. J.; Brinkworth, C. S.; Burlingame, A. L.: Side-chain fragmentation of alkylated cysteine residues in electron capture dissociation mass spectrometry. *Journal of the American Society for Mass Spectrometry* 17, 1271-1274 (2006)
32. Savitski, M. M.; Nielsen, M. L.; Zubarev, R. A.: Side-chain losses in electron capture dissociation to improve peptide identification. *Analytical Chemistry* 79, 2296-2302 (2007)
33. Faith, M.; Savitski, M. M.; Nielsen, M. L.; Kjeldsen, F.; Andren, P. E.; Zubarev, R. A.: Analytical utility of small neutral losses from reduced species in electron capture dissociation studied using swedecd database. *Analytical Chemistry* 80, 8089-8094 (2008)
34. Jensen, C. S.; Wyer, J. A.; Houmoller, J.; Hvelplund, P.; Nielsen, S. B.: Electron-capture induced dissociation of doubly charged dipeptides: On the neutral losses and n-c-alpha bond cleavages. *Physical Chemistry Chemical Physics* 13, 18373-18378 (2011)
35. Kaczorowska, M. A.: Electron capture dissociation and collision induced dissociation behavior of peptides containing methionine, selenomethionine and oxidized methionine. *International Journal of Mass Spectrometry* 389, 54-58 (2015)
36. Xia, Q. W.; Lee, M. V.; Rose, C. M.; Marsh, A. J.; Hubler, S. L.; Wenger, C. D.; Coon, J. J.: Characterization and diagnostic value of amino acid side chain neutral losses following electron-transfer dissociation. *Journal of the American Society for Mass Spectrometry* 22, 255-264 (2011)
37. Laskin, J.; Yang, Z. B.; Ng, C. M. D.; Chu, I. K.: Fragmentation of alpha-radical cations of arginine-containing peptides. *Journal of the American Society for Mass Spectrometry* 21, 511-521 (2010)
38. Xia, Y.; Chrisman, P. A.; Pitteri, S. J.; Erickson, D. E.; McLuckey, S. A.: Ion/molecule reactions of cation radicals formed from protonated polypeptides via gas-phase ion/ion electron transfer. *Journal of the American Chemical Society* 128, 11792-11798 (2006)
39. Smith, S. A.; Kalcic, C. L.; Safran, K. A.; Stemmer, P. M.; Dantus, M.; Reid, G. E.: Enhanced characterization of singly protonated phosphopeptide ions by femtosecond laser-induced ionization/dissociation tandem mass spectrometry (fs-lid-ms/ms). *Journal of the American Society for Mass Spectrometry* 21, 2031-2040 (2010)
40. Li, P.; Hoffmann, W. D.; Jackson, G. P.: Multistage mass spectrometry of phospholipids using collision-induced dissociation (cid) and metastable atom-activated dissociation (mad). *Int J Mass Spectrom* (2016)
41. Cooper, H. J.; Hudgins, R. R.; Hakansson, K.; Marshall, A. G.: Characterization of amino acid side chain losses in electron capture dissociation. *Journal of the American Society for Mass Spectrometry* 13, 241-249 (2002)
42. Haselmann, K. F.; Budnik, B. A.; Kjeldsen, F.; Polfer, N. C.; Zubarev, R. A.: Can the (m center dot-x) region in electron capture dissociation provide reliable information on amino acid composition of polypeptides? *European Journal of Mass Spectrometry* 8, 461-469 (2002)
43. Fung, Y. M. E.; Chan, T. W. D.: Experimental and theoretical investigations of the loss of amino acid side chains in electron capture dissociation of model peptides. *Journal of the American Society for Mass Spectrometry* 16, 1523-1535 (2005)
44. Curable fluoroelastomer compositions. U.S. Pat. No. 8,288,482.
45. Flexible laminated fluoropolymer containing composites. EP Pat. App. Pub. No. 0202996 A2.
46. Hassan, I., Pinto, S., Weisbecker, C., Attygalle, A. B.: Competitive Deprotonation and Superoxide [O2 (-*)] Radical-Anion Adduct Formation Reactions of Carboxamides under Negative-Ion Atmospheric-Pressure Helium-Plasma Ionization (HePI) Conditions. J Am Soc Mass Spectrom 27, 394-401 (2016)
47. Pshenichnyuk, S. A., Kukhto, A. V., Kukhto, I. N., Asfandiarov, N. L.: Resonance capture of electrons by electroactive organic molecules. Russ J. Phys. Chem. B 4, 1014-1027 (2010)
48. Hunt, D. F., Harvey, T. M., Russell, J. W.: Oxygen as a reagent gas for the analysis of 2,3,7,8-tetrachlorodibenzo-p-dioxin by negative ion chemical ionization mass spectrometry. J. Chem. Soc. Chem. Commun., 10.1039/C39750000151 151-152 (1975)

Example 4: Charge Transfer Dissociation (CTD) of Complex Oligosaccharides: Comparison with Collision-Induced Dissociation (CID) and Extreme Ultraviolet Photodissociation (XUV-PD)

INTRODUCTION

Notably, this energy is in the energy range used for XUV-PD. This experimental setup is not currently available commercially, yet a benchtop ion trap mass spectrometer modified with a saddle field source can be implemented in conventional laboratories. All these characteristics indicate that CTD can be extremely promising as an alternative to XUV-PD.

In this work, we thus compared the fragmentation obtained on a modified ion trap mass spectrometer by LE-CID, XUV-PD and CTD, for two classes of oligosaccharides. The first oligosaccharide is an example from a class of sugars derived from the homogalacturonan portion of highly methylated citrus pectins; the second example is from a class of hybrid oligo-porphyrans derived from the red algae *Porphyra umbilicalis*. Both sugars are challenging to characterize by conventional tandem MS due to the possibility of isomeric forms and the presence of labile modifications. The fragmentation patterns observed by CTD for several sodiated $[M+Na]^+$ oligosaccharide ions show a remarkable similarity to 18 eV-XUV-PD. The two methods produce fragments resulting from a variety of glycosidic bond cleavages and cross-ring glycan cleavages. Analogous to XUV-PD, CTD allows the unambiguous determination of the complex structure of modified glycans. Promisingly, CTD thus opens the possibilities of achieving high energy fragmentation with an instrumental setting that, in principle, is more practical and affordable than other high-energy tandem MS methods.

Experimental

Oligosaccharides Preparation:

The pure oligogalacturonans with a degree of polymerization (DP) of 5 and a degree of methylation (DM) of 3 were produced after the preparation of a series of homogalacturonans (described in [34]) following fractionation using Ion pairing-reversed phase chromatography separation (IP-RP-UHPLC) as used in [1]. The hybrid agar/porphyran DP6 was produced as described in [35], except that no pretreatment by a 3-agarases was applied.

Tandem Mass Spectrometry Measurement:

Oligosaccharides were analyzed using a modified ion trap mass spectrometer described below. Samples were diluted to a concentration of 10 $\mu g \cdot mL^{-1}$ and manually infused at a flow rate of 5 $\mu L \cdot min^{-1}$. Measurements were performed in positive ion mode on the singly charged sodium adducts. Spectra were typically averaged for 1 min.

Extreme Ultra-Violet Photoactivation (XUV-PD) MS/MS:

The experimental setup was developed at the SOLEIL synchrotron radiation facility at the endstation of the DISCO beamline [36]. A bending magnet-based synchrotron beamline was coupled to a linear ion trap (LTQ XL, ThermoFisher Scientific). An automatic shutter was used to synchronize the photon beam (tuned to 18 eV) with the trapped precursor ions. Precurosr ions were isolation with a 2 Da window and exposed to XUV photons for 1000 ms. Spectra were typically averaged over 2 minutes [1, 2].

Low Energy Collision Induced dissociation (LE-CID) MS/MS:

LE-CID experiments were performed on the modified linear ion trap used for XUV-PD MS/MS. The collision energy and time was adapted for each oligosaccharide based on the signal/noise ratio observed for fragments. Precursor ions were isolated in the same manner as XUV-PD. Spectra were typically averaged over 2 minutes.

Charge Transfer Dissociation (CTD) MS/MS:

A saddle field fast ion source (VSW/Atomtech, Macclesfield, UK), was interfaced to a Bruker amaZon 3D ion trap mass spectrometer (BrukerDaltronics, Bremen, Germany) via a custom vacuum chamber cover. The instrument modification and working principle are highly analogous to the previous work on a linear ion trap [32]. ESI-generated precursor ions were isolated with an isolation window of 4.0 Da and exposed to the 6 kV helium cation beam for 30 ms. The helium gas flow was controlled via a variable leak valve to the saddle field source, and measured by the ion trap gauge (pressure readout≈$1.20\times10^{-5}$ mbar). The presented CTD spectra were averaged over 4 minutes and background-subtracted.

Data Processing:

To be compared, all raw data were transformed in mzML format using MSConvert (http://proteowizard.sourceforge.net/downloads.shtml) and further processed using mMass 5.3.0 [37].

Results and Discussion:

Sequencing of Oligosaccharides and Isomeric Characterization:

FIGS. 19A-19D show the fragmentation spectra obtained following LE-CID, XUV-PD and CTD activation of an oligogalacturonan consisting of 5 glycosidic units bearing 3 methyl groups (DP5DM3) and isolated as the sodiated adduct species, $[M+Na]^+$, at m/z 945.2. The LE-CID spectrum shown in FIG. 19A highlights the limitation met with LE-CID for the structural characterization of this class of oligosaccharides. Among the 41 annotated fragments, only 13 could be unambiguously assigned to the structure, with the labeling of the reducing end with $^{18}O$ (spectra of heavy oxygen labeled species are not presented) and the knowledge of the structure of the oligosaccharide analyzed. Sixteen peaks, mainly localized in the high mass range, correspond to neutral losses ($H_2O$, $CH_3OH$ and $CO_2$) of other fragments and do not provide any valuable structural information. Among the 13 assigned fragments, 5 led to a doublet peaks with $^{18}O$ labeling, which indicates that they arise from different origins. For example, these 5 peaks encompass two fragments, one arising from the reducing end (and containing the labeled $^{18}O$), and one that likely does not contain the reducing end. Importantly, using LE-CID, the absence of $^{18}O$ labeling is not absolute proof that the fragment contains the non-reducing end of the oligosaccharide. This is because double or consecutive fragmentation may occur, as exemplified by the 17 fragments marked by a double cross in FIG. 19A, which could not be assigned to a single fragmentation of the structure of the DP5DM3 oligogalacturonan. The occurrence of these double fragmentations complicates the interpretation and may also lead to an erroneous interpretation of the spectrum. Details of neutral losses and double fragmentations are provided in the Table 1. Table 1 shows the complete annotation of the fragments observed for the DP5DM3 oligogalacturonan using LE-CID, XUV-DPI and He-CTD. Unambiguous fragments are indicated by bold font. The fragments presenting a possible ambiguity are indicated in by italics. Neutral losses and double fragmentation (DF) are indicated by underlining and double underlining, respectively. DN indicates a double loss of neutral molecule. Double fragmentation and neutral losses only observed in LE-CID are notated with one asterisk (*). Unambiguous fragments only observed in XUV-DPI and He-CTD are notated with two asterisks (**).

TABLE 1

| | CID | | XUV-DPI | | He-CTD |
|---|---|---|---|---|---|
| m/z | $^{18}O$ | assignation | $^{18}O$ | assignation | assignation |
| 283.1 | | | ○ | | $^{3,5}A_2$** |
| 313.1 | | | ○ | $^{3,5}A_2$** | $^{2,5}A_2$** |
| 343.1 | | | ○ | $^{0,2}A_2$** | $^{0,2}A_2$** |
| 347.1 | ○ | $\underline{\underline{^{0,2}A_2/Y_4;^{0,2}A_5/Y_2}}$* | | $^{1,5}A_2$** | $^{1,5}A_2$** |
| 361.2 | ○ | $\underline{\underline{^{0,2}A_4/Y_3}}$ | ○ | $\underline{\underline{^{0,2}A_4/Y_3}}$ | $\underline{\underline{^{0,2}A_4/Y_3}}$ |

TABLE 1-continued

| | CID | | XUV-DPI | | He-CTD |
|---|---|---|---|---|---|
| m/z | $^{18}O$ | assignation | $^{18}O$ | assignation | assignation |
| 371.1 | ○ | $B_2$; $B_3/Z_4$ | ○ | $B_2$ | $B_2$ |
| 387.2 | | | ○ | $C_2''$** | $C_2''$** |
| 389.2 | • | $Z_2 + (C_2; B_3/Y_4)$ | • | $Z_2 + C_2$ | $C_2$ |
| 398.6 | | | • | $^{0,2}X_4^{2+/\bullet}$—$H_2O$** | $^{0,2}X_4^{2+/\bullet}$—$H_2O$** |
| 403.2 | ○ | $B_4/Y_3;C_4/Z_3$ | ○ | $B_4/Y_3;C_4/Z_3$ | $B_4/Y_3;C_4/Z_3$ |
| 407.2 | • | $Y_2$ | • | $Y_2$ | $Y_2$ |
| 413.1 | ○ | $^{0,2}X_4/B_3$—$H_2O$; $^{1,5}X_3/B_4$—$H_2O$* | | | |
| 417.2 | | | • | $^{1,5}X_2$—$H_2O$** | $^{1,5}X_2$—$H_2O$** |
| 421.1 | ○ | $Y_3/C_4$* | | | |
| 431.2 | ○ | $^{1,5}X_3/B_4;^{0,2}X_4/B_3$ | ○ | $^{2,4}A_3$ | $^{2,4}A_3$ |
| 434.2 | | | ○ | $^{0,2}A_5''^{2+/\bullet}$—$H_2O$** | $^{0,2}A_5''^{2+/\bullet}$—$H_2O$** |
| 435.1 | | | • | $^{1,5}X_2$** | $^{1,5}X_2$** |
| 443.2 | | | • | $^{1,4}A_3$—$H_2O$** | $^{1,4}A_3$—$H_2O$** |
| 445.2 | ○ | $^{0,2}X_3/B_4$* | | | |
| 449.1 | • | $^{0,2}X_3 + {}^{1,5}X_3/C_4;^{0,2}X_4/C_3$ | • | $^{0,2}X_2$ | $^{0,2}X_2$ |
| 454.6 | | | • | $[M + Na]^{2+/\bullet}$—$2\bullet H_2O$ | $[M + Na]^{2+/\bullet}$—$2\bullet H_2O$ |
| 463.2 | ○ | $^{0,2}X_3/C_4$* | | | |
| 463.7 | | | • | $[M + Na]^{2+/\bullet}$—$H_2O$ | $[M + Na]^{2+/\bullet}$—$H_2O$ |
| 472.6 | | | • | $[M + Na]^{2+/\bullet}$** | $[M + Na]^{2+/\bullet}$** |
| 473.0 | | | | | $^{3,5}A_3$** |
| 495.1 | | | • | $^{3,5}X_2$** | $^{3,5}X_2$** |
| 503.3 | | | ○ | $^{2,5}A_3$** | |
| 517.2 | ○ | $B_3$—$CO_2$ and/or $B_4/Z_4$—$CO_2$ | | | |
| 519.1 | | | ○ | $^{0,2}A_3$** | $^{0,2}A_3$** |
| 537.1 | ○ | $^{0,2}A_4/Y_5;^{0,2}A_5/Y_4$* | | | |
| 543.2 | ○ | $B_3$—$H_2O$* | | | |
| 561.2 | ○ | $B_3$; $B_4/Z_4$ | ○ | $B_3$ | $B_3$ |
| 565.0 | • | $Y_3$—MeOH* | | | |
| 577.2 | | | ○ | $C_3''$** | $C_3''$** |
| 579.2 | • | $Z_3 + C_3$; $B_4/Y_4$ | • | $Z_3 + C_3$ | $Z_3 + C_3$ |
| 589.2 | ○ | $^{1,5}X_4/B_4$—$H_2O$* | | | |
| 595.1 | | | | | $Y_3''$** |
| 597.2 | • | $Y_3$ | • | $Y_3$ | $Y_3$ |
| 607.2 | ○ | $^{1,5}X_4/B_4$* | • | $^{1,5}X_3$—$H_2O$** | $^{1,5}X_3$—$H_2O$** |
| 621.2 | ○ | $^{0,2}X_4/B_4$ | ○ | $^{2,4}A_4$ | $^{2,4}A_4$ |
| 625.1 | • | $^{1,5}X_3$ | • | $^{1,5}X_3$ | |
| 633.2 | | | ○ | $^{1,4}A_4$—$H_2O$** | $^{1,4}A_4$—$H_2O$** |

TABLE 1-continued

| | CID | | XUV-DPI | | He-CTD |
|---|---|---|---|---|---|
| m/z | $^{18}O$ | assignation | $^{18}O$ | assignation | assignation |
| 638.2 | | | • | $^{0,2}X_3^{\bullet}$** | |
| 639.1 | • | $^{0,2}X_3$ + $^{0,2}X_4/C_4$* | • | $^{0,2}X_3$ | $^{0,2}X_3$ |
| 663.3 | | | ○ | $^{3,5}A_4$** | $^{3,5}A_4$** |
| 685.1 | | | • | $^{3,5}X_3$** | |
| 693.2 | • | $Z_4$—$CO_2$—$H_2O$* | ○ | $^{2,5}A_4$ | $^{2,5}A_4$ |
| 709.1 | | | ○ | $^{0,2}A_4$** | $^{0,2}A_4$** |
| 711.2 | • | $Z_4$—$CO_2$ | | | $Z_4$—$CO_2$ |
| 733.1 | ○ | $B_4$—$H_2O$ | ○ | $B_4$—$H_2O$ | $B_4$—$H_2O$ |
| 737.1 | | | • | $Z_4$—$H_2O$ | $Z_4$—$H_2O$ |
| 739.2 | • | $^{0,2}X_4$—$CO_2$—MeOH | | | |
| 751.2 | ○ | $B_4$ | ○ | $B_4$ | $B_4$ |
| 755.1 | | $Z_4$ | • | $Z_4$ | $Z_4$ |
| 769.3 | ○ | $C_4$ | ○ | $C_4$ | $C_4$ |
| 773.2 | • | $Y_4$ | • | $Y_4$ | $Y_4$ |
| 783.2 | • | $^{1,5}X_4$—$H_2O$ | • | $^{1,5}X_4$—$H_2O$ | |
| 796.2 | | | | | $^{0,2}X_4^{\bullet}$—$H_2O$** |
| 797.2 | • | $^{0,2}X_4$—$H_2O$ | | | $^{0,2}X_4$—$H_2O$** |
| 801.3 | | | • | $^{1,5}X_4$** | $^{1,5}X_4$** |
| 814.1 | | | • | $^{0,2}X_4^{\bullet}$** | $^{0,2}X_4^{\bullet}$** |
| 815.2 | • | $^{0,2}X_4$ | | | $^{0,2}X_4$ |
| 839.3 | | | | | $^{3,5}A_5$ |
| 849.2 | ○ | $^{0,2}A_5$—2•$H_2O$* | | | |
| 855.3 | | | ○ | $^{0,3}A_5$** | |
| 867.2 | ○ | $^{0,2}A_5$—$H_2O$* | | | |
| 885.3 | ○ | $^{0,2}A_5$ | ○ | $^{0,2}A_5$ | |
| 899.3 | | | • | $[M + Na]^+$—$CO_2$ | |
| 909.2 | • | $[M + Na]^+$—2•$H_2O$* | | | |
| 913.1 | • | $[M + Na]^+$—MeOH * | | | |
| 927.1 | • | $[M + Na]^+$—$H_2O$ | • | $[M + Na]^+$—$H_2O$ | $[M + Na]^+$—$H_2O$ |
| 945.2 | • | $[M + Na]^+$ | • | $[M + Na]^+$ | $[M + Na]^+$ |
| 625.1 | • | $^{1,5}X_3$ | • | $^{1,5}X_3$ | $^{1,5}X_3$ |
| 633.2 | | | ○ | $^{1,4}A_4$—$H_2O$ | $^{1,4}A_4$—$H_2O$ |
| 638.2 | | | • | $^{0,2}X_3^{\bullet}$ | |

Figure 19A:
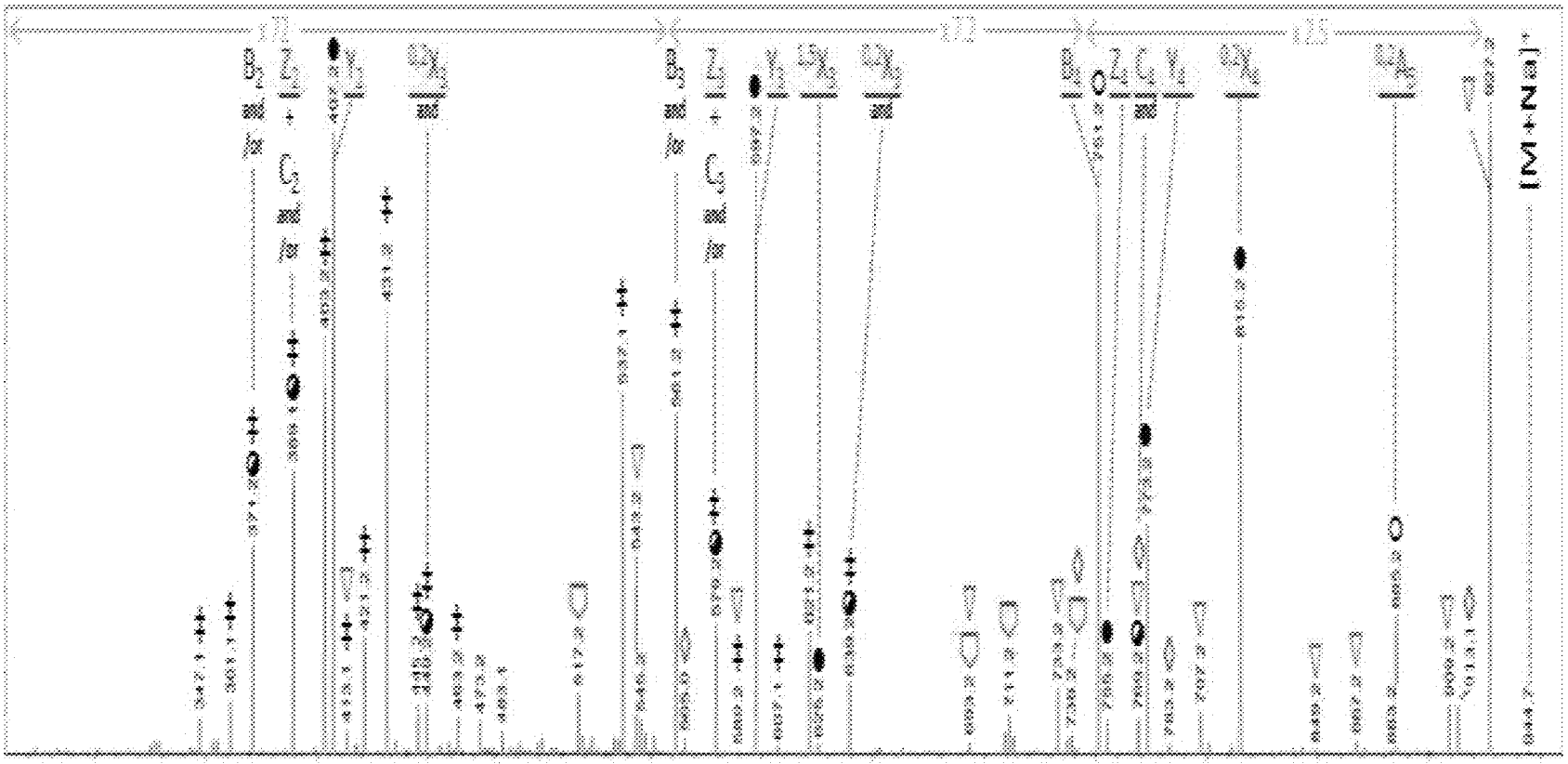
Figure 19B:
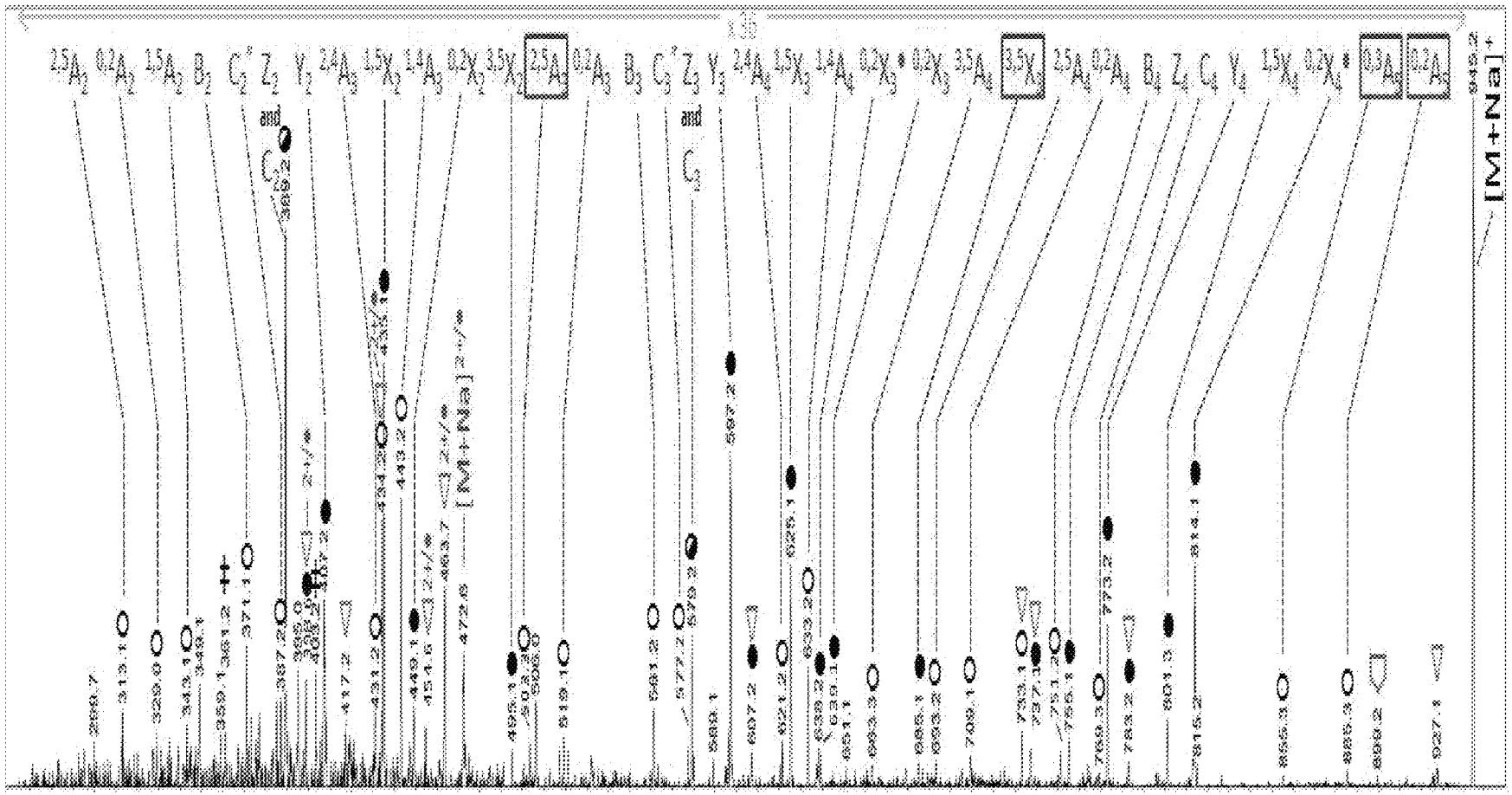
Figure 19C:
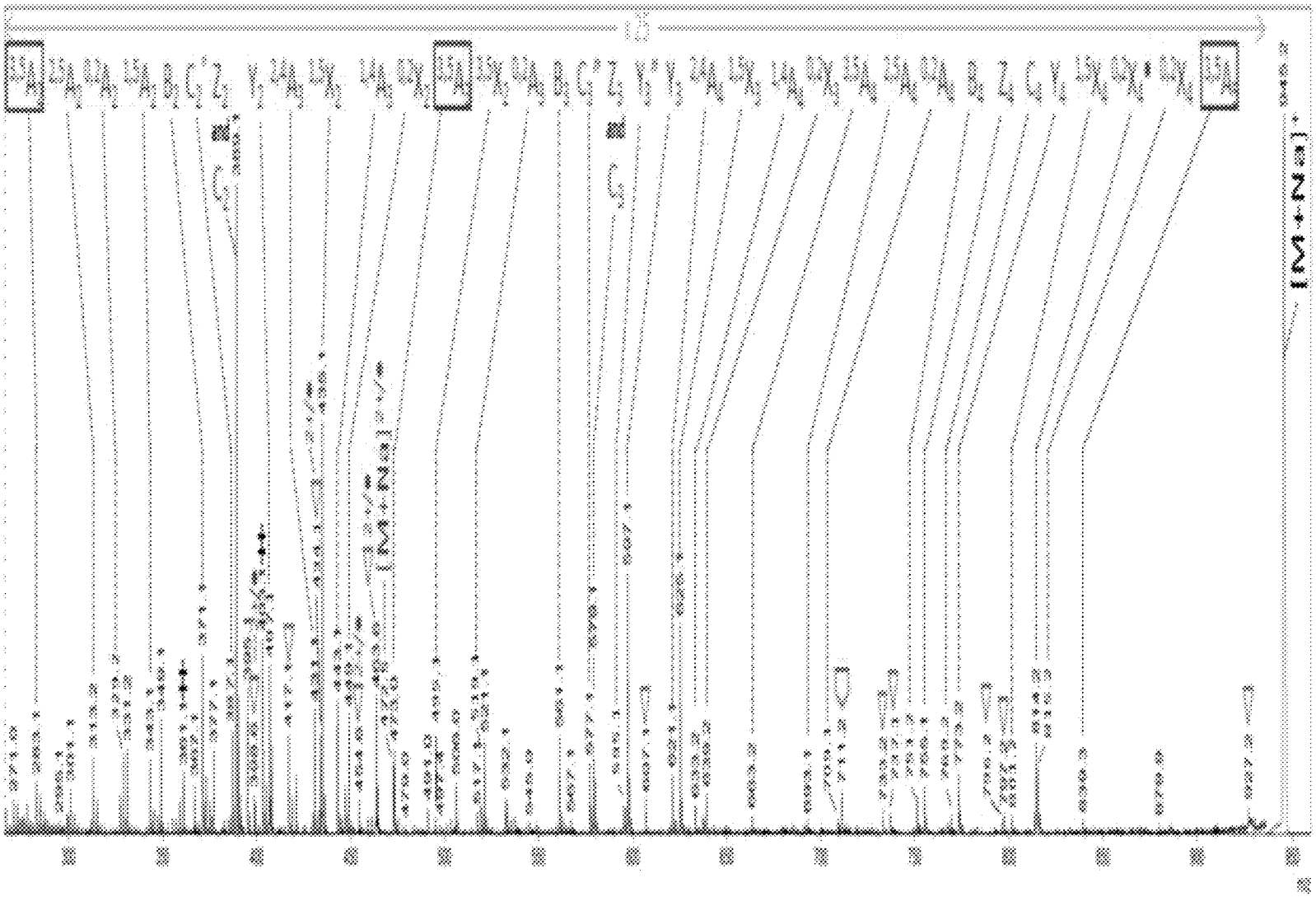

In agreement with [1] and as shown in FIG. 19B, the picture is strikingly different after XUV-PD analysis of the DP5DM3 oligo-homogalacturonan. The number of fragments observed is drastically increased and a systematic series of fragments are produced from both ends of the oligosaccharide. These fragments are easier to assign because the number of neutral losses is significantly reduced. In addition, no or very few double fragmentations are observed. This is exemplified by the intense peak observed at m/z 537.1 in LE-CID, which could only be attributed to a double fragmentation ($^{0.2}A_4/Y_5$ or $^{0.2}A_5/Y_4$), and is entirely absent in the XUV-PD tandem MS spectrum. Altogether, these features simplify the annotation of the fragments and the complete structure can be determined unequivocally: the glycosidic bond cleavages allow the retrieval of the sequence of the monosaccharides, while the numerous intracyclic fragments permit the differentiation of the majority of the hydroxyl functions. The cross-ring fragments thus provide information on the branching pattern and localization of the chemical modifications and therefore, characterization of the exact isomeric form.

The same DP5DM3 oligosaccharide was exposed to the 6 KeV $He^+$ beam and subjected to CTD for 30 ms (FIG. 19C), presents the accumulated spectrum obtained from a one-minute acquisition. The first observation is that CTD produces a variety of between-ring and cross-ring glycan cleavages, which show remarkable similarity to the product ion spectrun observed in XUV-PD MS with 18 eV photons (FIG. 19B). A few fragments (annotations framed in FIGS. 19B and 19C) were found to be specific to each technique, but the low intensities and the lack of data acquired over a larger range of species prevent us from making generalizations about mechanistic differences. Interestingly, the doubly charged radical species ($[M+Na]^{2+/.}$) at m/z 472.6 for XUV-PD and m/z 472.5 for CTD, along with fragments corresponding water losses (i.e. ${}^{0.2}A_5{}^{'2+/.}$—$H_2O$ at m/z 434.2 for XUV-PD and m/z 434.1 for CTD; ${}^{0.2}X_4{}^{2+/.}$—$H_2O$ at m/z 398.6 for both XUV-PD and CTD), indicate that the two activation methods both go through an electron detachment process and the production of an oxidized—or charge-increased—radical intermediate. The similarity between the CTD spectrum and the 18 eV PD spectrum gives some idea of the activation energies available through He-CTD.

Positioning of Liable Modifications:

Another limitation of LE-CID for the structural characterization of oligosaccharides is the commonly-observed loss of labile modifications, such as methyl esters and sulfates. As observed in the previous example, some intense losses of the methyl-ester functions (losses of $CH_3OH$) are observed in LE-CID, whereas XUV-PD and CTD preserved these modifications while cleaving the backbone of the oligo-homogalacturonan (FIGS. 19A-19D). In the following example a sulfated oligosaccharide was investigated to test the limits of CTD. Sulfation is one of the most labile modifications of polysaccharides and is very important because sulfation has a crucial impact on the biological properties and end uses of polysaccharides. Examples include clinical applications and sulfated glycosaminoglycans, carrageenans, fucoidans, porphyrans, ulvans [38, 39].

Figure 20A:
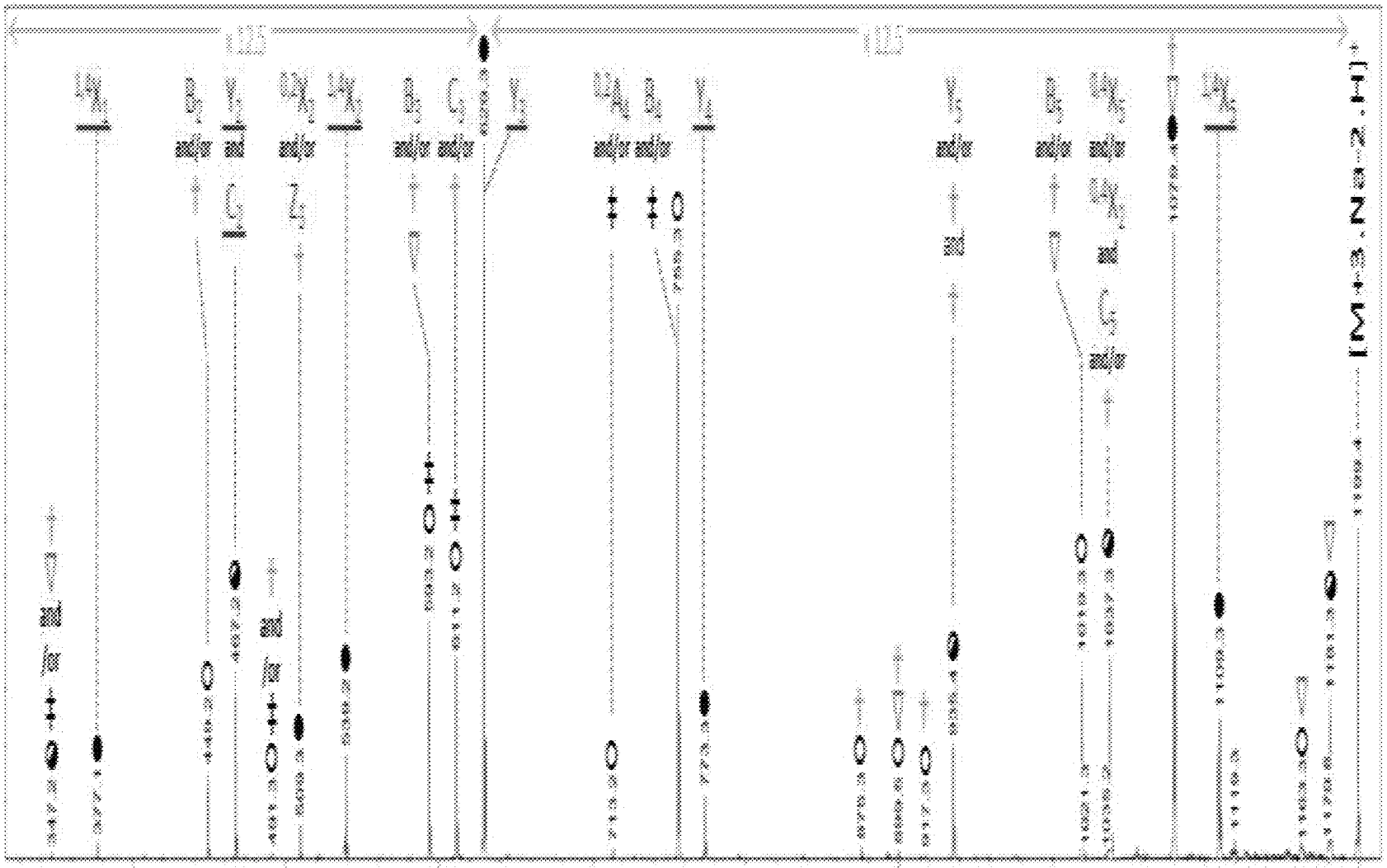

FIG. 20A shows the LE-CID spectrum obtained for a doubly sulfated hybrid DP6 oligosaccharide composed of one agar moiety (4-linked 3,6-anhydro-α-L-Galp(1→3) β-D-Galp, (LA-G)) between two porphyran motifs (α-L-Galp-6-sulfate (1→3) β-D-Galp, (L6S-G)) resulting in the species: L6S-G-LA-G-L6S-G. Spectrums were also produced demonstrating that the precursor can be a triply sodiated singly charged adduct ion $[M+3Na-2H]^+$. The LE-CID spectrum of the doubly sulfated precursor contains few diagnostic fragments. A predominant fragment is observed at m/z 1079.4, corresponding to the loss of $H_2SO_4Na$. In spite of a labeling of the molecule with ${}^{18}O$ at the reducing end, only 7 fragments could be unambiguously assigned. Again, the main difficulty preventing a clear assignment of the fragments in this LE-CID spectrum arises from the occurrence of double fragmentations and sulfate losses.

Figure 20B:
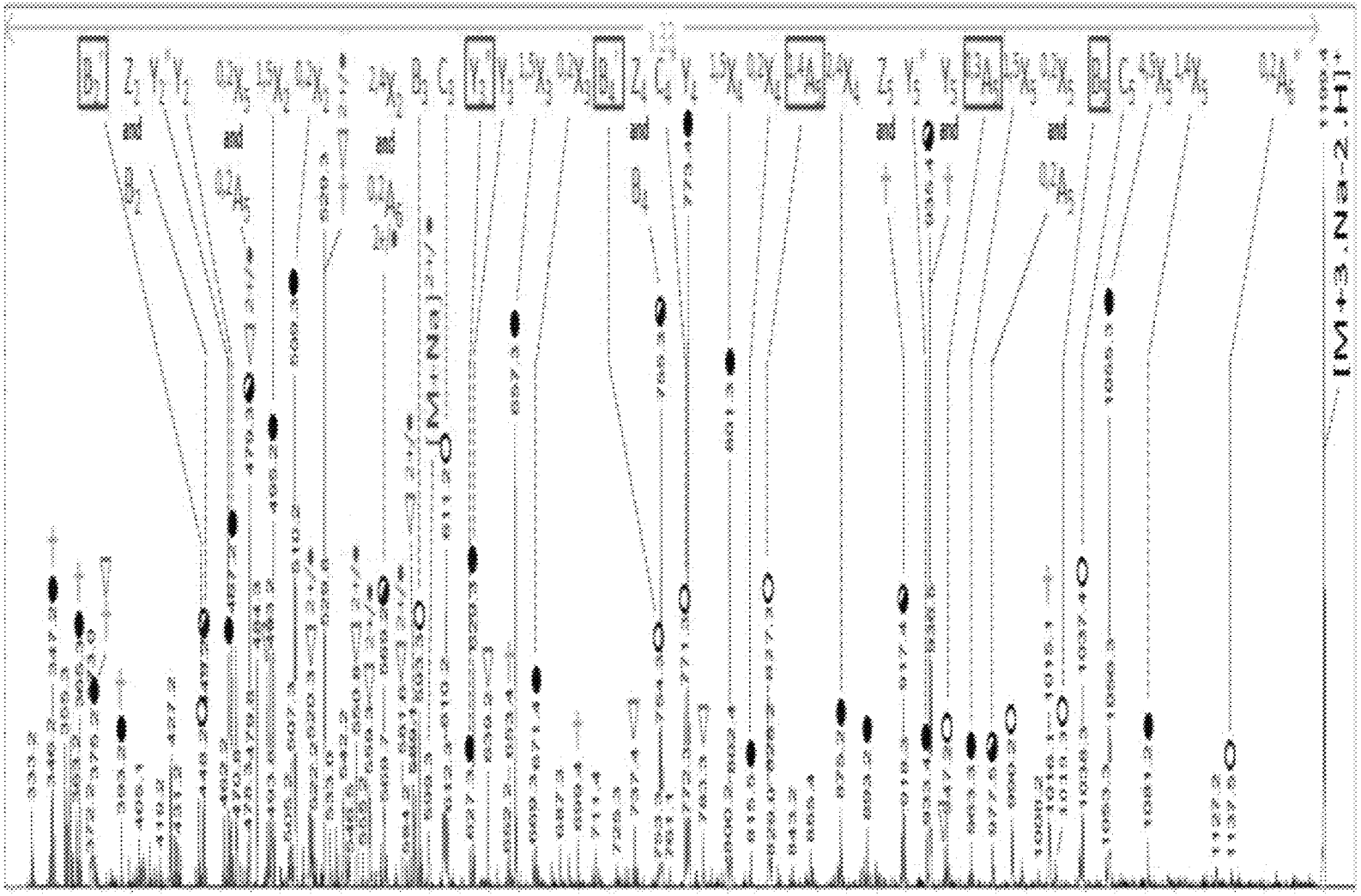
Figure 20C:
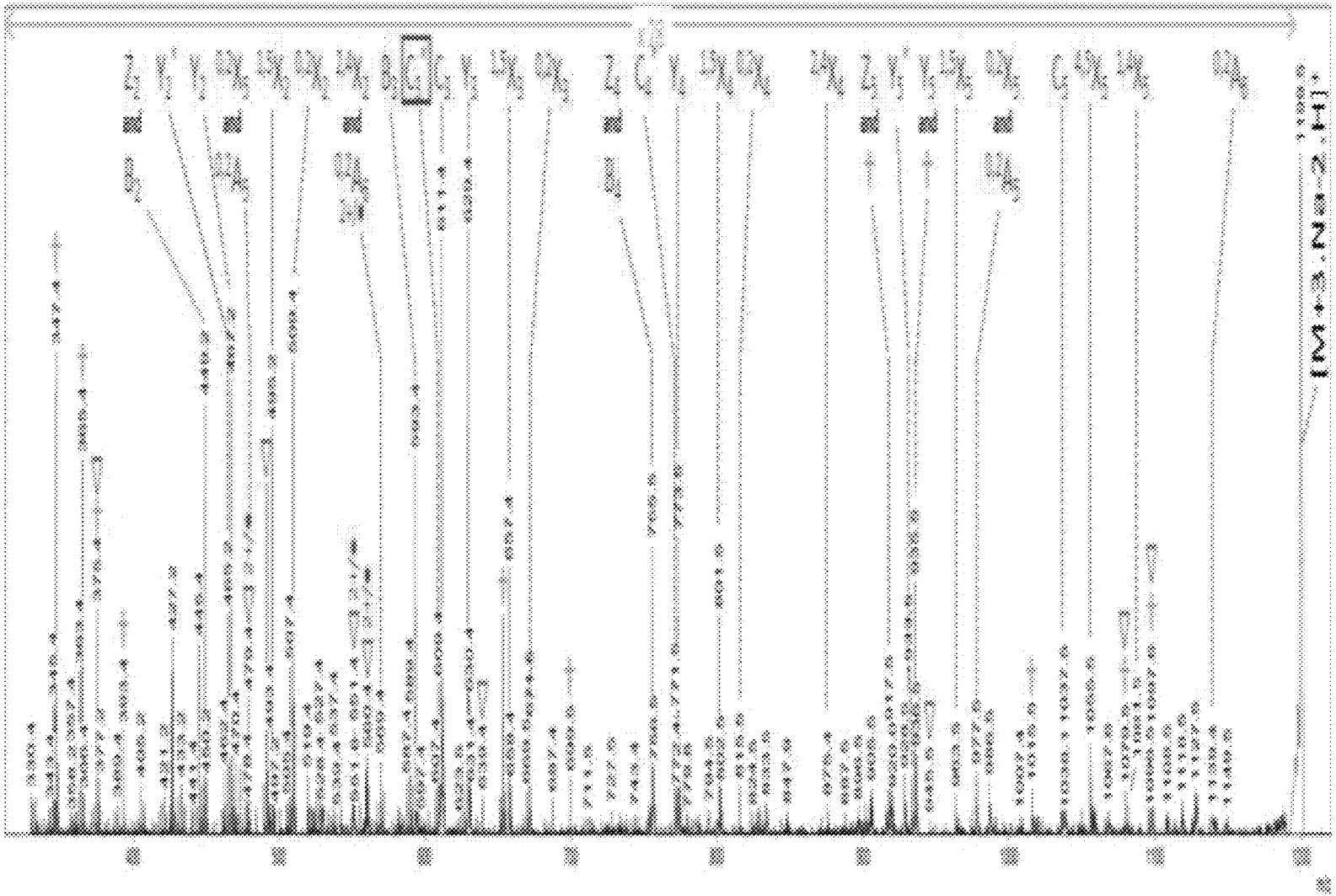

The XUV-PD (FIG. 20B) and CTD (FIG. 20C) spectra recorded for the same (L6S-G-LA-G-L6S-G) species are very similar to one another and significantly different from the LE-CID spectrum. The XUV-PD and CTD spectra contain a variety of informative fragments, including many intracyclic fragments with very few sulfate losses. In both cases, a majority of hydroxyl functions could be differentiated, thereby enabling an accurate localization of the branching and modifications borne by the molecule. Interestingly, some of the observed fragments indicate a slight a difference in the activation mechanism between XUV-PD and CTD. In the XUV-PD analysis, an intense desulfated species was detected at m/z 529.3, corresponding to a doubly charged radical cation $[M+2Na-2H—NaHSO_4—H_2O—]^{2+/.}$. This species is totally absent in the CTD fragmentation spectrum, but two ions corresponding to a loss of $SO_3Na$ (m/z 1097.6) and $HSO_4Na$ (m/z 1079.5) are produced. These observations would need to be confirmed from other examples, but they may indicate that the electron detachment does not occur at the same position along the oligosaccharide in XUV-PD as in CTD.

Figure 54A:
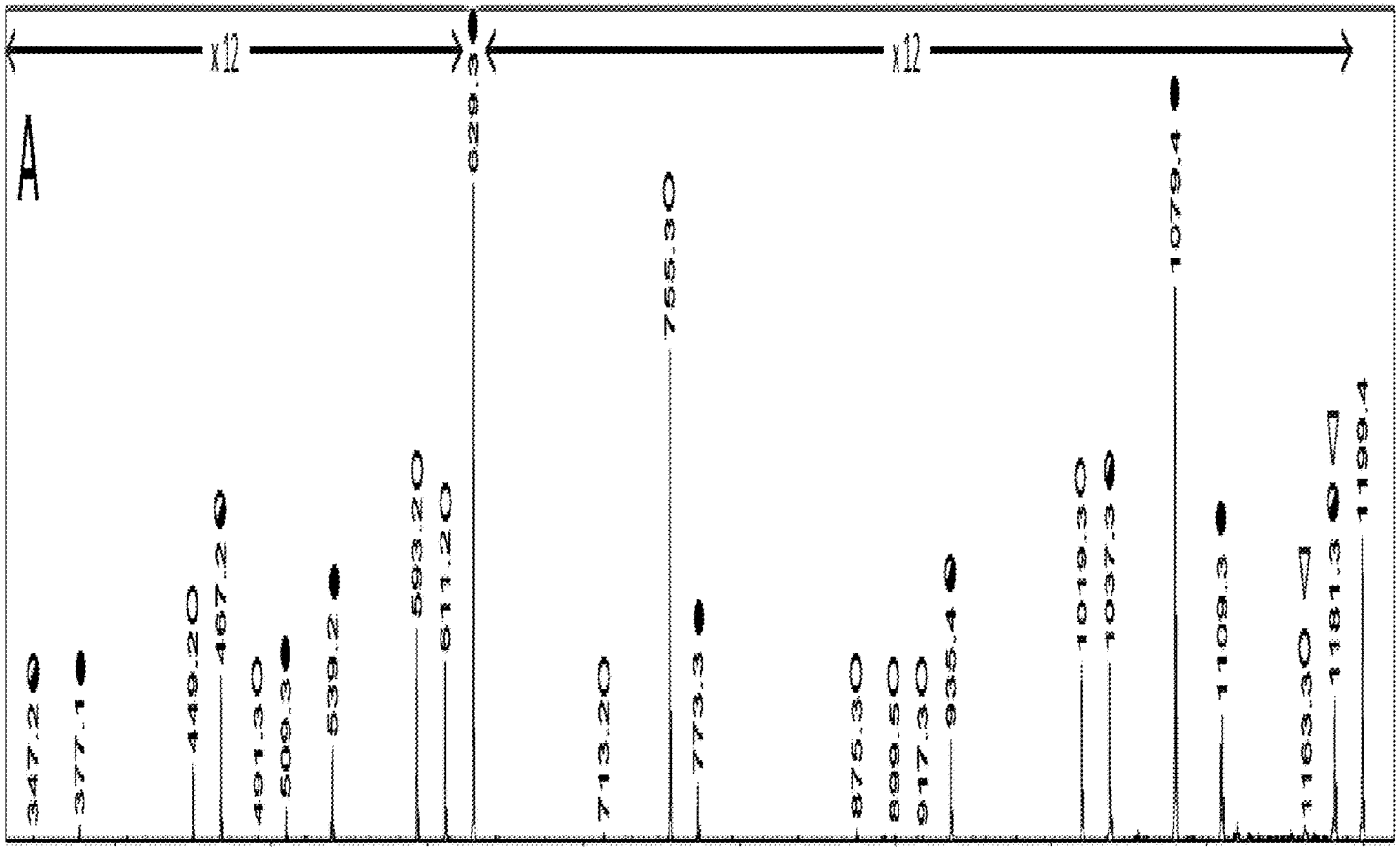
Figure 54B:
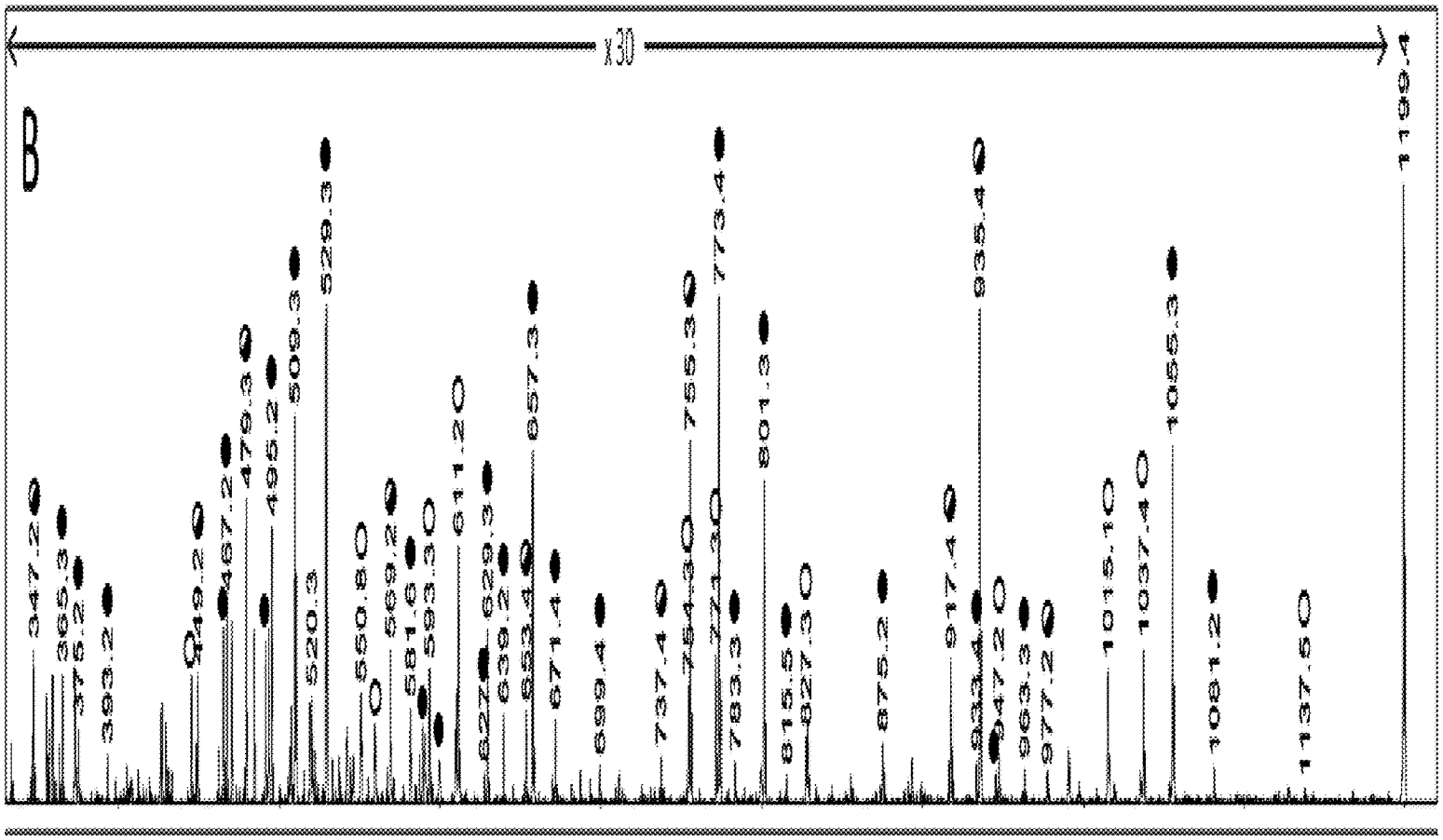
Figure 54C:
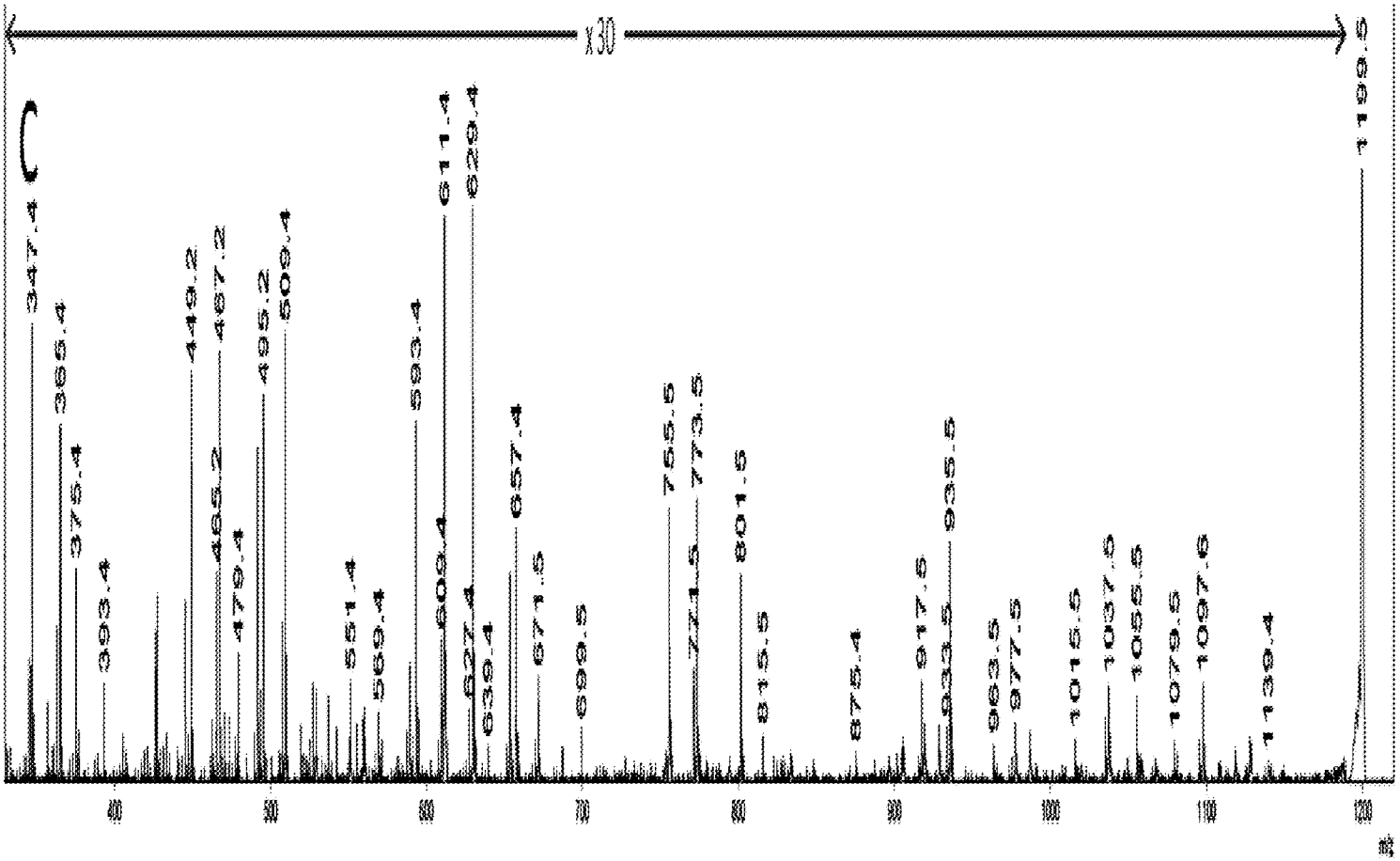

FIGS. 54A-54D show fragmentation spectra of the DP6 hybrid oligoporphyran isolated as a $[M+3Na-2H]^+$, obtained by: (FIG. 54A) LE-CID, (FIG. 54B) XUV-DPI and (FIG. 54C) He-CTD and corresponding structures (FIG. 54D). Spectra correspond to a 1-mn registration. Schematic annotation of ions: (●) reducing-end containing fragments, as evidenced by the ${}^{18}O$ labeling, (○) non-labeled fragments; (◕) ions encompassing both ${}^{18}O$-labeled fragments and non-labeled fragments; (Δ) $H_2O$ losses; (†) sulfate losses; (‡) ions arising from a double fragmentation. Doubly charged fragments are annotated with ${}^{2+/.}$ label. Unambiguous fragments for each tandem MS approach are reported on the corresponding structures on the left. Fragments are further detailed in Table 2. Table 2 shows the complete annotation of the fragments observed for the oligoporphyran DP6 using LE-CID, XUV-DPI and He-CTD. Unambiguous fragments are displayed in bold. The fragments presenting a possible ambiguity are indicated by italic. Neutral losses, sulfates losses (SL) and double fragmentation (DF) are indicated by single underline, single underline and italics, and double underline, respectively. DF* indicate fragments possibly arising from multiple (>2) fragmentations. Double fragmentation and neutral losses only observed in LE-CID are notated with a single asterisk (*). Unambiguous fragments only observed in XUV-DPI and He-CTD are notated with double asterisks (**).

TABLE 2

| | CID | | XUV-DPI | | He-CTD |
|---|---|---|---|---|---|
| m/z | ${}^{18}O$ | assignation | ${}^{18}O$ | assignation | assignation |
| 347.3 | • | $\underline{Z_2} + \underline{B_2}$; DF* | • | $\underline{\dagger(Z_2 + B_2)}$ | $\underline{\dagger(Z_2 + B_2)}$ |
| 365.3 | | | • | $\underline{\dagger Y_2}$ | $\underline{\dagger Y_2}$ |
| 375.3 | | | • | $\underline{\dagger^{1,5}X_2—H_2O}$ | $\underline{\dagger^{1,5}X_2—H_2O}$ |
| 377.1 | • | ${}^{1,4}X_1$ | | | |

TABLE 2-continued

| | CID | | XUV-DPI | | He-CTD |
|---|---|---|---|---|---|
| m/z | $^{18}O$ | assignation | $^{18}O$ | assignation | assignation |
| 393.3 | | | • | †$^{1,5}X_2$ | †$^{1,5}X_2$ |
| 448.3 | | | ○ | $B_2$'** | ** |
| 449.3 | ○ | $B_2$; $Z_3/C_5$; $Y_3/B_5$ | • | $Z_2 + B_2$** | $Z_2 + B_2$** |
| 465.2 | | | • | $Y_2$''** | $Y_2$''** |
| 467.3 | • | $Y_2 + C_2$; $Y_3/C_5$ | • | $Y_2$** | $Y_2$** |
| 479.3 | | | • | $(^{0,2}X_5 + {}^{0,2}A_5)^{2+/\bullet}$—$H_2O$** | $(^{0,2}X_5 + {}^{0,2}A_5)^{2+/\bullet}$—$H_2O$** |
| 491.3 | ○ | $B_3$; DF ** | • | $^{0,2}X_4$—$H_2O$** | $^{0,2}X_4$—$H_2O$** |
| 495.3 | | | • | $^{1,5}X_2$** | $^{1,5}X_2$** |
| 509.3 | • | $^{0,2}X_2$; $Y_2$ | • | $^{0,2}X_2$ and †$C_2$ | $^{0,2}X_2$ and †$C_2$ |
| 529.3 | | | • | $^{2+/\bullet}$—2•$H_2O$ | |
| 539.3 | • | $^{1,4}X_2$ | | | |
| 550.8 | | | ○ | $^{0,2}A_6''^{2+/\bullet}$—2•$H_2O$** | ** |
| 551.4 | | | | ** | $^{0,2}A_6'^{2+/\bullet}$—2•$H_2O$** |
| 559.3 | | | ○ | $^{0,2}A_6''^{2+/\bullet}$—$H_2O$** | ** |
| 560.4 | | | | ** | $^{0,2}A_6'^{2+/\bullet}$—$H_2O$** |
| 569.2 | | | • | $^{0,2}X_5$ and $^{0,2}A_6'^{2+/\bullet}$** | $^{0,2}X_5$ and $^{0,2}A_6'^{2+/\bullet}$** |
| 581.6 | | | • | m/z599.3—2•$H_2O$ | |
| 590.3 | | | • | m/z599.3—$H_2O$ | |
| 593.3 | ○ | $B_3$; $^{0,2}A_4$—$H_2O$ | ○ | $B_3$ | $B_3$ |
| 599.3 | | | • | | |
| 609.4 | | | | | $C_3$''** |
| 611.3 | ○ | $C_3$; $^{0,2}A_4$ | ○ | $C_3$ | $C_3$ |
| 627.3 | | | • | $Y_3$'' | |
| 629.3 | • | $Y_3$ | • | $Y_3$ | |
| 639.3 | | | • | $^{1,5}X_3$—$H_2O$** | $^{1,5}X_3$—$H_2O$** |
| 653.4 | | | • | $Z_4 + B_4$ | $Z_4 + B_4$ |
| 657.3 | | | • | $^{1,5}X_3$** | $^{1,5}X_3$** |
| 671.4 | | | • | $^{0,2}X_3$** | $^{0,2}X_3$** |
| 699.4 | | | • | †$^{1,5}X_4$ | †$^{1,5}X_4$ |
| 713.2 | ○ | $^{0,2}A_4$ | | | |
| 737.4 | | | • | ($Z_4$ and $B_4$)—$H_2O$** | |
| 754.3 | | | ○ | $B_4$'** | |
| 755.3 | ○ | $B_4$; $Z_5/C_5$; $Y_5/B_5$ | • | $Z_4$ and $B_4$** | $Z_4$ and $B_4$** |
| 771.3 | | | ○ | $C_4$''** | $C_4$''** |
| 773.4 | • | $Y_4$ | • | $Y_4$ | $Y_4$ |
| 783.3 | | | • | $^{1,5}X_4$—$H_2O$** | ** |
| 801.3 | | | • | $^{1,5}X_4$** | $^{1,5}X_4$** |
| 815.5 | | | • | $^{0,2}X_4$** | $^{0,2}X_4$** |

TABLE 2-continued

| | CID | | XUV-DPI | | He-CTD |
|---|---|---|---|---|---|
| m/z | $^{18}O$ | assignation | $^{18}O$ | assignation | assignation |
| 827.3 | | | ○ | $^{1,4}A_5$—$H_2O$** | ** |
| 875.3 | ○ | $^{0,2}A_5$* | • | $^{2,4}X_4$** | $^{2,4}X_4$** |
| 899.5 | ○ | $B_5$—$H_2O$* | | | |
| 917.4 | ○ | $B_5$* | • | $Y_5$ and †$B_5$** | $Y_5$ and †$B_5$** |
| 933.4 | | | • | $Y_5$"** | $Y_5$"** |
| 935.4 | • | $Y_4$; m/z1037.4 | • | $Y_5$ and †$C_5$** | $Y_5$ and †$C_5$** |
| 945.3 | | | • | $^{1,5}X_5$—$H_2O$** | $^{1,5}X_5$—$H_2O$** |
| 947.3 | | | ○ | $^{0,3}A_5$** | |
| 963.3 | | | • | $^{1,5}X_5$** | $^{1,5}X_5$** |
| 977.5 | | | • | $^{0,2}X_5$** and $^{0,2}A_5$** | $^{0,2}X_5$** and $^{0,2}A_5$** |
| 1015.1 | | | ○ | ($C_5$—Na + H)** | ($C_5$—Na + H)** |
| 1019.3 | ○ | $B_3$; $^{0,2}A_5$—$H_2O$ | ○ | $B_5$ | |
| 1037.4 | • | $C_5$; $^{0,2}A_6$ + $^{0,2}X_5$; $^{0,2}X_5$ | ○ | $C_5$** | $C_5$** |
| 1055.3 | | | • | $^{4,5}X_5$** | $^{4,5}X_5$** |
| 1079.4 | • | $[M + 3•Na—2H]^+$—$H_2O$* | | | † m/z1097.6—$H_2O$ |
| 1081.3 | | | • | $^{1,4}X_5$—$H_2O$** | $^{1,4}X_5$—$H_2O$** |
| 1097.6 | | | | | †$[M + 3•Na—2H]^+$ |
| 1109.3 | • | $^{1,4}X_5$ | | | |
| 1137.5 | | | ○ | $^{0,2}A_6$"** | |
| 1139.4 | | | | | $^{0,2}A_6$"** |
| 1163.3 | ○ | $[M + 3•Na—2• H]^+$—2•$H_2O$* | | | |
| 1181.3 | • | $[M + 3•Na—2• H]^+$—$H_2O$* | | | |
| 1199.4 | | $[M + 3•Na—2H]^+$ | | $[M + 3•Na—2H]^+$ | $[M + 3•Na—2H]^+$ |

SUMMARY

As a conclusion, these two examples illustrate that CTD shares the same distinctive characteristics as XUV-PD in the fragmentation of oligosaccharides, including the possibility to differentiate isomers and characterize modified species such as methyl-etherified porphyran or laterally branched species. Considering the possibility of implementing CTD on benchtop mass spectrometers, this approach thus appears especially promising in the field of glycomics.

REFERENCES FOR EXAMPLE 4

1. Ropartz, D., Lemoine, J., Giuliani, A., Bittebiere, Y., Enjalbert, Q., Antoine, R., Dugourd, P., Ralet, M. C., Rogniaux, H.: Deciphering the structure of isomeric oligosaccharides in a complex mixture by tandem mass spectrometry: photon activation with vacuum ultra-violet brings unique information and enables definitive structure assignment. Anal. Chim. Acta 807, 84-95 (2014)
2. Ropartz, D., Giuliani, A., Herve, C., Geairon, A., Jam, M., Czjzek, M., Rogniaux, H.: High-energy photon activation tandem mass spectrometry provides unprecedented insights into the structure of highly sulfated oligosaccharides extracted from macroalgal cell walls. Anal. Chem. 87, 1042-1049 (2015)
3. Domon, B., Costello, C. E.: A systematic nomenclature for carbohydrate fragmentations in FAB-MS/MS spectra of glycoconjugates. Glycoconjugate J. 5, 397-409
4. Antoine, R., Dugourd, P.: Visible and ultraviolet spectroscopy of gas phase protein ions. Phys. Chem. Chem. Phys. 13, 16494-16509 (2011)
5. Reilly, J. P.: Ultraviolet photofragmentation of biomolecular ions. Mass Spectrom. Rev. 28, 425-447 (2009)
6. Brodbelt, J. S.: Photodissociation mass spectrometry: new tools for characterization of biological molecules. Chem. Soc. Rev. 43, 2757-2783 (2014)
7. Devakumar, A., Thompson, M. S., Reilly, J. P.: Fragmentation of oligosaccharide ions with 157 nm vacuum ultraviolet light. Rapid Commun. Mass Spectrom. 19, 2313-2320 (2005)
8. Giuliani, A., Milosavljevic, A. R., Canon, F., Nahon, L.: Contribution of synchrotron radiation to photoactivation studies of biomolecular ions in the gas phase. Mass Spectrom. Rev. 33, 424-441 (2014)
9. Kailemia, M. J., Li, L., Ly, M., Linhardt, R. J., Amster, I. J.: Complete mass spectral characterization of a synthetic ultralow-molecular-weight heparin using collision-induced dissociation. Anal. Chem. 84, 5475-5478 (2012)

10. Kailemia, M. J., Ruhaak, L. R., Lebrilla, C. B., Amster, I. J.: Oligosaccharide analysis by mass spectrometry: a review of recent developments. Anal. Chem. 86, 196-212 (2014)
11. Ko, B. J., Brodbelt, J. S.: 193 nm Ultraviolet photodissociation of deprotonated sialylated oligosaccharides. Anal. Chem. 83, 8192-8200 (2011)
12. An, H. J., Lebrilla, C. B.: Structure elucidation of native N- and O-linked glycans by tandem mass spectrometry (tutorial). Mass Spectrom. Rev. 30, 560-578 (2011)
13. Zubarev, R. A., Kelleher, N. L., McLafferty, F. W.: Electron capture dissociation of multiply charged protein cations. a nonergodic process. J. Am. Chem. Soc. 120, 3265-3266 (1998)
14. Nielsen, M. L., Budnik, B. A., Haselmann, K. F., Olsen, J. V., Zubarev, R. A.: Intramolecular hydrogen atom transfer in hydrogen-deficient polypeptide radical cations. Chem. Phys. Lett. 330, 558-562 (2000)
15. Leach, F. E., 3rd, Arungundram, S., Al-Mafraji, K., Venot, A., Boons, G. J., Amster, I. J.: Electron detachment dissociation of synthetic heparan sulfate glycosaminoglycan tetrasaccharides varying in degree of sulfation and hexuronic acid stereochemistry. Int. J. Mass Spectrom. 330-332, 152-159 (2012)
16. Wolff, J. J., Chi, L., Linhardt, R. J., Amster, I. J.: Distinguishing glucuronic from iduronic acid in glycosaminoglycan tetrasaccharides by using electron detachment dissociation. Anal. Chem. 79, 2015-2022 (2007)
17. Wolff, J. J., Amster, I. J., Chi, L., Linhardt, R. J.: Electron detachment dissociation of glycosaminoglycan tetrasaccharides. J. Am. Soc. Mass Spectrom. 18, 234-244 (2007)
18. Kjeldsen, F., Haselmann, K. F., Budnik, B. A., Jensen, F., Zubarev, R. A.: Dissociative capture of hot (3-13 eV) electrons by polypeptide polycations: an efficient process accompanied by secondary fragmentation. Chem. Phys. Lett. 356, 201-206 (2002)
19. Budnik, B. A., Haselmann, K. F., Elkin, Y. N., Gorbach, V. I., Zubarev, R. A.: Applications of electron-ion dissociation reactions for analysis of polycationic chitooligosaccharides in Fourier transform mass spectrometry. Anal. Chem. 75, 5994-6001 (2003)
20. Wolff, J. J., Laremore, T. N., Aslam, H., Linhardt, R. J., Amster, I. J.: Electron-induced dissociation of glycosaminoglycan tetrasaccharides. J. Am. Soc. Mass Spectrom. 19, 1449-1458 (2008)
21. Zubarev, R. A.: Reactions of polypeptide ions with electrons in the gas phase. Mass Spectrom. Rev. 22, 57-77 (2003)
22. Leach, F. E., 3rd, Ly, M., Laremore, T. N., Wolff, J. J., Perlow, J., Linhardt, R. J., Amster, I. J.: Hexuronic acid stereochemistry determination in chondroitin sulfate glycosaminoglycan oligosaccharides by electron detachment dissociation. J. Am. Soc. Mass Spectrom. 23, 1488-1497 (2012)
23. Syka, J. E., Coon, J. J., Schroeder, M. J., Shabanowitz, J., Hunt, D. F.: Peptide and protein sequence analysis by electron transfer dissociation mass spectrometry. Proc. Natl. Acad. Sci. U.S.A. 101, 9528-9533 (2004)
24. Zaia, J., Miller, M. J. C., Seymour, J. L., Costello, C. E.: The role of mobile protons in negative ion CID of oligosaccharides. J. Am. Soc. Mass Spectrom. 18, 952-960 (2007)
25. Naggar, E. F., Costello, C. E., Zaia, J.: Competing fragmentation processes in tandem mass spectra of heparin-like Glycosaminoglycans. J. Am. Soc. Mass Spectrom. 15, 1534-1544 (2004)
26. Seymour, J. L., Costello, C. E., Zaia, J.: The influence of sialylation on glycan negative ion dissociation and energetics. J. Am. Soc. Mass Spectrom. 17, 844-854 (2006)
27. Kailemia, M. J., Park, M., Kaplan, D. A., Venot, A., Boons, G. J., Li, L., Linhardt, R. J., Amster, I. J.: High-field asymmetric-waveform ion mobility spectrometry and electron detachment dissociation of isobaric mixtures of glycosaminoglycans. J. Am. Soc. Mass Spectrom. 25, 258-268 (2014)
28. Zaia, J., McClellan, J. E., Costello, C. E.: Tandem mass spectrometric determination of the 4S/6S sulfation sequence in chondroitin sulfate oligosaccharides. Anal. Chem. 73, 6030-6039 (2001)
29. McClellan, J. E., Costello, C. E., O'Connor, P. B., Zaia, J.: Influence of charge state on product ion mass spectra and the determination of 4S/6S sulfation sequence of chondroitin sulfate oligosaccharides. Anal. Chem. 74, 3760-3771 (2002)
30. Zaia, J., Li, X. Q., Chan, S. Y., Costello, C. E.: Tandem mass spectrometric strategies for determination of sulfation positions and uronic acid epimerization in chondroitin sulfate oligosaccharides. J. Am. Soc. Mass Spectrom. 14, 1270-1281 (2003)
31. Zaia, J., Costello, C. E.: Tandem mass Spectrometry of sulfated heparin-like glycosaminoglycan oligosaccharides. Anal. Chem. 75, 2445-2455 (2003)
32. Hoffmann, W. D., Jackson, G. P.: Charge transfer dissociation (CTD) mass spectrometry of peptide cations using kiloelectronvolt helium cations. J. Am. Soc. Mass Spectrom. 25, 1939-1943 (2014)
33. Chingin, K., Makarov, A., Denisov, E., Rebrov, O., Zubarev, R. A.: Fragmentation of positively-charged biological ions activated with a beam of high-energy cations. Anal. Chem. 86, 372-379 (2014)
34. Ralet, M. C., Williams, M. A., Tanhatan-Nasseri, A., Ropartz, D., Quemener, B., Bonnin, E.: Innovative enzymatic approach to resolve homogalacturonans based on their methylesterification pattern. Biomacromolecules 13, 1615-1624 (2012)
35. Correc, G., Hehemann, J.-H., Czjzek, M., Helbert, W.: Structural analysis of the degradation products of porphyran digested by Zobellia galactanivorans β-porphyranase A. Carbohydr. Polym. 83, 277-283 (2011)
36. Giuliani, A., Jamme, F., Rouam, V., Wien, F., Giorgetta, J. L., Lagarde, B., Chubar, O., Bac, S., Yao, I., Rey, S., Herbeaux, C., Marlats, J. L., Zerbib, D., Polack, F., Refregiers, M.: DISCO: a low-energy multipurpose beamline at synchrotron SOLEIL. Journal of synchrotron radiation 16, 835-841 (2009)
37. Niedermeyer, T. H., Strohalm, M.: mMass as a software tool for the annotation of cyclic peptide tandem mass spectra. PLoS One 7, e44913 (2012)
38. Capila, I., Linhardt, R. J.: Heparin-protein interactions. Angew Chem. Int. Ed. Engl. 41, 391-412 (2002)
39. Pomin, V. H., Mourao, P. A.: Structure, biology, evolution, and medical importance of sulfated fucans and galactans. Glycobiology 18, 1016-1027 (2008)

Example 5: One Step, Two-Electron Oxidation of Gas-Phase Insulin Via Charge Transfer Dissociation (CTD)

INTRODUCTION

Insulin is produced in the B-cells of the islets of Langerhans of the pancreas, which helps maintain the blood glucose levels from getting too high or too low as well as regulate the amino acid uptake by body cells and inhibits the breakdown of glycogen, protein and fat [1]. Similar to many polypeptide species, insulin has multiple disulfide linkages that stabilize the three-dimension structure for proper biological function. Therefore, disruption of these disulfide linkages is necessary for retrieving primary sequence information of insulin. Intact bovine insulin could also serve as a good model for the investigation of the dissociation behavior of polypeptides with multiple disulfide linkages.

Mass spectrometry (MS) shows high selectivity and sensitivity, and capability of performing a variety of experiments, which makes it an appealing technique for analyzing biological molecules [2]. Due to the advent of soft ionization methods such as electrospray ionization (ESI) [3] or matrix-assisted laser desorption ionization (MALDI) [4], biomolecules can be kept intact for the acquisition of their molecular mass. The development of tandem mass spectrometry (MS/MS) has greatly advanced the application of MS in the structural characterization of biomolecules. MS/MS technique enables the structural analysis of selected precursor ions originating from ESI or MALDI and the dissociation of these ions within the context of MS/MS to obtain structural information [5].

Insulin or disulfide linkage-containing polypeptides have been extensively examined during the past few decades using various MS/MS techniques (i.e. ion activation methods), such as collision-induced dissociation (CID) [6-9], post source decay [4], electron capture dissociation (ECD) [10-12], electron transfer dissociation (ETD) [9, 13-17], electron induced dissociation (EID) [18], electron detachment dissociation (EDD) [19], infrared multiphoton dissociation (IRMPD) [19] and ultraviolet photodissociation (UVPD) [20-24]. As the most widely used ion activation methods [25], CID relies on the conversion of kinetic energy into internal energy through ion/molecule collision and gives rise to mostly b- and y-type ions from backbone amide bond cleavages. CID of insulin at various charge states (1+, 2+, 3+, 4+ and 5+) was investigated. The fragmentation efficiency shows a strong dependence on the charge state of the precursor. One particular limitation of CID is little or limited sequence information related to cyclic structure stabilized by disulfide linkages could be obtained [8]. Electron-based ion activation method-ECD-showed the capability of cleaving disulfide bonds for proteins, but with a relatively low efficiency [26]. Julian and coworkers combined UV pre-activation with ECD, which could cleave all the three-disulfide bonds of insulin and exhibited more extensive backbone fragmentation than a single ECD experiment [24]. Loo and coworkers used sulfolane as the supercharging reagent in protein solution, and the resulting supercharged protein ions exhibited enhanced ECD and S—S bond fragmentation efficiency [27].

Charge transfer dissociation (CTD) is an alternative MS/MS technique developed by the Jackson research group [28]. CTD involves the interaction between helium cations and peptide cations of interest, which can produce a nearly complete set of a-ions from substance P [28]. It is noteworthy that the precursor ions are at 1+ charge state, and the fragmentation event was carried out on a low-cost three-dimensional quadrupole ion trap (QIT) mass spectrometer. Such advantages make CTD an appealing technique in ion activation method kit. To explore the possibility of applying this technique to small proteins as a top-down approach, CTD of insulin at charge states of 4+, 5+ and 6+ was carried out in this work.

Experimental

Instrumentation:

All experiments were performed on a modified Bruker (BrukerDaltonics, Bremen, Germany) equipped with a saddle field fast ion gun installed on the top of ring electrode [28, 29]. Briefly, a 2-mm hole was drilled in the ring electrode for the permission of helium cations into the trap. The Saddle field fast ion was used as the helium source. The ion source was installed onto a three-dimensional quadrupole ion trap (QIT) mass. A 6 kV wave generator from a high voltage amplifier produced helium ions with the portion of the scan function; similar to previous MAD-MS experiments [29].

Reagents:

Bovine insulin was purchased from Sigma-Aldrich (St. Louis, Mo.) and used without further purification. The insulin solution was prepared with a final concentration of approximately 20 μM in 49.5/49.5/1 (v/v/v) methanol/water/glacial acetic. Methanol (HPLC-grade) and glacial acetic acid were purchased from Fisher Scientific (Waltham, Mass.). Water was obtained from an in-house Milli-Q purification system with >18 MΩ salt content.

Methods:

Mass Spectrometry Measurement: All mass spectra were collected in positive mode with an ESI voltage of 4.5 kV, capillary voltage of 8 V and capillary temperature of 250° C. and a heated ESI source temperature of 60° C. The pressure was estimated to be approximately $1.2\times10^{-5}$ mbar. Full mass spectra were collected at a different operating m/z range depending on the precursor ion.

Collision-Induced Dissociation Measurements: The precursor ion of interest was isolated using a selection window of ±4 Da relative to the selected centroid m/z value. The accumulation time (injection time) was set to be about 1.0 ms. Low mass cutoff (LMCO) was typically set to be ~1/4 of the precursor mass. E.g., for insulin 5+(m/z 1148), the LMCO was set to be m/z 300. The amplitude was set to be ~0.30 V. A typical CID run lasts 1.5 minutes.

Charge Transfer Dissociation Measurements: CTD experiments were conducted in the way similar to CID experiments. The isolation window width of ±4 Da was used. The ICC was disabled and a QIT injection time was set to be 50 ms. A variable leak-valve was used to control the flow of the helium ($1.20\times10^{-5}$ mbar) through the ion gun. CTD was performed by the introduction of helium cations into the three-dimensional quadrupole ion trap. A waveform generator was synchronized with the time slot reserved for CID fragmentation. The waveform generator was triggered by a TTL signal from the mass spectrometer, and it generates a 0-5 V square wave. The detailed operating principle was described elsewhere [28]. A typical CTD experiment consists of 2.5 min for product ion spectra, followed by 2.0 min for background spectra (helium beam on but ESI off). The background spectra were subtracted from the product ion spectra. In the $MS^3$ CID experiments, CTD-generated product ions were isolated and subjected to certain CID amplitude at $MS^3$ level.

Resonance Ejection: Resonance ejection experiments were conducted for the investigation of dissociation pathways. The precursor ions of interest were isolated and were subjected to helium irradiation at $MS^2$ level. One of the product ions was resonantly ejected upon the application of a relatively high CID amplitude (~2.5V). The experiment was repeated three times, and all the product ion spectra were averaged for final analysis. To determine the effect of the ejection of the first generation product ion, the average abundance of the product ion in the ejection spectrum was compared with the average abundance of that same product ion in the CTD spectrum.

Figure 21A:
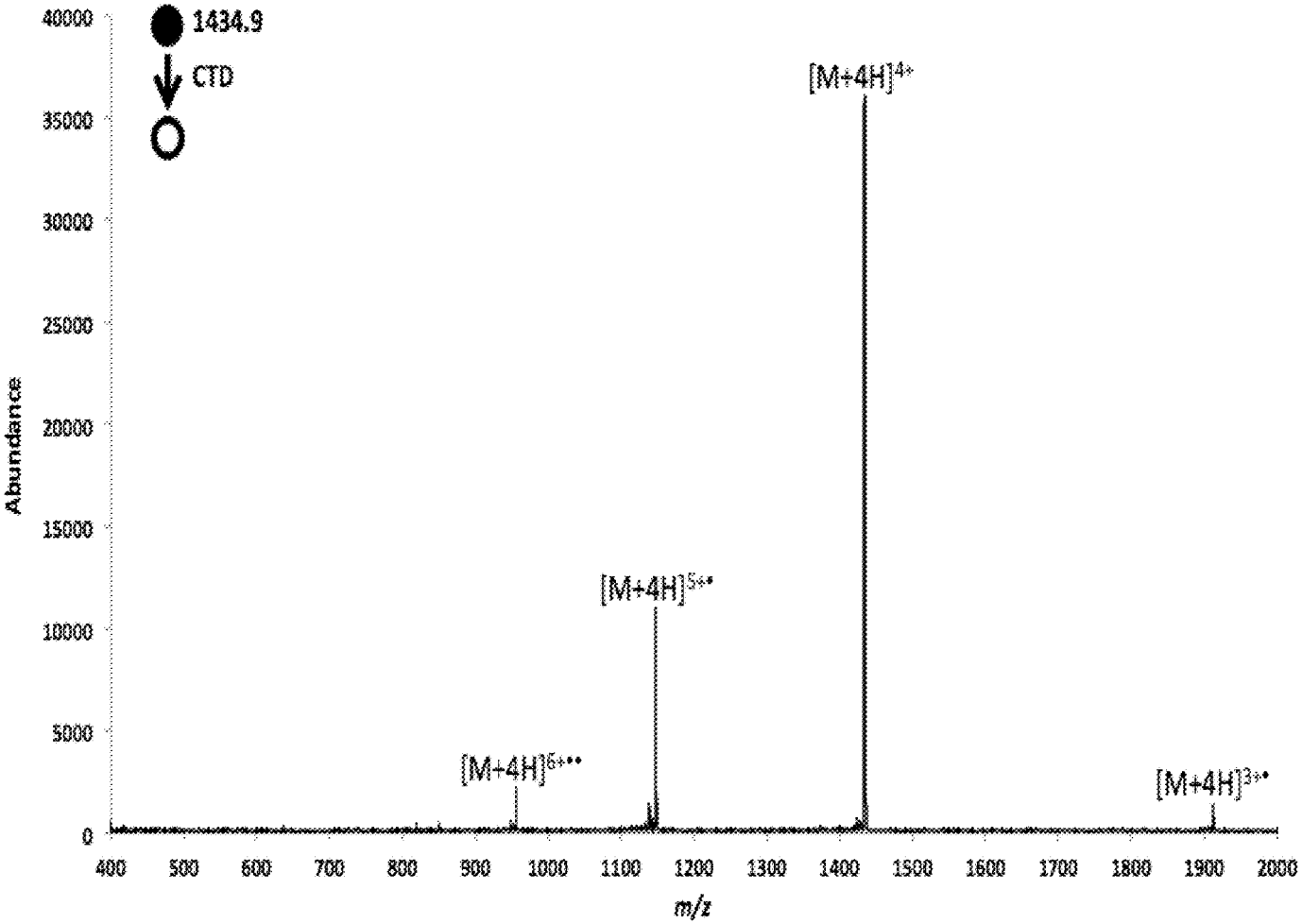
FIGS. 21A-21C show CTD spectra of (FIG. 21A) $[M+4H]^{4+}$, (FIG. 21B) $[M+5H]^{5+}$ and (FIG. 21C) $[M+6H]^{6+}$ ions derived from bovine insulin.
Figure 21B:
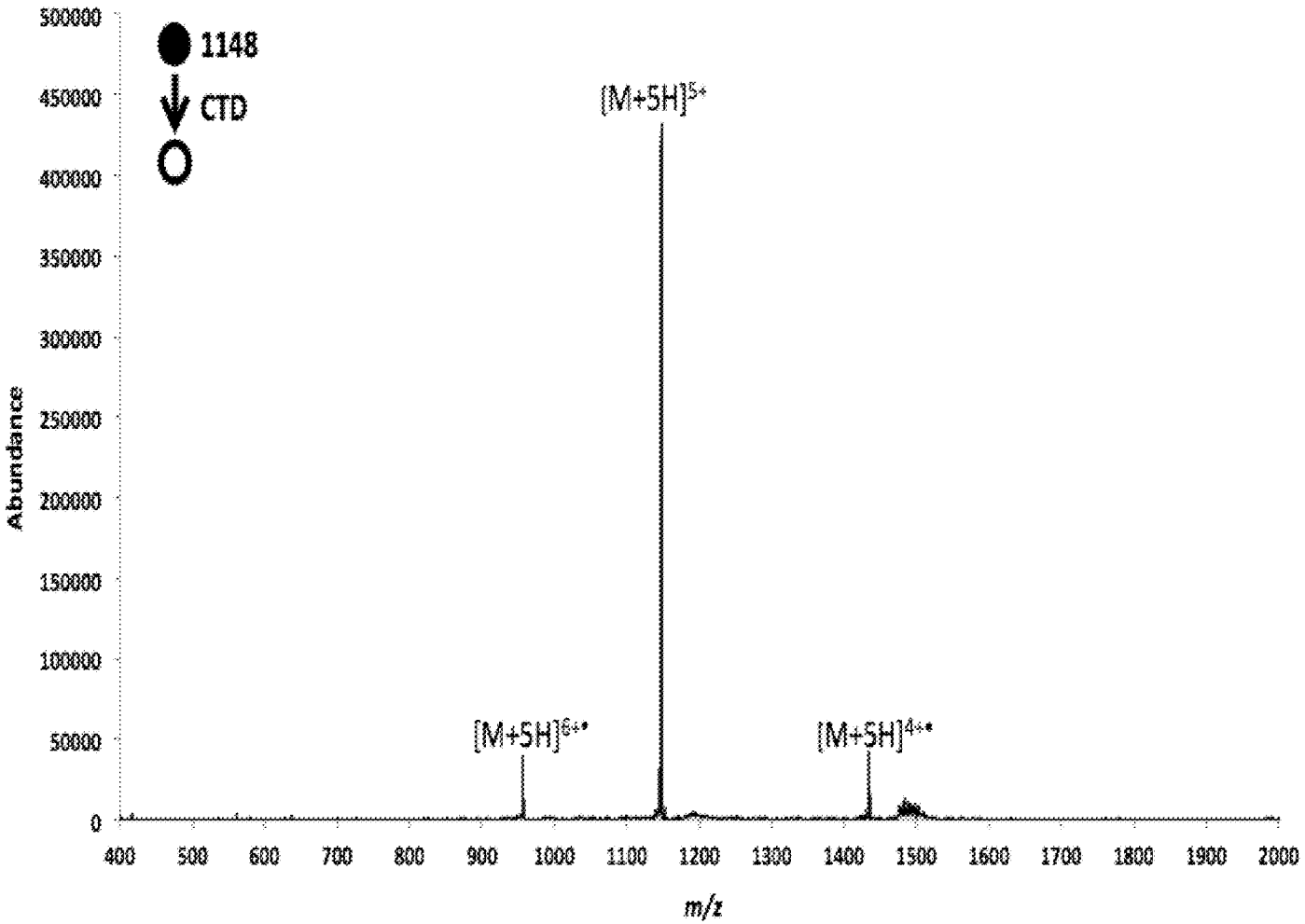
Figure 21C:
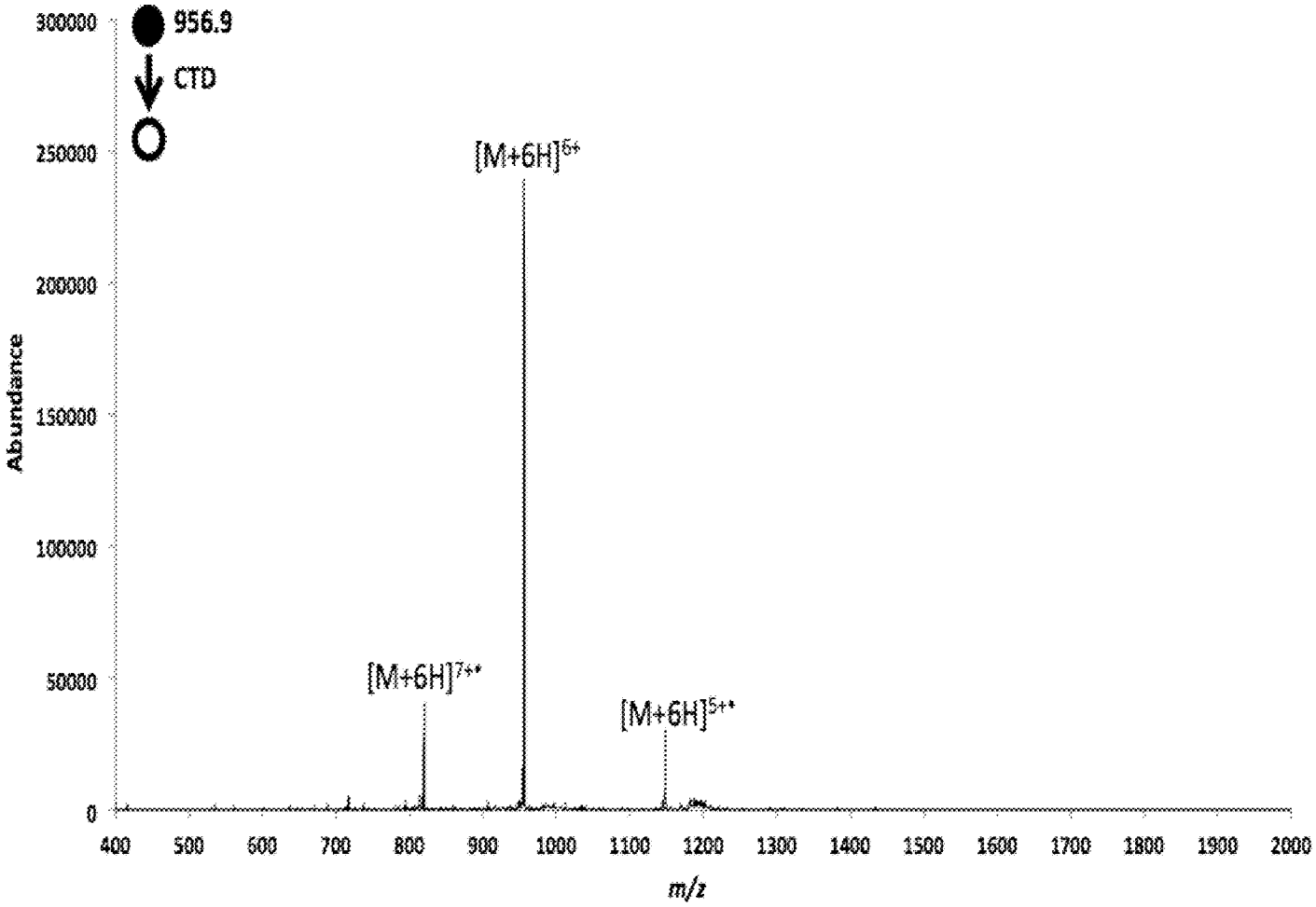

Results and Discussion:

FIGS. 21A-21C show CTD spectra of (FIG. 21A) $[M+4H]^{4+}$, (FIG. 21B) $[M+5H]^{5+}$ and (FIG. 21C) shows $[M+6H]^{6+}$ ions derived from bovine insulin. CTD spectra of $[insulin+4H]^{4+}$, $[insulin+5H]^{5+}$, and $[insulin+6H]^{6+}$ are shown in FIGS. 21A-21C. In FIG. 21A, when the 4+ insulin precursor ion was subjected to helium cation irradiation, two type radicals are generated—[insulin+4H]$^{5+}$. (charge-increased product ion) and [insulin+4H]$^{3+}$. (charge-decreased product ion). The proposed formation path of [insulin+4H]$^{5+}$. is shown follows:

$$[M+4H]^{4+}+He^{+}\rightarrow[M+4H]^{5+}.+He^{\circ} \quad \text{(Eq. 1a)}$$

Similar charge-increased product ions were also observed in the CTD spectra of [insulin+5H]$^{5+}$ and [insulin+6H]G$^{6+}$. The formations of the two charge-increased species are proposed in reaction 2a and 3a.

$$[M+5H]^{5+}+He^{+}\rightarrow[M+5H]^{6+}.+He^{\circ} \quad \text{(Eq. 2a)}$$

$$[M+6H]^{6+}+He^{+}\rightarrow[M+6H]^{7+}.+He^{\circ} \quad \text{(Eq. 3a)}$$

FIG. 22 shows reaction Scheme 1, which shows dissociation channels observed in CTD of insulin 4+, 5+ and 6+ charge states. Key for peptide sequencing: black line, product ions observed in charge state 1+; red line, product ions observed in charge state 2+; blue line observed in charge state 3+; fragment ion with another chain attached are marked a whole green line.

Figure 24A:
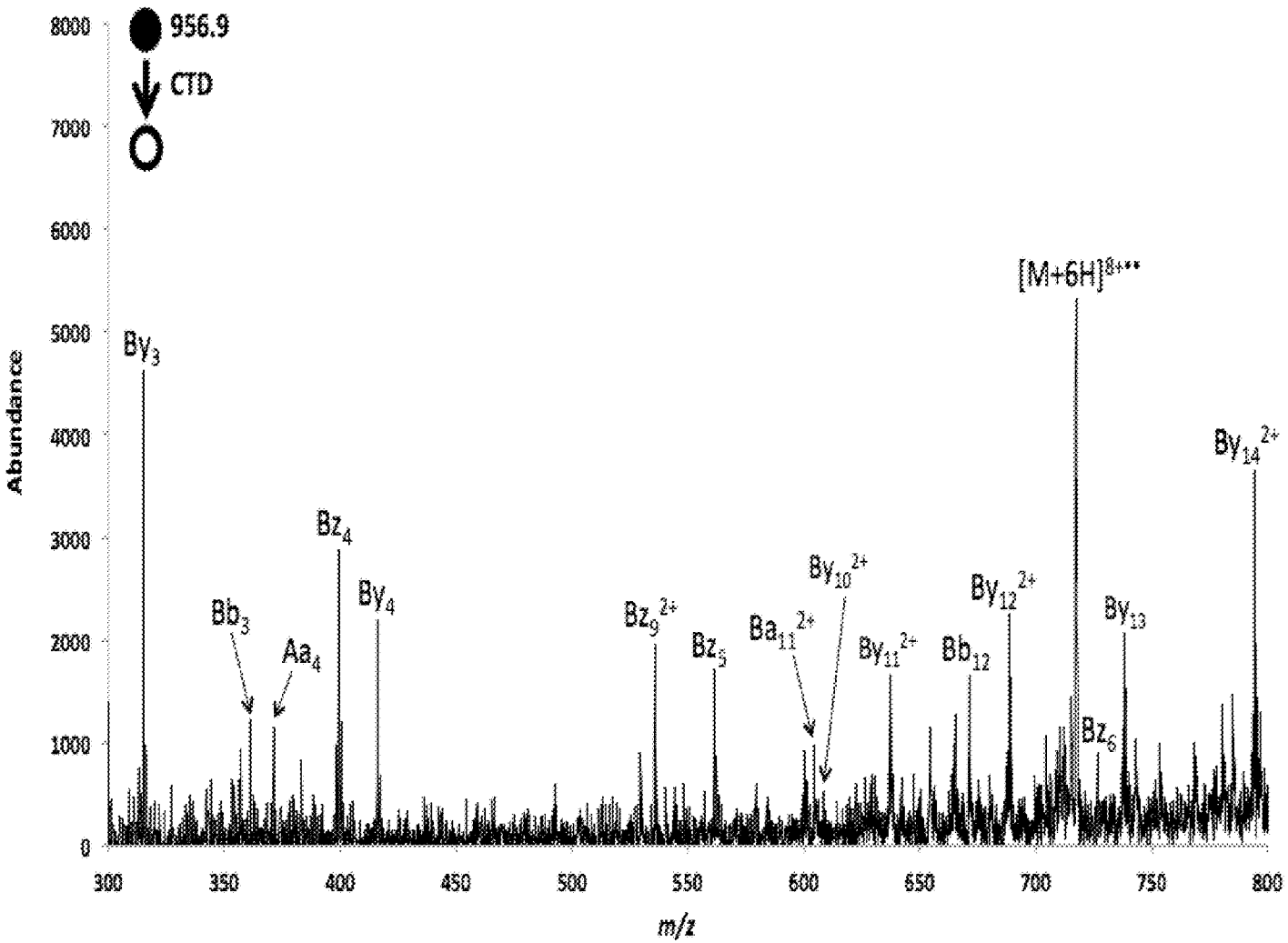
FIGS. 24A-24B show the CTD spectra of 6+ insulin ranging from (FIG. 24A) m/z 300-1300, and (FIG. 24B) m/z 800-1500.
Figure 24B:
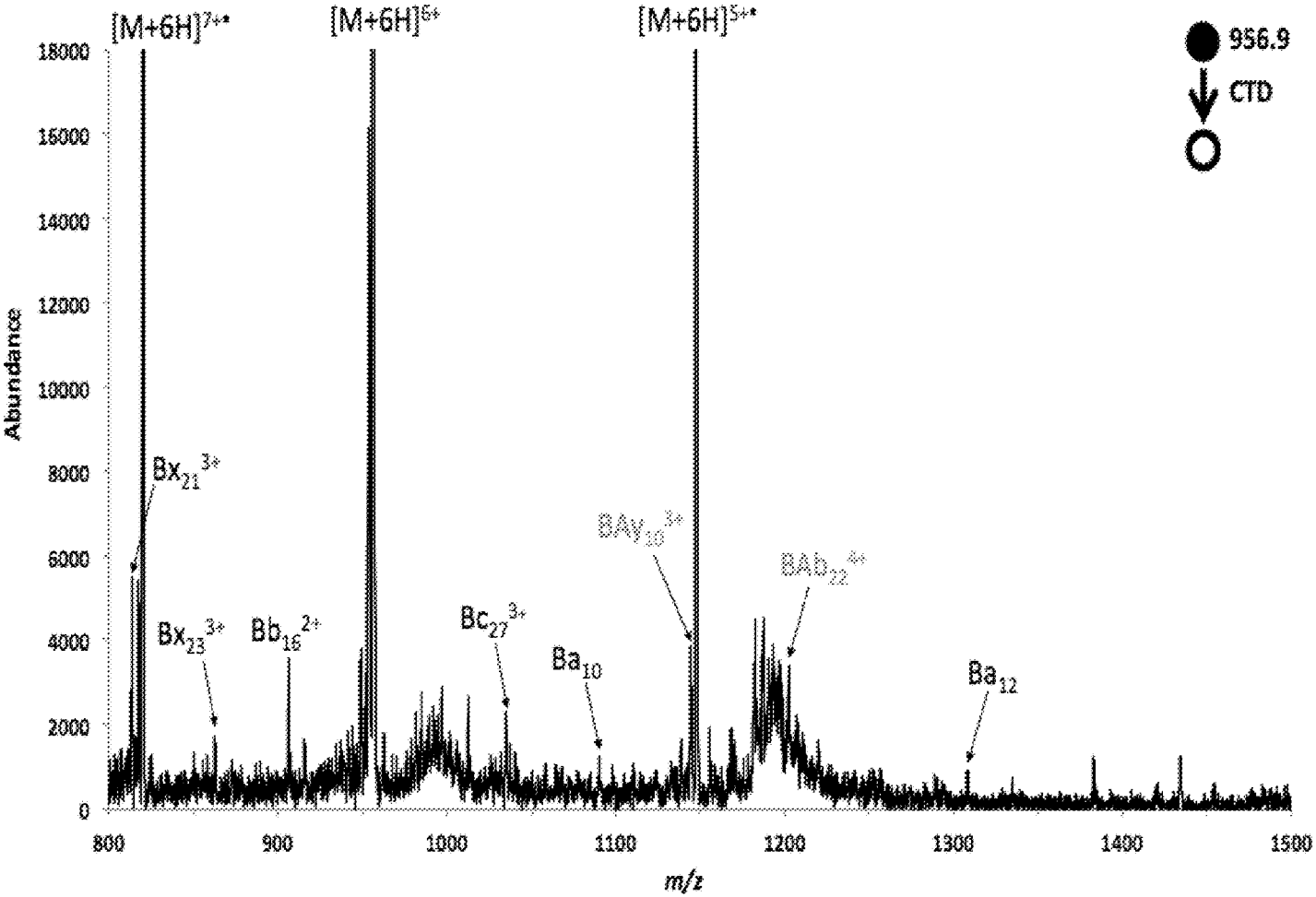

The close-ups of FIG. 21A, FIG. 21B, and FIG. 21C were generated. Close-ups of FIGS. 21B and 21C are shown in FIGS. 24A-24B, respectively. The close-up of FIG. 21A is not shown.

Only a few fragmentations were induced during CTD of insulin 4+(data not shown). Two low-intensity fragment ions ($By_6$ and $By_{11}^{2+}$) arising from the cleavage on the C-terminus of the B-chain. No evidence for separation of the A- and B-chain was observed in CTD of insulin 4+. One possible cause of the minor cleavage is the lack of ion count during the precursor isolation in the ion trap (ESI spectrum of insulin was generated but is not shown).

Figure 56:
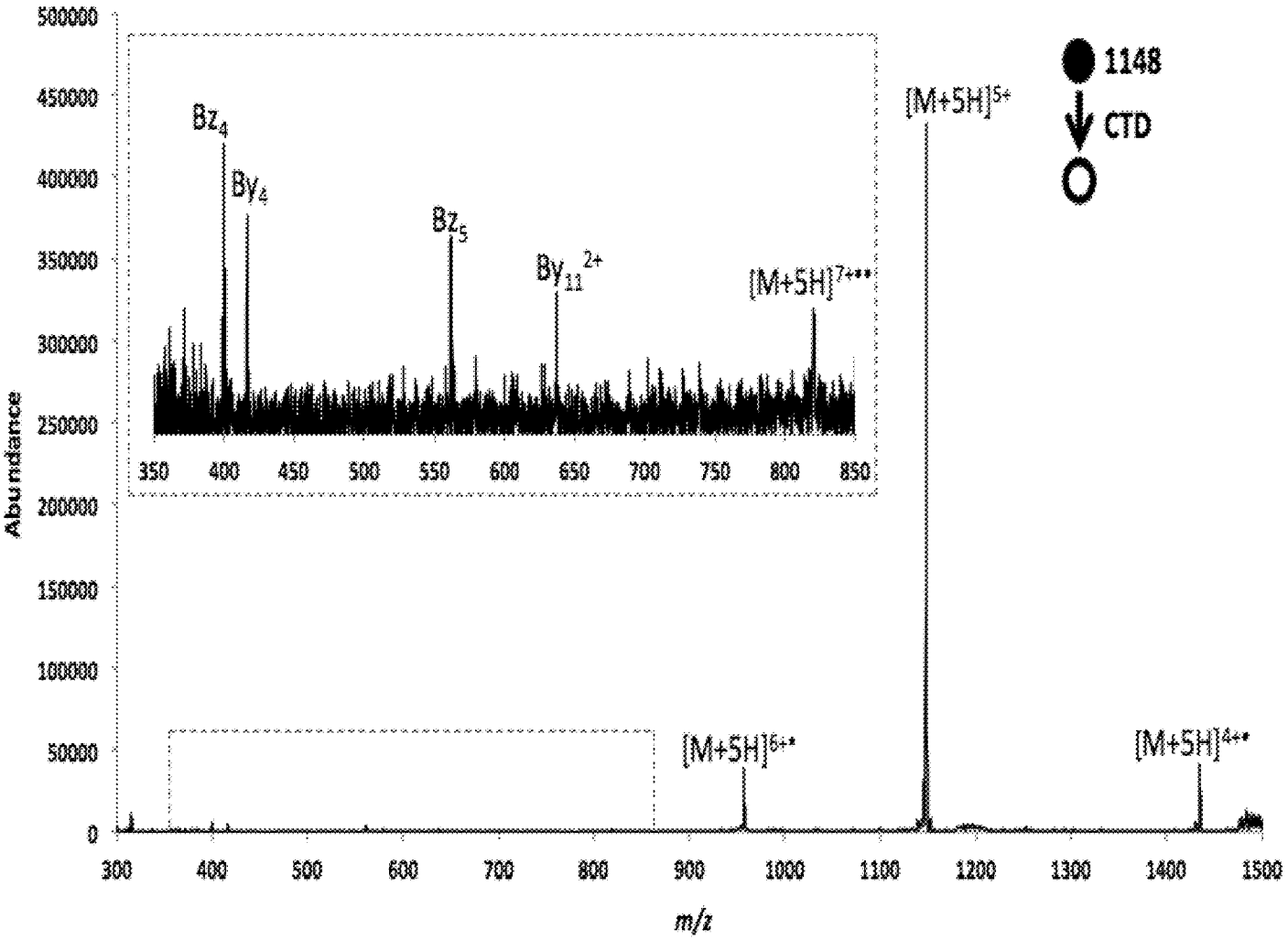
FIG. 56 shows CTD spectrum of insulin 5+. Four fragment ions were observed, which all originate from the cleavage of the C-terminus of B-chain outside the loop structure defined by the disulfide linkage were obtained. No cleavages inside the loop structure were observed. Similar to insulin 4+, there is no evidence for the separation of the two chains.

FIG. 56 shows CTD spectrum of insulin 5+. Four fragment ions were observed, which all originate from the cleavage of the C-terminus of B-chain outside the loop structure defined by the disulfide linkage were obtained. No cleavages inside the loop structure were observed. Similar to insulin 4+, there is no evidence for the separation of the two chains.

Compared with insulin 4+ and 5+, CTD of insulin 6+ produces much more fragment ions (FIGS. 24A-24B). A set of contiguous z-ions was observed, i.e. $Bz_4$, $Bz_5$ and $Bz_6$. Similar to the CTD results of insulin 5+, these fragments arise from the cleavage of C-terminus of B-chain outside the loop structure. One fragmentation of A-chain was observed ($Aa_4$), which arises from the cleavage of N-terminus of A-chain outside the loop structure. Interestingly, a set of doubly charged contiguous y-ions ($By_{10}^{2+}$, $By_{11}^{2+}$, $By_{12}^{2+}$, $By_{13}^{2+}$ and $By_{14}^{2+}$) was observed. $By_{10}^{2+}$ and $By_{11}^{2+}$ could be formed by the cleavage of C-terminus of B-chain outside the loop, but the formation of $By_{12}^{2+}$, $By_{13}^{2+}$ and $By_{14}^{2+}$ requires breakage of both interchain disulfide bonds. Similarly, the presence of $Ba_{10}$, $Ba_{11}^{2+}$ and $Ba_{12}$ also requires the cleavage of both disulfide linkages. All the above observations evidenced CTD could induce fragmentation of disulfide linkages and provide primary sequence information within the cyclic structure.

The above CTD results also show a dramatic dependence on the charge state of precursor ions. As the precursor charge state increases from 4+ to 6+, a dramatic increase of fragment ions was observed. At a higher charge state, more fragment ions were observed as well as more types of fragments. This means more bonds and a greater variety of bonds were cleaved. A possible explanation for this is the increasing charge state promotes more fragmentation channels during CTD process. The preferential backbone dissociation occurs near the C-terminus of the B-chain. Likewise, similar charge-dependence and preference in cleavage sites were also observed in the ETD experiments on insulin (6+, 5+, 4+ and 3+) [14]. In general, the extent of ETD dissociation and the variety of fragment ions have been reported to increase with the charge state of precursor ion. As for insulin 6+, CTD doesn't produce as many fragment ions near the N-terminus of B-chain as ETD does. ETD excels in providing primary sequence information outside the loop structure, but it could not provide any backbone information within the loop structure. CID of insulin 5+ has been reported in ref. [6, 8]-all the cleavages happened in regions external to the disulfide bonds; no structurally informative fragments from the polypeptide within the disulfide linkages were obtained. While in this case, CTD is capable of fragmenting the loop region protected by disulfide bonds, providing complementary information to regular ETD and CID experiments.

Figure 25A:
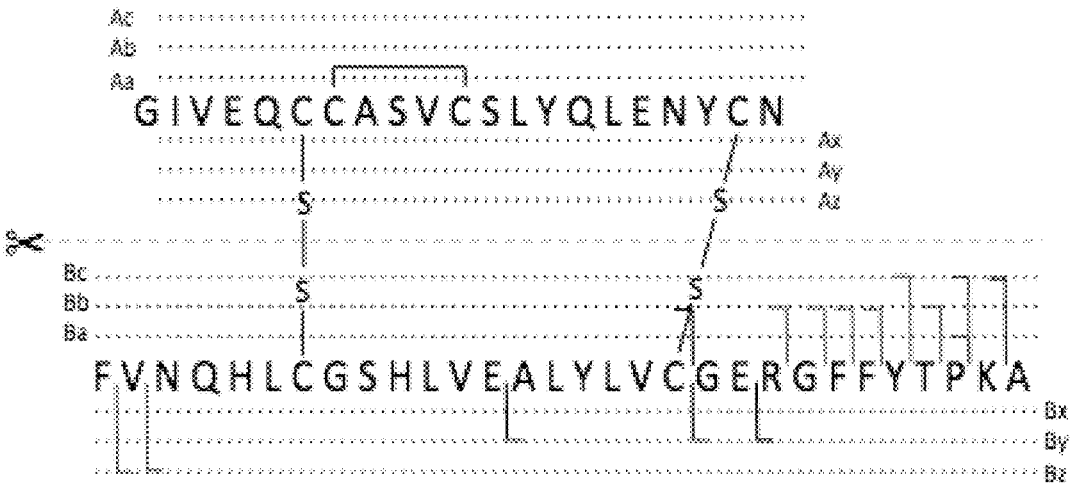
FIGS. 25A-25C shows Scheme 2, which is the dissociation channels observed in (FIG. 25A) $MS^3CID$ of $[Insulin+4H]^{5+}$. derived from CTD $[Insulin+4H]^{4+}$, (FIG. 25B) $MS^3CID$ of $[Insulin+5H]^{6+}$. derived from CTD $[Insulin+5H]^{5+}$ and (FIG. 25C) $MS^3CID$ of $[Insulin+6H]^{7+}$. derived from CTD $[Insulin+6H]^{6+}$.
Figure 25B:
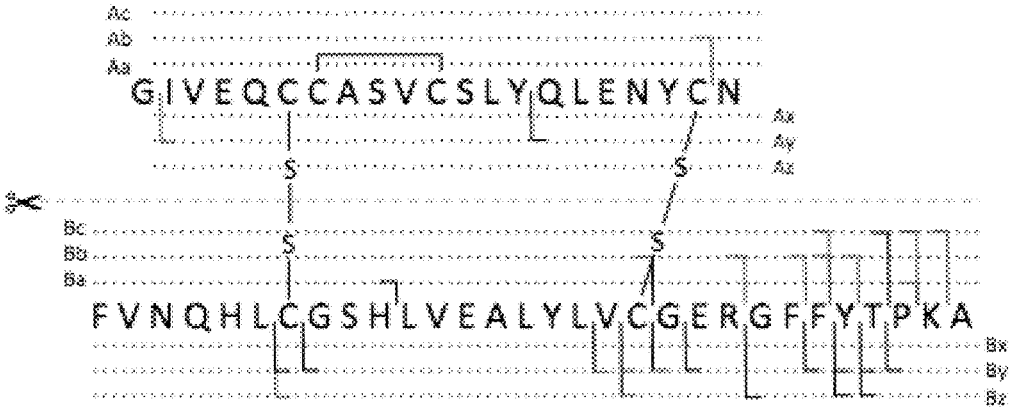
Figure 25C:
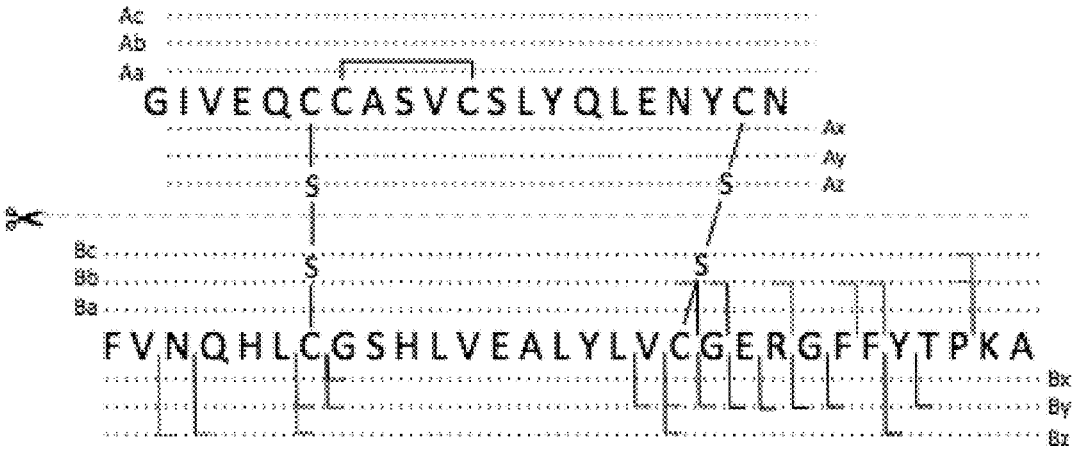
Figure 26A:
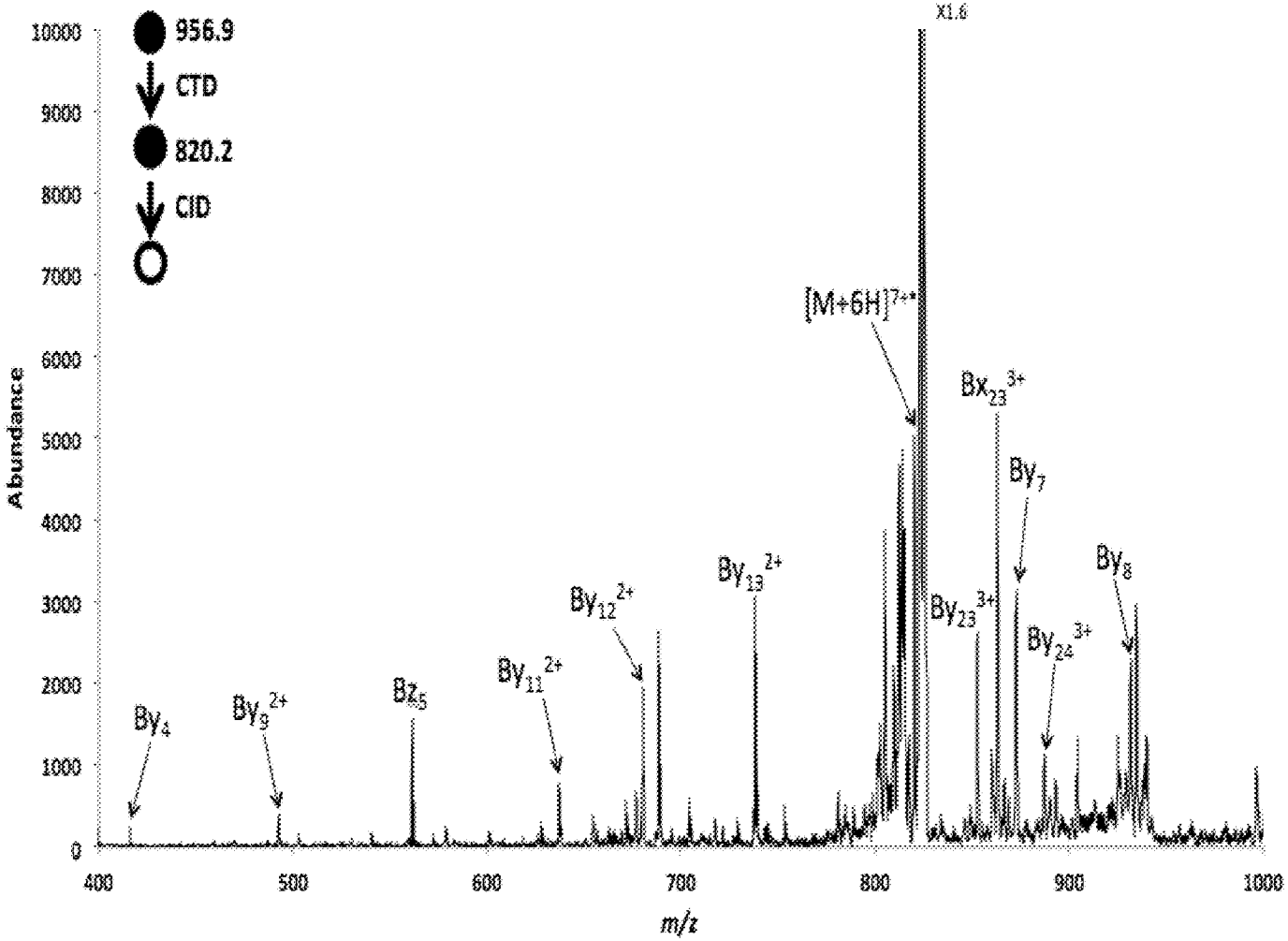
FIGS. 26A-26B show the $MS^3$ CID spectrum of $[Insulin+6H]^{7+}$. ranging from (FIG. 26A) m/z 400-1000, and (FIG. 26B) m/z 1000-1400.

FIGS. 25A-25C shows Scheme 2, which is the dissociation channels observed in (FIG. 25A) MS$^3$CID of [Insulin+4H]$^{5+}$. derived from CTD [Insulin+4H]$^{4+}$, (FIG. 25B) MS$^3$CID of [Insulin+5H]$^{6+}$. derived from CTD [Insulin+5H]$^{5+}$ and (FIG. 25C) MS$^3$CID of [Insulin+6H]$^{7+}$. derived from CTD [Insulin+6H]$^{6+}$. FIG. 26A shows the MS$^3$ CID spectrum of [Insulin+6H]$^{7+}$. derived from CTD of [Insulin+6H]$^{6+}$. The MS$^3$ CID spectrum is dominated by a wide range of y-ions derived from the cleavages of B-chain.

Figure 27:
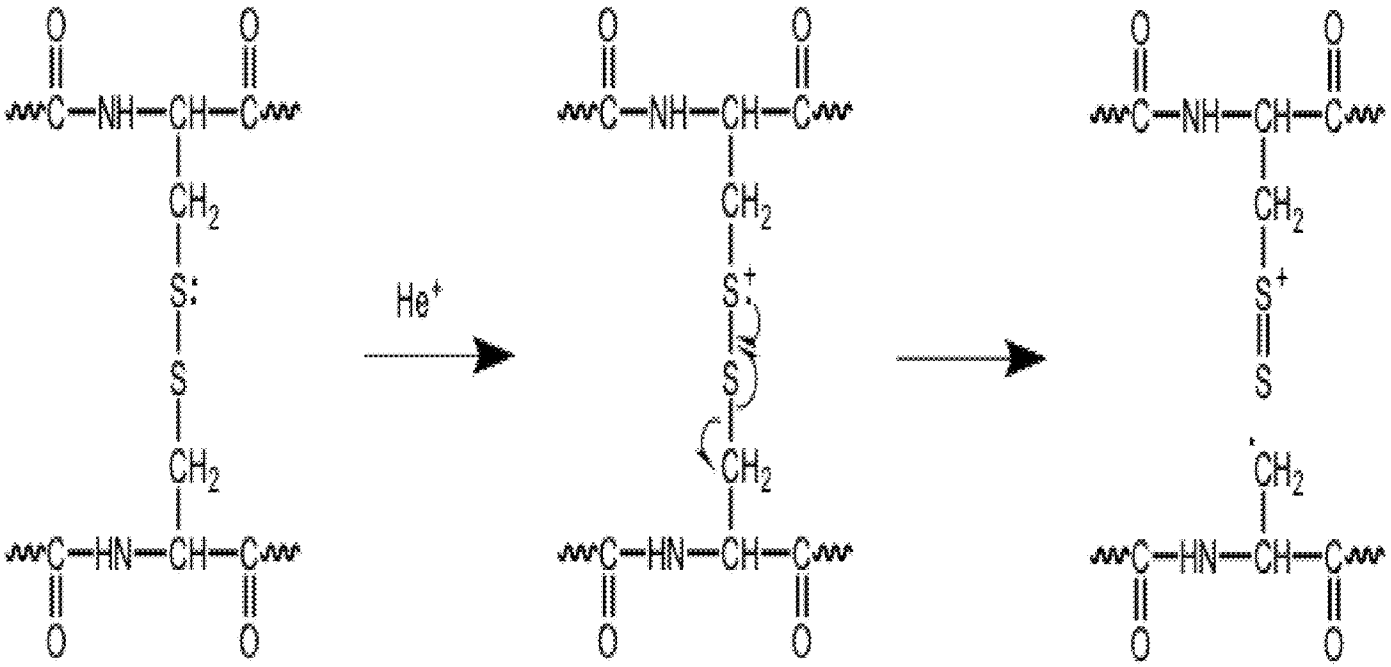
FIG. 27 shows a proposed mechanism for formation of a radical on $CH_2$.

In the high mass range (m/z 1000-1400), fragment ions of relatively high abundance were observed, most of which originated from cleavages of the B-chain with the entire A-chain attached (i.e. $ABb_{22}^{4+}$, $ABb_{24}^{4+}$, $ABc_{28}^{4+}$ and $ABz_{24}^{4+}$). In FIG. 26A, an ion at m/z 1326 ($B(z_{12}\text{-}S)^{+}$) is associated with cleavage of the disulfide bond between A-chain Cys-20 and B-chain Cys-19. The ($z_n$-S)+ type fragment ion has also been reported in ion trap collisional activation experiment of insulin [8]. The fragmentation pathway for this product ion could be quite similar to the mechanism proposed in ref. [8]. Scheme 3 (FIG. 27) shows helium cation removes an electron from one sulfur of the disulfide linkage, which leads to the homolytic cleavage of neighboring C—S bond of B-chain Cys-19. The radical on $CH_2$ directs a second homolytic cleavage of N—C bond, which leaves a C═C bond in the resulting z-type ion and a radical on the commentary c-type ion.

Figure 26B:
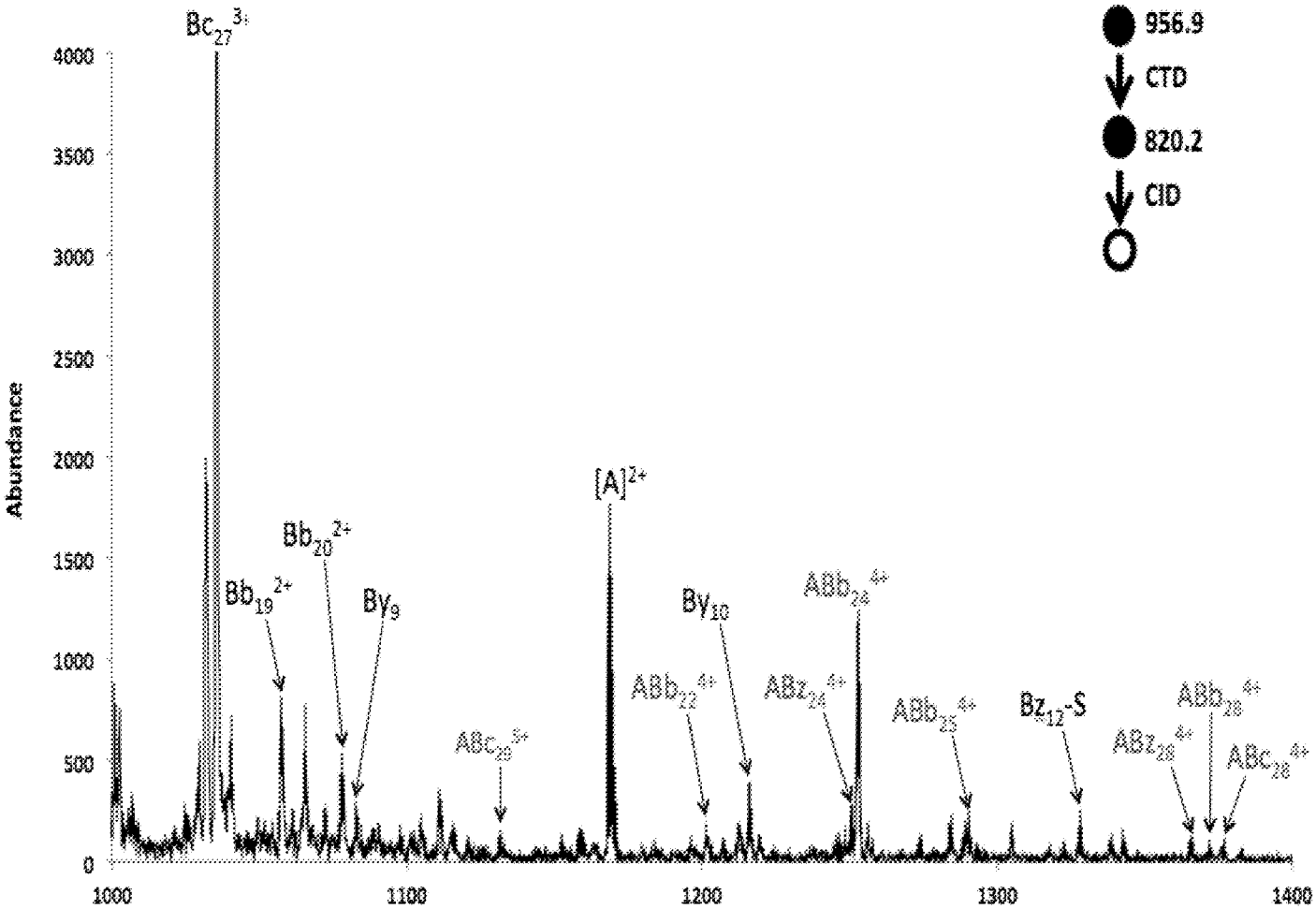
Figure 28:
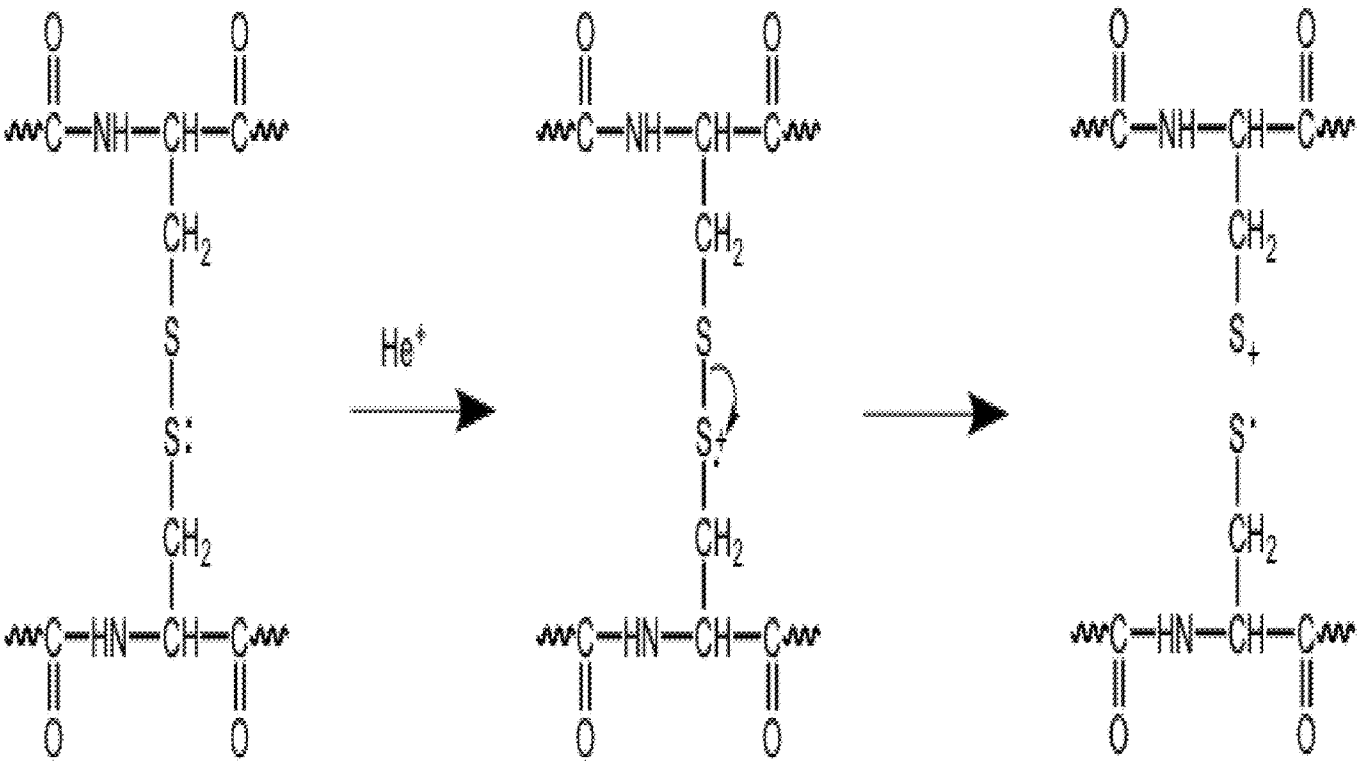
FIG. 28 shows a proposed mechanism for formation of $[A]^{2+}$.

FIG. 26B shows a fragment at m/z 1169, corresponding in mass to the double protonated A-chain adduct ([A]$^{2+}$). [A]$^{2+}$ fragment is not commonly observed in a regular CID of similar precursor charge state [8], but it is observed in CTD-MS$^3$ CID experiments. The formation of [A]$^{2+}$ requires the cleavage of both disulfide bonds. The formation of [A]$^{2+}$ is proposed in Scheme 4 (FIG. 28).

The observation of [A]$^{2+}$ strongly evidenced the cleavage of both disulfide linkages. This type of individual chain adduct ion has been widely reported in literatures. Zubarev and coworkers observed doubly charged peptide monomers due to the cleavage of an S—S bond in UVPD experiments [20]. McLafferty and coworkers have reported singly charged peptide monomers corresponding to the breakage of an S—S bond in ECD experiments [10]. Individual chain adduct ions of insulin were also reported in CID of [M+6H]$^{5+}$. derived from ETD of [M+6H]$^{6+}$ [14] and CID of gold-cationized bovine insulin ions [7].

The CID spectrum of [Insulin+4H]$^{5+}$. derived from CTD of insulin 4+ was generated. In the low mass range (m/z 400-1000), only three fragments were generated. While in the high mass range (m/z 1000-1400), more fragment ions with high abundances were produced. Most of the fragments were quadruply charged, and originate from the cleavage of the B-chain outside the loop structure with the entire A-chain attached, such as contiguous ion sets ($ABb_{22}^{4+}$, $ABb_{23}^{4+}$, $ABb_{24}^{4+}$ and $ABb_{25}^{4+}$) and ($ABb_{23}^{3+}$, $ABb_{24}^{3+}$ and $ABb_{25}^{3+}$).

The CTD-generated $[Insulin+5H]^{6+}$. was isolated and subjected to a CID amplitude. The resulting $MS^3$ CID spectrum (not shown) contained slightly more fragments than that of $[Insulin+4H]^{5+}$. CID of $[Insulin+5H]^{6+}$. produced more By-ions outside the loop structure, around the C-terminus of B-chain.

Figure 29A:
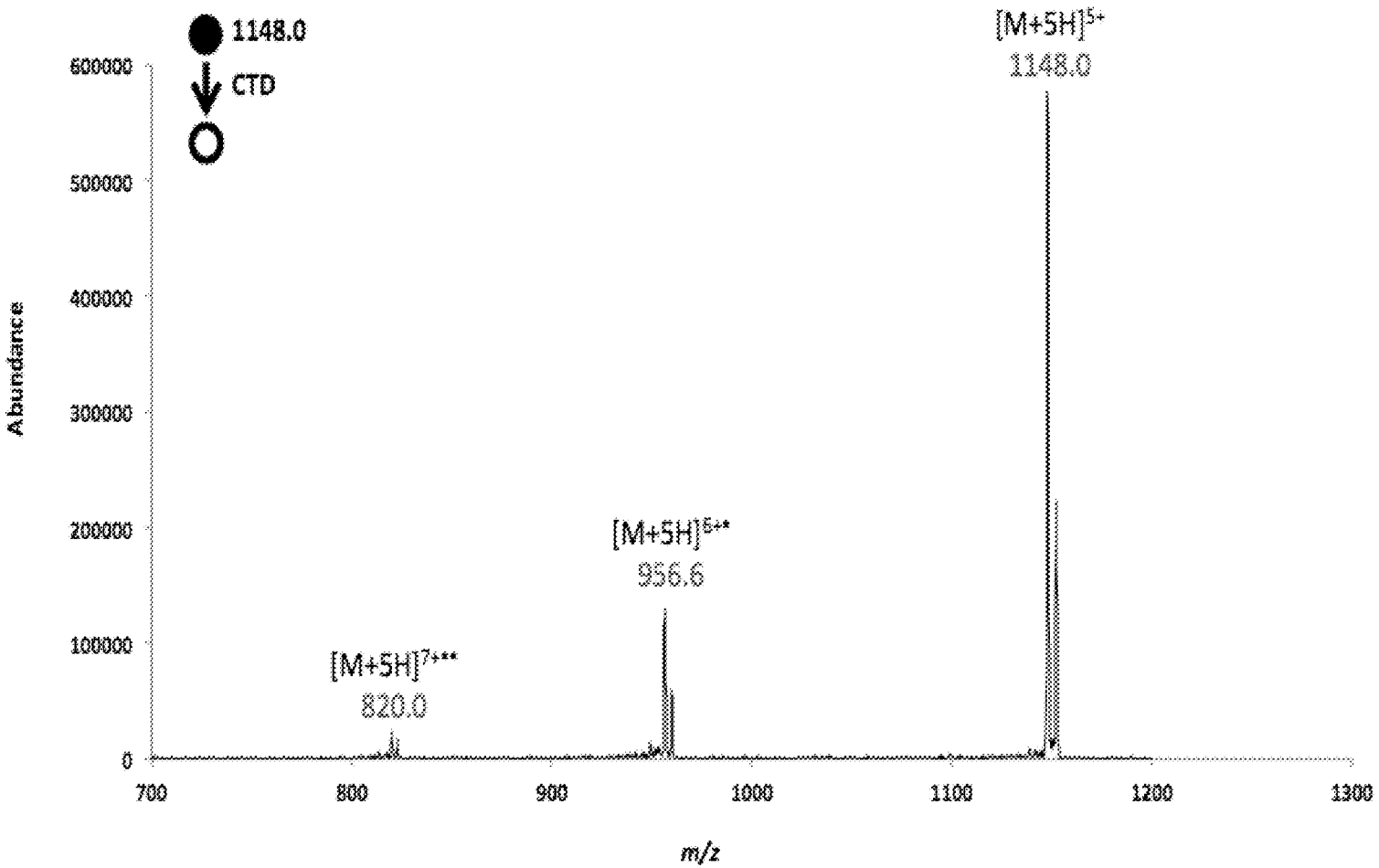
FIG. 29A-29B shows a (FIG. 29A) CTD spectrum of insulin 5+ and (FIG. 29B) a CTD spectrum of insulin 5+, with $[M+4H]^{5+}$. being resonantly ejected.
Figure 29B:
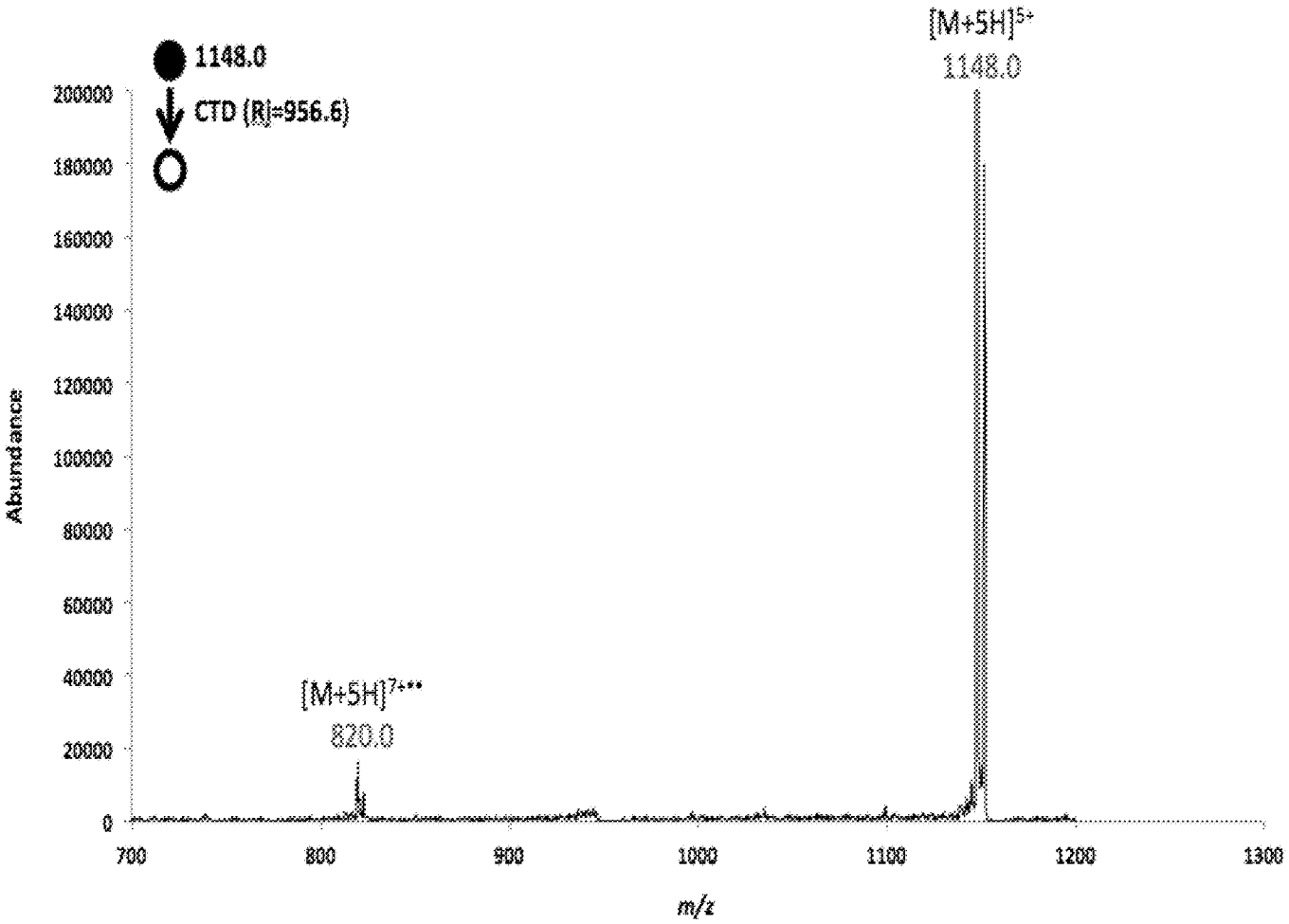

FIGS. 29A-29B shows a (FIG. 29A) CTD spectrum of insulin 5+ and (FIG. 29B) a CTD spectrum of insulin 5+, with $[M+4H]^{5+}$. being resonantly ejected. FIGS. 29A-29B show the resonance ejection experiment conducted during CTD process, as an attempt to investigate the origin of di-radical species ($[M+5H]^{7+}$.. and $[M+6H]^{8+}$..), which were both observed in CTD of insulin 5+ and 6+ charge states. $[M+5H]^{7+}$.. was accompanied by $[M+5H]^{6+}$. during the CTD process. This leads us to consider the formation of $[M+5H]^{7+}$.. in two possible pathways: (1) it is formed directly from the precursor ion (pathway A (Eq. 4)) via the loss of two electrons; (2) it is formed through a two-step reaction (pathway B (Eq. 5)) that involves generation of an intermediate ($[M+5H]^{6+}$.), from which the product ion $[M+5H]^{7+}$.. is formed.

$$[M+5H]^{5+}+He^{+}\rightarrow[M+5H]^{7+}..+e^{-}+He \quad \text{(Eq. 4)}$$

$$[M+5H]^{5+}+He^{+}\rightarrow He+[M+5H]^{6+}. \quad \text{(Eq. 5)}$$

$$[M+5H]^{6+}.+He^{+}\rightarrow[M+5H]^{7+}..+2e^{-}$$

FIG. 29A shows a regular CTD spectrum of the $[M+5H]^{5+}$. Both $[M+5H]^{6+}$. and $[M+5H]^{7+}$.. are present. In FIG. 29B, the first-generation product ion ($[M+5H]^{6+}$.) was resonantly ejected while CTD is occurring. Each spectrum was averaged from data of 3 repeated experiments. With the $[M+5H]^{6+}$. being resonantly ejected, $[M+5H]^{7+}$.. did not show a significant decrease. This means the formation of $[M+5H]^{7+}$.. is not affected when $[M+5H]^{6+}$. is taken away immediately. Therefore, the formation of $[M+5H]^{7+}$.. doesn't involve $[M+5H]^{6+}$. as an intermediate. This indicates the primary formation pathway of $[M+5H]^{7+}$.. is direct loss of two electrons from the protonated precursor ion ($[M+5H]^{5+}$).

Figure 30A:
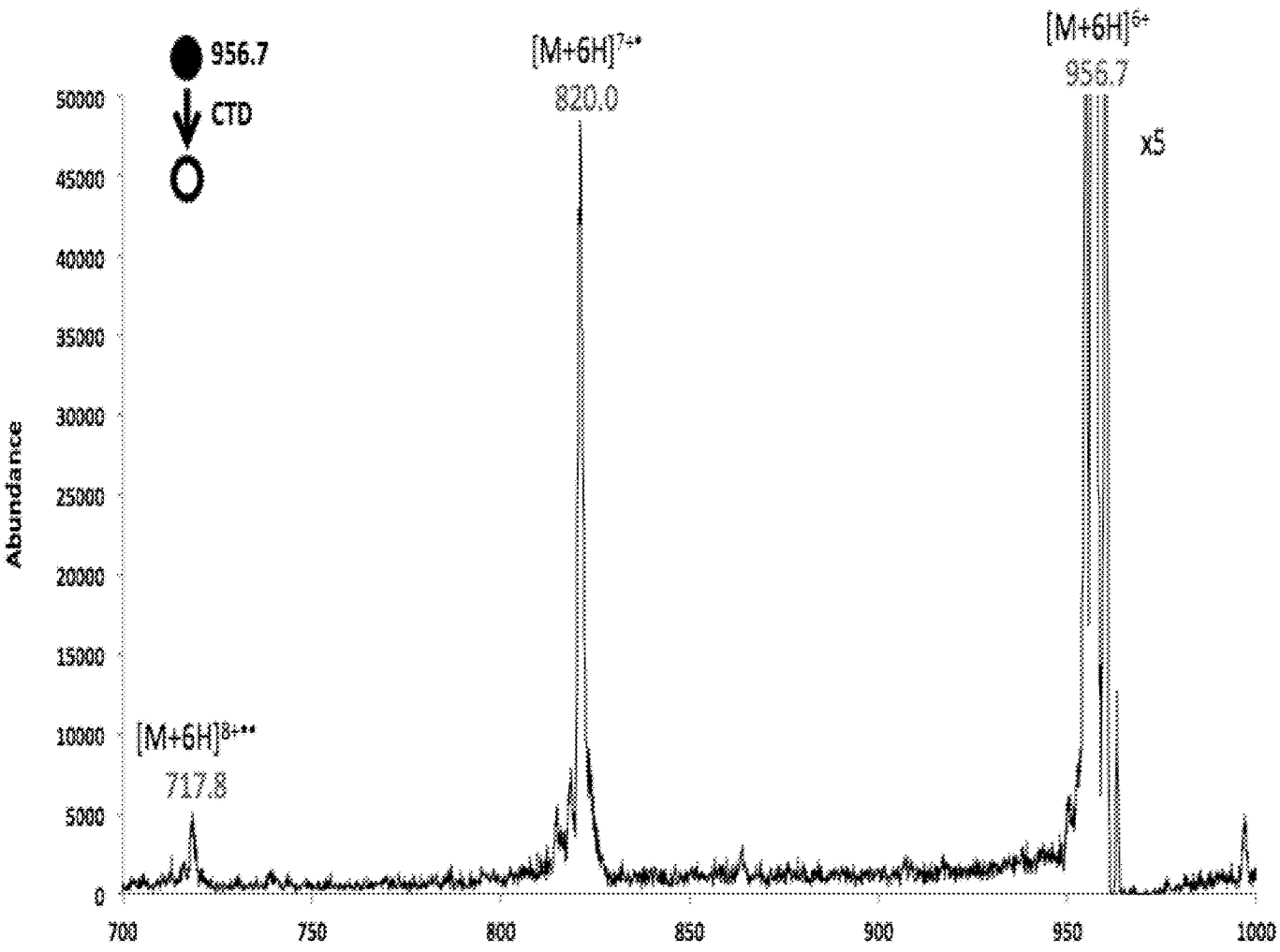
FIGS. 30A-30B show (FIG. 30A) a CTD spectrum of insulin 6+, (FIG. 30B) the same experiment with $[M+6H]^{7+}$. is being resonantly ejected.
Figure 30B:
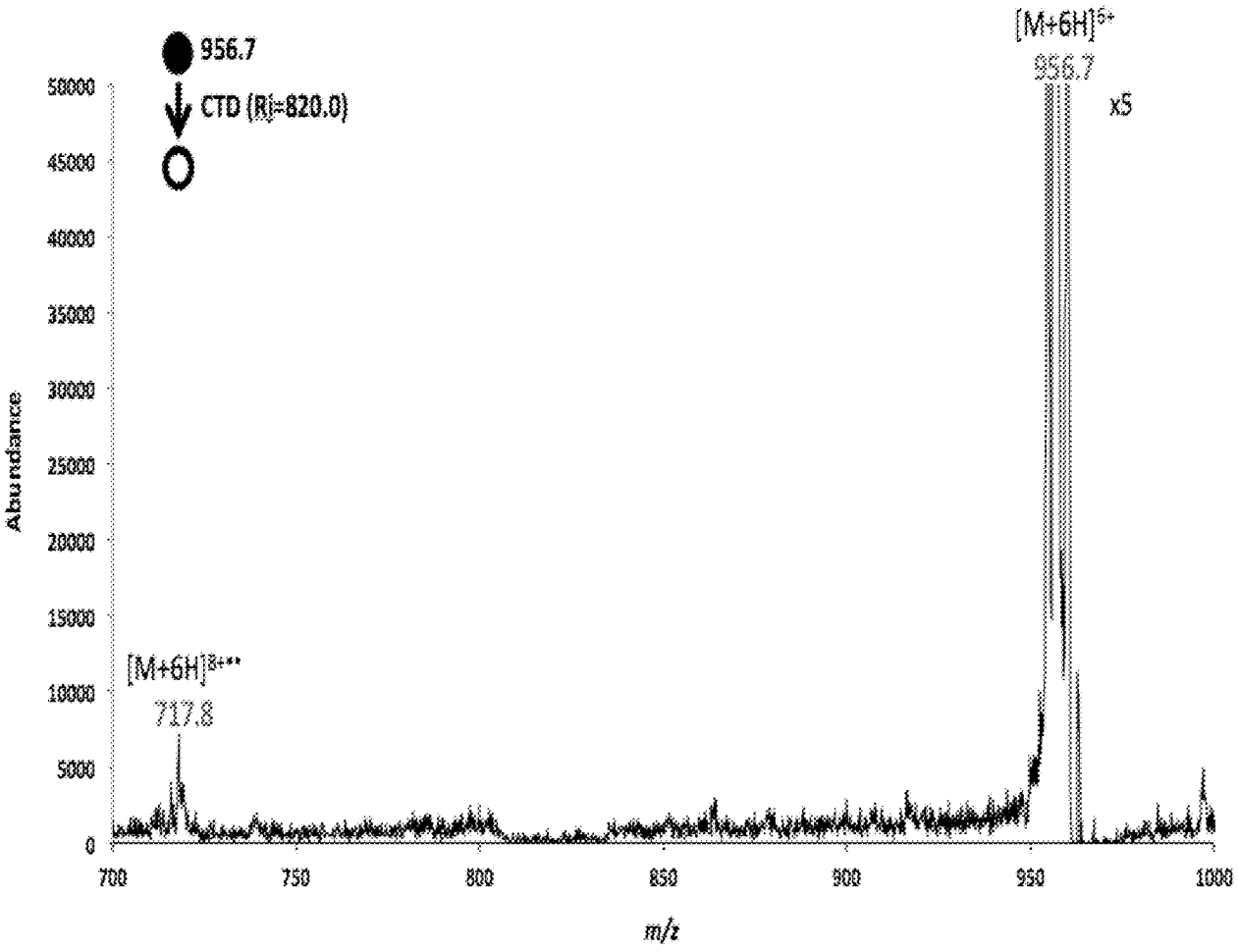

FIGS. 30A-30B show (FIG. 30A) a CTD spectrum of insulin 6+, (FIG. 30B) the same experiment with $[M+6H]^{7+}$. is being resonantly ejected. Similarly, the product ion ($[M+6H]^{8+}$..) can also be formed through two possible pathways shown by (Eq. 6 and Eq. 7):

$$[M+6H]^{6+}+He^{+}\rightarrow[M+6H]^{8+}..+e+He \quad \text{(Eq. 6)}$$

$$[M+6H]^{6+}+He^{+}\rightarrow He+[M+6H]^{7+}. \quad \text{(Eq. 7)}$$

$$[M+6H]^{7+}.+He^{+}\rightarrow[M+6H]^{8+}+2e^{-}$$

With $[M+6H]^{7+}$. being resonantly ejected during CTD of $[M+6H]^{6+}$, the intensity of $[M+6H]^{8+}$.. did not significantly decrease. This indicates the formation of $[M+6H]^{8+}$.. doesn't involve $[M+6H]^{7+}$.; this di-radical ion is primarily formed from the protonated precursor ion via two electron loss. The changes in the intensities of peaks in FIGS. 29A-29B and FIGS. 30A-30B were statistically verified in supporting information (Table 1, and Table 2, and data not shown).

These experiments show that the pathway A (Eq. 6) might be the primary channel for the generation of di-radical species. But it cannot be ruled out that pathway B (Eq. 7) is the minor reaction channel.

SUMMARY

ESI-generated insulin cations (4+, 5+ and 6+ charge states) were subjected to helium-cation irradiation, producing both charge-increased species and charge-decreased species. This interaction is also accompanied by a few fragment ions, the number and relative abundances of which are highly dependent on charge states of precursor ions. 6+ insulin precursor ion produces the maximum number of fragment ions, most of which originates from the cleavages on the B-chain outside the loop structure defined by the disulfide linkages. The presence of multiple disulfide linkages appears to make difference in each charge state. However, separation of the A and the B chains was not observed in direct CTD of insulin cations. The charge-increased product ions from CTD process were further isolated and subjected to CID reaction at $MS^3$ level. This approach not only produced more fragment ions than a single CTD experiment, but also showed the capability of breaking disulfide bonds. Both breakages of one disulfide bond and double disulfide bonds were observed. The resonance ejection experiments were conducted during CTD process, which revealed an interesting one-step 2-electron oxidation pathway for the formation of $[M+5H]^{7+}$.. or $[M+6H]^{8+}$.. during CTD process, instead of the more commonly 1-electron oxidation pathway that is commonly observed in CTD experiments. The insulin results describe here shows that CTD provides an alternative high-energy fragmentation method for singly and multiple charged biological ions as well as providing very unique gas-phase fragment ions. When extended into CTD-$MS^3$ CID, the capability of breaking disulfide linkages offers more insight into cyclic structure of disulfide linkage-containing molecules.

REFERENCES FOR EXAMPLE 5

1. Zhu, S. Y., Russ, H. A., Wang, X. J., Zhang, M. L., Ma, T. H., Xu, T., Tang, S. B., Hebrok, M., Ding, S.: Human pancreatic beta-like cells converted from fibroblasts. Nat Commun 7, (2016)
2. Zhurov, K. O., Fornelli, L., Wodrich, M. D., Laskay, U. A., Tsybin, Y. O.: Principles of electron capture and transfer dissociation mass spectrometry applied to peptide and protein structure analysis. Chem Soc Rev 42, 5014-5030 (2013)
3. Pulfer, M., Murphy, R. C.: Electrospray mass spectrometry of phospholipids. Mass Spectrom Rev 22, 332-364 (2003)
4. Jones, M. D., Patterson, S. D., Lu, H. S.: Determination of disulfide bonds in highly bridged disulfide-linked peptides by matrix-assisted laser desorption/ionization mass spectrometry with postsource decay. Anal Chem 70, 136-143 (1998)
5. Kalcic, C. L., Reid, G. E., Lozovoy, V. V., Dantus, M.: Mechanism Elucidation for Nonstochastic Femtosecond Laser-Induced Ionization/Dissociation: From Amino Acids to Peptides. J Phys Chem A 116, 2764-2774 (2012)
6. Stephenson, J. L., Cargile, B. J., McLuckey, S. A.: Ion trap collisional activation of disulfide linkage intact and reduced multiply protonated polypeptides. Rapid Commun Mass Sp 13, 2040-2048 (1999)

7. Mentinova, M., McLuckey, S. A.: Cleavage of multiple disulfide bonds in insulin via gold cationization and collision-induced dissociation. Int J Mass Spectrom 308, 133-136 (2011)
8. Wells, J. M., Stephenson, J. L., McLuckey, S. A.: Charge dependence of protonated insulin decompositions. Int J Mass Spectrom 203, A1-A9 (2000)
9. Chrisman, P. A., McLuckey, S. A.: Dissociations of disulfide-linked gaseous polypeptide/protein anions: Ion chemistry with implications for protein identification and characterization. J Proteome Res 1, 549-557 (2002)
10. Zubarev, R. A., Kruger, N. A., Fridriksson, E. K., Lewis, M. A., Horn, D. M., Carpenter, B. K., McLafferty, F. W.: Electron capture dissociation of gaseous multiply-charged proteins is favored at disulfide bonds and other sites of high hydrogen atom affinity. J Am Chem Soc 121, 2857-2862 (1999)
11. Kocher, T., Engstrom, A., Zubarev, R. A.: Fragmentation of peptides in MALDI in-source decay mediated by hydrogen radicals. Anal Chem 77, 172-177 (2005)
12. Li, H. L., O'Connor, P. B.: Electron Capture Dissociation of Disulfide, Sulfur-Selenium, and Diselenide Bound Peptides. J Am Soc Mass Spectr 23, 2001-2010 (2012)
13. Gunawardena, H. P., Gorenstein, L., Erickson, D. E., Xia, Y., McLuckey, S. A.: Electron transfer dissociation of multiply protonated and fixed charge disulfide linked polypeptides. Int J Mass Spectrom 265, 130-138 (2007)
14. Liu, J., Gunawardena, H. P., Huang, T. Y., McLuckey, S. A.: Charge-dependent dissociation of insulin cations via ion/ion electron transfer. Int J Mass Spectrom 276, 160-170 (2008)
15. Chrisman, P. A., Pitteri, S. J., Hogan, J. M., McLuckey, S. A.: SO2-electron transfer ion/ion reactions with disulfide linked polypeptide ions. J Am Soc Mass Spectr 16, 1020-1030 (2005)
16. Cole, S. R., Ma, X. X., Zhang, X. R., Xia, Y.: Electron Transfer Dissociation (ETD) of Peptides Containing Intrachain Disulfide Bonds. J Am Soc Mass Spectr 23, 310-320 (2012)
17. Mentinova, M., Han, H. L., McLuckey, S. A.: Dissociation of disulfide-intact somatostatin ions: the roles of ion type and dissociation method. Rapid Commun Mass Sp 23, 2647-2655 (2009)
18. Lioe, H., O'Hair, R. A. J.: Comparison of collision-induced dissociation and electron-induced dissociation of singly protonated aromatic amino acids, cystine and related simple peptides using a hybrid linear ion trap-FT-ICR mass spectrometer. Anal Bioanal Chem 389, 1429-1437 (2007)
19. Kalli, A., Hakansson, K.: Preferential cleavage of S—S and C—S bonds in electron detachment dissociation and infrared multiphoton dissociation of disulfide-linked peptide anions. Int J Mass Spectrom 263, 71-81 (2007)
20. Fung, Y. M. E., Kjeldsen, F., Silivra, O. A., Chan, T. W. D., Zubarev, R. A.: Facile disulfide bond cleavage in gaseous peptide and protein cations by ultraviolet photodissociation at 157 nm. Angew Chem Int Edit 44, 6399-6403 (2005)
21. Agarwal, A., Diedrich, J. K., Julian, R. R.: Direct Elucidation of Disulfide Bond Partners Using Ultraviolet Photodissociation Mass Spectrometry. Anal Chem 83, 6455-6458 (2011)
22. Stinson, C. A., Xia, Y.: Radical induced disulfide bond cleavage within peptides via ultraviolet irradiation of an electrospray plume. Analyst 138, 2840-2846 (2013)
23. Soorkia, S., Dehon, C., Kumar, S. S., Pedrazzani, M., Frantzen, E., Lucas, B., Barat, M., Fayeton, J. A., Jouvet, C.: UV Photofragmentation Dynamics of Protonated Cystine: Disulfide Bond Rupture. J Phys Chem Lett 5, 1110-1116 (2014)
24. Wongkongkathep, P., Li, H. L., Zhang, X., Loo, R. R. O., Julian, R. R., Loo, J. A.: Enhancing protein disulfide bond cleavage by UV excitation and electron capture dissociation for top-down mass spectrometry. Int J Mass Spectrom 390, 137-145 (2015)
25. Wells, J. M., McLuckey, S. A.: Collision-induced dissociation (CID) of peptides and proteins. Method Enzymol 402, 148-185 (2005)
26. Ganisl, B., Breuker, K.: Does Electron Capture Dissociation Cleave Protein Disulfide Bonds? Chemstryopen 1, 260-268 (2012)
27. Zhang, J., Loo, R. R. O., Loo, J. A.: Increasing fragmentation of disulfide-bonded proteins for top-down mass spectrometry by supercharging. Int J Mass Spectrom 377, 546-556 (2015)
28. Hoffmann, W. D., Jackson, G. P.: Charge Transfer Dissociation (CTD) Mass Spectrometry of Peptide Cations Using Kiloelectronvolt Helium Cations. J Am Soc Mass Spectr 25, 1939-1943 (2014)
29. Cook, S. L., Collin, O. L., Jackson, G. P.: Metastable atom-activated dissociation mass spectrometry: leucine/isoleucine differentiation and ring cleavage of proline residues. J Mass Spectrom 44, 1211-1223 (2009)

Example 6: Charge Transfer Dissociation (CTD) of Phosphocholines: Gas-Phase Ion/Ion Reactions Between Helium Cations and Phospholipid Cations

INTRODUCTION

Lipids are essential components of cellular membranes in living cells [1, 2]. In addition to serving as a "container" for the cell, lipids also show remarkable involvement in a 5-% range of lipid-lipid and lipid-protein interactions, thus acting as key players with distinctive biochemical roles and biophysical properties [3]. A detailed description of all lipids and their functions at the cellular level would greatly facilitate the understanding of signaling, lipid metabolism, and membrane vesicle trafficking. However, the full structural characterization and quantitation of all lipids in a given system remains a formidable challenge to biochemists [4].

Mass spectrometry (MS) has emerged as an indispensable analytical tool for the structural characterization of lipids. Soft ionization techniques, such as electrospray ionization (ESI) [4] and matrix-assisted laser desorption/ionization (MALDI) [5], help ionize lipids in their native states, without requiring derivatization and without causing decomposition, thereby enabling the unequivocal determination of molecular weights. These soft ionization techniques are typically used in conjunction with tandem mass spectrometry (MS/MS) to provide structural detail and to help resolve constitutional isomers. Low energy collision-induced dissociation (CID) is the most prevalent MS/MS technique, and it has been employed for the structural analysis of a wide variety of lipid classes, including sphingomyelin (SM) [6], phosphatidylglycerol (PG) [7], glycerophosphoethanolamine (GPE) [8], glycerophosphocholine (GPC) [9], and glycerophosphatidic acid (GPA) [10].

Low-energy collisional activation of lipids mainly produces fragments corresponding to the loss of entire fatty acyl substituents (neutral ketenes and fatty acids), and is thus not informative enough for full structure characterization [11]. To enhance the amount of obtainable structural information, a variety of MS/MS techniques have been explored as the alternative for the structural interrogation of lipids, including high-energy (HE) CID [12, 13], ion/molecule reactions such as Paternò-Büchi reactions [14], OzESI/OzlD [15-20]), ion/ion reactions [21, 22], ion/photon reactions (e.g. UVPD [23], IRMPD [24]), electron-based reactions (e.g. ETD [25], EIEIO [26], EID [27, 28]) and radical-directed dissociation (RDD) [29, 30].

In OzESI/OzlD, the exposure of unsaturated lipids to ozone molecules results in an ozonide, which then dissociates into fragment ion pair(s) with diagnostic mass separation that enables an unambiguous identification of sites of unsaturation [16, 17]. McLuckey, Blanksby and coworkers have sown that gas-phase ion/ion reactions can be used to convert lipid cations into their anion form, thereby providing incredible selectivity toward certain lipid classes [21, 22]. When combined with low energy CID, ion/ion reactions could provide enhanced structural information, such as acyl chain lengths and degrees of unsaturation [21, 22]. Whereas the current state of the art in tandem mass spectrometry has a variety of approaches to target certain functional groups and chemistries, the communities interested in lipid characterization and lipidomics would stand to benefit from additional, complementary or more-universal approaches to tandem mass spectrometry.

Charge transfer dissociation (CTD) is a possible alternative to the aforementioned MS/MS techniques, which proceeds via exposure of gas-phase precursor cations to a kiloelectronvolt beam of helium cations [31]. Upon the interaction with helium cations, peptide cations decompose via radical-driven pathways that are significantly different from low energy CID but analogous to other high-energy fragmentation methods [31]. CTD has the ability to increase the number of positive charges on a precursor ion and is workable with singly charged precursor ions, unlike ETD and ECD.

In this example, the utility of CTD as a means of structural characterization for phosphatidylcholines is demonstrated. Helium-cation irradiation of protonated lipids produces highly extensive cleavage along lipid acyl chains (i.e. POPC, PSPC) and charge-increased ion series for lipids containing multiply carbon-carbon (CC) double bonds (i.e. 9E- and 9Z-DOPC). The 12 Da peak spacing feature and ratio change in fragment ion intensity in the vicinity of CC double bond observed in CTD spectra are closely related to the position and geometry of CC double bond(s), which leads toward a near-complete characterization of lipid structures.

Experimental

Instrumentation:

All mass spectra (CID, CTD and MAD) were collected on a Bruker amaZon ETD mass spectrometer (BrukerDaltronics, Bremen, Germany), which has been modified to perform lipid cation/helium cation or lipid cation/metastable atom reactions. Installation of saddle field fast ion/fast atom source (VSW/Atomtech, Macclesfield, UK), connection between electronic components and working principle are highly analogous to those described for Thermo Fisher LTQ Velos Pro instrument [31] and experimental setup of MAD-MS [32].

Materials:

All the lipids used in this experiment were purchased from Avanti Polar Lipids (Alabaster, Ala.). The involved lipids and their shorthand designations are as follows: 1-hexadecanoyl-2-octadecanoyl-sn-glycero-3-phosphocholine (PSPC, 16:0/18:0), 1-hexadecanoyl-2-(9Z-octadecenoyl)-sn-glycero-3-phosphocholine (POPC, 16:0/18:1 (9Z)), 1,2-di-(9E-octadecenoyl)-sn-glycero-3-phosphocholine (9E-DOPC, 18:1/18:1(9E,9E)), 1,2-di-(9Z-octadecenoyl)-sn-glycero-3-phosphocholine (9Z-DOPC, 18:1/18:1(9Z, 9Z)), 1,2-di-(5Z,8Z, 11Z,14Z-eicosatetraenoyl)-sn-glycero-3-phosphocholine (DAPC, 20:4/20:4), and sphingomyelin (SM, d18:1/18:0). Lipid analytes were prepared at a concentration of ~60 μM in a solution of 49.5/49.5/1 (v/v/v) methanol/water/acetic acid prior to positive electrospray ionization (ESI).

Method:

Each lipid solution was continuously infused into the ESI source with an electronic syringe pump (#1725, Hamilton Company Reno, Nev., NV) at a flow rate of 160 μL/h. The skimmer was at ground potential and the electrospray needle was set at 4.5 kV. The temperature of the heated capillary was 220° C. The $[M+H]^+$ or $[M+Na]^+$ ions were mass-selected using an isolation window of 1.0 or 4.0 Da depending on the need for isotope information. The saddle field ion source was only switched on during an $MS^2$ scan function in which the isolated ions were stored at a desired low mass cut-off (e.g. 150) with the excitation amplitude set to zero. A 6 kV square wave with a pulse width of 25 ms was supplied to the saddle field ion source for the generation of reagent helium cations (or metastable helium). The helium flow was controlled via a variable leak valve, and the pressure read-out was obtained from pressure monitor of the ion trap gauge in the main vacuum region. Using this indirect measurement, the helium gas supply was adjusted to provide a reading of $\sim 1.20\times10^{-5}$ mbar for all the experiments, which was barely above the base pressure of $\sim 8\times10^{-6}$ mbar. A typical low mass cut off (LMCO) value of m/z 150 was used for the removal of ionized residual background compounds. All the mass spectra (CID, CTD and MAD) were accumulated in the profile mode, with up to 4 minutes of averaging to improve the signal-to-noise ratio (S/N).

Figure 31A:
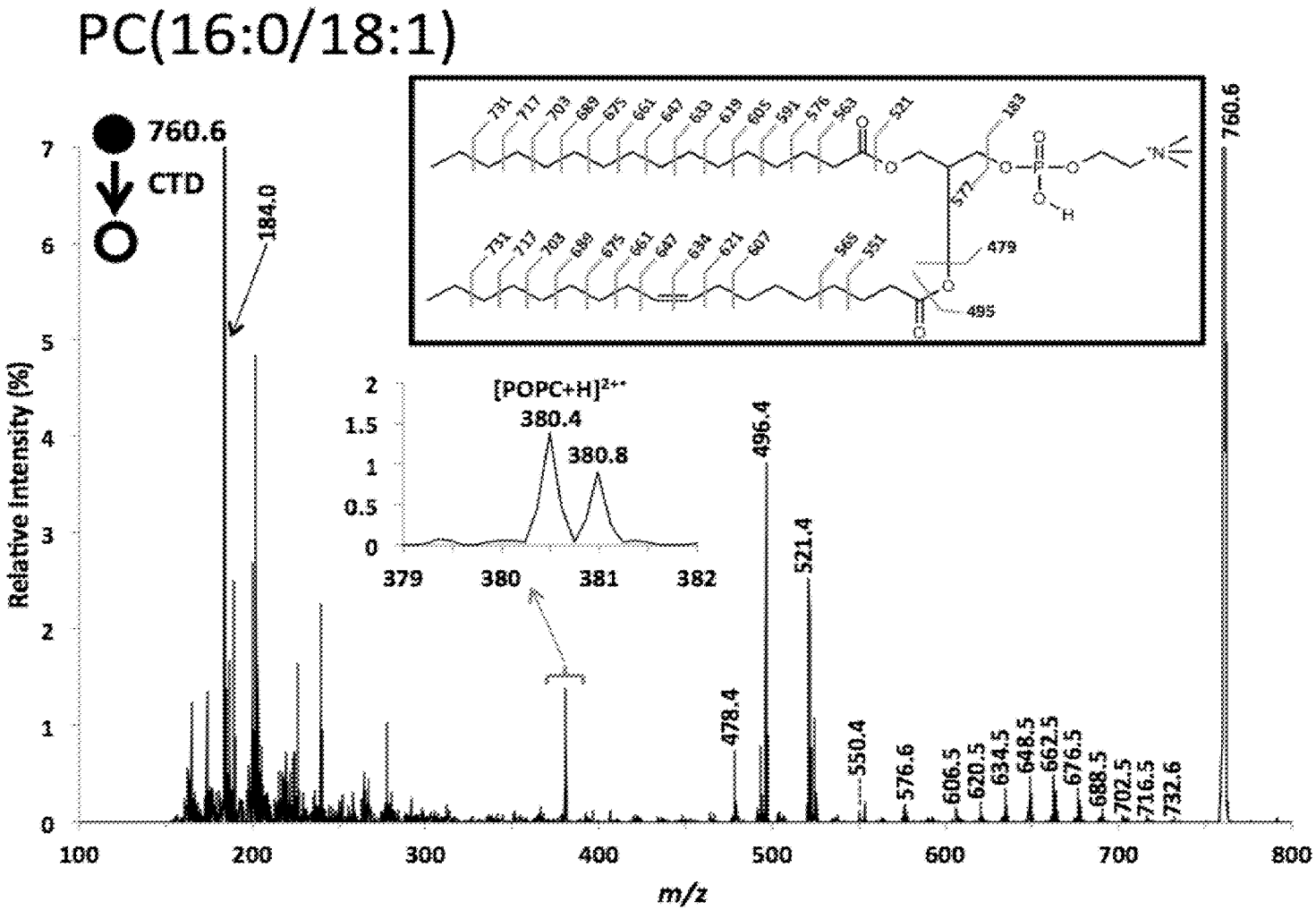
FIGS. 31A-31C show (FIG. 31A) a CTD spectrum of $[POPC+H]^+$ (16:0/18:1), (FIG. 31B) a MAD spectrum of $[POPC+H]^+$ (16:0/18:1), and (FIG. 31C) a CID spectrum of $[POPC+H]^+$ (16:0/18:1). The diagram insets in each figure show possible cleavages and theoretical masses for fragmentations without hydrogen rearrangements.
Figure 31B:
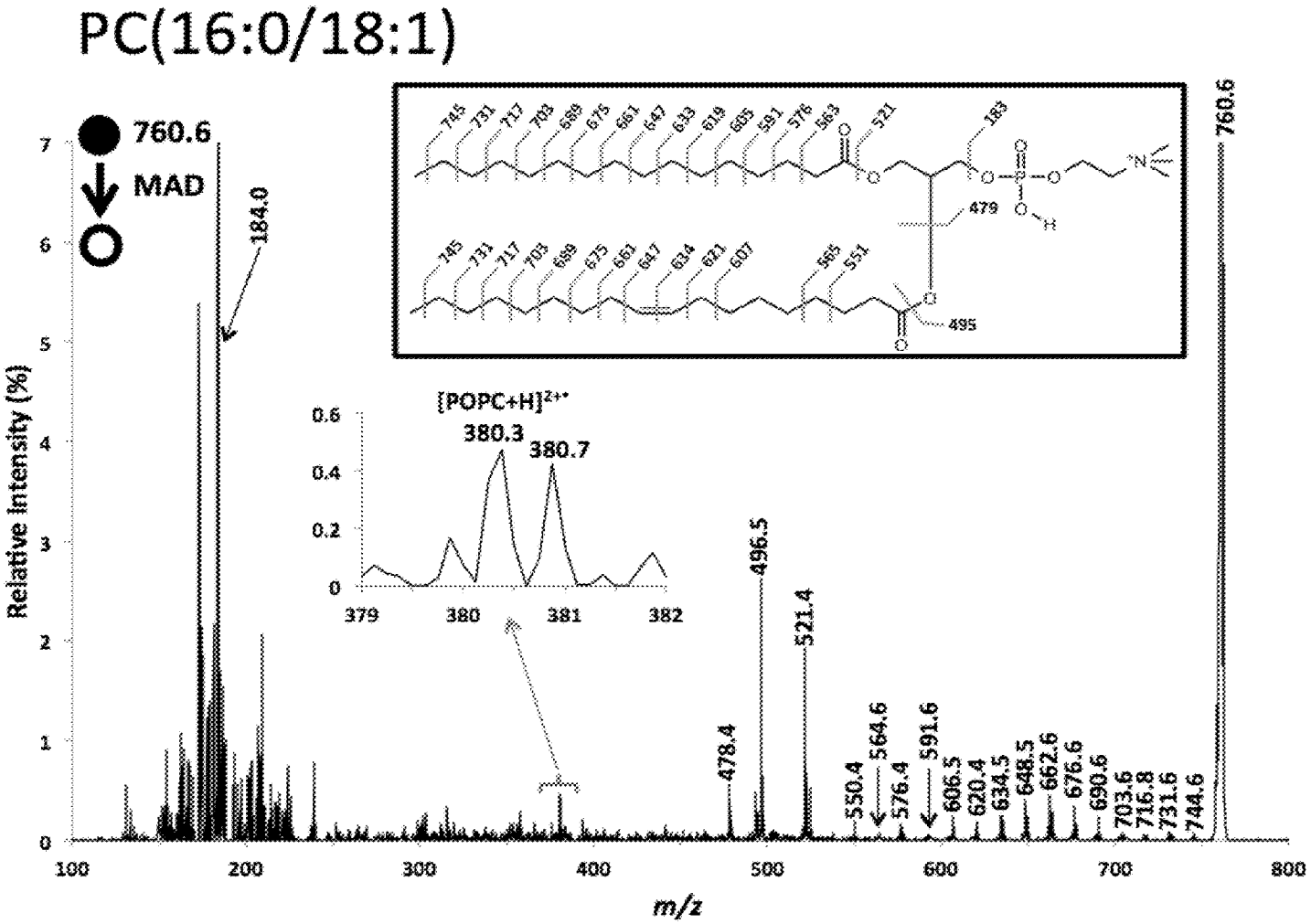
Figure 31C:
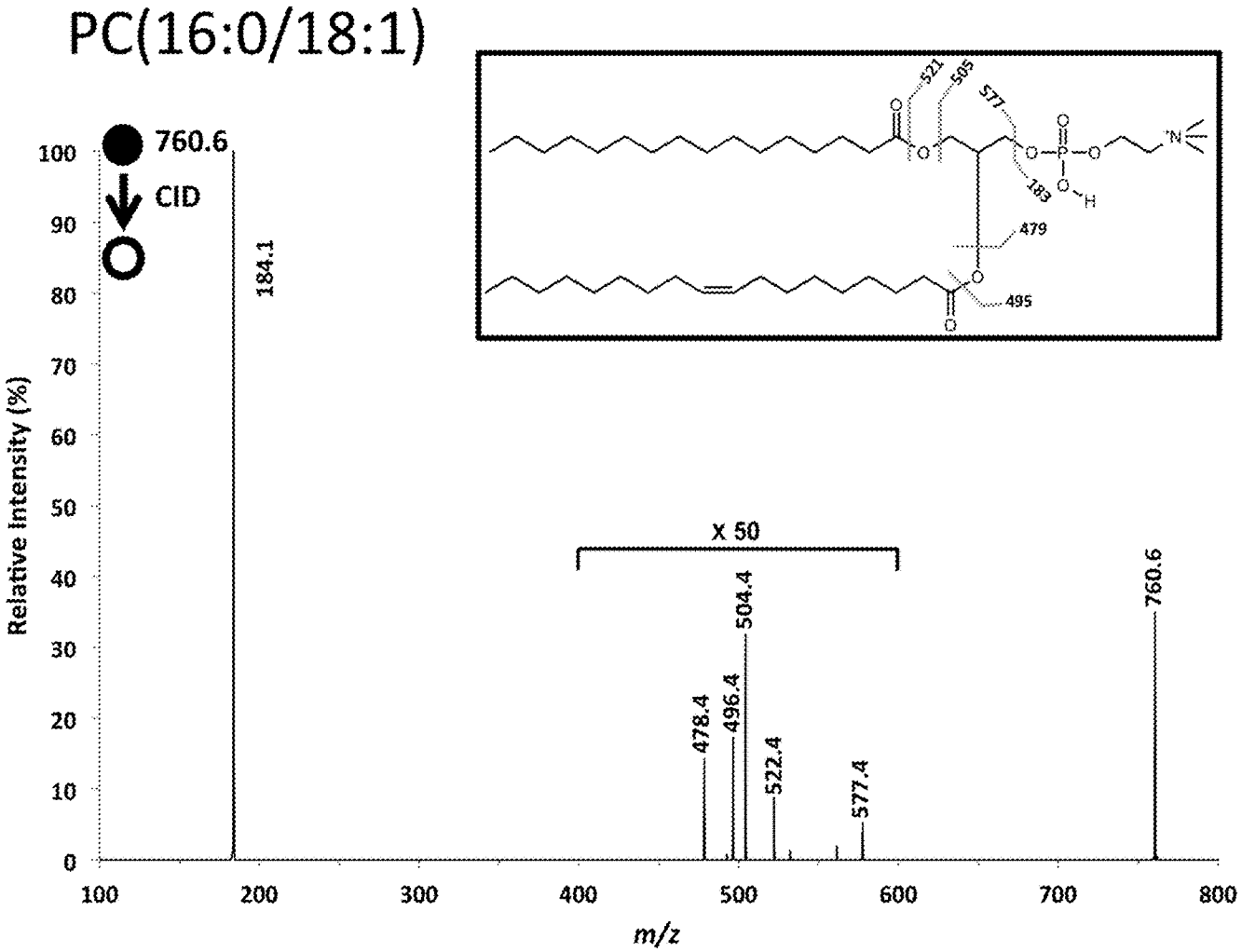

Results:

FIGS. 31A-31C show (FIG. 31A) a CTD spectrum of $[POPC+H]^+$ (16:0/18:1), (FIG. 31B) a MAD spectrum of $[POPC+H]^+$ (16:0/18:1), and (FIG. 31C) a CID spectrum of $[POPC+H]^+$ (16:0/18:1). The diagram insets in each figure show possible cleavages and theoretical masses for fragmentations without hydrogen rearrangements.

Helium irradiation of protonated POPC results in a range of fragments, as shown in FIG. 31A. The CTD spectrum looks generally similar to the MAD spectrum (FIG. 31B), but both greatly differ from traditional CID (FIG. 31C) [11] or electron ionization (EI) spectra [33, 34]. All fragmentation methods give a dominant fragment ion at m/z 184.0, which is a diagnostic fragment of the phosphocoline head group [35, 36]. The CTD spectrum also shows a doubly charged fragment at m/z 380.4, which corresponds to the charge exchange product $[POPC+H]^{2+}$., which is similar to the Penning ionized product ion observed in MAD [36]. CTD shows three fragments at m/z 478.4, m/z 496.4 and m/z 521.4, which are associated with entire acyl chain losses. These fragments resemble closely the MAD fragmentation pattern, but greatly differ from that of CID. CTD also shows an extensive dissociation along two acyl chains (ranging from m/z 550 to m/z 732), which is also similar to MAD.

Figure 32A:
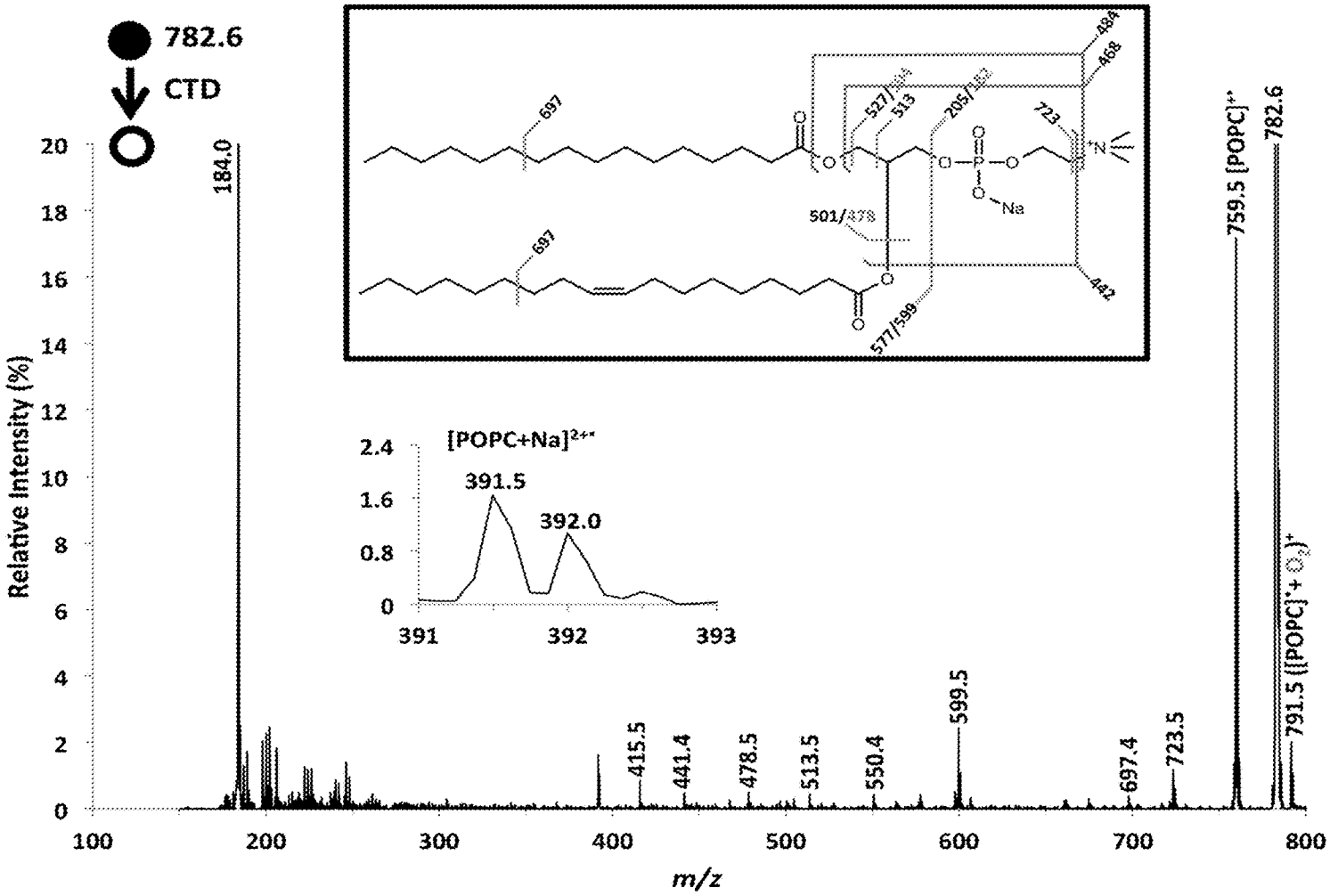
FIGS. 32A-32C show (FIG. 32A) a CTD spectrum of [POPC+Na]+ (16:0/18:1)
Figure 32B:
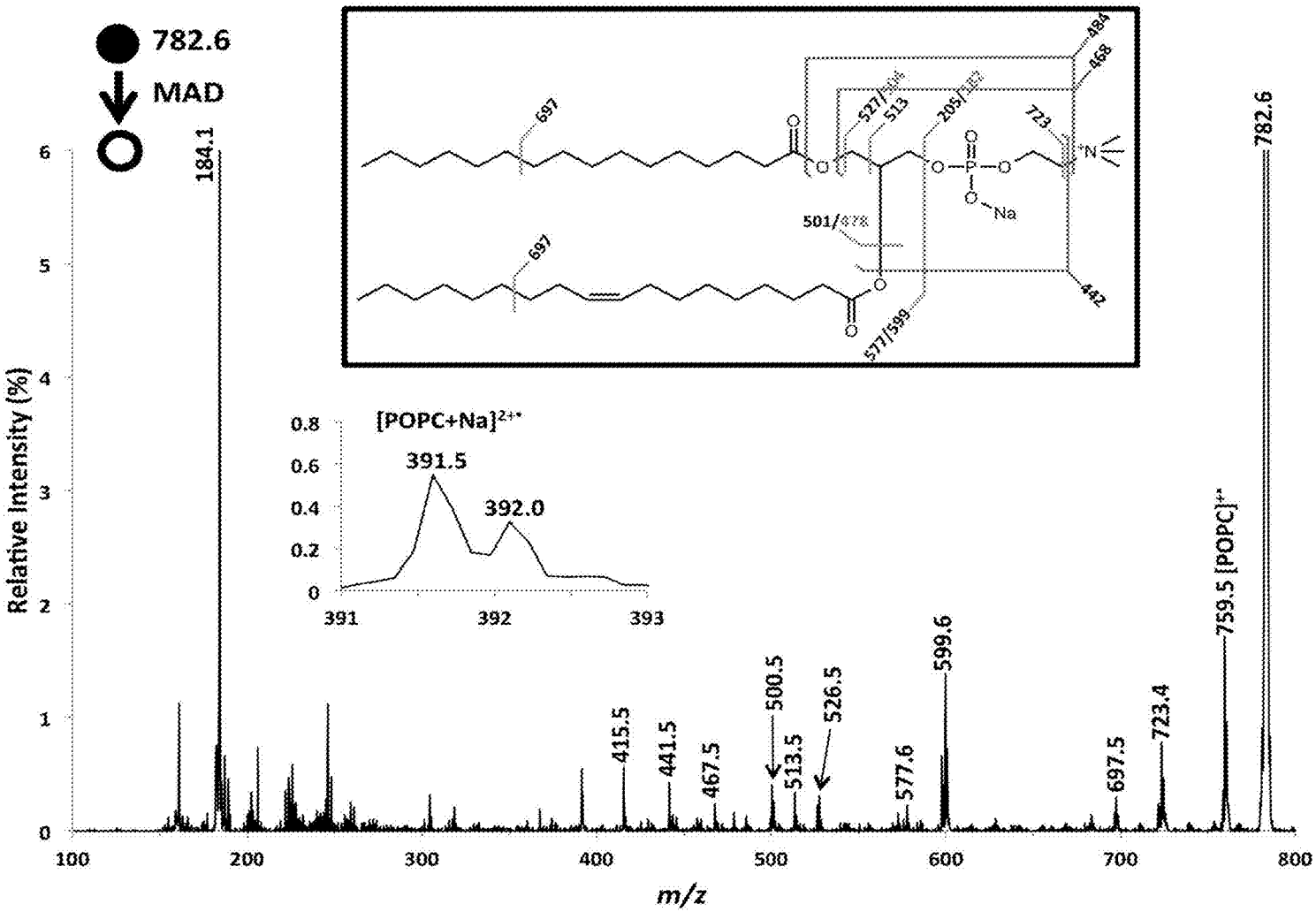
Figure 32C:
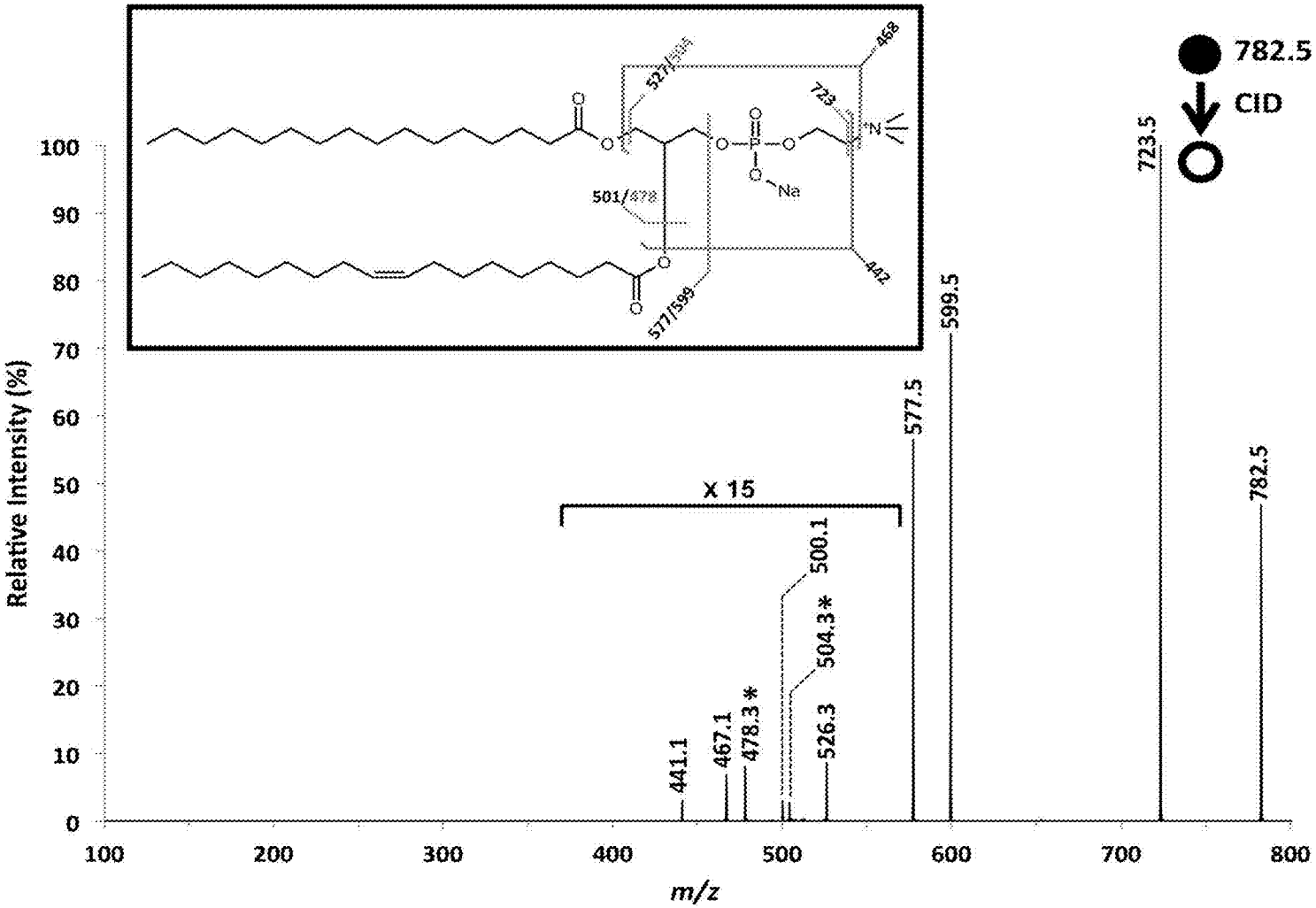
Figure 34A:
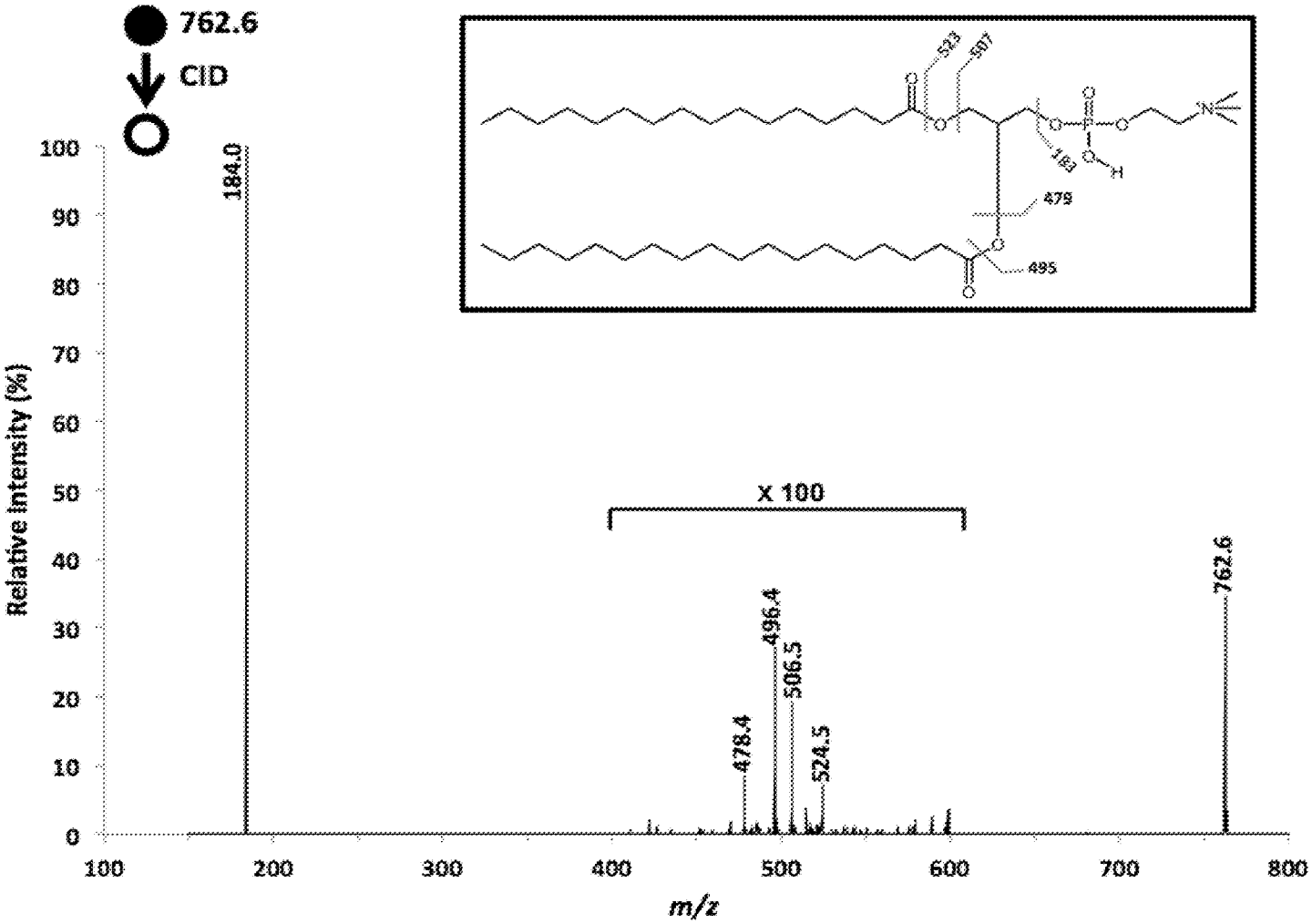
FIGS. 34A-34B show (FIG. 34A) a CID and (FIG. 34B) a CTD spectra of $[PSPC+H]^+$ (16:0/18:0).
Figure 34B:
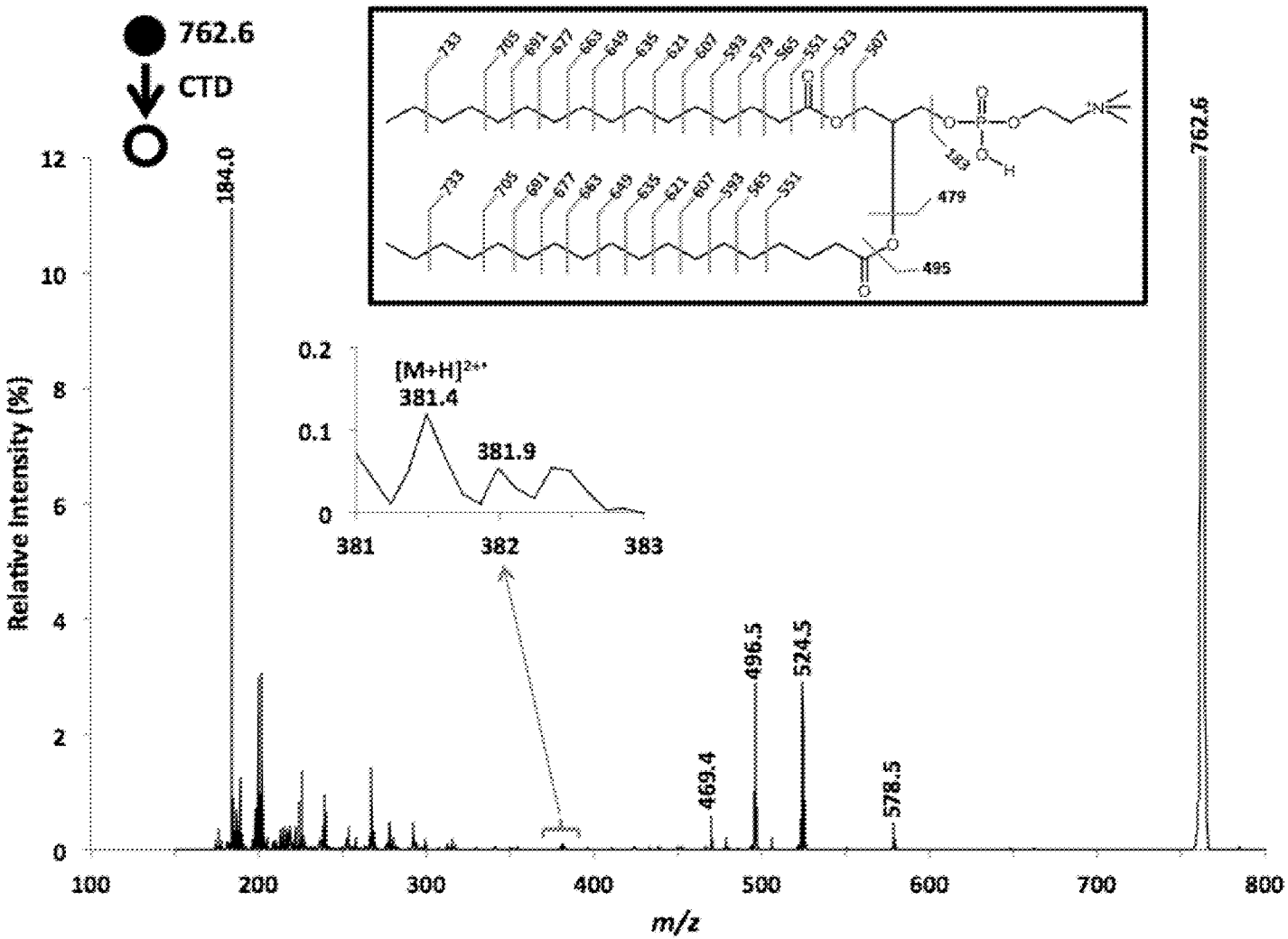

Helium-CTD of sodiated POPC produces a fragmentation pattern that highly resembles that of MAD spectrum of $[POPC+Na]^+$, as shown in FIGS. 32A-32C. In addition to phosphocoline head group fragment at m/z 184.0 and ionized species ($[M+Na]^{2+}$.) at m/z 391.5, a variety of fragments related to cleavages of glycerol backbone and its vicinity were observed, including the loss of one unit, such as $N(CH_3)_3$ (m/z 723.5), entire head group (m/z 599.5) and sn-1/sn-2 acyl chains (m/z 526.5 or m/z 500.5); simultaneous loss of two units, such as m/z 441.4 and m/z 467.5. The cleavage of $C_1$-$C_2$ bond within the glycerol backbone at m/z 513.5 was observed, which is only observed in CTD and MAD spectra. FIGS. 34A-34B show (FIG. 34A) CID and (34B) CTD spectra of $[PSPC+H]^+$ (16:0/18:0).

The said resemblances and differences indicate the CTD process could involve both CID-like (even-electron rearrangement) fragmentation pathways and MAD-like (radical-induced) fragmentation pathways [36].

It is not surprising to observe discrepancy between CTD spectra of protonated POPC and that of sodiated POPC. Different adduct form leading to distinct dissociation patterns has also been observed in low energy CID [6, 9, 11] and post source decay (PSD) experiments [5]. The distinction in PSD spectra for the two adduct forms was attributed to the different binding of $H^+$ and $Na^+$ to lipid head group, which results in differential fragmentation propensities, as was proposed in ref. [5].

Figure 36A:
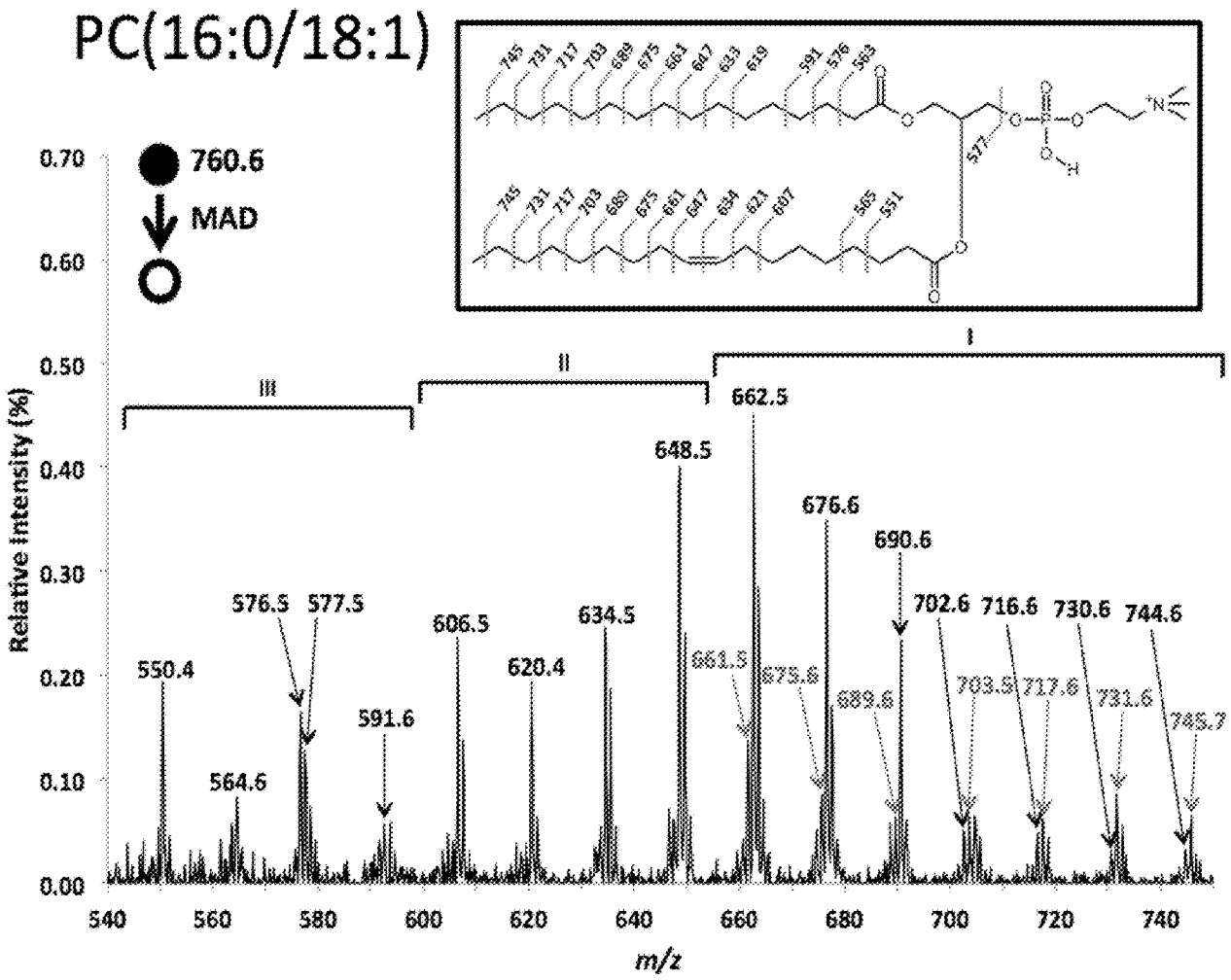
FIGS. 36A-36C show zoomed-in regions from m/z 540-750.
Figure 36B:
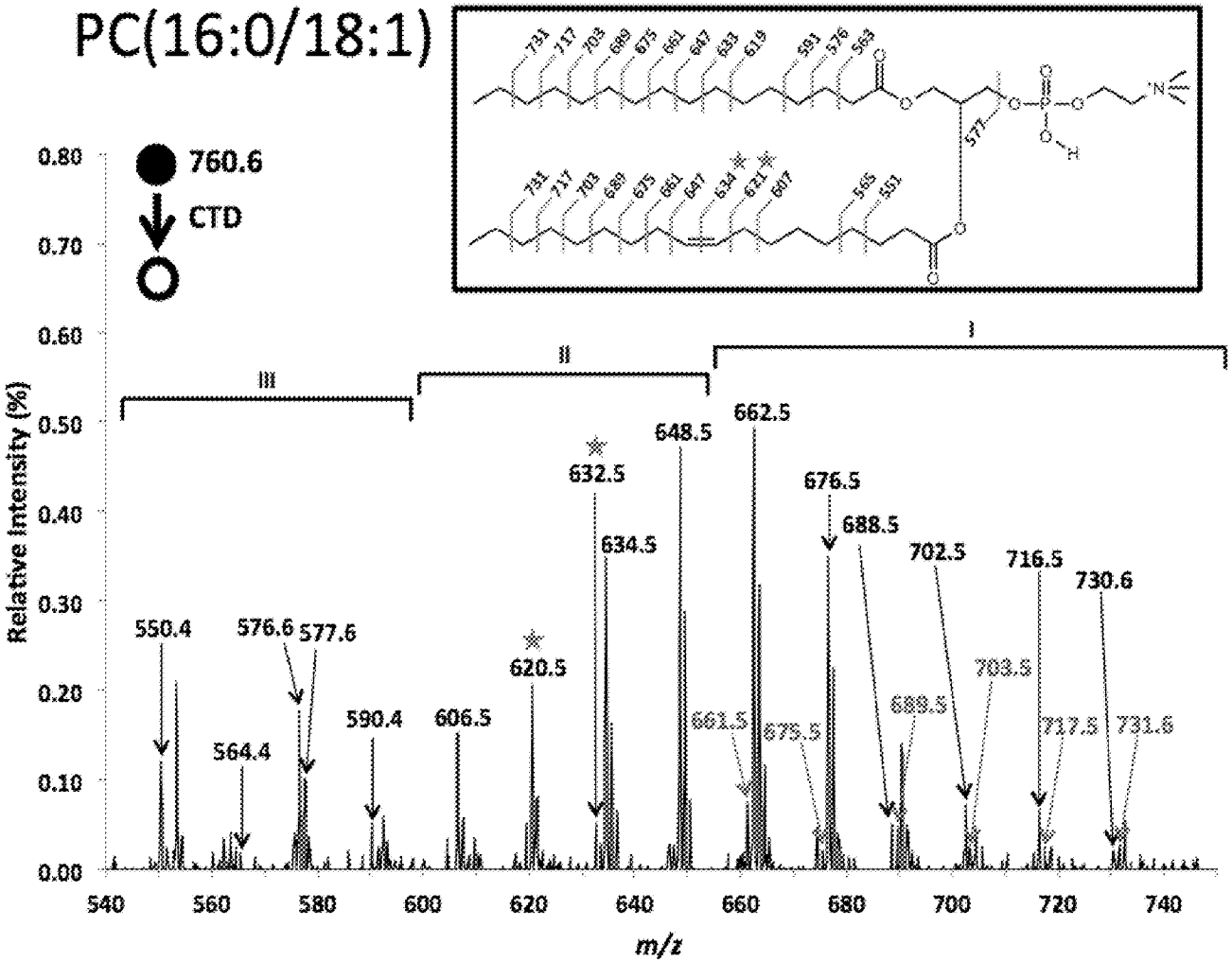
Figure 36C:
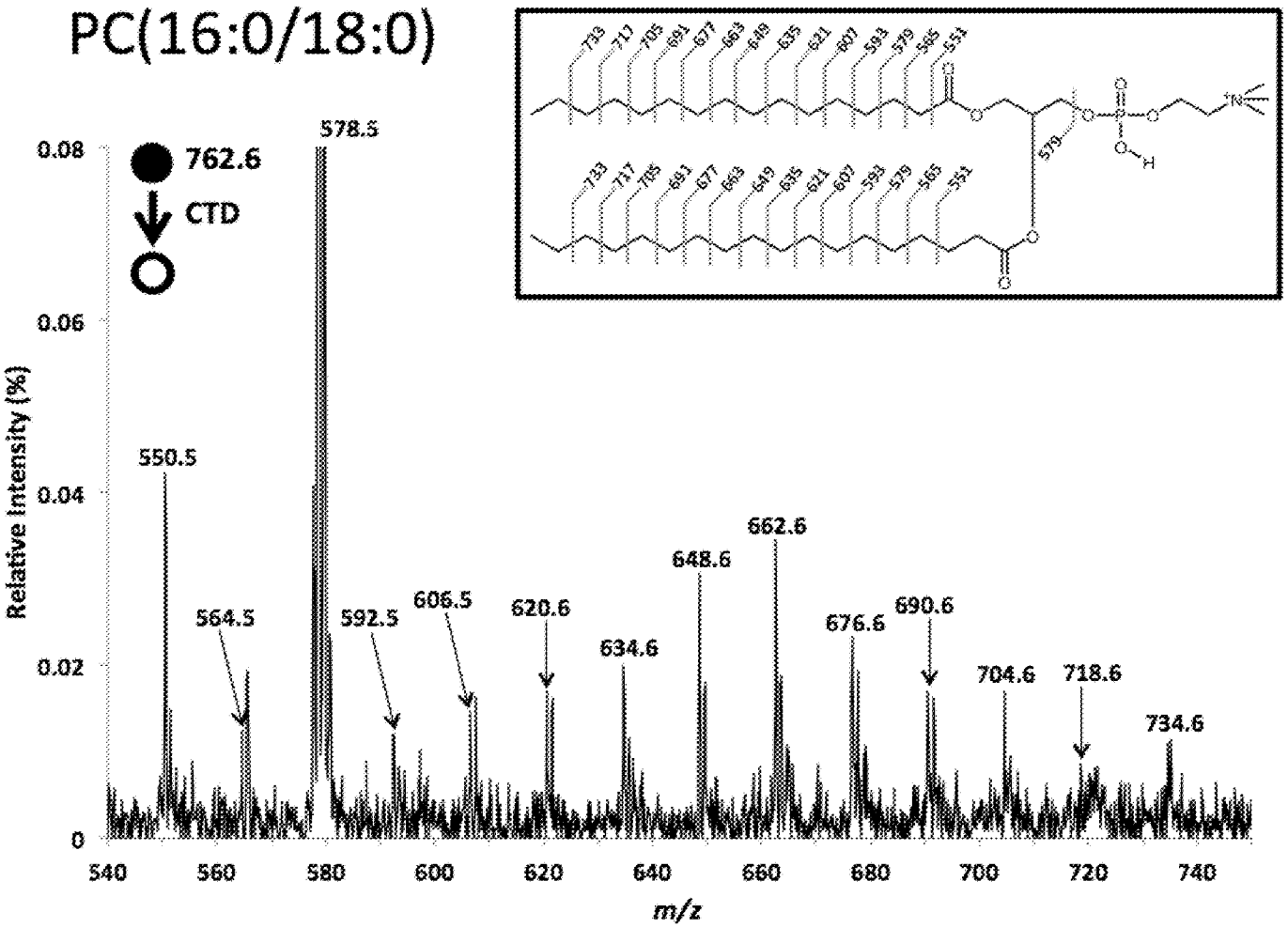

FIGS. 33A-33D show zoomed-in regions from m/z 470-540: (FIG. 33A) MAD spectrum of $[POPC+H]^+$ (16:0/18:1); (FIG. 33B) CTD spectrum of $[POPC+H]^+$ (16:0/18:1); (FIG. 33C) CTD spectrum of $[PSPC+H]^+$ (16:0/18:0) with a precursor isolation window width=4.0; (FIG. 33D) CTD spectrum of $[PSPC+H]^+$ (16:0/18:0) with a precursor isolation window width=1.0. A more detailed comparison between CTD and MAD spectra of $[POPC+H]^+$ is given using the zoomed-ins in FIGS. 33A-33B, and FIGS. 36A-36B. FIGS. 36A-36C show zoomed-in regions from m/z 540-750: (FIG. 36A) MAD spectrum of $[POPC+H]^+$ (16:0/18:1); CTD spectra of (FIG. 36B) $[POPC+H]^+$ (16:0/18:1) and (FIG. 36C) $[PSPC+H]^+$ (16:0/18:0). The green font shows the $C_nH_{2n+1}$.-type losses.

Figure 33A:
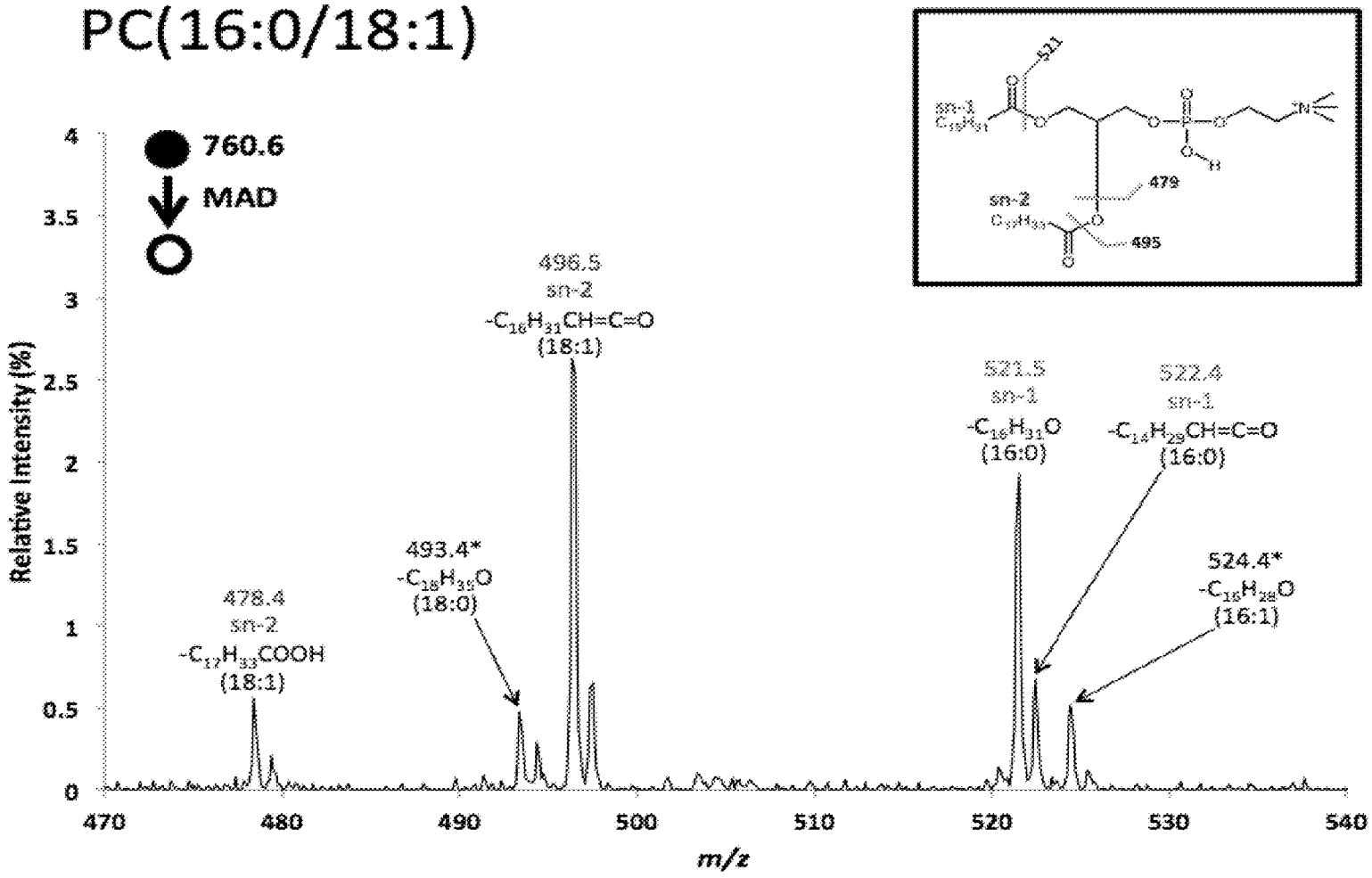
FIGS. 33A-33D show zoomed-in regions from m/z 470-540.
Figure 33B:
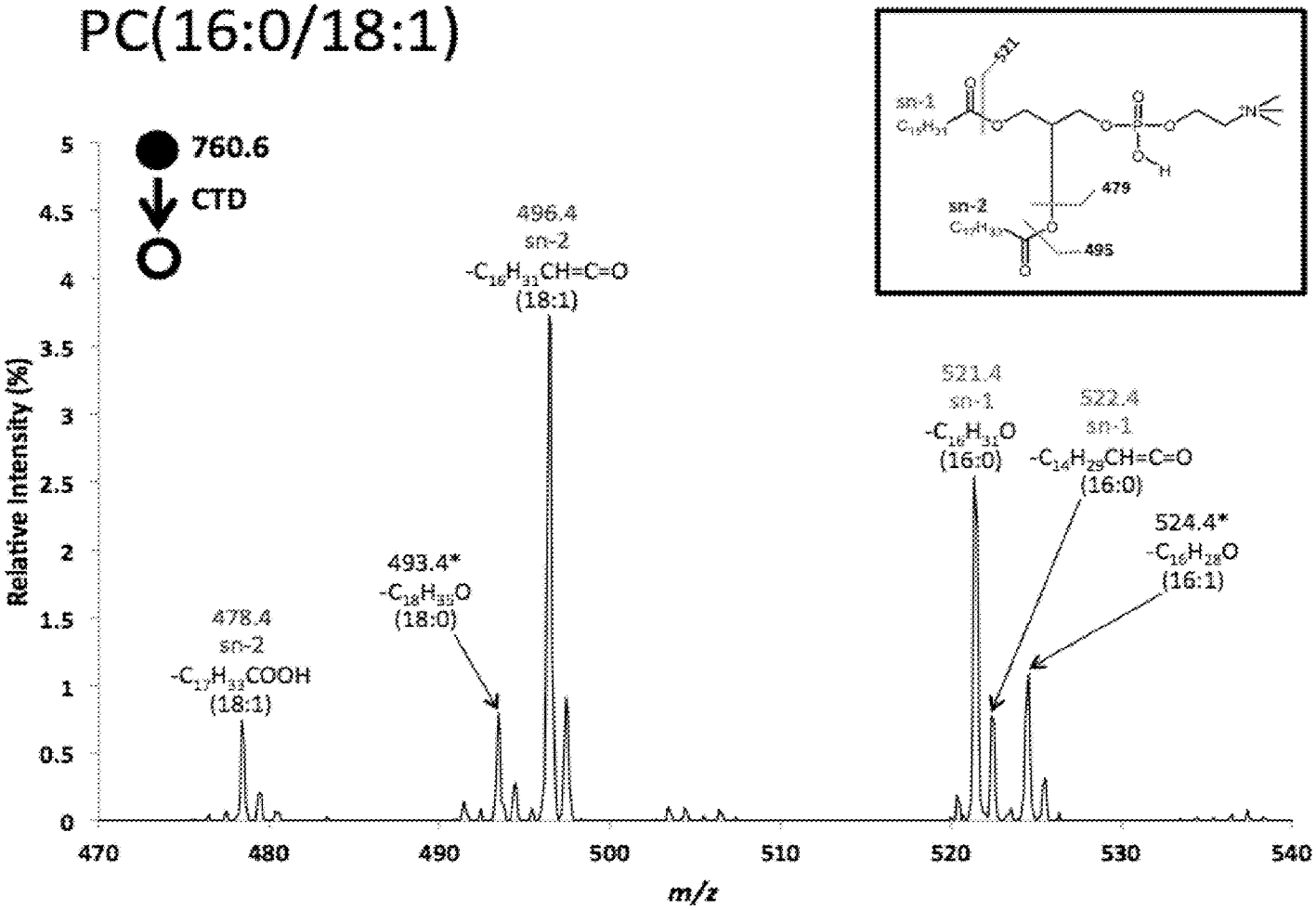

CTD spectrum of $[POPC+H]^+$ shows great resemblance to MAD spectrum in the region from m/z 470-540 (FIGS. 33A-33B). The common features include neutral ketene losses at m/z 522 (sn-1) and m/z 496 (sn-2), as well as elimination of sn-2 fatty acid at m/z 478 [36]. Since the same batch of purchased POPC sample was used for both MAD and CTD experiments, the same set of contamination peaks at m/z 493.4 (loss of C(18:0) chain) and m/z 524.4 (loss of C(16:1) chain) were observed [36], possibly originating from the isomerization of POPC during its synthesis process [26, 37]. FIGS. 33A-33B can be both compared with FIG. 33C for the visualization of the fragment reflecting the C(18:0) acyl chain loss. Spectrum in FIG. 33D was collected as a replica of FIG. 33C, but with a much narrower isolation window (width=1.0). The exclusion of $^{13}C$ contribution helps confirm the peak assignments in FIG. 33C.

Figure 33C:
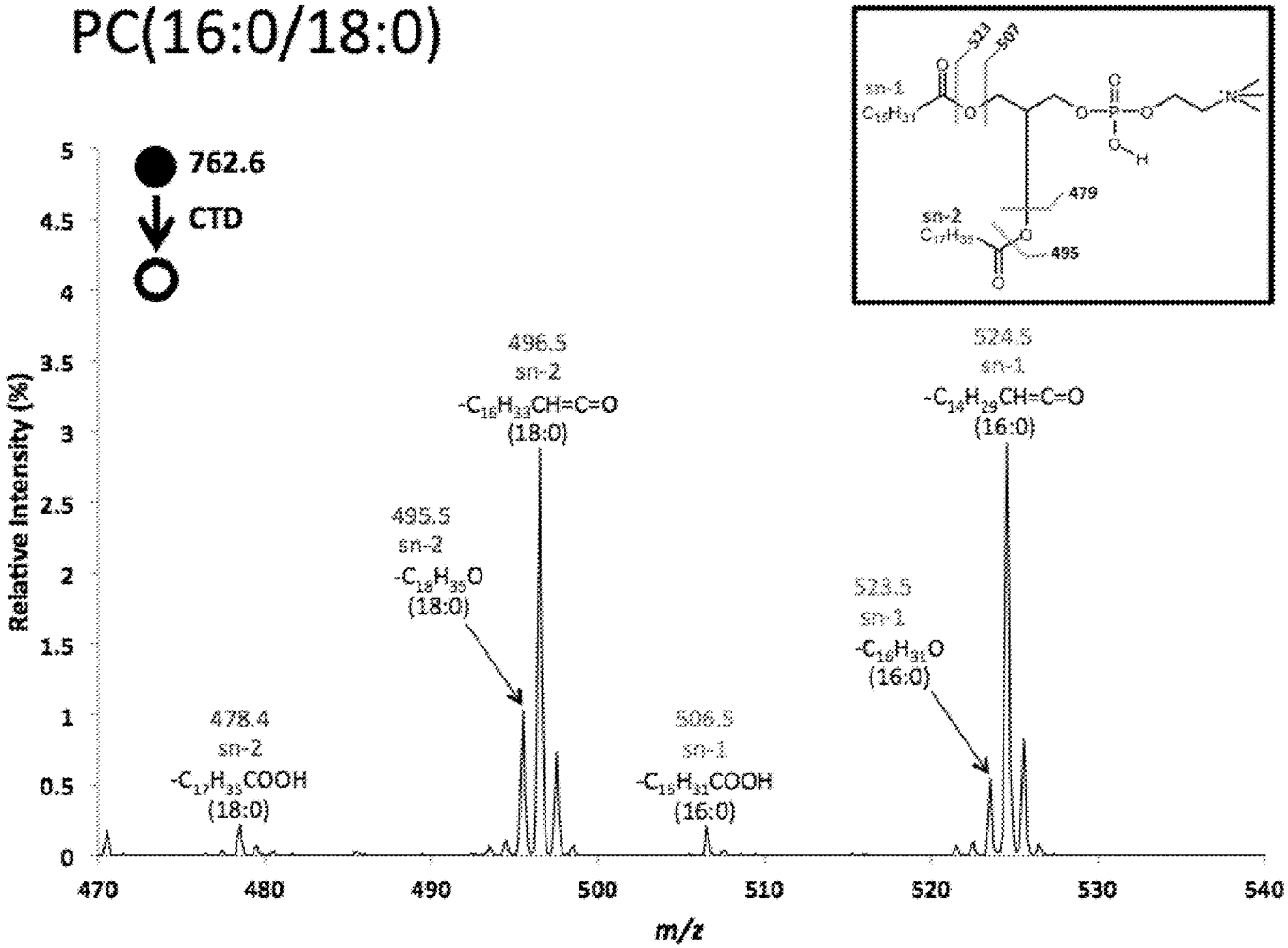
Figure 33D:
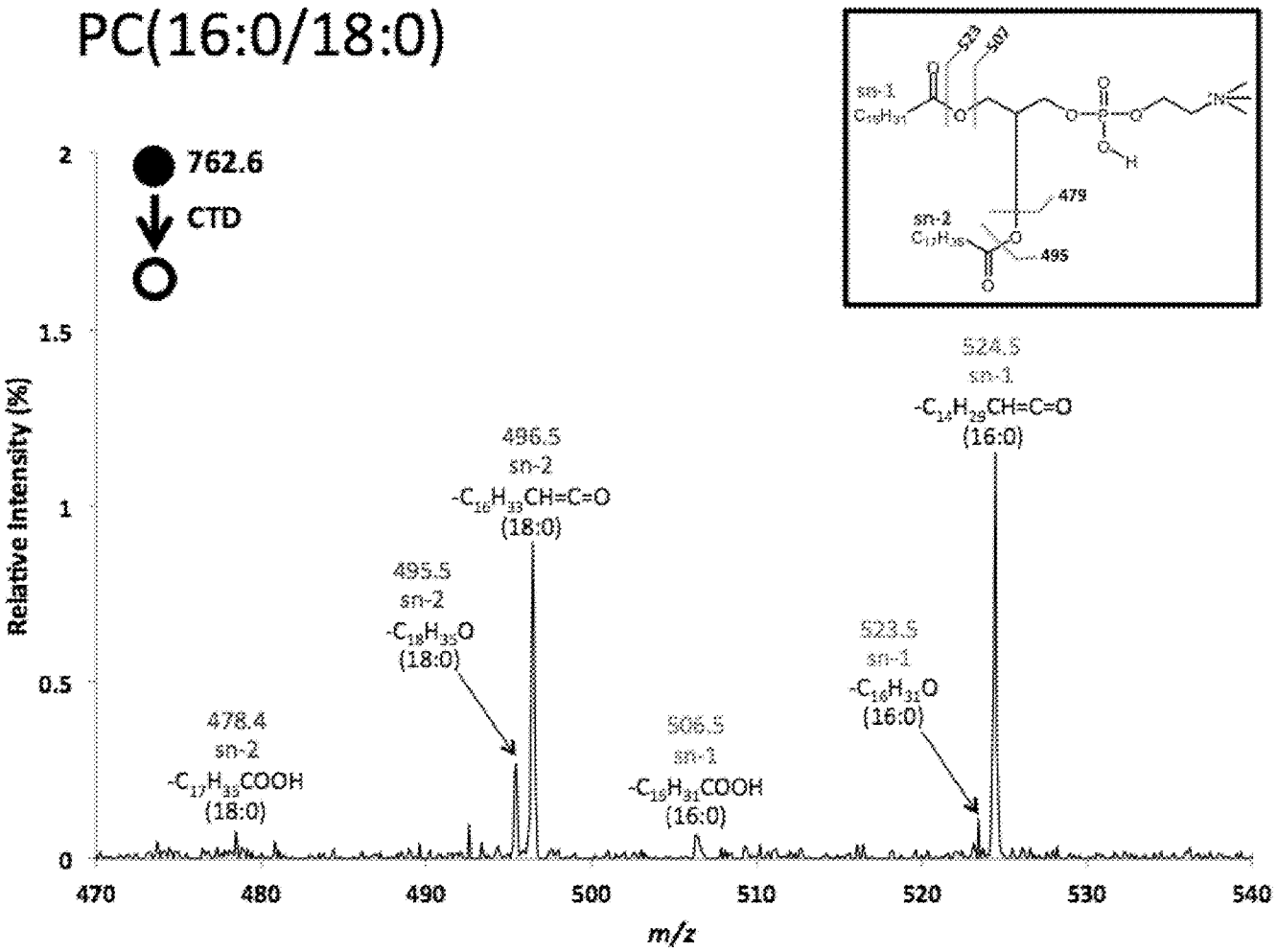
Figure 35:
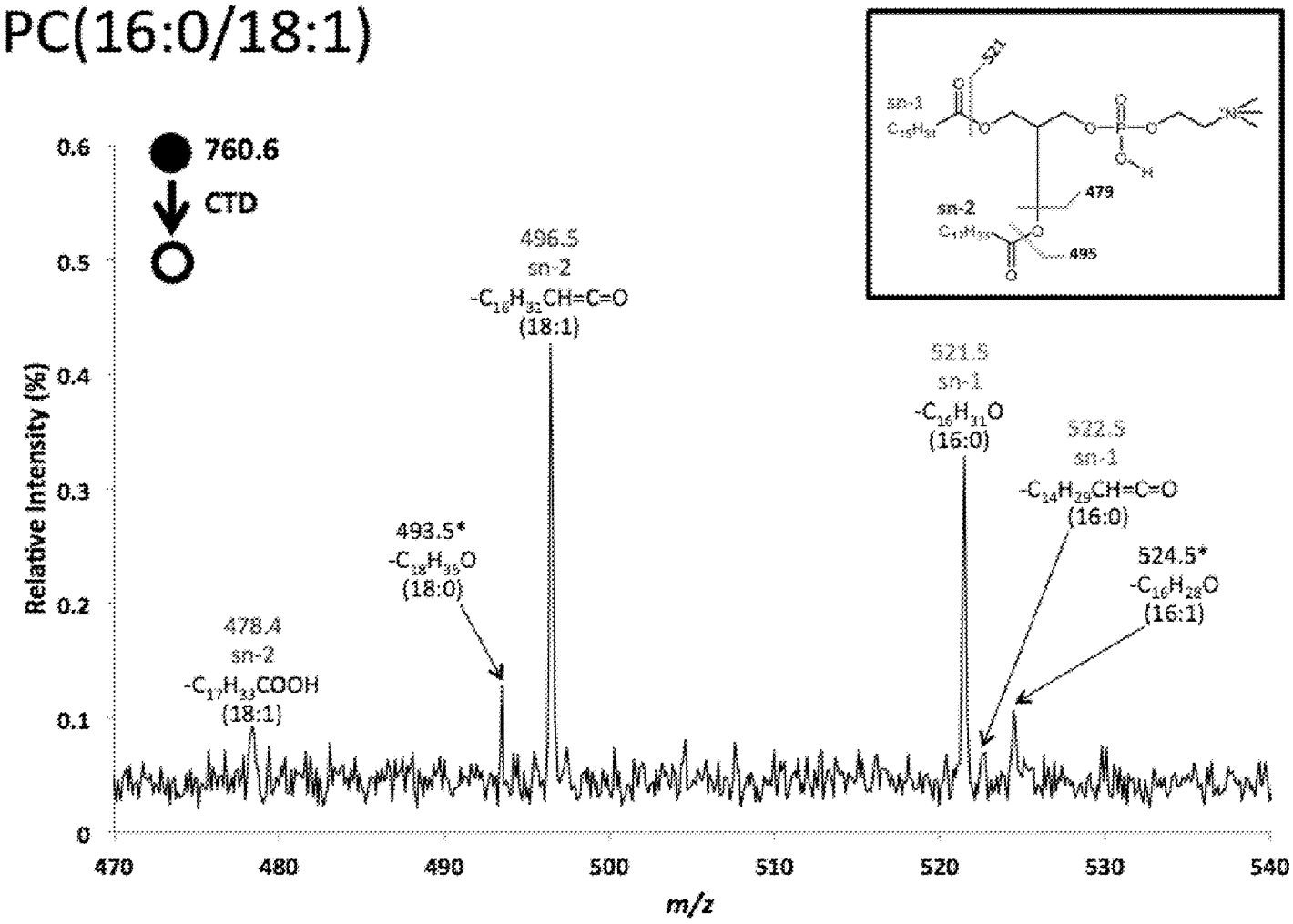
FIG. 35 shows a zoomed-in region from m/z 470-540 of CTD spectrum of $[POPC+H]^+$ (16:0/18:1) with an isolation window width of 1.0 Da.
Figure 55A:
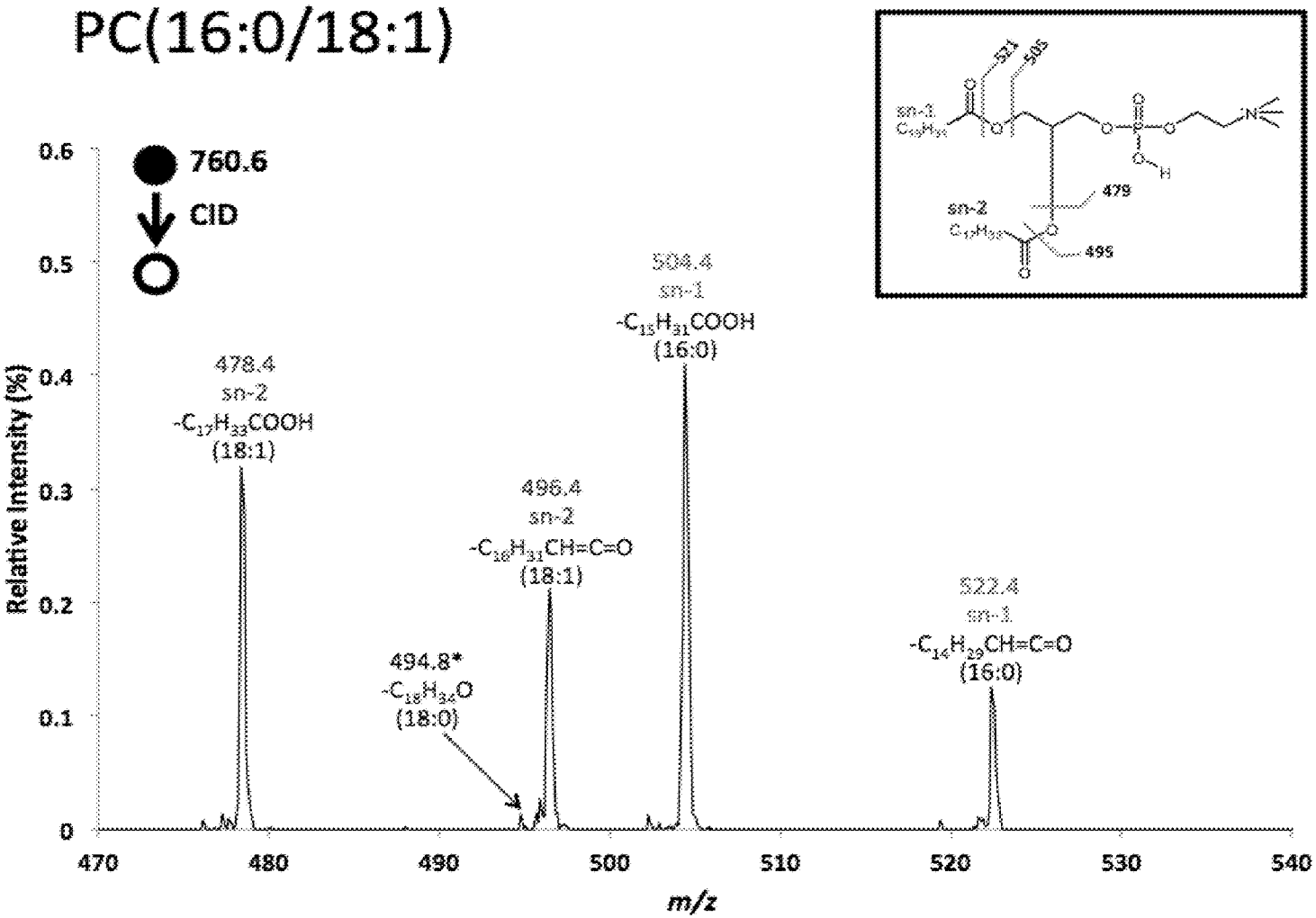
FIGS. 55A-55B show zoomed-in regions from m/z 470-540 of CID spectra of (FIG. 55A) $[POPC+H]^+$ (16:0/18:1) and (FIG. 55B) $[PSPC+H]^+$ (16:0/18:0).
Figure 55B:
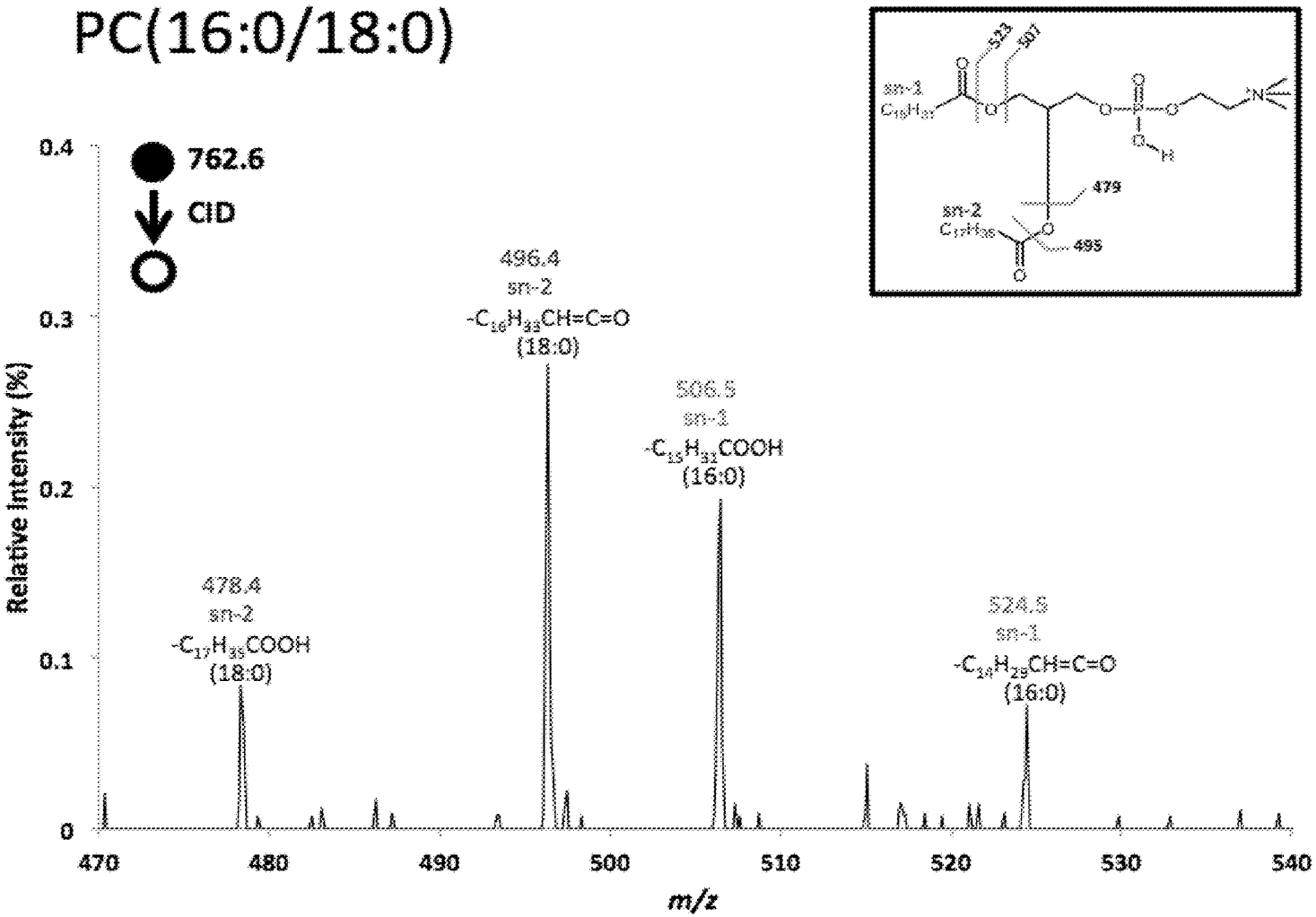

FIGS. 55A-55B show zoomed-in regions from m/z 470-540 of CID spectra of (FIG. 55A) $[POPC+H]^+$ (16:0/18:1) and (FIG. 55B) $[PSPC+H]^+$ (16:0/18:0). Different from CID spectrum of PSPC (FIG. 55B), CTD spectrum in FIG. 33C shows two sets of fragments associated with sn-1/sn-2 ketene losses: odd-electron fragments at m/z 495.5 and m/z 523.5, as well as even-electron fragments at m/z 496.5 and m/z 524.5. For both POPC and PSPC, CTD spectra show preferential neutral ketene loss over neutral fatty acid loss, which significantly differs from CID spectrum (FIG. 35) but resembles EID spectrum [28].

As for the even-electron fragments in FIG. 33C, CTD doesn't show a distinctive preference in the formation of m/z 496 (sn-2 ketene loss) or m/z 522/524 (sn-1 ketene loss), compromising its ability in the differentiation between sn-1/sn-2 ketene losses. This is different from CID, which preferentially produces sn-2 ketene loss over sn-1 ketene loss (m/z 496>m/z 522 or 524) (FIG. 35) and has been utilized for the identification of sn-1/sn-2 positional isomers [11]. Contrary to the above phenomenon, J. Jones et al observed an opposite trend in the EID fragmentation of phospholipids—a preferential sn-1 ketene loss over sn-2 ketene loss (m/z 522 or 524>m/z 496) [28].

These odd-electron fragments in FIG. 33C were also observed in MAD [36] and EID [28] spectra of the same lipid, which suggests high analogy among CTD, MAD and EID. The odd-electron fragments must be generated via the introduction of radical species during the fragmentation process, indicating the involvement of radical cleavages in CTD [36]. Interestingly, the fragment at m/z 495.5 (sn-2 position) is more abundant than the one at m/z 523.5 (sn-1 position). This trend highly agrees with that from the said EID results: the more favorable formation of radical cation associated with sn-2 position [28]. This coincidence, along with the more favorable neutral ketene loss over fatty acid loss in CTD, is indicative of high resemblance of CTD in its mechanistic nature to that of EID.

For easier visualization, the two spectra in FIGS. 36A-36B were both arbitrarily segmented into three sessions.

CTD spectrum of $[POPC+H]^+$ (FIG. 36B) produces extensive fragmentation along the two acyl chains. Session I shows the acyl cleavages close to the w-end of the lipid chains, even-electron fragments at m/z 730.5, m/z 716.5, m/z 702.5, m/z 688.5, m/z 676.5 and m/z 662.5 were observed, corresponding to the neutral loss of $C_nH_{2n}+_2$ elements; odd-electron fragments at m/z 731.5, m/z 717.5, m/z 703.5, m/z 689.5, m/z 675.5 and m/z 661.5 were observed (green font), corresponding to neutral loss of $C_nH_{2n+1}$. elements (alkyl radicals). Almost the same even-/odd-electron fragment series were observed in both MAD (FIG. 36A) and EID spectra [28].

These ladder-like pattern of even-electron fragments are separated by 14.0 m/z units, which is commonly observed in EI [33, 34], HE-CID [38] as well as the recently reported electron-based MS/MS experiments (EIEIO [26], EID [28]) on lipids. The accompanying odd-electron fragments associated with the losses of alkyl radicals were also reported in the said or other MS/MS experiments [26, 28, 38]. The serial neutral loss of $C_nH_{2n+2}$ could either be the neutral loss of alkane or be the neutral loss of alkene+$H_2$ (i.e. 1,4-cyclic elimination) [28, 39]. The general features of CTD includes the interaction with ~6 keV $He^+$, generation of odd-electron fragments (vide supra) and high analogy to MAD, EIEIO and EID. Taking all these into account, the fragmentation associated with $C_nH_{2n+2}$ and $C_nH_{2n+1}$. losses could be rationalized in a way similar to the radical mechanism proposed in ref. [38] or [40].

In session II (vinyl bond vicinity), CTD-generated fragments exhibit identical nominal masses to that of MAD, but distinctive features were observed in the two techniques as well. The general abundance distribution in CTD spectrum resembles to that in MAD spectrum, but slight differences can also be observed. MAD spectrum shows the diminished ion intensity at the CC double bond site along with the elevated ion intensity corresponding to distal allyl cleavages—the most prevalent dissociation pattern of unsaturated acyl chains, which has been widely reported in FAB [41], HE CID [40], EIEIO [26] and EID [28] experiments. The pattern of CTD spectrum in this vicinity looks slightly different. Intriguingly, CTD spectrum contains a distinctive peak pair at m/z 620.5 and m/z 632.5, whose spacing is a diagnostic value-12 Da. This characteristic peak spacing has been well studied and documented as the diagnostic value for localization of CC double bonds. Mass spectrometric experiments involving EI [42], HE-CID [43], RDD [29, 30], MAD-$MS^3$ CID [44] have made use of this diagnostic feature for the determination of double bond positioning in unsaturated fatty acid derivatives and phospholipids.

Similar to MAD, CTD only produces a few fragments in session III (the α-end of the acyl chain), including contributions from both sn-1 and sn-2 acyl chain cleavages. The rare dissociation in this session is also analogous to EID results of $[POPC+H]^+$ [28]. The fragment at m/z 577.6 could possibly be attributed to cleavage related to head group loss.

Consistent with CTD results of POPC, CTD of PSPC (FIG. 36C) also produces extensive dissociation along two acyl chains, with even higher extent of fragmentation. Structurally different from POPC, PSPC contains two fully saturated acyl chains (16:0/18:0). Consequently, a more extensive ladder-like dissociation pattern can be seen from m/z 718.6 to m/z 550.5, corresponding to the mutual contribution of sn-1 and sn-2 acyl chain. Moreover, the fragment ion intensities appear to be more uniform along the entire saturated acyl chains [26]. It is worth noting that the nominal masses from m/z 592.5 to m/z 718.6 are in one-to-one correspondence with those in EID of PSPC [28]. Another difference exists that CTD of PSPC doesn't produce the aforementioned odd-electron fragment series. The lack of odd-electron fragments in PSPC was also reported in EID experiments [28]. A remarkably abundant peak at m/z 578.5 (cleavage of $C_3$-$C_4$ bond) was observed in PSPC spectrum, which could possibly originate from the contribution from cleavages of both $C_3$-$C_4$ bond on C(16:0) acyl chain and $C_5$-$C_6$ bond on C(18:0) acyl chain, or/and a preferred dissociation channel in either/both bonds [28].

FIGS. 37A-37F show (FIG. 37A) CID spectrum of $[9E\text{-}DOPC+H]^+$ (18:1/18:1), (FIG. 37B) CTD spectrum of $[9E\text{-}DOPC+H]^+$ (18:1/18:1, zoomed-in regions from m/z 500-530: (FIG. 37C) CID spectrum of $[9E\text{-}DOPC+H]^+$ (18:1/18:1); (FIG. 37D) CTD spectrum of $[9E\text{-}DOPC+H]^+$ (18:1/18:1); (FIG. 37E) CID spectrum of $[9Z\text{-}DOPC+H]^+$ (18:1/18:1); (FIG. 37F) CTD spectrum of $[9Z\text{-}DOPC+H]^+$ (18:1/18:1). The orange font in panel (FIG.) and (FIG. 37F) shows the $C_nH_{2n+2}$-type losses and their tentative assignments.

Figure 37A:
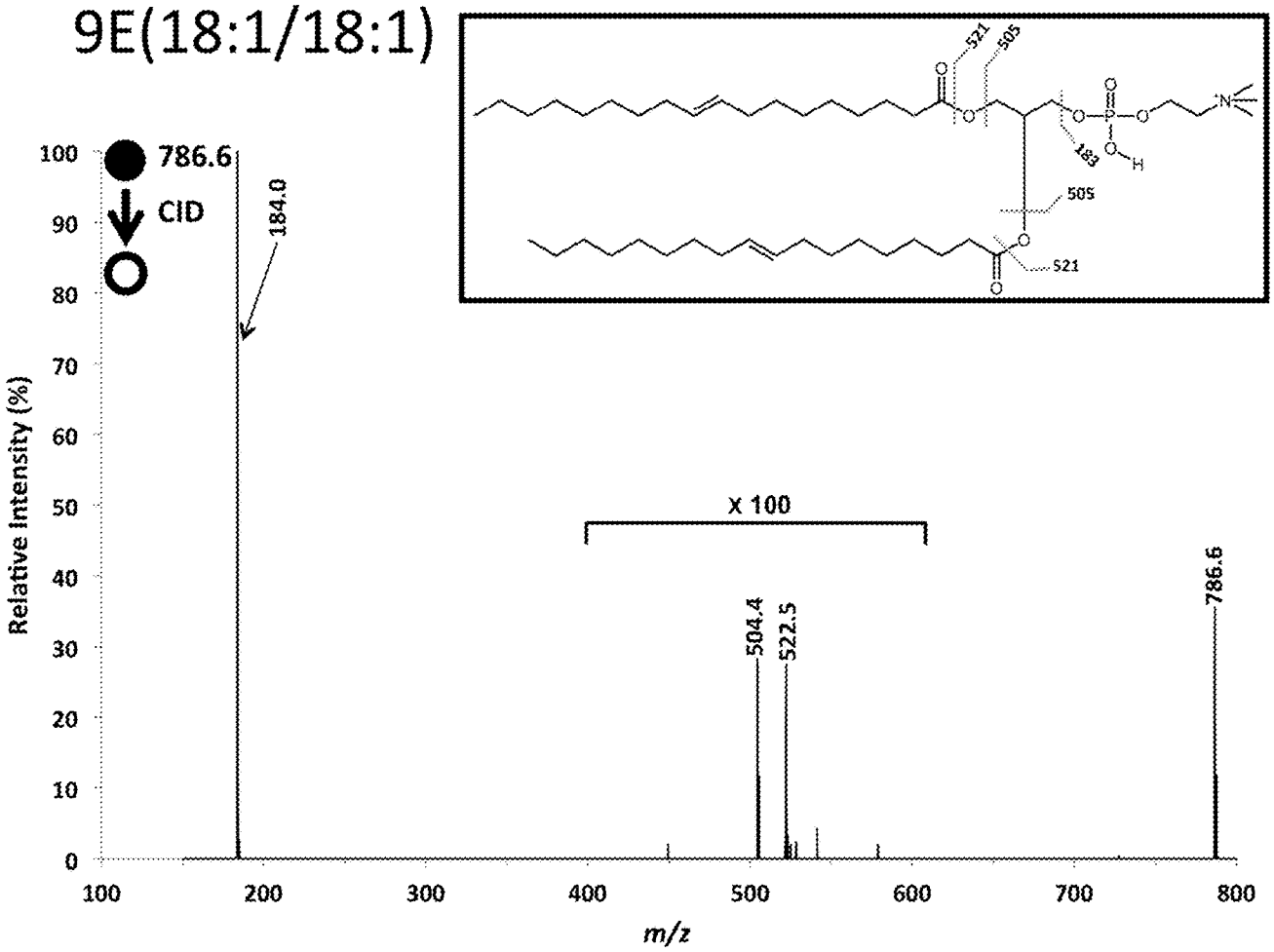
FIGS. 37A-37F show (FIG. 37A) CID spectrum of $[9E-DOPC+H]^+$ (18:1/18:1), (FIG. 37B) CTD spectrum of $[9E-DOPC+H]^+$ (18:1/18:1, zoomed-in regions from m/z 500-530.
Figure 37B:
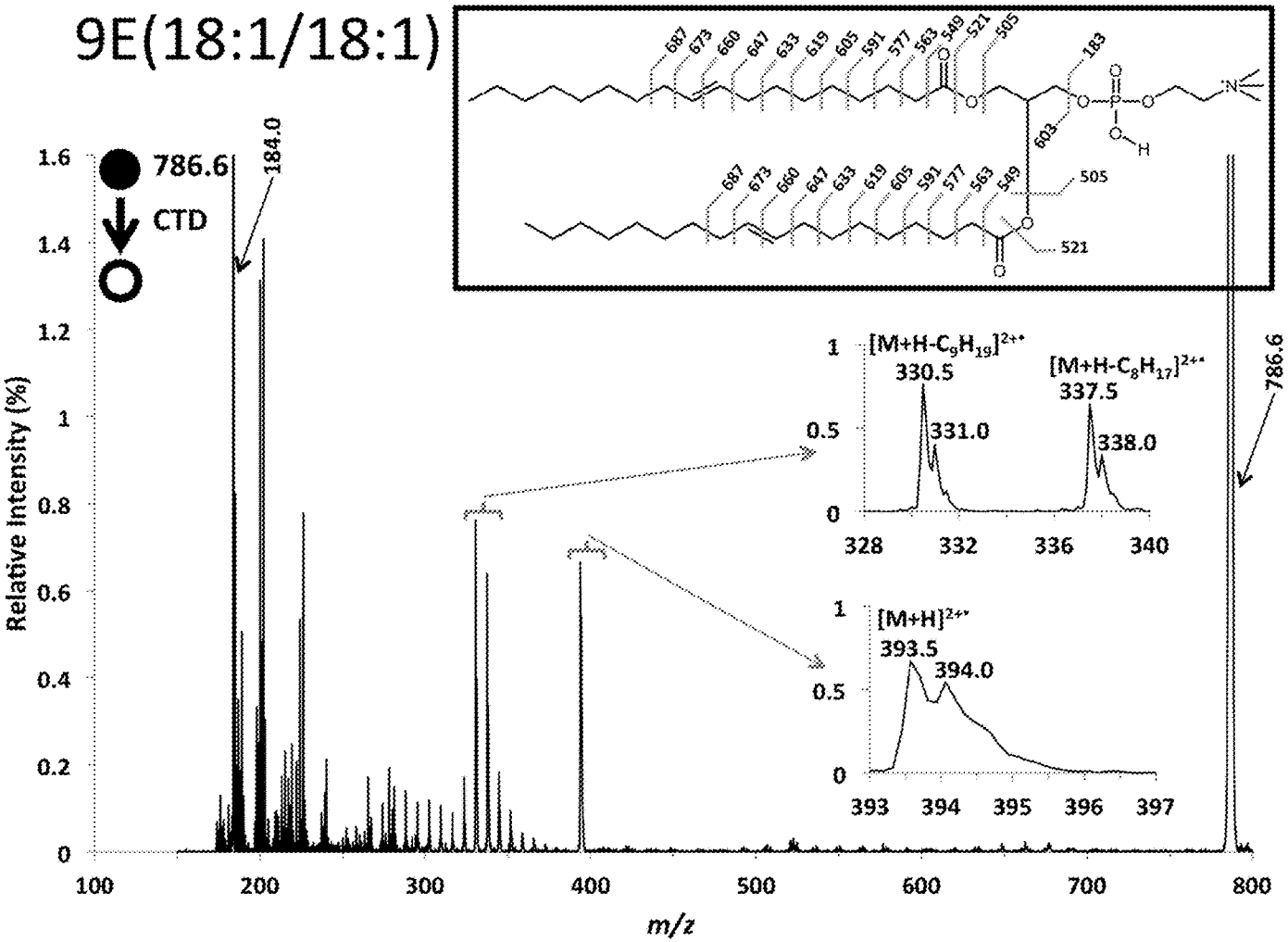

CID and CTD spectra of protonated 9E-DOPC (18:1/18:1) are shown in FIGS. 37A-37B. Collisional activation of this lipid only produces three fragments, as was reported in literature [36]. But CTD of the same lipid, same adduct form produces a much more extensive fragmentation coverage, which not only includes head group loss (m/z 184.0), sn-1/sn-2 alkyl ketene loss (m/z 521) and sn-1/sn-2 fatty acid loss (m/z 505), but also includes charge-increased ion series ($[9E\text{-}DOPC+H]^{2+}$. at m/z 393.5, $[9E\text{-}DOPC+H—C_9H_{19}]^{2+}$. at m/z 330.5, etc) and acyl chain cleavages enough for covering CC double bond vicinity. This pattern is almost identical to that of MAD spectrum of $[9E\text{-}DOPC+H]^+$ (18:1/18:1) [36]. The remarkable similarity of the two ion activation methods suggests a similar mechanistic nature in them, which can help evidence mechanistic hypothesis in the fragmentation pathway of CTD.

Figure 37C:
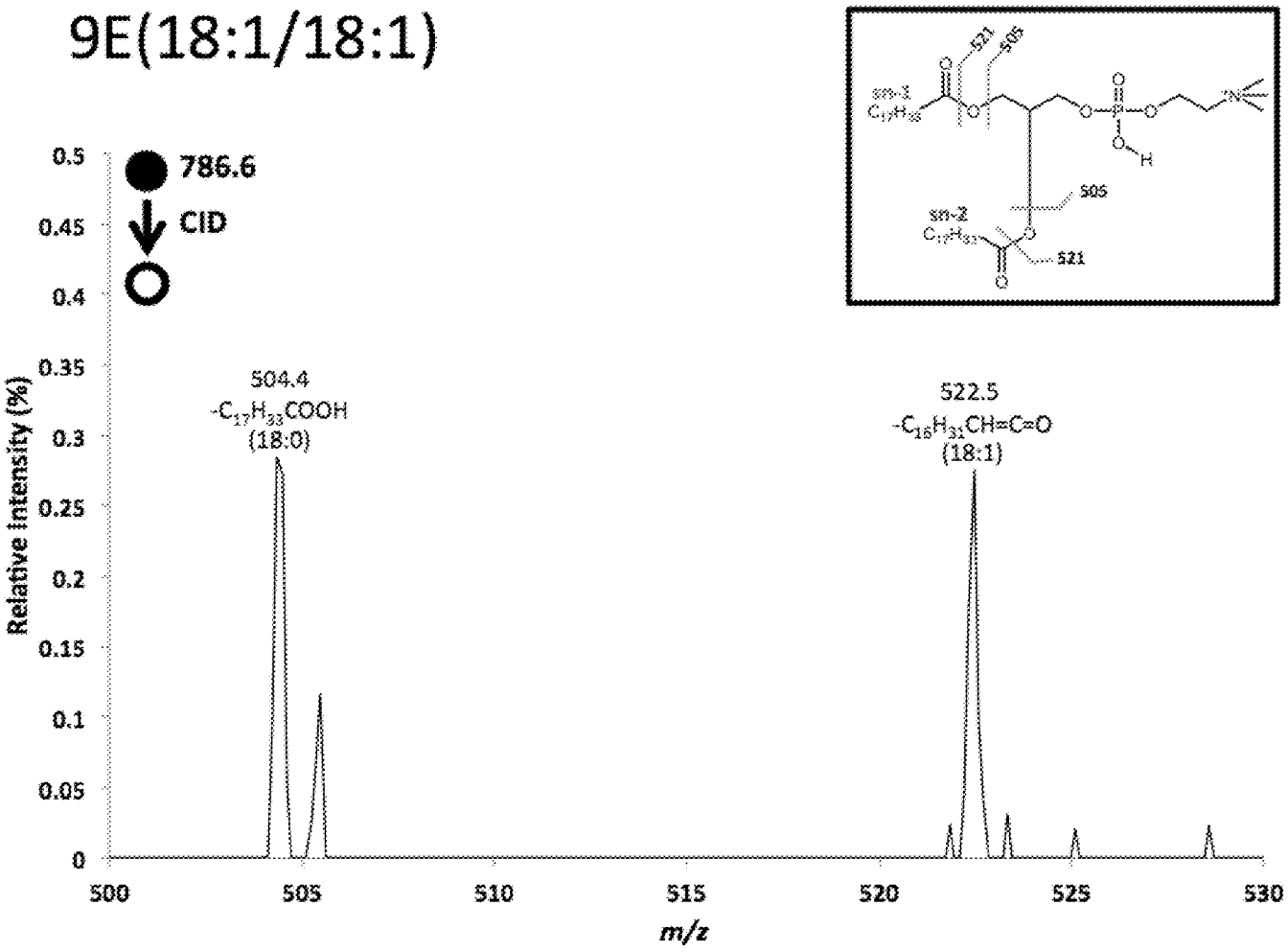
Figure 37D:
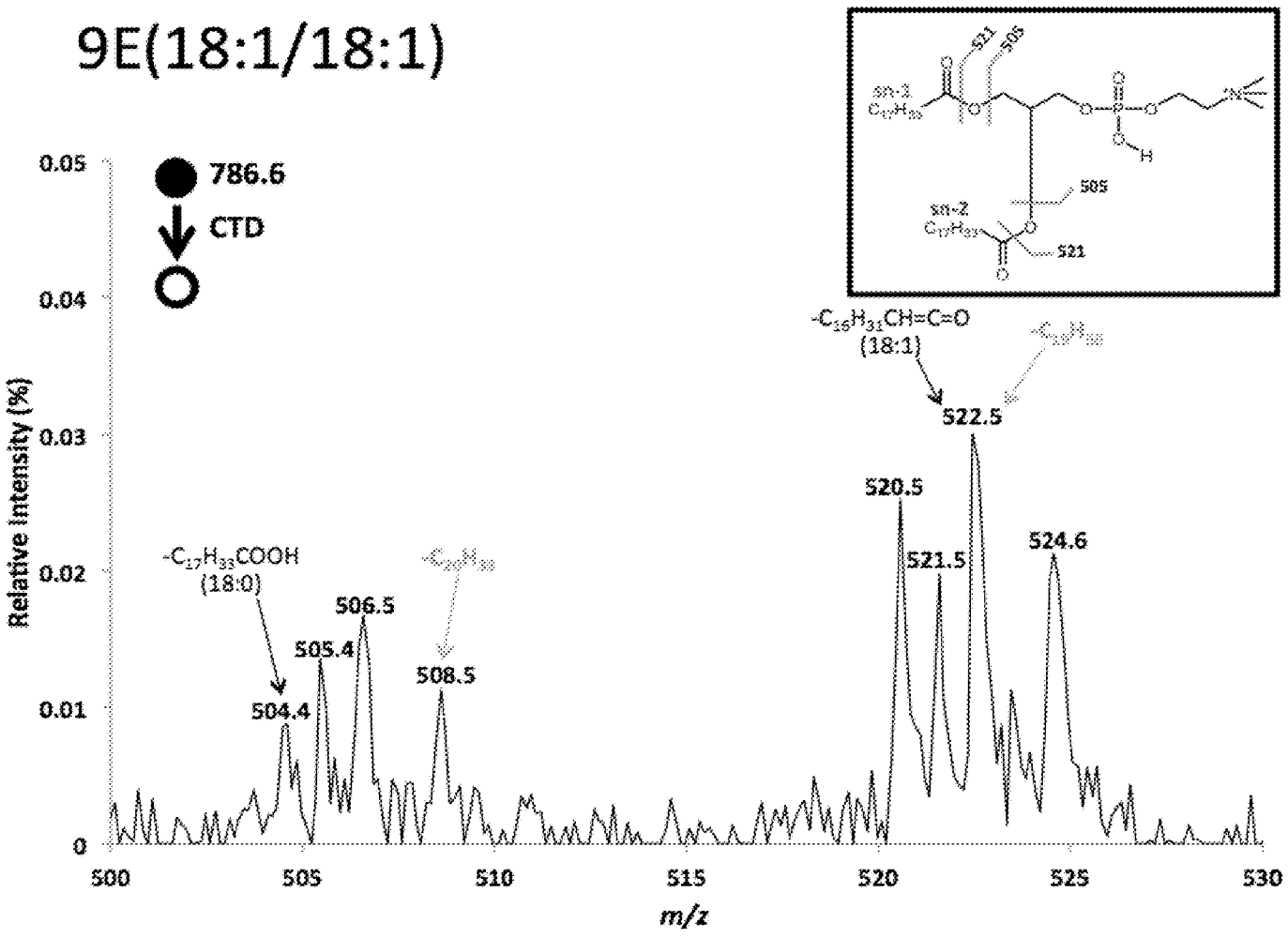
Figure 37E:
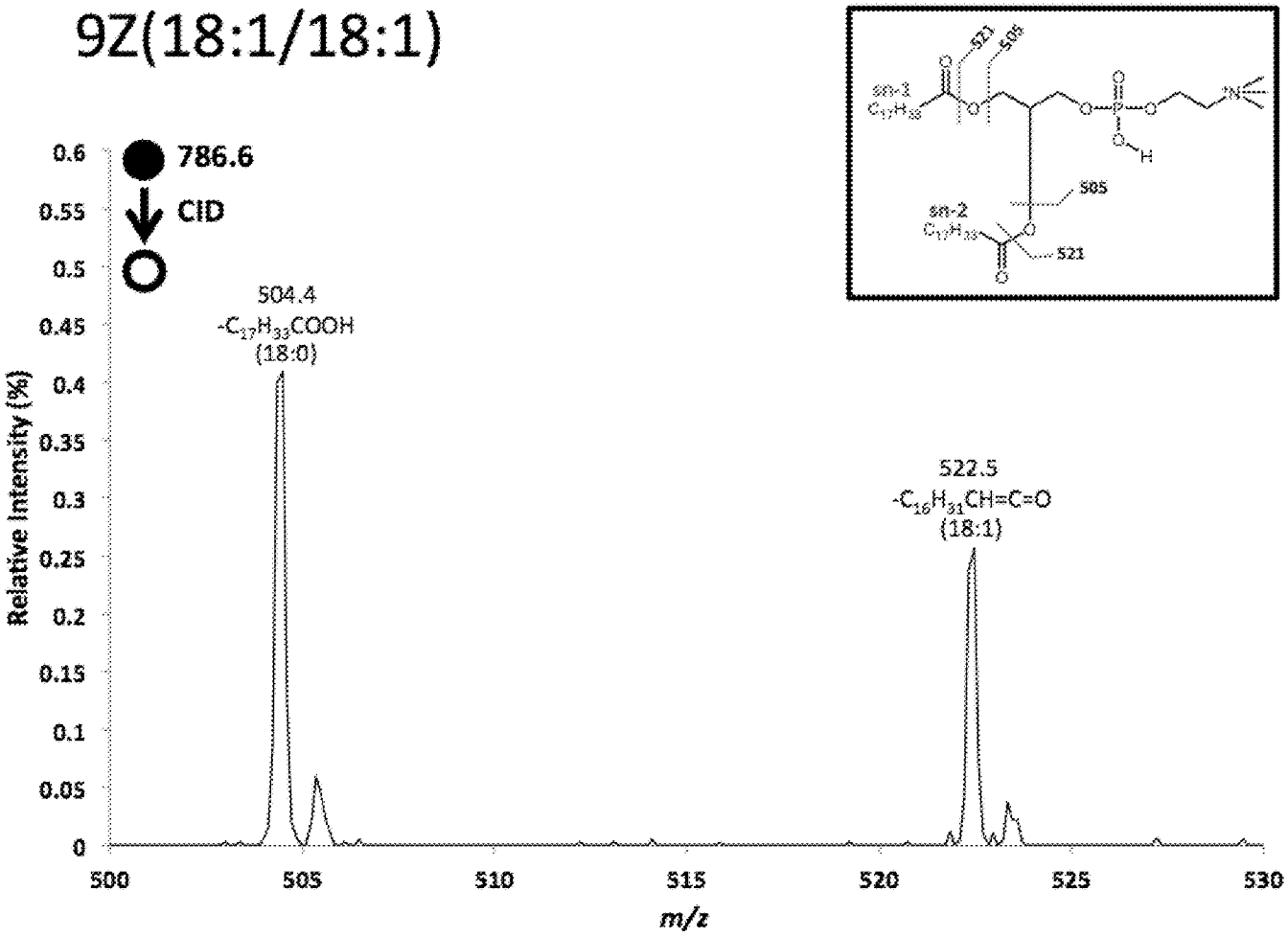
Figure 37F:
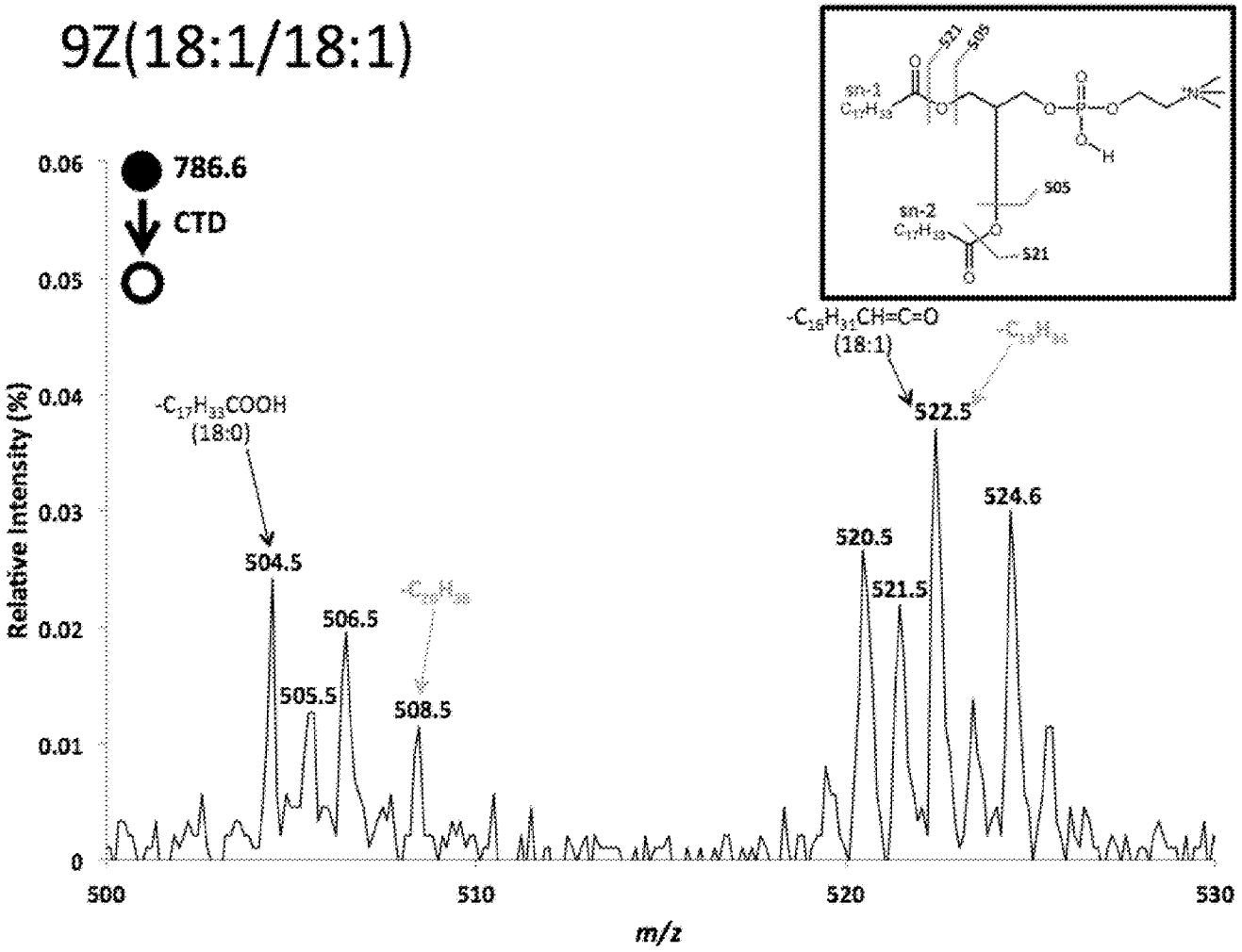

The middle panels of FIGS. 37C-37D show the m/z 500-530 range comparison of CID and CTD results of 9E-DOPC, while FIGS. 37E-37F are dedicated to show that of 9Z-DOPC. For CTD spectrum, the peak patterns around m/z 521 and m/z 505 resemble that of MAD spectrum in ref. [36], but vastly differ from that of CID zoomed-in. CID mainly proceeds through even-electron rearrangements, yielding even-electron fragments. The vast difference from CID and the presence of odd-electron fragments as MAD does reveals the involvement of radical fragmentation in CTD process. The zoomed-in CTD spectrum of cis-double bond lipid (9Z-DOPC) looks very similar to that of trans-double bond lipid (9E-DOPC), which agrees with the reported difficulty in differentiating cis- and trans-geometry of CC double bond [45]. For both 9E- and 9Z-DOPC, the preference in ketene loss (m/z 522.5) over fatty acid loss (m/z 506.5) is in contrast to CID spectra. This preferential ketene loss highly agrees with the aforesaid trend in CTD spectra of POPC and PSPC. The reproducible feature across lipids with different acyl chain combinations further confirms the distinctive mechanistic nature of CTD, which should be different from that of even-electron CID, but is close to radical dissociation feature of MAD, EIEIO and EID.

Figure 38A:
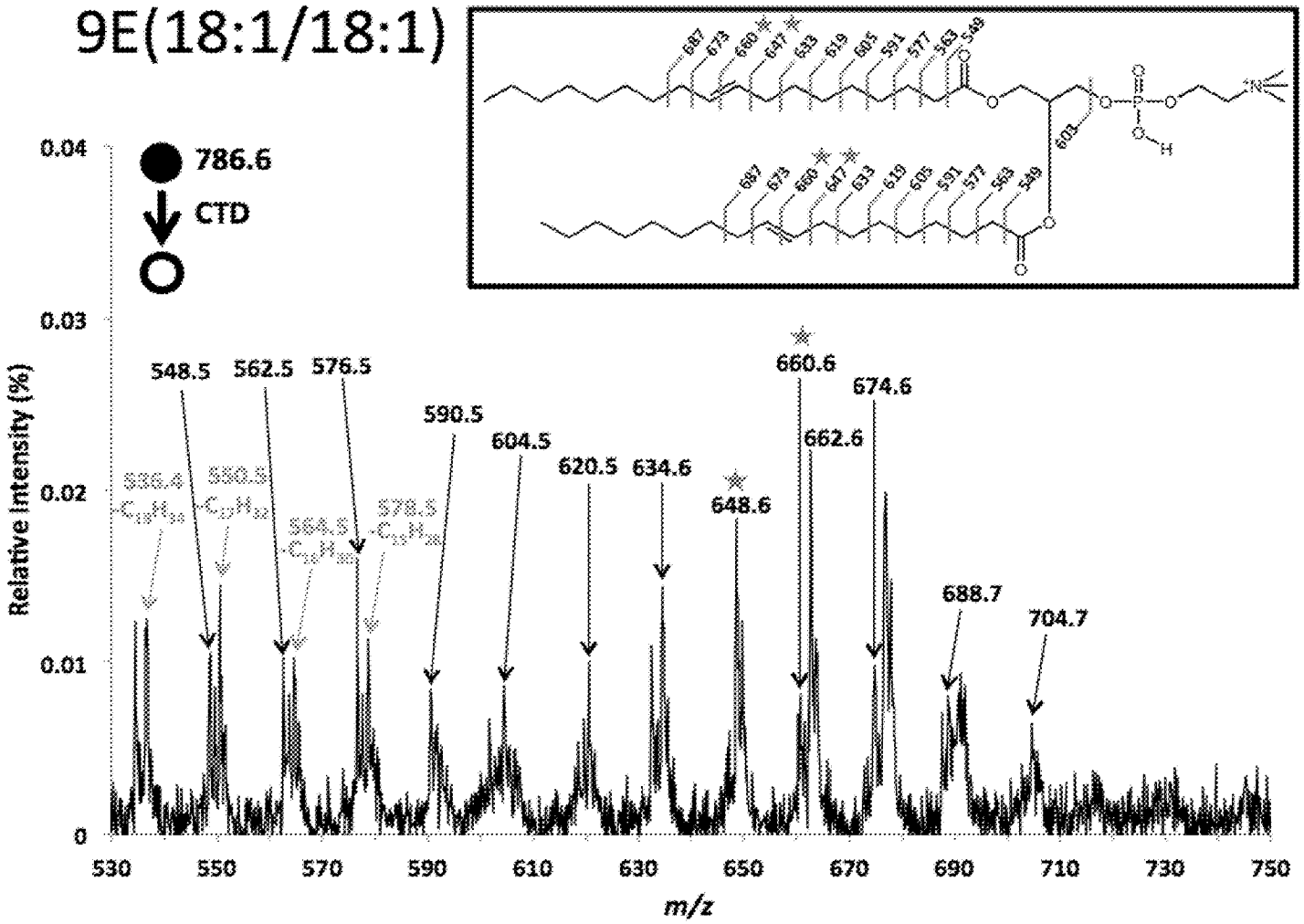
FIGS. 38A-38B show zoomed-in regions from m/z 530-750 of CTD spectra of (FIG. 38A) $[9E-DOPC+H]^+$ (18:1/18:1)
Figure 38B:
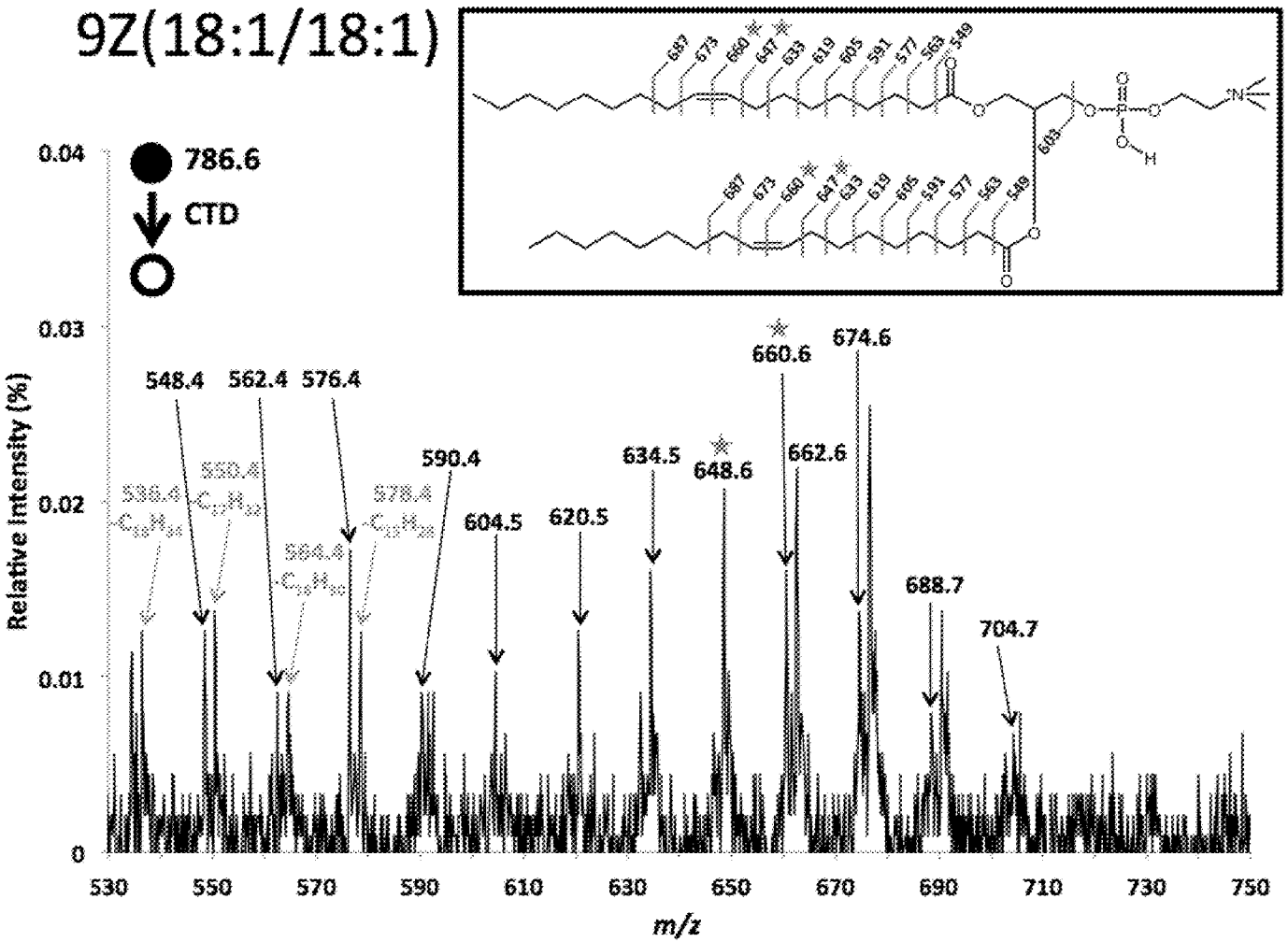

FIGS. 38A-38B show zoomed-in regions from m/z 530-750 of CTD spectra of (FIG. 38A) $[9E\text{-}DOPC+H]^+$ (18:1/18:1); (FIG. 38B) $[9Z\text{-}DOPC+H]^+$ (18:1/18:1). The light gray font shows the $C_nH^2_{n-2}$-type losses and their tentative assignments. FIGS. 38A-38B show magnified CTD spectra of $[9E\text{-}DOPC+H]^+$ and $[9Z\text{-}DOPC+H]^+$ from m/z 530-750. Different from PSPC that has two saturated acyl chains, 9E- and 9Z-DOPC both have mono-double bond-containing acyl chains instead. Consistent with CTD results of POPC and PSPC, ladder-like fragmentation pattern was observed in CTD spectra of both 9E- and 9Z-DOPC. Different from CTD results of POPC and PSPC, fewer fragments were observed for 9E- and 9Z-DOPC. The lack of carbon-carbon singly bonds cleavages closer to w-end was also seen in EID spectra of 9Z- and 6Z-DOPC [28]. It seems that the presence of multiple CC double bonds obstructs the propensity of CTD fragmentation.

Consistent with the CTD results of POPC, the diagnostic peak spacing of 12 Da was also observed for both 9E- and 9Z-DOPC, which offers an unambiguous localization of CC double bonds in both lipids. The consistency in this 12 Da spacing demonstrates the reproducibility of CTD in producing this double bond-specific feature. This also indicates the promising potential of CTD for the diagnosis/differentiation of sites of unsaturation in lipids, or further possible extension into other biomolecules with unsaturated olefinic chains, such as fatty acids methyl esters (FAMEs), oleic acids, etc.

Different from CTD spectra of POPC and PSPC, CTD spectra of 9E- and 9Z-DOPC show a unique neutral loss series: m/z 508 ($—C_{20}H_{38}$), m/z 522 ($—C_{19}H_{36}$), m/z 536 ($—C_{18}H_{34}$), m/z 550 ($—C_{17}H_{32}$), m/z 564 ($—C_{16}H_{30}$) and m/z 578 ($—C_{15}H_2$) (light gray font in FIGS. 37C-37D, 38A and 38B). The tentative assignments were shown in the following parenthesis. This type of $C_nH_{2n-2}$ neutral loss highly agrees with the observation in EID experiments, which could be attributed to the mutual cleavages of both unsaturated acyl chains [28].

Figure 39A:
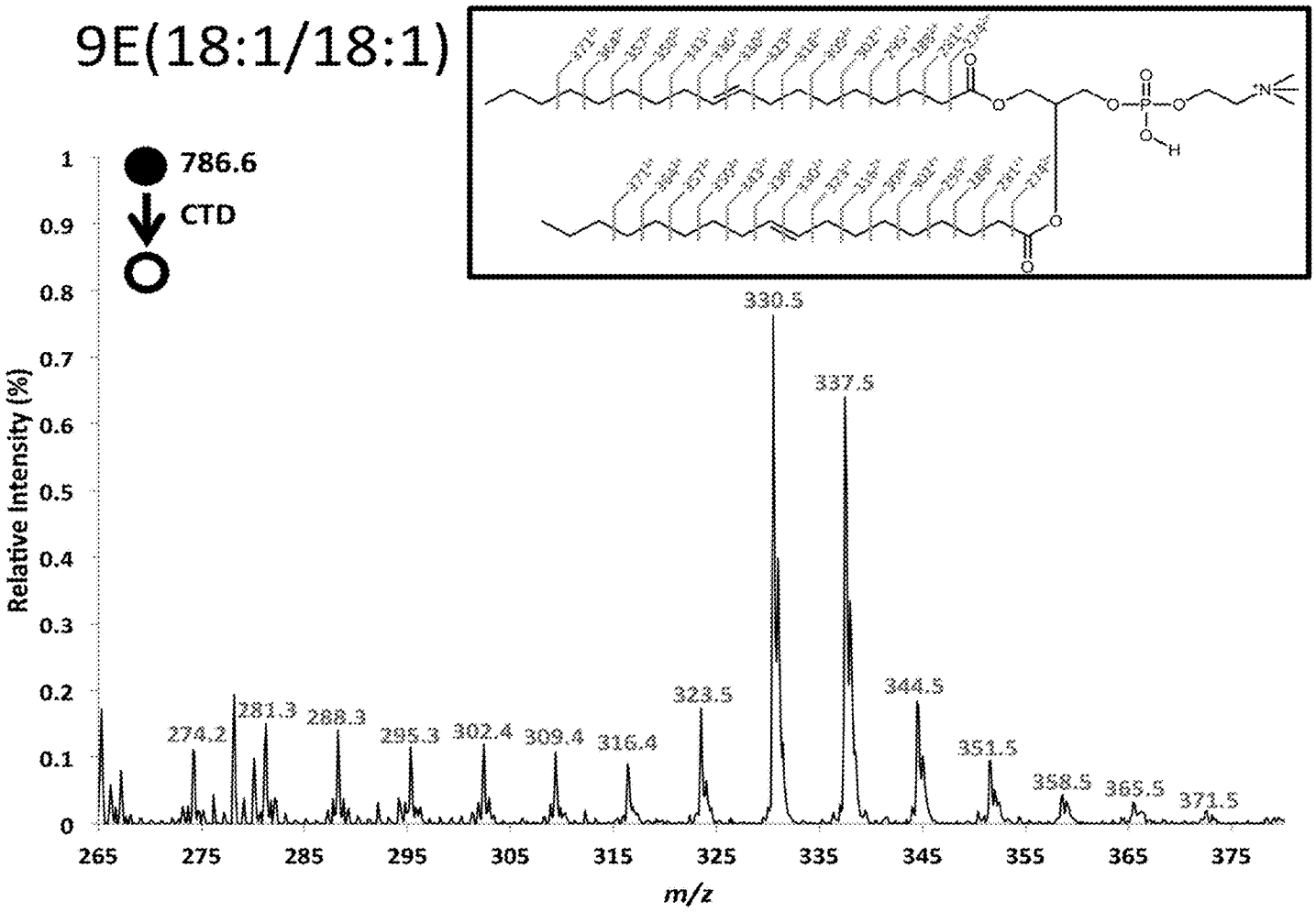
Figure 39B:
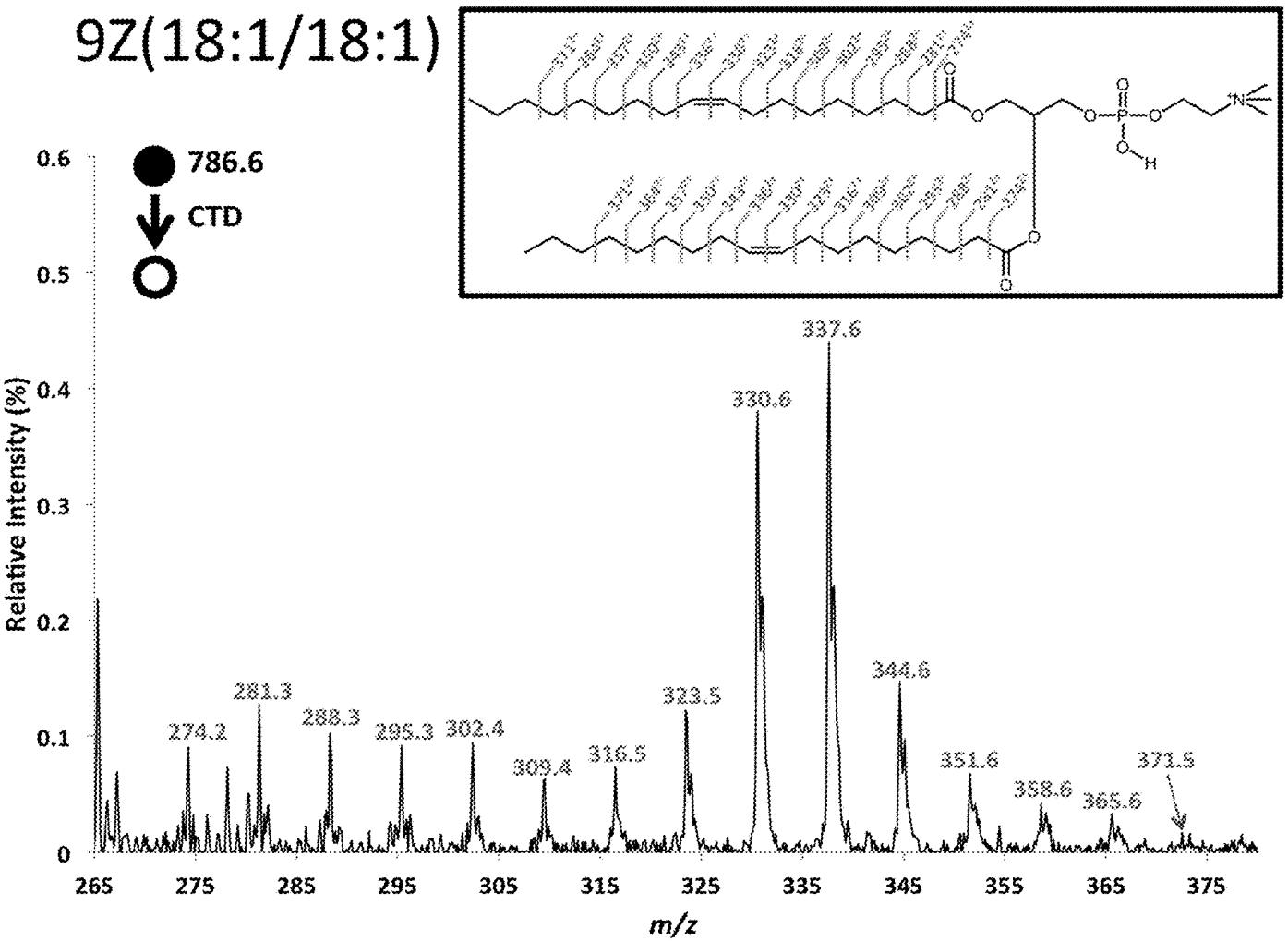

FIGS. 39A-39B show zoomed-in regions from m/z 265-380 of CTD spectra of: (FIG. 39A) $[9E\text{-}DOPC+H]^+$ (18:1/18:1); (FIG. 39B) $[9Z\text{-}DOPC+H]^+$ (18:1/18:1). FIGS. 39A-39B shows the comparison of the unique doubly charged ion series in CTD of $[9E\text{-}DOPC+H]^+$ and $[9Z\text{-}DOPC+H]^+$, which shows a peak spacing of 7.0 Da instead of 14.0 Da. To our best knowledge, this 7.0 Da-ladder pattern was rarely reported in gas-phase ion activation experiments. Nevertheless, this pattern was also observed in MAD spectra of 9E- and 9Z-DOPC [36], suggesting a significant mechanistic similarity between CTD and MAD. The doubly charged ion series almost cover the entire acyl chain. 9E- and 9Z-DOPC spectra not only exhibit a similar extent of chain cleavage, but also show a similar fragment ion intensity distribution.

Noticeably, the most abundant peaks are at m/z 330 and m/z 337 corresponding to cleavages at or next to the site of unsaturation in both lipids.

In 9E-DOPC spectrum, the peak at m/z 330 is more abundant than m/z 337; while in 9Z-DOPC spectrum, the trend is reversed. The variation in fragment ion intensities seems to be sensitive to the geometry of double bond. Since 9E- and 9Z-DOPC only differ in double bond geometry, identical fragments are generated for both lipids. Given the similar dissociation pattern and lack of diagnostic fragments, the most common way to discriminate them is to track the changes in relative abundances of certain fragments. This concept has been reported and utilized in the differentiation of geometrical isomers of FAMEs using low-energy electron ionization mass spectrometry [45].

Figure 40A:
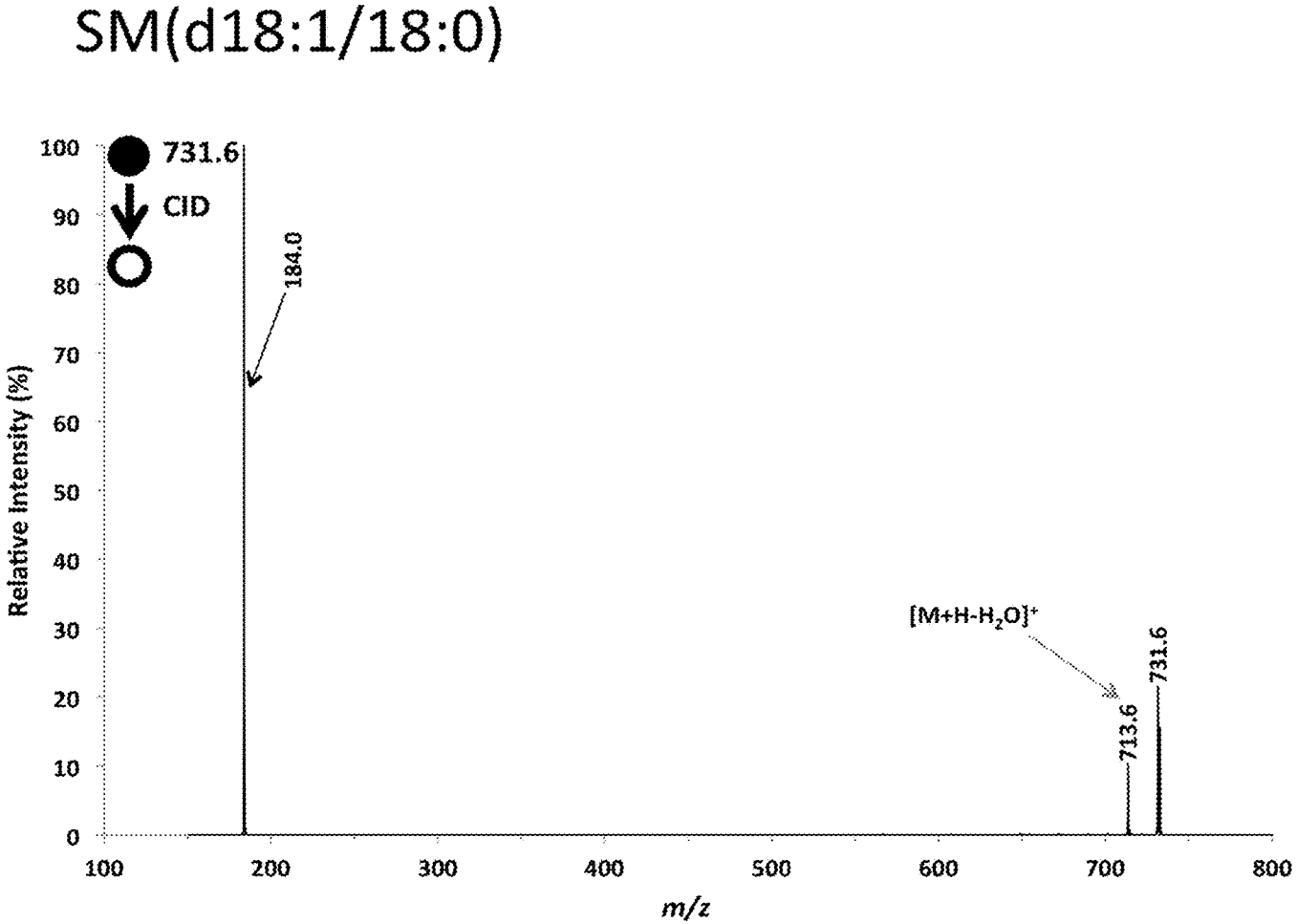
FIGS. 40A-40B show (FIG. 40A) CID spectrum of $[SM+H]^+$ (d18:1/18:0) and (FIG. 40B) CTD spectrum of $[SM+H]^+$ (d18:1/18:0).
Figure 40B:
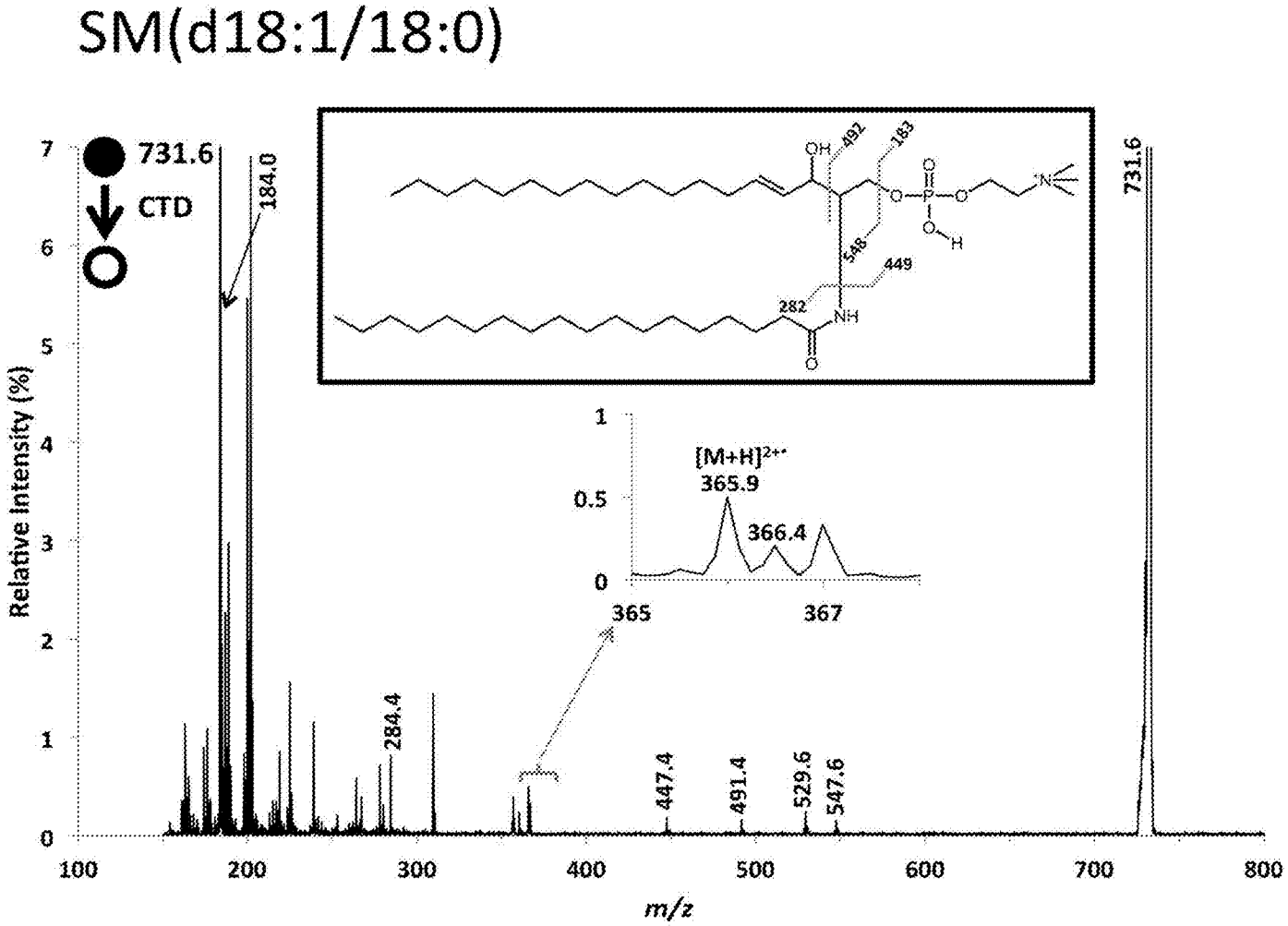
Figures 45A, 45B, 45C, 45D, 45E, 45F:
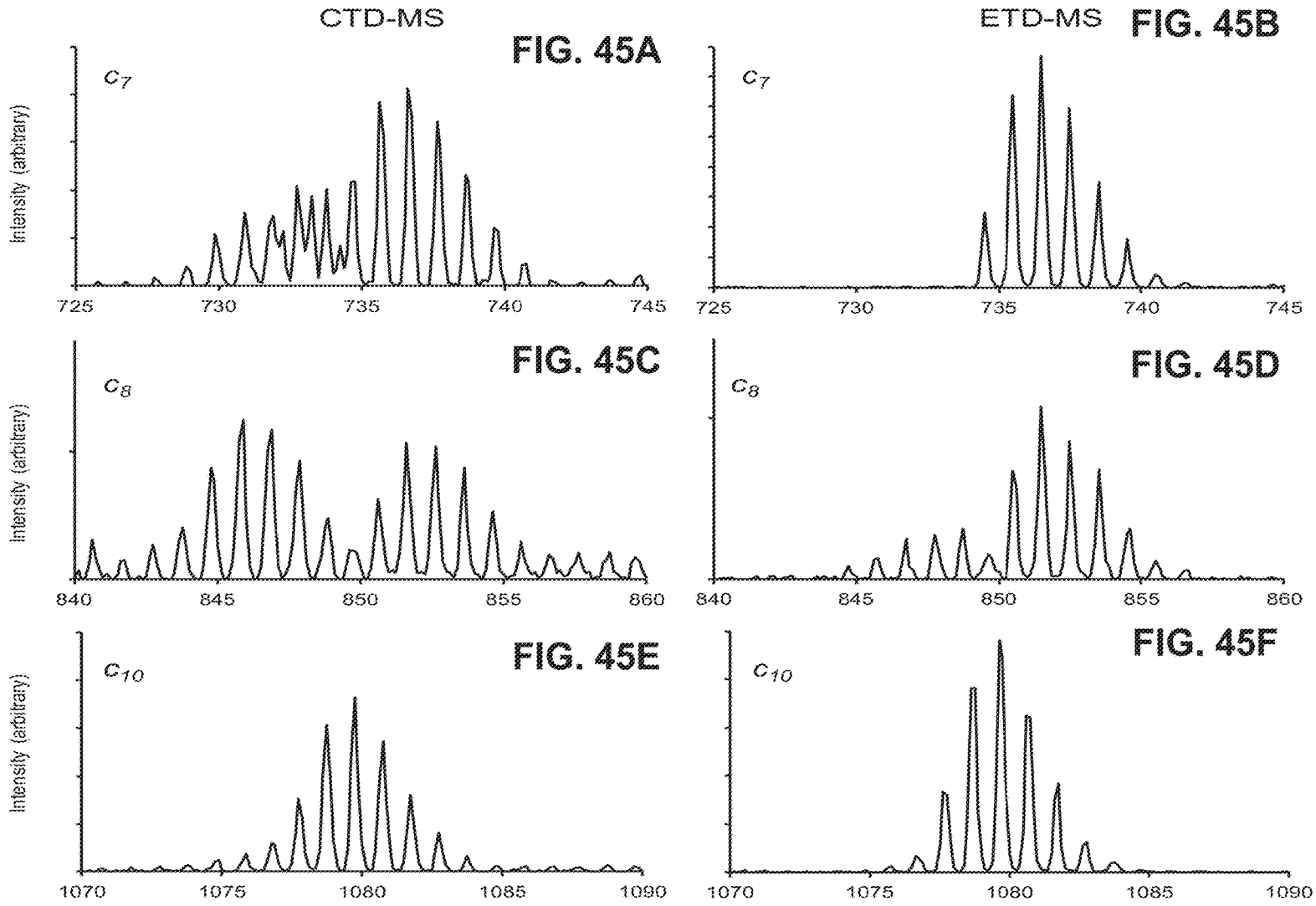
FIGS. 45A-45L show spectra from a comparison of c-ions resulting from CTD-MS (FIGS. 45A, 45C, 45E, 45G, 45I, and 45K) and ETD-MS (FIGS. 45B, 45D, 45E, 45H, 45J and 45L) after HDX of $[KKDDDDDIIKIIK+3H]^{3+}$ precursor ions. Note that the bottom panels showing the charge reduced ions, $[M+H]^+/[M+2H]^+$ and $[M+H]^+/[M+2H]^+./[M+3H]^+$.., were produced from the [M+2H]2+ and [M+3H]3+ precursor ions respectively. These respective molecular ions were generated during CTD and ETD analysis
Figures 45G, 45H, 45I, 45J, 45K, 45L:
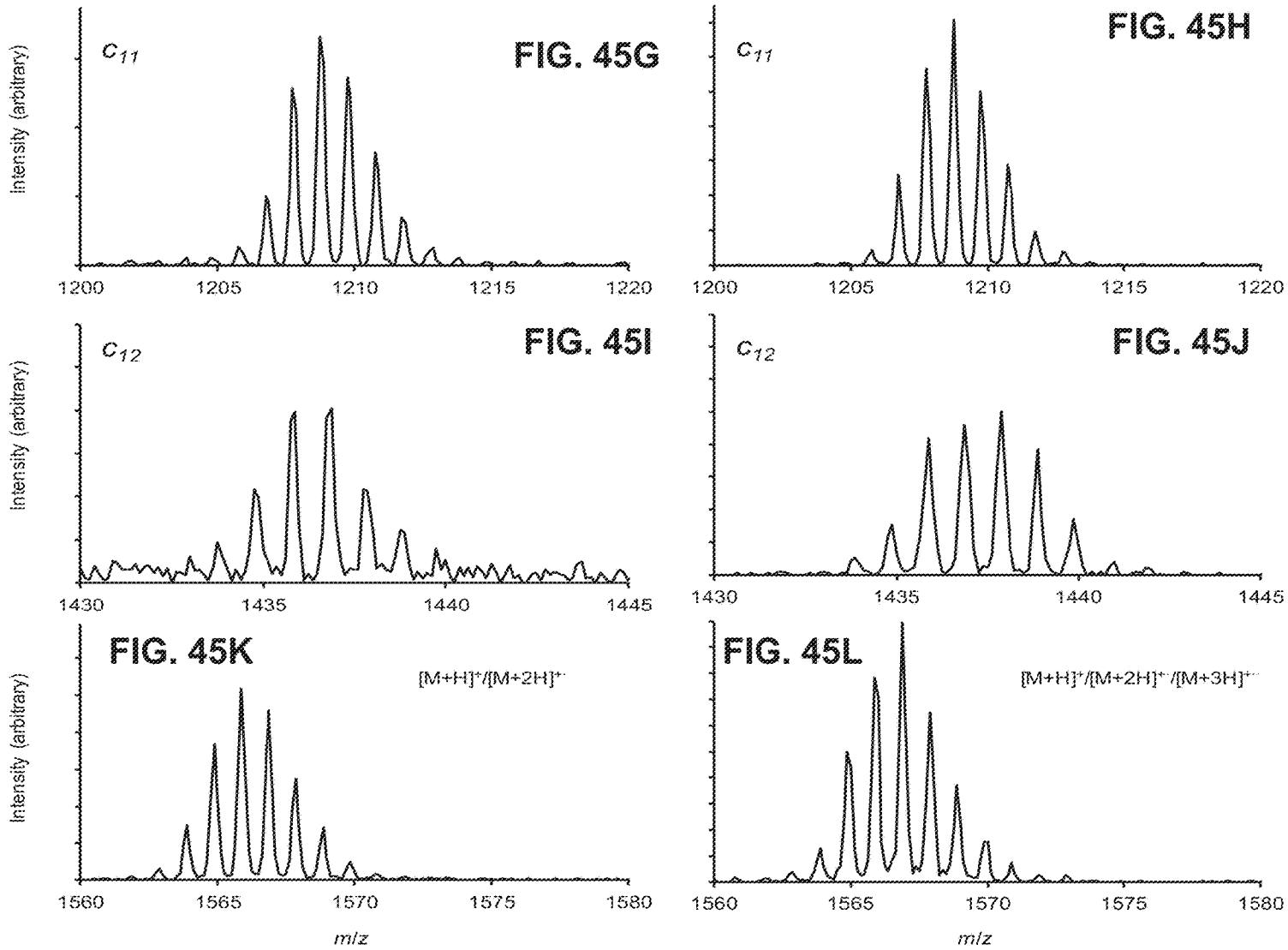

FIGS. 40A-40B show (FIG. 40A) CID spectrum of $[SM+H]^+$ (d18:1/18:0) and (FIG. 45B) CTD spectrum of $[SM+H]^+$ (d18:1/18:0). FIGS. 40A-40B show the comparison between CTD and CID spectra of protonated sphingomyelin. Collisional activation of sphingomyelin produces very few fragments: m/z 184.0 associated with phosphocholine head group loss and m/z 713.6 associated with a neutral water loss [36]. The inefficiency of CID in producing structurally informative fragments is consistent with literature reports [6, 41, 46]. However, CTD of the same adduct form of sphingomyelin is capable of producing slightly more fragments, including a characteristic charge-increased product ion ($[M+H]^{2+}$.) at m/z 365.9 and two fragments at m/z 447.4 and m/z 491.4 corresponding to the entire acyl chain losses. They were distinctive product ions that are only observed in CTD, not observed in MAD experiment [36]. Sphingomyelin is structurally different from the other tested phospholipids: one fatty acyl group is alkylated to the lipid backbone, with the other fatty acyl group being connected to sphingosine via an amide bond [41]. The absence of the two ester-connections could possibly make a less "fragile" molecule, resulting in a less efficient dissociation pattern of MS/MS techniques.

Figure 41A:
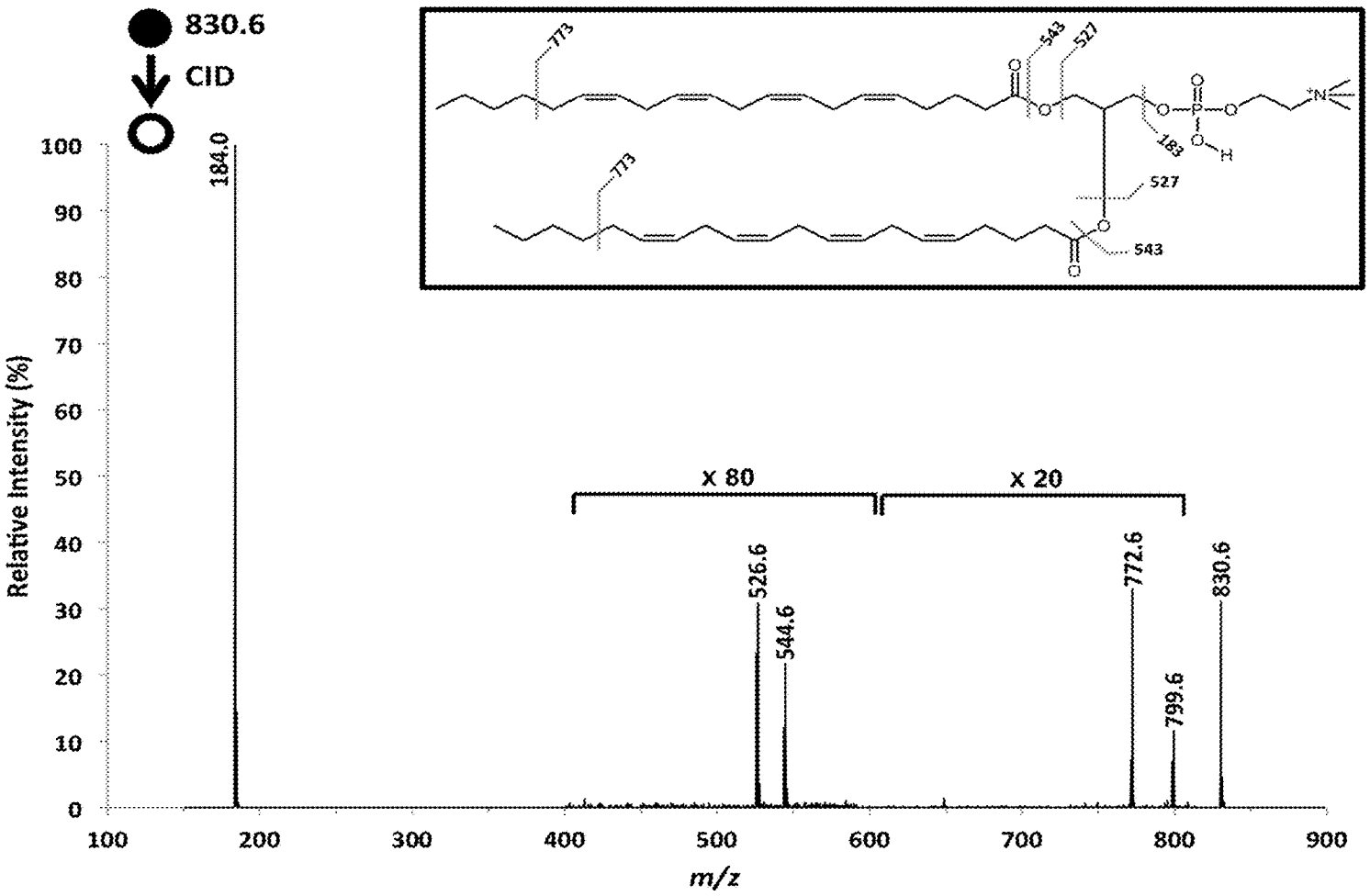
FIGS. 41A-41C show (FIG. 41A) a CID spectrum of $[DAPC+H]^+$ (20:4/20:4)
Figure 41B:
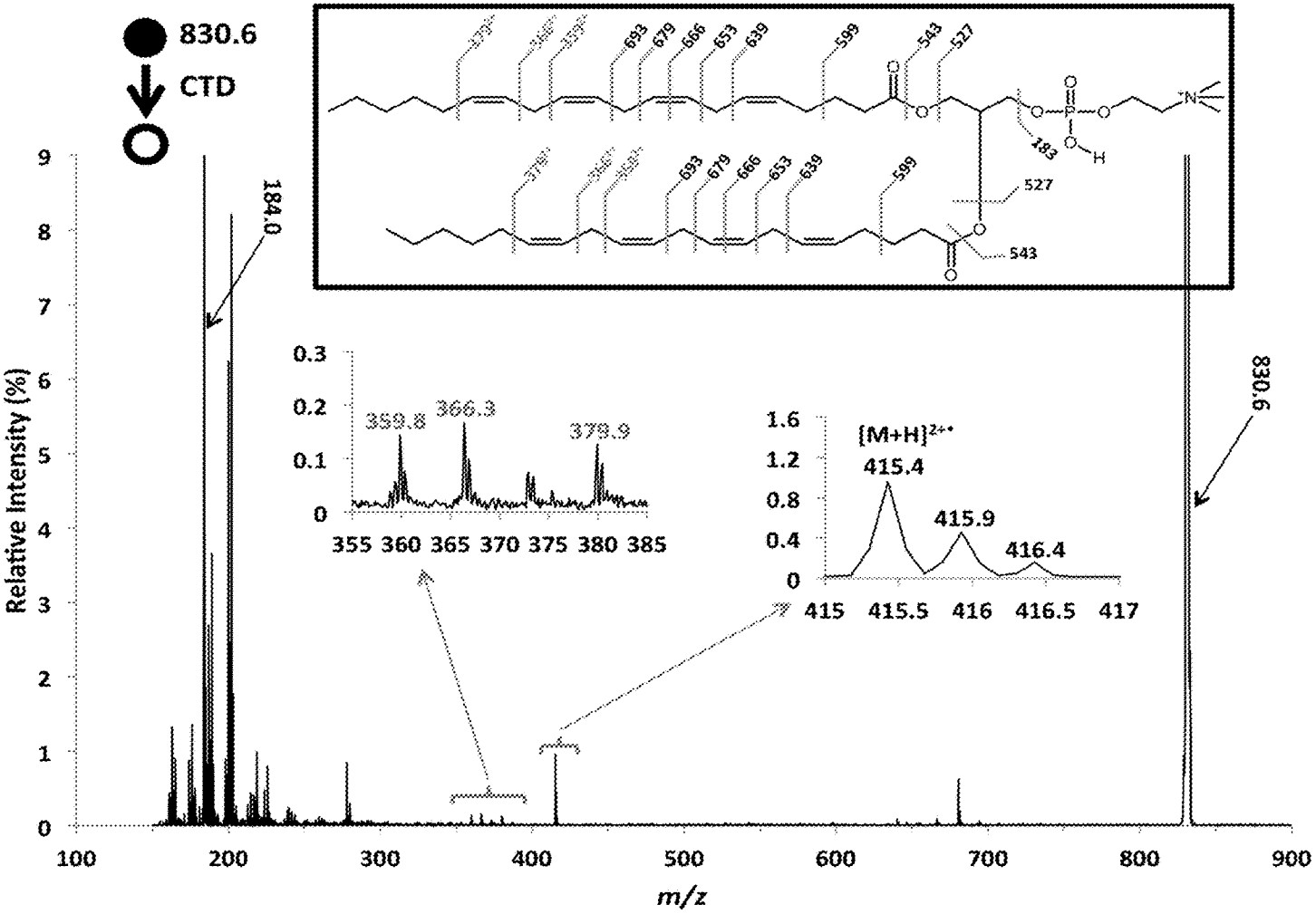
Figure 41C:
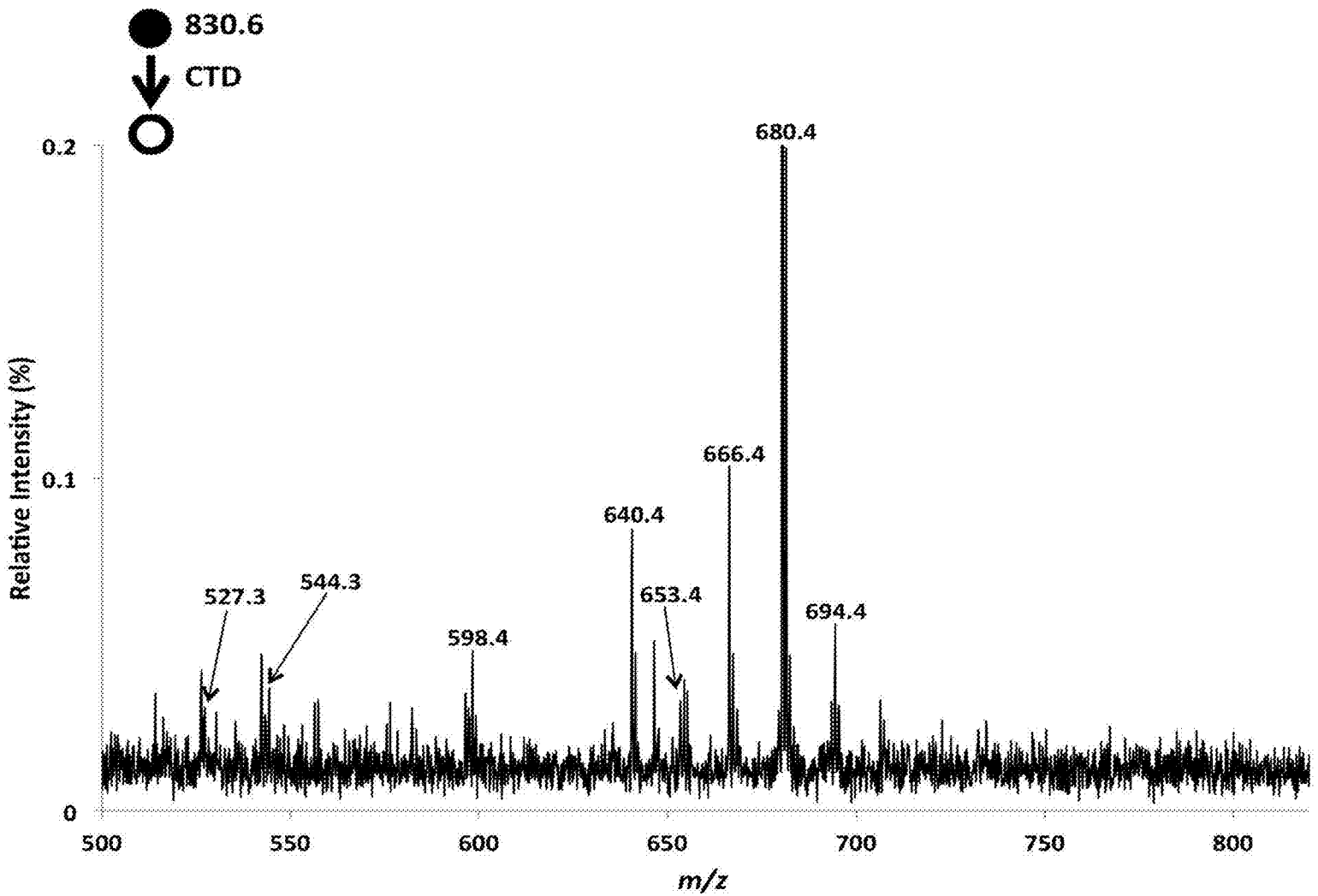

CID and CTD spectra of $[DAPC+H]^+$ are shown in FIGS. 41A-41C. Upon collisional activation, $[DAPC+H]^+$ mainly produces fragments corresponding to head group loss, sn-1/sn-2 fatty acid and alkyl ketene losses, which is quite similar to the pattern of CID of $[9E-/9Z-DOPC+H]^+$. CTD of DAPC not only produces the said cleavages, but also produces 1+ and 2+ fragments in the vicinity of four-double bond-region. The charge-increased product ion ($[M+H]^{2+}$.) at m/z 415.4 was generated as was generated for all the examined phospholipids. The reproducible generation of $[M+H]^{2+}$. further evidences the spectral characteristics of CTD, which is indicative of the important involvement of this doubly charged radical in CTD process. Unfortunately, the zoomed-in region from m/z 500 to 850 doesn't show a great S/N ratio, which is inferior to that of MAD spectrum [36]. Consistent with MAD of DAPC, CTD of DAPC also produces quite limited cleavages. The rationale in offered in MAD experiment [36] could possibly account for this inefficient fragmentation of CTD too.

SUMMARY

Charge transfer dissociation mass spectrometry (CTD-MS) has previously been shown as a promising alternative for structure interrogation of gas-phase peptide ions. The particular intriguing feature of this approach is the capability of producing a distinctive a-ion series for extensive peptide sequence coverage via some unique dissociation channels. Herein, we report CTD-MS on a different set of biomolecules-phospholipids, which not only gives rise to CID-like fragments, but also produces extensive dissociation within lipid acyl chains, yielding information that is not achievable through CID approach. The additional structural information includes the CC double bond positioning, or even its stereochemistry, if found to be general. Importantly, the diagnostic spacing of ion pairs is preserved across a range of lipids with varying acyl chain lengths and number of CC double bonds. The fact that CTD approach was carried out on a relatively low-cost 3D ion trap platform, along with the enriched structural information it provides, could foresee a potential tool in the future lipidomics kit. If tested in a larger lipid pool, CTD approach could be exploited to probe the structure of other classes of lipids or to the gas phase chemistry of other biomolecules.

REFERENCES FOR EXAMPLE 6

[1] Op den Kamp, J. A., Lipid asymmetry in membranes, Annu. Rev. Biochem., 48 (1979) 47-71.

[2] Ramanadham, S., Bohrer, A., Gross, R. W., Turk, J., Mass spectrometric characterization of arachidonate-containing plasmalogens in human pancreatic islets and in rat islet beta-cells and subcellular membranes, Biochemistry, 32 (1993) 13499-13509.

[3] Blanksby, S. J., Mitchell, T. W., Advances in mass spectrometry for lipidomics, Annu. Rev. Anal. Chem., 3 (2010) 433-465.

[4] Pulfer, M., Murphy, R. C., Electrospray mass spectrometry of phospholipids, Mass Spectrom Rev, 22 (2003) 332-364.

[5] Al-Saad, K. A., Siems, W. F., Hill, H. H., Zabrouskov, V., Knowles, N. R., Structural analysis of phosphatidylcholines by post-source decay matrix-assisted laser desorption/ionization time-of-flight mass spectrometry, J. Am. Soc. Mass Spectrom., 14 (2003) 373-382.

[6] Hsu, F. F., Turk, J., Structural determination of sphingomyelin by tandem mass spectrometry with electrospray ionization, J. Am. Soc. Mass Spectrom., 11 (2000) 437-449.

[7] Hsu, F. F., Turk, J., Studies on phosphatidylglycerol with triple quadrupole tandem mass spectrometry with electrospray ionization: Fragmentation processes and structural characterization, J. Am. Soc. Mass Spectrom., 12 (2001) 1036-1043.

[8] Hsu, F. F., Turk, J., Charge-remote and charge-driven fragmentation processes in diacyl glycerophosphoethanolamine upon low-energy collisional activation: a mechanistic proposal, J. Am. Soc. Mass Spectrom., 11 (2000) 892-899.

[9] Hsu, F. F., Turk, J., Electrospray ionization/tandem quadrupole mass spectrometric studies on phosphatidylcholines: the fragmentation processes, J. Am. Soc. Mass Spectrom., 14 (2003) 352-363.

[10] Hsu, F. F., Turk, J., Structural characterization of unsaturated glycerophospholipids by multiple-stage linear ion-trap mass spectrometry with electrospray ionization, J. Am. Soc. Mass Spectrom., 19 (2008) 1681-1691.

[11] Ho, Y. P., Huang, P. C., A novel structural analysis of glycerophosphocholines as TFA/K(+) adducts by electrospray ionization ion trap tandem mass spectrometry, Rapid Commun Mass Spectrom, 16 (2002) 1582-1589.

[12] Adams, J., Gross, M. L., Charge-Remote Fragmentations of Closed-Shell Ions—a Thermolytic Analogy, J. Am. Chem. Soc., 111 (1989) 435-440.

[13] Adams, J., Charge-Remote Fragmentations—Analytical Applications and Fundamental-Studies, Mass Spectrom. Rev., 9 (1990) 141-186.

[14] Ma, X., Xia, Y., Pinpointing double bonds in lipids by Paterno-Buchi reactions and mass spectrometry, Angew. Chem. Int. Ed. Engl., 53 (2014) 2592-2596.

[15] Thomas, M. C., Mitchell, T. W., Blanksby, S. J., Ozonolysis of phospholipid double bonds during electrospray ionization: a new tool for structure determination, J Am Chem Soc, 128 (2006) 58-59.

[16] Thomas, M. C., Mitchell, T. W., Harman, D. G., Deeley, J. M., Murphy, R. C., Blanksby, S. J., Elucidation of double bond position in unsaturated lipids by ozone electrospray ionization mass spectrometry, Anal Chem, 79 (2007) 5013-5022.

[17] Thomas, M. C., Mitchell, T. W., Harman, D. G., Deeley, J. M., Nealon, J. R., Blanksby, S. J., Ozone-induced dissociation: elucidation of double bond position within mass-selected lipid ions, Anal Chem, 80 (2008) 303-311.

[18] Brown, S. H., Mitchell, T. W., Blanksby, S. J., Analysis of unsaturated lipids by ozone-induced dissociation, Biochim. Biophys. Acta., 1811 (2011) 807-817.

[19] Poad, B. L., Pham, H. T., Thomas, M. C., Nealon, J. R., Campbell, J. L., Mitchell, T. W., Blanksby, S. J., Ozone-induced dissociation on a modified tandem linear ion-trap: observations of different reactivity for isomeric lipids, J. Am. Soc. Mass Spectrom., 21 (2010) 1989-1999.

[20] Pham, H. T., Maccarone, A. T., Campbell, J. L., Mitchell, T. W., Blanksby, S. J., Ozone-induced dissociation of conjugated lipids reveals significant reaction rate enhancements and characteristic odd-electron product ions, J. Am. Soc. Mass Spectrom., 24 (2013) 286-296.

[21] Stutzman, J. R., Blanksby, S. J., McLuckey, S. A., Gas-phase transformation of phosphatidylcholine cations to structurally informative anions via ion/ion chemistry, Anal Chem, 85 (2013) 3752-3757.

[22] Rojas-Betancourt, S., Stutzman, J. R., Londry, F. A., Blanksby, S. J., McLuckey, S. A., Gas-Phase Chemical Separation of Phosphatidylcholine and Phosphatidylethanolamine Cations via Charge Inversion Ion/Ion Chemistry, Anal Chem, 87 (2015) 11255-11262.

[23] Madsen, J. A., Cullen, T. W., Trent, M. S., Brodbelt, J. S., IR and UV Photodissociation as Analytical Tools for Characterizing Lipid A Structures, Anal. Chem., 83 (2011) 5107-5113.

[24] Zehethofer, N., Scior, T., Lindner, B., Elucidation of the fragmentation pathways of different phosphatidylinositol phosphate species (PIPx) using IRMPD implemented on a FT-ICR MS, Anal. Bioanal. Chem., 398 (2010) 2843-2851.

[25] Liang, X., Liu, J., LeBlanc, Y., Covey, T., Ptak, A. C., Brenna, J. T., McLuckey, S. A., Electron transfer dissociation of doubly sodiated glycerophosphocholine lipids, J. Am. Soc. Mass Spectrom., 18 (2007) 1783-1788.

[26] Campbell, J. L., Baba, T., Near-complete structural characterization of phosphatidylcholines using electron impact excitation of ions from organics, Anal Chem, 87 (2015) 5837-5845.

[27] Yoo, H. J., Hakansson, K., Determination of double bond location in fatty acids by manganese adduction and electron induced dissociation, Anal Chem, 82 (2010) 6940-6946.

[28] Jones, J. W., Thompson, C. J., Carter, C. L., Kane, M. A., Electron-induced dissociation (EID) for structure characterization of glycerophosphatidylcholine: determination of double-bond positions and localization of acyl chains, J. Mass Spectrom., 50 (2015) 1327-1339.

[29] Pham, H. T., Ly, T., Trevitt, A. J., Mitchell, T. W., Blanksby, S. J., Differentiation of complex lipid isomers by radical-directed dissociation mass spectrometry, Anal Chem, 84 (2012) 7525-7532.

[30] Pham, H. T., Trevitt, A. J., Mitchell, T. W., Blanksby, S. J., Rapid differentiation of isomeric lipids by photodissociation mass spectrometry of fatty acid derivatives, Rapid Commun Mass Spectrom, 27 (2013) 805-815.

[31] Hoffmann, W. D., Jackson, G. P., Charge transfer dissociation (CTD) mass spectrometry of peptide cations using kiloelectronvolt helium cations, J. Am. Soc. Mass Spectrom., 25 (2014) 1939-1943.

[32] Cook, S. L., Collin, O. L., Jackson, G. P., Metastable atom-activated dissociation mass spectrometry: leucine/isoleucine differentiation and ring cleavage of proline residues, J. Mass Spectrom., 44 (2009) 1211-1223.

[33] Klein, R. A., Mass spectrometry of the phosphatidylcholines: dipalmitoyl, dioleoyl, and stearoyl-oleoyl glycerylphosphorylcholines, J. Lipid Res., 12 (1971) 123-131.

[34] Klein, R. A., Mass spectrometry of the phosphatidylcholines: fragmentation processes for dioleoyl and stearoyl-oleoyl glycerylphosphorylcholine, J. Lipid Res., 12 (1971) 628-634.

[35] Castro-Perez, J., Roddy, T. P., Nibbering, N. M., Shah, V., McLaren, D. G., Previs, S., Attygalle, A. B., Herath, K., Chen, Z., Wang, S. P., Mitnaul, L., Hubbard, B. K., Vreeken, R. J., Johns, D. G., Hankemeier, T., Localization of fatty acyl and double bond positions in phosphatidylcholines using a dual stage CID fragmentation coupled with ion mobility mass spectrometry, J. Am. Soc. Mass Spectrom., 22 (2011) 1552-1567.

[36] Deimler, R. E., Sander, M., Jackson, G. P., Radical-Induced Fragmentation of Phospholipid Cations Using Metastable Atom-Activated Dissociation Mass Spectrometry (Mad-Ms), Int. J. Mass Spectrom., 390 (2015) 178-186.

[37] Maccarone, A. T., Duldig, J., Mitchell, T. W., Blanksby, S. J., Duchoslav, E., Campbell, J. L., Characterization of acyl chain position in unsaturated phosphatidylcholines using differential mobility-mass spectrometry, J. Lipid Res., 55 (2014) 1668-1677.

[38] Wysocki, V. H., Ross, M. M., Charge-Remote Fragmentation of Gas-Phase Ions—Mechanistic and Energetic Considerations in the Dissociation of Long-Chain Functionalized Alkanes and Alkenes, International Journal of Mass Spectrometry and Ion Processes, 104 (1991) 179-211.

[39] Jensen, N. J., Tomer, K. B., Gross, M. L., Gas-Phase Ion Decompositions Occurring Remote to a Charge Site, J. Am. Chem. Soc., 107 (1985) 1863-1868.

[40] Claeys, M., Nizigiyimana, L., VandenHeuvel, H., Derrick, P. J., Mechanistic aspects of charge-remote fragmentation in saturated and mono-unsaturated fatty acid derivatives, evidence for homolytic cleavage, Rapid Commun. Mass Spectrom., 10 (1996) 770-774.

[41] Murphy, R. C., Harrison, K. A., Fast atom bombardment mass spectrometry of phospholipids, Mass Spectrom. Rev., 13 (1994) 57-75.

[42] Dobson, G., Christie, W. W., Mass spectrometry of fatty acid derivatives, Eur. J. Lipid Sci. Tech., 104 (2002) 36-43.

[43] Griffiths, W. J., Yang, Y., Lindgren, J. A., Sjovall, J., Charge remote fragmentation of fatty acid anions in 400 eV collisions with xenon atoms, Rapid Commun. Mass Spectrom., 10 (1996) 21-28.

[44] Li, P., Hoffmann, W. D., Jackson, G. P., Multistage mass spectrometry of phospholipids using collision-induced dissociation (CID) and metastable atom-activated dissociation (MAD), Int. J. Mass Spectrom., doi.10.1016/j.ijms.2016.02.010 (2016).

[45] Hejazi, L., Ebrahimi, D., Guilhaus, M., Hibbert, D. B., Discrimination Among Geometrical Isomers of alpha-Linolenic Acid Methyl Ester Using Low Energy Electron Ionization Mass Spectrometry, J. Am. Soc. Mass Spectrom., 20 (2009) 1272-1280.

[46] Ann, Q. H., Adams, J., Collision-Induced Decomposition of Sphingomyelins for Structural Elucidation, Biol. Mass Spectrom., 22 (1993) 285-294.

Example 7: On-Line Hydrogen Deuterium Scrambling Using Charge Transfer Dissociation Mass Spectrometry (CTD-MS)

INTRODUCTION

Protein hydrogen deuterium exchange-mass spectrometry (HDX-MS) is an isotopic labeling strategy involving the exchange of heteroatom hydrogens with deuterium over a defined period of time.[1-3] The main focus of HDX-MS methodology is to elucidate regions of protein structure[4,5], folding dynamics[1,6-12] and protein interactions[13-17] via mass shifts caused by the incorporation of deuterium after exchange events. Most commonly, these exchange reactions involve the incubation of protein within a buffered solution containing deuterium oxide.

For solution-based measurements, these isotopic labels would ultimately be located at amide backbone locations that indicate the formation of secondary interactions. Although HDX is complicated by exchange-1 (EX1)[18,19] kinetics resulting from local and global protein fluctuations as well as primary sequences that display intrinsically slow kinetics, the general assumption is that hydrogen bonding networks found in secondary, tertiary and quaternary scaffolds are less frequented by intermolecular interactions with the aqueous solution, thereby resulting in slower exchange for structured regions.

Many HDX-MS experiments use high-performance liquid chromatography (HPLC) consisting of an immobilized pepsin column for online digestion followed by trapping and reversed-phase separation of peptic fragments that are subsequently mass analyzed.[20,21] For fully deuterated proteins, because the process back-exchanges side-chain and unstructured regions to hydrogen, protected backbone amide locations that retain deuterium can be measured. This bottom-up approach is well-suited for elucidating the deuterium retention levels of proteolytic peptides from proteins that were labeled in a native state. Although per-residue deuterium incorporation can be measured from the comparison of two peptides that differ by one residue in length, highly digested samples create complicated datasets that result in unreasonably long analysis times for peptide sequencing and identification.[22,23]

Tandem mass spectrometry (MS/MS) presents a technique that is well suited to site-specific (per-residue) deuterium retention using both top-down[24-26] and bottom-up[27,28] approaches. Early HDX-MS/MS studies employed collision-induced dissociation (CID) to elucidate per-residue deuterium incorporation.[29,30] In general, CID relies on the conversion of translational energy to internal energy via inelastic collisions of selected ions with an inert buffer gas such as helium. Through multiple collisions, the internal energy of the molecular ion increases and fragmentation occurs at the most labile peptide bonds; for proteins and peptides, CID predominantly produces b- and y-type fragment ions.[31]

Although CID combined with HDX has shown some success,[30,32] a particular limitation is hydrogen/deuterium (HD) scrambling. A problem with CID is that it is accompanied by the mobilization of protons.[33] These mobile protons, found on both acidic and basic residues, can migrate throughout the molecule and participate in the fragmentation process.[33] Because proton mobilization occurs before dissociation in CID, the final location of the proton on the product ion is typically different than the initial location on the unactivated precursor ion. Mobilization is obviously problematic when using HDX-MS/MS to target structural areas because redistribution occurs equally for mobile deuteriums as it does for mobile hydrogens. For this reason, structured regions expected to contain higher levels of deuterium could appear lower than the "true" deuterium content value. Conversely, unstructured regions may be artificially enriched. In such cases, per-residue measurements provide ambiguous or erroneous structural information.

More recently, electron capture dissociation (ECD) and electron transfer dissociation (ETD) have been shown to fragment deuterated precursor ions without HD-scrambling.[28,34-38] In contrast to CID, electron-based fragmentation of biomoleuclar ions proceeds through high-energy mechanisms, which proceed through short-lived, odd electron intermediates. This radical-driven fragmentation tends to occur rapidly, before protons can mobilize. ECD and ETD primarily produce c and z ions with significantly fewer b and y ions. Although ECD and ETD can involve the transfer of a proton from a basic side chain to a c ion,[39] such observations can be accounted for and are more predicable than the proton mobilization associated with CID. Importantly, because electron excitation occurs before proton randomization, per-residue HDX studies typically proceed without the loss of the initial deuterium label.

The efficacy of electron based fragmentation processes like ECD and ETD are known to be dependent on the charge state of the precursor ion, with charge states ≥3+ being most efficient. Given that HDX-MS platforms produce often produce peptides in low charge states (i.e. 1+ or 2+) using electrospray ionization, per-residue measurements can be difficult to obtain. ECD and ETD are not compatible with singly-charged precursors. With this in mind, it would be highly desirable to have access to a fragmentation technique that could proceed via odd electron or radical-induced pathways for low charge state precursors and without proton mobilization.

Recently, a new MS/MS technique known as charge transfer dissociation (CTD) of peptides, proteins and polysaccharide ions has been demonstrated using either helium cations[40] or cations from an air plasma.[41] In CTD, the reagent ions have kinetic energies sufficient to overcome the Columbic barrier experienced between the reagent and bimolecular cations. CTD product ions are seen to result from both vibrationally- and radically-driven dissociation pathways that resemble those formed from both CID and ECD/ETD processes.[40,41] In other cases, cation-cation reactions result in both non-dissociative charge reduction and gas-phase supercharging.[41] Of particular interest is the ability of CTD to produce radical fragmentations for precursor ions with charge states of 1+ or 2+. Although the processes that influence these observations are currently difficult to pinpoint, the capability of fragmenting low charge state precursor ions may offer an improvement over traditional techniques.

In the present study, the combination of HDX with CTD-MS is explored. Because HD-scrambling is a concern, a model peptide specifically designed to determine the extent of HD-scrambling[38] is used as a benchmark. These experiments are directly compared to ETD experiments, which have been obtained under non-scrambling conditions. Separate experiments used an online and continuous HDX system coupled with pepsin digestion and simultaneous HDX quenching for structural elucidation of deuterated ubiquitin. Using the non-scrambling conditions found with the model peptide, HDX-CTD-MS results are presented in a proof-of-concept, per-residue structural evaluation of the N-terminal region (residues 1-15) of ubiquitin. Because the N-terminal region contains both the fastest and slowest exchanging residues of the protein, an exchange-out time of ~50 seconds was sufficient to exchange unstructured areas while retaining deuterium within structured regions.

Experimental Section

Sample:

Ubiquitin (bovine erythrocytes, 98%) and lyophilized pepsin (porcine, 3200-4500 units/mg protein), Deuterium oxide (99.9%) and glacial acetic acid (99%) were purchased from Sigma-Aldrich (St. Louis, Mo.). The model peptide (MP) having the sequence KKDDDDDIIKIIK (90.6% purity) was purchased from Genscript (Piscataway, N.J., USA). Proteins and peptides were used without further purification and all other reagents were MS grade or the equivalent.

Sample Preparation:

Ubiqutin Studies. Ubiquitin (1.0 mg) was added to 1.0 mL of $D_2O$ (99.9%). The solution was incubated at 37° C. for 10 days and left for more than 3 weeks at room temperature. This method allowed for ~98% deuterium incorporation of ubiquitin. Pepsin solutions were prepared by adding lyophilized powder (1.0 mg) to 1.0 mL acidified 18 MΩ $H_2O$ (8% glacial acetic acid v:v) at pH~2.0. A schematic of the online system is presented in FIG. 1 and has been previously described.[42] Briefly, the HDX reaction, followed by quenching and simultaneous digestion, was performed using two micro-Tee assemblies (Upchurch Scientific Inc, Oak Harbor, Wa) connected with a PEEK capillary (1588 μm o.d.×152 μm i.d). Using a 500-μL syringe (Hamilton, Reno, Nev., USA), a high precision syringe pump (KD scientific Holliston, Mass., USA) delivered the deuterated ubiquitin solution to the first micro-Tee assembly at a flow rate of 0.60 $\mu L\text{-}min^{-1}$. The instrument-equipped syringe pump delivered the room temperature exchange-out solution at a flow rate of 10.0 $\mu L \cdot min^{-1}$. HDX of deuterated ubiquitin proceeded for ~47.4 seconds over a capillary length of 50.8 cm. A third 500-μL syringe containing ice-cooled pepsin solution (pH ~2.0) was programmed with another syringe pump (KD scientific) to a second micro-Tee assembly at a flow rate of 0.80 $\mu L \cdot min^{-1}$. HDX quenching and simultaneous protein digestion was preformed over a capillary length of 25.4 cm (~30 sec digestion time) and was interfaced directly to the commercial ESI source. The resulting peptic peptides were electrosprayed into the MS instrument using a bias voltage of +4.0 kV at a combined flow rate of 11.40 $\mu L\text{-}min^{-1}$.

Scrambling Control Peptide: For the evaluation of H/D scrambling, MP (1.0 mg) was added to 1.0 mL of $D_2O$ (99.9%) and allowed to incubate for ~24 hours at 25° C. An online time-resolved system for continuous HDX was used for scrambling studies. Briefly, a 500-μL syringe (Hamilton, Reno, Nev., USA) containing the deuterated peptide solution was delivered to a micro-Tee assembly using a high precision syringe pump (KD scientific Holliston, Mass., USA) at a flow rate of 0.20 $\mu L \cdot min^{-1}$. Using the instrument equipped syringe pump, acidified 18 MΩ $H_2O$ (6% acetic acid, pH~2.5) was introduced to the second port of micro-Tee at 10.00 $\mu L \cdot min^{-1}$. The HDX reaction of deuterated peptide occurred over a length of 10.1 cm resulting in an exchange-out time of ~11 seconds. The source region was heated to only 100° C. and the capillary exit potential reduced to +50 V. A detailed list of instrumental parameters to mitigate HD-scrambling is given in the Supporting Information section. Instrumental parameters for ubiquitin HDX studies were selected based upon the peptide exhibiting a 0% scrambling trend (see Supporting Information) during ETD experiments (see below).

Mass Spectrometry Measurements:

Precursor Mass Spectra.

Full mass spectra were collected for all ions by setting the mass analyzer scan parameters over a range of m/z 150 to 2000 and setting the ion charge control (ICC) to a target of $2\times10^5$. Precursor mass spectra were collected over 1.0 minute with 10 μscans/scan.

ETD Measurements.

ETD analysis was conducted on isolated precursor ions using a selection window of ±10 Da around the selected centroid m/z value to avoid off-resonance heating and scrambling. The ICC was disabled and a trap injection time of 1.0 ms was used to control the ion abundance. ETD of precursor ions was enabled by the introduction of fluoranthene radicals into the QIT for 40 ms. ETD Fragmentation spectra were collected for 1.0 minute to adequately sample the resulting isotopic distribution of product ions.

CTD Measurements.

Figures 42A, 42B, 42C:
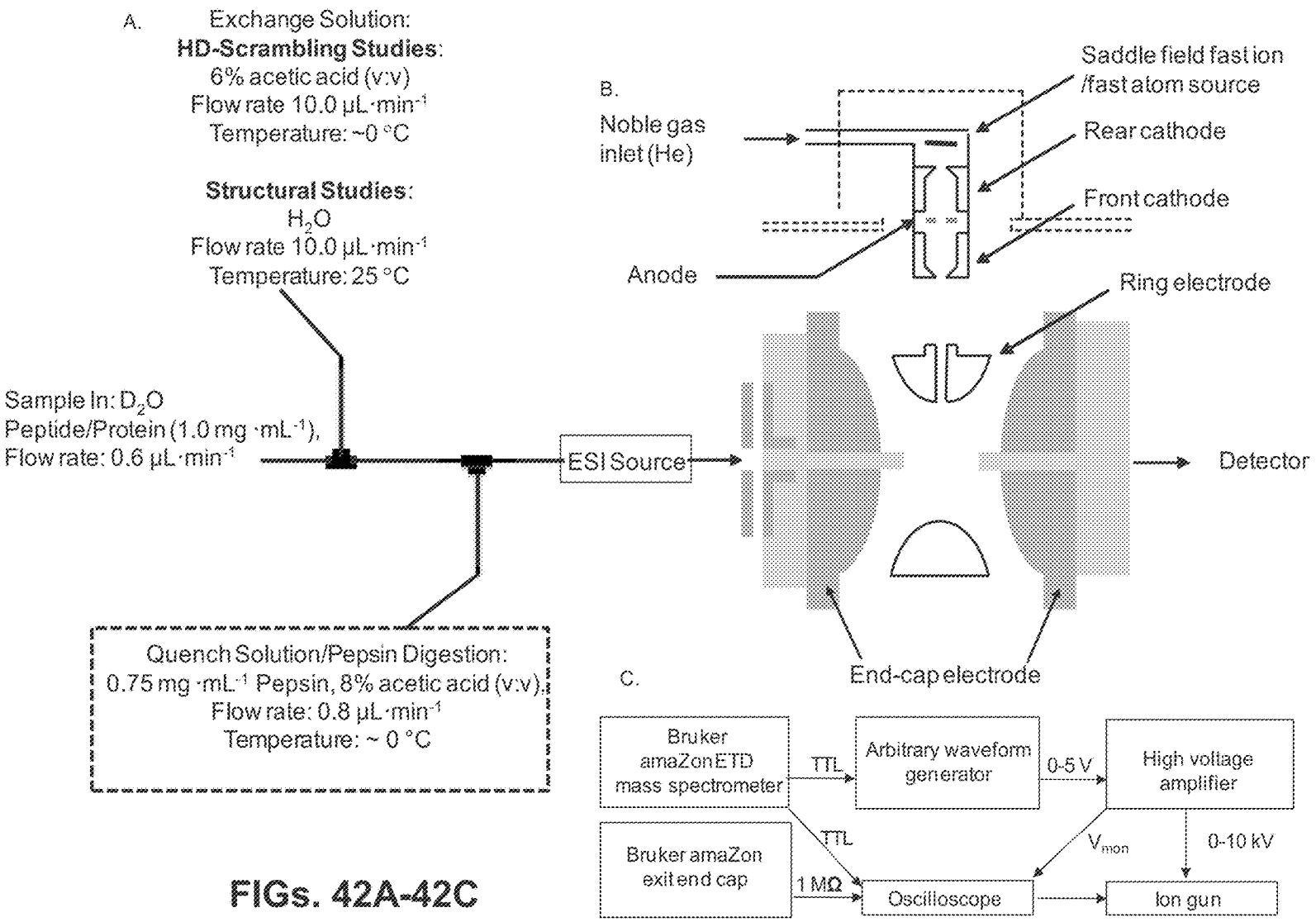
FIGS. 42A-42C shows a schematic representation showing (FIG. 42A) the microfludic online HDX system used in HD-scrambling and structural studies. This system was directly interfaced to the commercial Bruker electrospray ionization source. The dashed-boxed region encompassing the syringe containing the pepsin solution was removed for HD-scrambling studies (FIG. 42B) Modified quadrupole ion trap showing the location of the saddle field ion source for the generation of $He^+$ cations.

CTD measurements were performed similarly to ETD measurements. Briefly, precursor ions were selected using a ±10 Da window around the centroid m/z value to avoid heating the precursor ions. The ICC was disabled and a quadrupole ion trap (QIT) injection time of 50 ms was used, which filled the trap beyond it's ideal space-charge limit. A variable leak-valve was used to control the flow of He gas ($1.40\times10^{-5}$ mbar) through a saddle field source (FIGS. 42A-42C). CTD fragmentation was performed by introducing 6 keV helium cations into the QIT using a square-wave pulse that was synchronized with the period of the scan cycle normally reserved for CID. The CID amplitude was set to zero to simply store the ions at the selected low mass cut-off value (e.g. m/z 150) during exposure to the helium cations. During HD-scrambling analysis of a ions, a low mass cut-off of m/z 230 was used. For the model peptide and HD-scrambling studies, product ion spectra were collected for 2 minutes with the $He^+$ beam enabled followed by background collection for 2 minutes with the $He^+$ beam disabled. For ubiquitin studies, these respective collection periods were 3 minutes and 2 minutes. Precursor and product ion spectra were averaged separately before background subtraction and processing.

Per-Residue Deuterium Measurements.

Mass spectra from both ETD and CTD were exported as ASCII files and converted into text files (.TXT). Using software developed in-house, deuterium retention was calculated from the deconvoluted product ion spectra by weighting $c_{n-1}$-ion or $a_n$-ion isotopologues according to their intensity values. The software creates a text output file containing the weighted-average m/z values for a given isotope envelope. Average m/z values for the unlabeled fragment ions are subtracted from those of the labeled fragment ions of the same charge state. This mass difference is reported as the deuterium content for each detectable fragment ion.

Results and Discussion:

Peptide Control

Studies and HD-Scrambling Evaluation:

To correctly evaluate the ability of CTD to retain deuterium labels, studies employing the model peptide first used ETD experiments to determine non-activating instrumental parameters (i.e., source conditions, transfer optics potentials, and RF amplitudes for ion trapping and isolation). The model peptide was designed by Zehl et al.[38] to contain a fast exchanging N-terminal region and a slow exchanging C-terminal portion; that is, under HDX quench conditions, backbone amide residues including $D^7$ through $I^{12}$ retain their deuterium label for several minutes.[43] FIG. 43 shows a table, which shows the theoretical limits (100% and 0%) for scrambling values calculated for the c-ion series of the model peptide as outlined by Zehl, et. al.[38] After online HDX-ETD-MS of $[M+3H]^{3+}$ peptide ions, a comparison of experimental product ions resulting from ETD resulted in close to the theoretical 0% scrambling trend. This trend shows very little change in fragment-ion deuterium retention across residues $K^1$ through $D^6$, followed by a marked increase in deuterium levels with each successive c ion. In contrast, under activating conditions like CID, this trend is not observed (Table 1) and product ions show higher levels of deuterium content.[38] Such a case would resemble that of the 100% scrambling trend (FIG. 43).

CTD Scrambling Analysis.

Figure 44A:
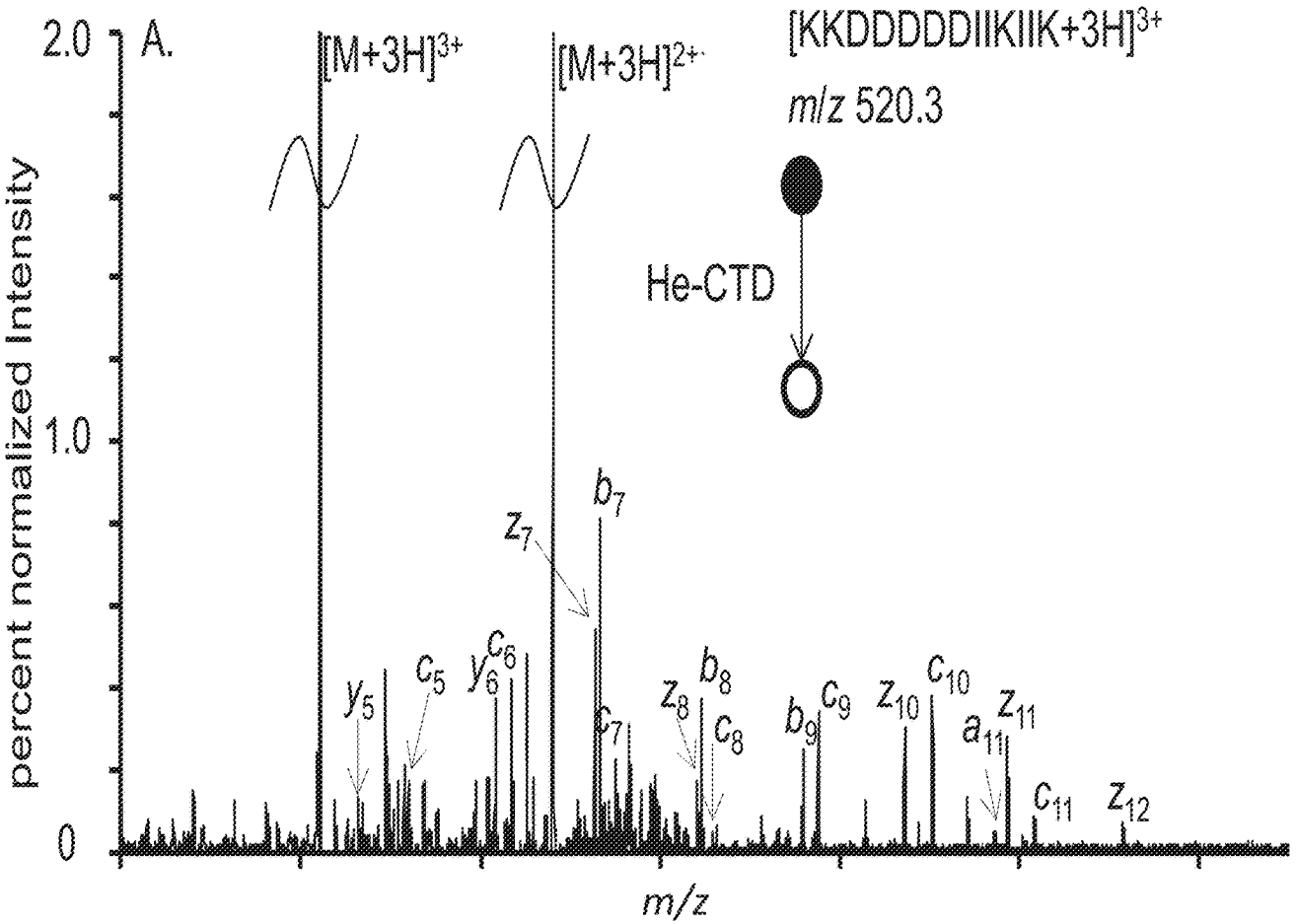
FIGS. 44A-44B show (FIG. 44A) MS/MS (CTD) spectrum of $[KKDDDDDIIKIIK+3H]^{3+}$ precursor ions. Several product ions resulting from various fragmentation pathways are labeled.

FIG. 44A shows the CTD spectrum for the unlabeled $[M+3H]^{3+}$ peptide ions. This spectrum shows that observable c ions sequence much of the model peptide.

Here, it is noted that sequence coverage spans $c_5$ through $c_{12}$, which covers a sizeable portion of the C-terminal region expected to retain deuterium after exchange experiments. Also observable in FIG. 44A are doubly-charged a-ions. These ions also cover both the N and C terminal sections of the model peptide. FIG. 43 gives per-residue deuterium retention changes for fragment ions from the deuterated model peptide. These data were obtained upon HDX-CTD-MS of the $[M+3H]^{3+}$ peptide ions. Identified c and a ions resulting from CTD of the precursor ions were selected for direct comparisons to the theoretical HD-scrambling values (FIG. 43). Here (FIG. 43), product ions generated by CTD appear to match the 0% scrambling values established during the ETD control analysis. In general, coefficients of variation are less than 20% for replicate (N=3) CTD trials. Similar to ETD studies, CTD product ions (FIG. 43) show that the fragment ion deuterium content assessment begins at relatively low levels of retention ($c_5$ and $a_3$ ions). Compared with the theoretical value, the calculated values for these ions (FIG. 43) mirror the deuterium retention level for 0% scrambling. With each successive CTD ion from either ion series, the major deuterium retention appears to begin at residue $I^8$ and sequentially increases across the IIKIIK region, as expected.

He-CTD c ions for HDX-MS. Because of the short interaction times, CTD is presumed to follow vertical activation (not adiabatic), and has been shown to fragment neutral molecules with appearance potentials on the order of 30 eV.[40] CTD therefore activates precursor ions through electronic and vibration modes. Fragment ions were generated and several y, b, c and z ions are identified. It is instructive to consider the c ions produced from He-CTD because they so-closely resemble ETD in position and abundance. For example, FIGS. 45A-45L show a comparison between several deuterated c ions as well as the charge-reduced, singly-charged ions generated from ETD and He-CTD. Both fragmentation techniques are very similar with regard to fragment ion deuterium retention levels and isotopic distributions.

Other studies using a beam of high-energy cations from a gas mixture have also reported c ions from multiply-charged peptides.[41] Although it is difficult to pinpoint the direct mechanisms that produce c ions during He-CTD, it is noted that ETD-type reactions may be generated from side reactions occurring as a result of He cation irradiation. Regardless of the origin of c ions, the results show that the distribution of c ions are very similar to ETD and indicate that He-CTD fragmentation of peptide precursor ions can proceed without HD scrambling.

He-CTD a Ions for HDX-MS.

Figure 46:
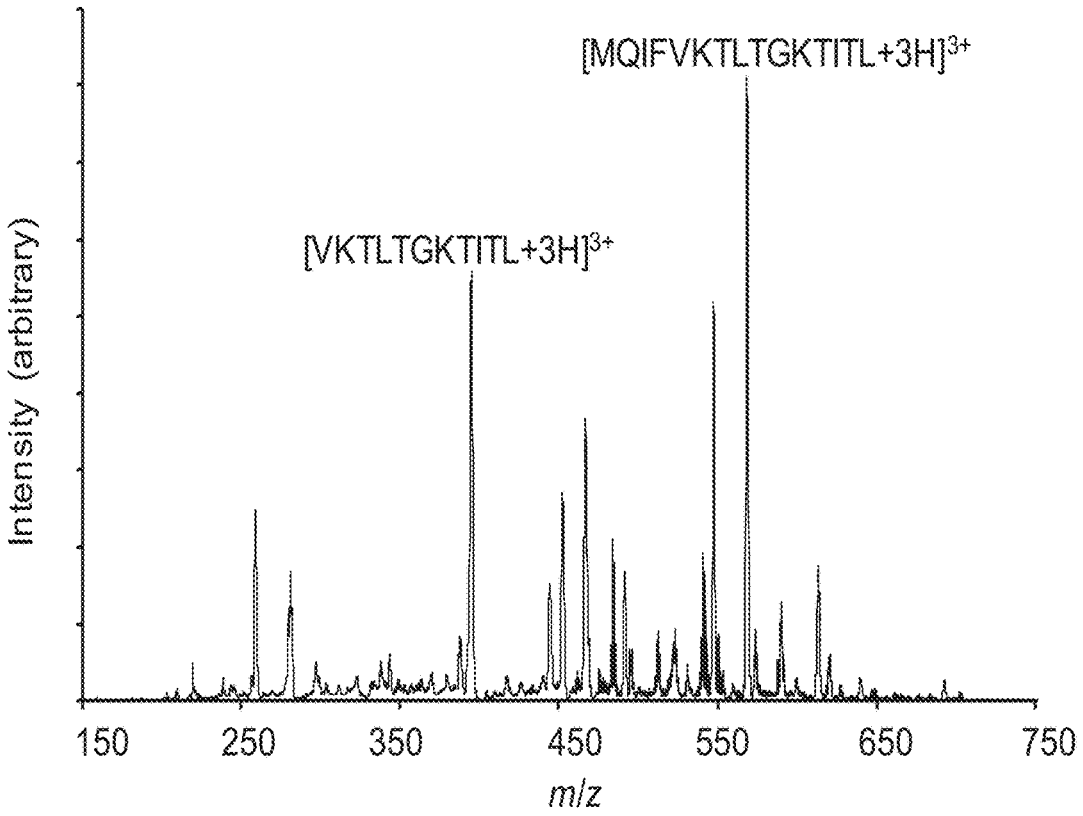
FIG. 46 shows a precursor mass spectrum resulting from HDX-PD-MS of labeled ubiquitin. $[VKTLTGKTITL+3H]^{3+}$ and $[MQIFVKTLTGKTITL+3H]^{3+}$ precursor ions were selected for ETD-MS and CTD-MS structural studies and are identified in the spectrum.

He-CTD generated a ions appear to be similar to those formed by ultraviolet photodissociation (UVPD). That is, a-type ions result from homolytic cleavage of the $C—C_\alpha$ bond to form $a_n$ and $a_n$+1 ions. These a+1 ions suggest that secondary dissociation of b ions to form a ions is not the dominant fragmentation pathway; however, such reactions cannot be ruled out. FIG. 46 shows the isotopic peak intensities for several singly-charged a ions from the $[M+2H]^{2+}$ precursor of the model peptide. The a+1 isotopic peak is significantly more intense than would be expected from a $^{13}C$ isotopic contribution and indicates radical dissociation. Although $a_8$-$a_{13}$ ions were calculated from doubly-charged ions, the singly-charged, a-type ions (FIG. 46) showed a more exaggerated a+1 contribution in the isotopic distribution.

Comparison of a ions (FIG. 43) for the early N-terminal regions show a slightly higher degree of deuterium content relative to c ions generated from both ETD or He-CTD. As mentioned above, this difference may be the result of the a+1 contribution to the average deuterium content value. Another explanation is the method of calculation for deuterium content for each ion series. Because $c_{n-1}$ and $a_n$ ions were used to determine deuterium content at the $n^{th}$ residue, differences in deuterium content values may be expected. More specifically, when determining backbone deuterium content at residue n, $a_n$ ions have more exchangeable locations than $C_{n-1}$ ions. This is especially true given that rapidly exchangeable sites will equilibrate to the percentage of infused deuterium prior to ESI (about 2%). That said, in general, there is a strong correlation between the deuterium content of a ions and c ions generated from either ETD or He-CTD.

Compared to the N-terminal half of the model peptide, a ions on the C-terminal end show slightly reduced deuterium content relative to c ions (FIG. 43). HDX-MS experiments using fully deuterated, monoisotopically selected $[M+H]^+$ peptide cations showed fragmentation by UVPD gives rise to $a_n$-type ions that lose amide deuterium and $C_\beta$ hydrogen from $a_n$+1 ions. Considering these results, a-type ions can lose some amide label which reduces the amount of retained deuterium (FIG. 43). This becomes less of a concern with non-deuterated samples, or at residues that have exchanged out deuterium, because the amide and $C_\beta$ hydrogen are indistinguishable and both contribute to the $a_n$-ion intensity. In this study, the average deuterium content was calculated over all isotopes using a 10 Da isolation window for each selected precursor. This selection window was used in order to limit ion heating during isolation and prevent scrambling. To some degree, averaging isotopic intensities from all precursor isotopes includes elimination reactions, $^2H$ retention and $^{13}C$ contribution to isotopic peak intensities. Although differences in a ions at the C-terminus are noted, overall these ions correlate with the expected deuterium content presented in FIG. 43.

Ammonia Neutral Loss and N-Terminal Scrambling.

Due to the complexity of CTD fragmentation spectra, the wider isotopic distribution of deuterated product ions and the relatively low resolution of the QIT, some product ions are not well resolved and inhibit the determination of accurate deuterium content. The compilation of these limitations has resulted in reduced sequence coverage during HDX-CTD studies relative to ETD. This specific limitation could be overcome if the product ion spectra could be collected with significantly greater resolving power. The reduced sequence coverage is especially true for the N-terminal region of the model peptide, which is a region that is useful for assessing scrambling. Although the larger CTD c ions match the 0% scrambling values (FIG. 43), it should be noted that some studies have indicated a uniform deuterium content increases across these peptides.[37] In part, this is due to the higher population of heteroatom sites that become populated under energizing processes. With this in mind, other studies have shown that ammonia neutral loss of the N-terminal region following ETD can be used to assess scrambling in peptides.[43]

Figure 44B:
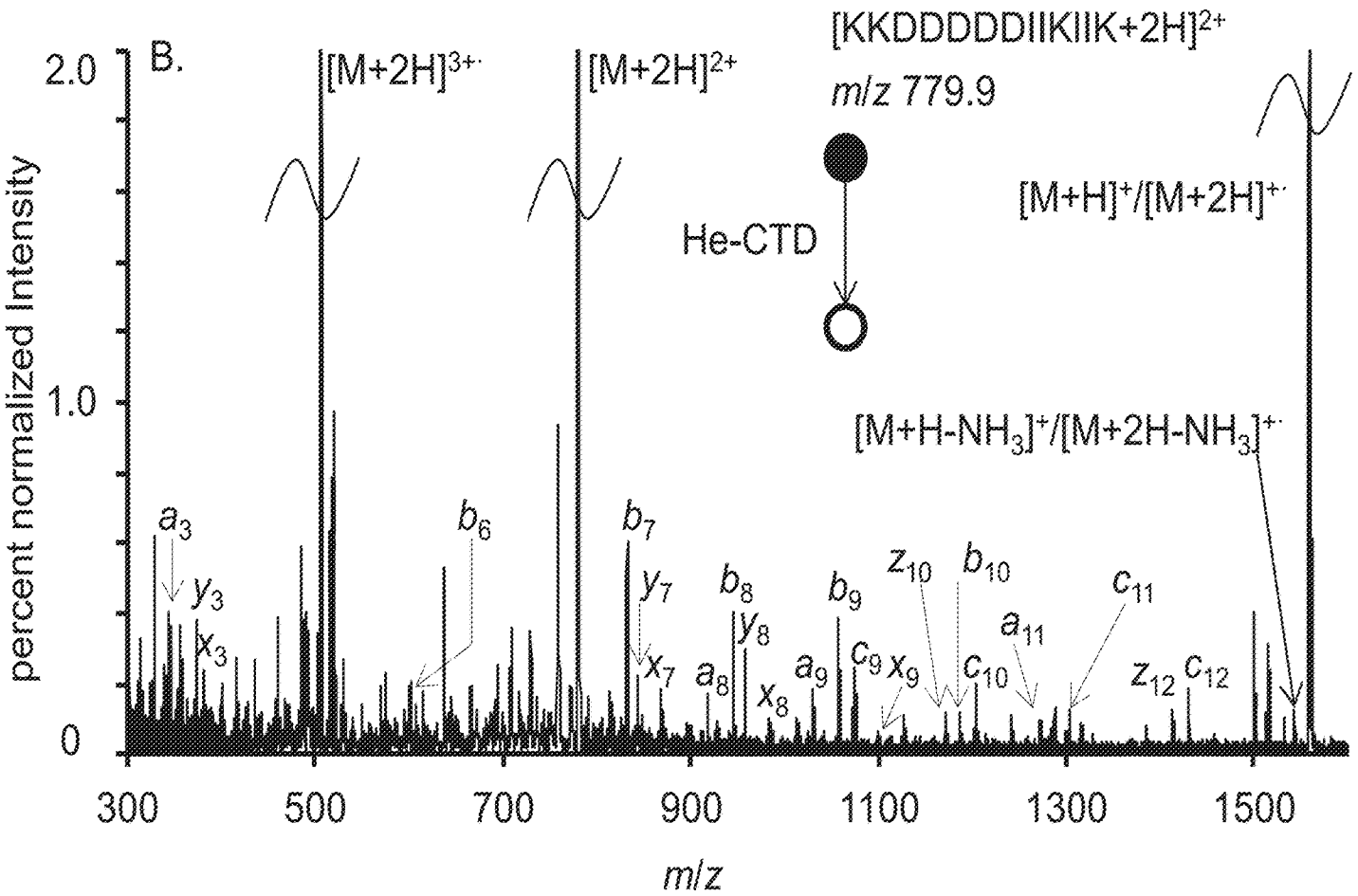

Evaluation of the CTD spectrum for $[M+2H]^{2+}$ ions from the model peptide (FIG. 44B) shows a notable abundance of intact precursor ions formed via electron transfer or H. transfer resulting in charge reduced $[M+H]^{+}/[M+2H]^{+}$. molecular ions. Similar observations have been reported for $[M+2H]^{2+}$ angiotensin ions irradiated with a beam of high-energy plasma cations (air), in which electron transfer appeared to be the predominant mechanism for charge reduction.[41] Here, it is noted that ETD produced inadequate fragmentation of these low charge state ions to warrant discussion.

Evaluation of the isotopic distribution (FIG. 44B) of the charge-reduced molecular ion shows that the charge-reduced product has a calculated mass that is ~1.4 Da greater than the average mass of the peptide. Also present in the CTD spectrum of $[M+2H]^{2+}$ ions (FIG. 44B) is the presence of ammonia-loss product ions ($[M+H—NH_3]^{+}/[M+2H—NH_3]^{+}$.). FIGS. 47A-47B show these ions and the charge-reduced ions after CTD of unlabeled $[M+2H]^{2+}$ precursor ions, respectively. The difference between ions is calculated at 16.6±0.1 Da and is consistent with the loss of ammonia to produce $[M+H—NH_3]^{+}/[M+2H—NH_3]^{+}$. ions. The comparison of the charge-reduced ion and ammonia-neutral-loss ions can be used to monitor scrambling as performed previously for ETD.[43]

CTD studies for the $[M+3H]^{3+}$ or $[M+2H]^{2+}$ precursor ions did not result in a full series of c ions required to fully evaluate HD-scrambling. FIGS. 47C-47D show the ammonia loss and charge-reduced ions upon HDX-CTD of labeled $[M+2H]^{2+}$ precursor ions, respectively. The difference in mass (16.6±0.1 Da) is very similar to that determined for the corresponding unlabeled ions. A statistical model[43] that considers the overall fragment ion deuterium content level and all exchangeable sites suggests that in the case of 100% HD-scrambling, the average theoretical deuterium content of the ammonia-loss ions would be 5.7. Notably, the deuterium retention between the labeled and unlabeled ammonia-loss ions revealed a deuterium retention value of 6.3±0.1 for these ions. [looks more like 6.7 to me—double check] The same total deuterium retention is also observed for the respective charge-reduced ions (FIGS. 47B and 47D).

The agreement between the respective labeled and unlabeled precursor and product ions indicates that scrambling is not observed during the CTD fragmentation processes. That is, under scrambling conditions, upon neutral ammonia loss from a precursor ion, the total deuterium content level would be less than that of the intact ion. These results further indicate that HD-scrambling during the CTD process is largely not observed for the model peptide, which has been specifically designed for HD-scrambling studies.[38]

HDX-CTD-MS Structural Determinations.

With complementary scrambling models indicate that CTD can proceed without proton mobilization, a proof-of-concept study is also used here to demonstrate structural determination capability using ubiquitin as the model protein.

Figure 48:
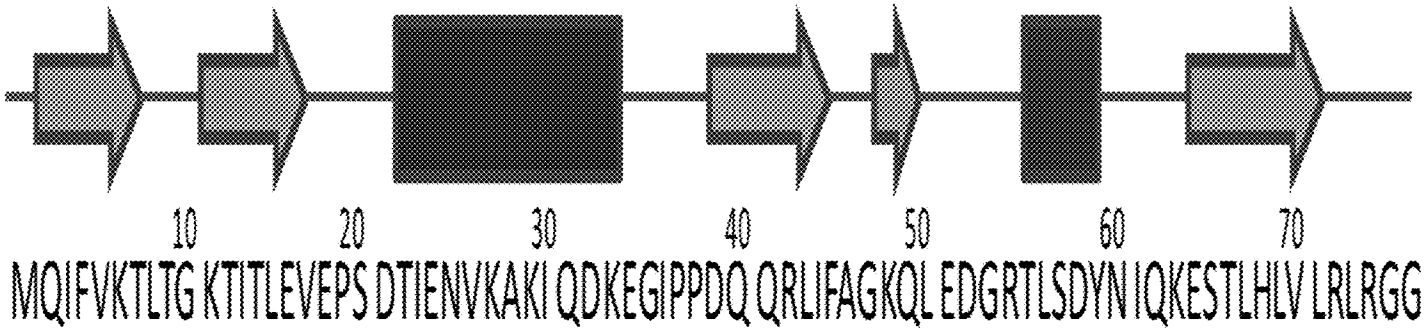
FIG. 48 shows the location of the secondary structural elements of ubiqutin atop the respective regions of primary sequence. Areas in light grey and dark grey represent beta-strands and helical regions, respectively. Portions of primary sequence that reference that correlate with lines connecting the light grey and dark grey areas are turns or unstructured regions. These structural elements have been taken from the ubiquitin crystal structure

Ubiquitin contains 144 labile hydrogens, where 72 are amide backbone, 69 are found on residue side chains and 3 sites are located on the N- and C-terminus. Using a continuous online system, as described previously,[42] HDX of labeled ubiquitin proceeds for ~48 seconds and results in the retention of ~46±1 deuteriums. This value was determined from the average m/z of undigested $[M+6H]^{6+}$, $[M+7H]^{7+}$ and $[M+8H]^{8+}$ ubiquitin ions. Presumably, these deuteriums are more concentrated in structured regions of the protein, which renders them largely inaccessible during the exchange process. FIG. 48 shows the secondary structural features for ubiquitin as a function of the primary sequence. Known structural regions are composed of 5 beta-sheets ($M^{1}$-$L^{7}$, $G^{10}$-$L^{15}$, $Q^{40}$-$F^{45}$, $G^{47}$-$L^{50}$ and $S^{65}$—$R^{72}$), an alpha-helix ($I^{23}$-$E^{34}$) and a 3/10 helix ($L^{56}$-$Y^{59}$).

FIG. 46 shows the spectrum for a single replicate of labeled ubiquitin that has undergone HDX and PD prior to MS analysis. In general, the most intense peptide ion signals appear to originate from the terminal ends of ubiquitin. These observations are similar to previous analyses using a similar online system, which was shown to be highly reproducible with respect to the observed peptide ions, peptide deuterium content and relative ion abundances.[42] Here, it is noted that the goal of this work is to perform He-CTD on peptides originating from a structured region of labeled ubiquitin using an online HDX-PD-MS microfluidic system. The analysis is therefore limited to two peptide ions of the highest abundance that were present in all replicate studies.

ETD Control Analysis of Deuterated Ubiquitin.

Figure 49A:
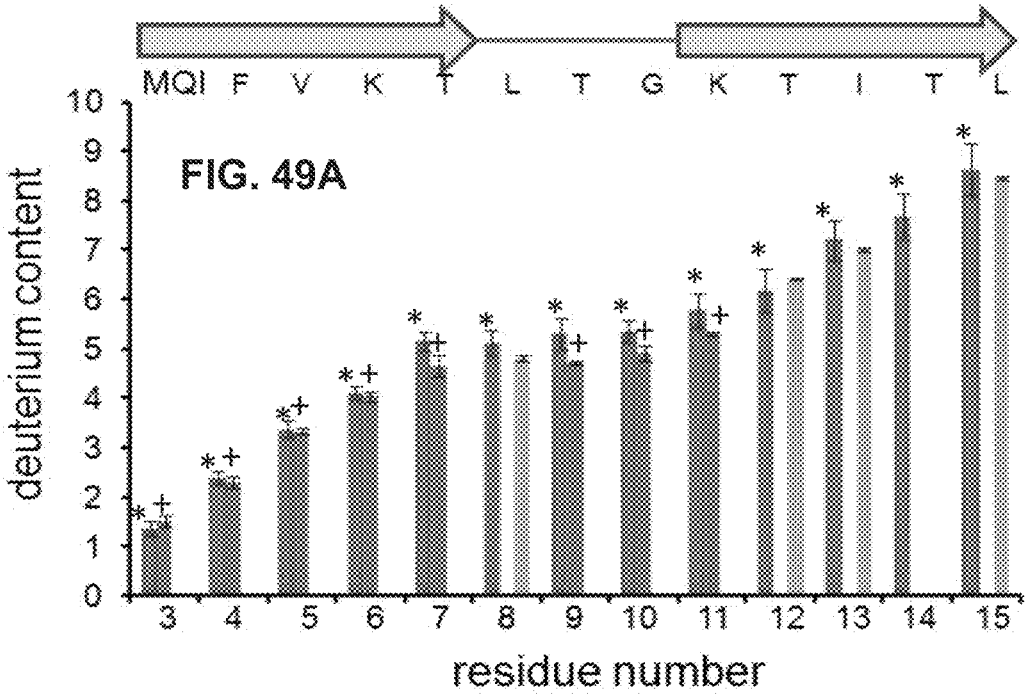
FIGS. 49A-49B show (FIG. 49A) Bar plots showing the total fragment ion deuterium content based on residue number, n, and calculated from the $C_{n-1}$ product ions generated by ETD (*) and CTD (+) as well as $a_n$ product ions generated by CTD of labeled $[MQIFVKTLTGKTITL+3H]^{3+}$ ions. The N-terminal region of ubiquitin spanning a beta strand (residues $M^1$-$T^7$), turn ($L^8$-$G^{10}$) and second beta strand from ($G^{10}$-$L^{15}$) is also shown.

$[MQIFVKTLTGKTITL+3H]^{3+}$ ions generated from HDX-PD-MS measurements were selected for ETD analysis having a total deuterium retention level of 8.7±0.6. A lack of deuterium retention within a region of primary sequence is indicated by similar deuterium content levels for adjacent fragment ions. FIG. 49A shows fragment ion deuterium retention beginning at $I^{3}$ and increasing to $T^{7}$. NMR[46,47] and top-down MS/MS[26,48] studies have shown strong protection across this region. In general, fragment ion deuterium levels as a function of residue appear to correctly map the location of secondary structural elements. For example, no change in deuterium content for fragment ions is observed for residues $L^{8}$-$K^{11}$ and values for residues $T^{7}$-$G^{10}$ are consistent with an unstructured turn between the first and second beta-strands. The fragment ion deuterium content level (FIG. 49A) is observed to increase across residues $K^{11}$-$L^{15}$, which correlates with the location of the second beta-strand (beginning at $G^{10}$). Evaluating the fragment ion deuterium content levels between residues $G^{10}$ and $K^{11}$ shows a change of ~0.43 deuteriums. This small change suggests that residues on the fringe of secondary structural elements are less protected than residues that occupy locations within these elements.[8] With respect to the ETD analysis of [MQIFVK- TLTGKTITL+3H]$^{3+}$ ions, the sequence coverage relative fragment ion deuterium content levels and relation to structural trends are very similar.[42]

Figure 49B:
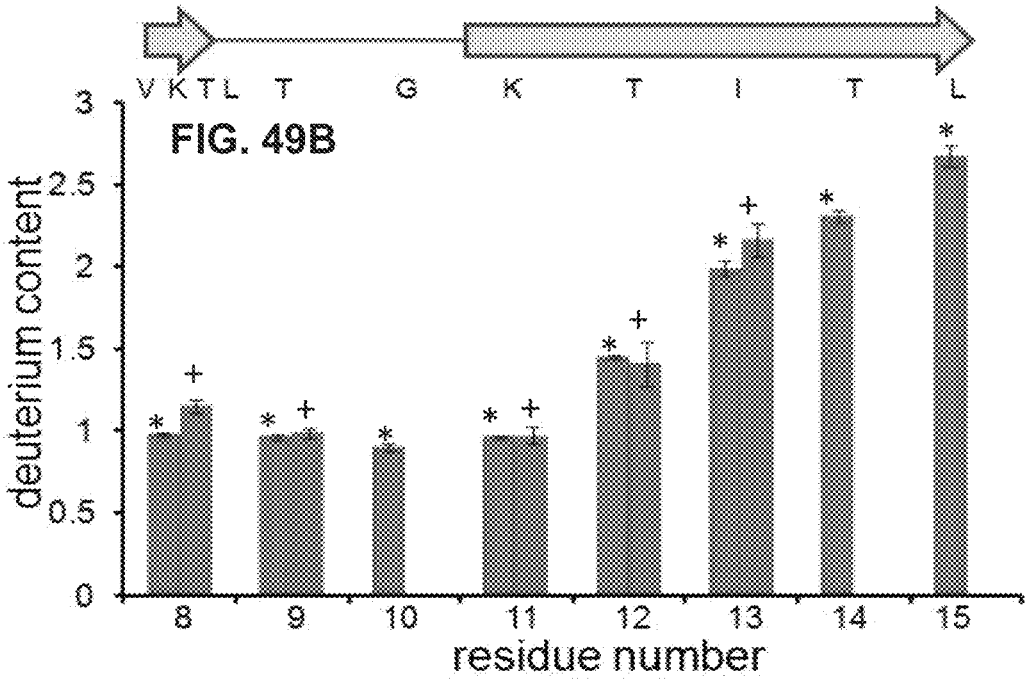

Also originating from the N-terminal region, [VKTLTGKTITL+3H]$^{3+}$ ions were studied using HDX-PD-MS/MS of labeled ubiquitin. Although the sequence overlaps significantly with [MQIFVKTLTGKTITL+3H]$^{3+}$ ions, pepsin digestion at the carboxyl side of $V^5$ significantly changes the deuterium content level. FIG. 49B shows the deuterium content for c ions originating from [VKTLTGKTITL+3H]$^{3+}$ precursor ions after HDX-ETD-MS of labeled ubiquitin. Evaluation of FIG. 49B shows a fragment ion deuterium content level of ~1 at residue $L^8$ after HDX. A reduced deuterium level may be expected because much of the structured N-terminal region has been cleaved. Enzymatic digestion also reacts to form a primary amine from the backbone amide of $V^s$, which can exchange (even under quench conditions) and further reduces the deuterium content level. Residues $T^7$-$G^{10}$ show no change in fragment ion deuterium content, followed by an increase across residues $K^{11}$-$L^{15}$. This trend is similar to that observed for [MQIFVKTLTGKTITL+3H]$^{3+}$ ions (see above) and also appears to correctly map structured areas within ubiquitin.

Per-Residue CTD Structural Analysis.

In order to provide direct comparisons between ETD and He-CTD fragment data for structural analysis, [MQIFVKTLTGKTITL+3H]$^{3+}$ ions generated during HDX-MS were also selected for He-CTD experiments. FIG. 49A shows the deuterium content level for c and a ions resulting from HDX-PD-CTD-MS. Deuterium content for the $c_4$ fragment ion provides the first observation beginning at residue $I^3$ and sequentially increasing to $T^7$. This is followed by an unchanged fragment ion deuterium content value across residues $T^7$-$T^9$. Notably, these levels are similar to those determined from ETD experiments (FIG. 49A). Although a complete homologous series of c ions was not generated, several a ions were informative for determining fragment ion deuterium content levels. FIG. 49A shows the fragment ion deuterium content at the $I^8$ residue which closely matches the deuterium content levels determined from both ETD and He-CTD c ions. The region $T^7$-$K^{11}$ is consistent with the unstructured turn between beta-sheets as mentioned above.

Although the fragment ion deuterium content level for He-CTD ions is slightly lower than that the determined by ETD, it is noteworthy that this region may have exchanged out to a higher degree before He-CTD studies (performed on separate days). That said, other consistencies are noted. For example, fragment ions encompassing the highly structured region between $I^3$—$K^6$ show similar deuterium content levels between ETD and He-CTD. A slight increase in fragment ion deuterium content is observed for residue $K^{11}$ relative to $T^9$. This trend is similar to that for the ETD analysis, where a small increase in deuterium content was observed for $K^{11}$. Again, the a ions were used to determine the fragment ion deuterium content throughout the remaining sequence. Here, the determined deuterium content (FIG. 49A) shows an increase across from $K^{11}$ to $L^{15}$ and is similar to the values obtained from ETD measurements.

Together, these similarities suggest that He-CTD is capable of qualitatively determining areas of structure within labeled proteins and this further indicates that HD-scrambling is largely avoided. It is also noted that the combined evaluation of of c and a ions provided complementary and supplementary information regarding deuterium content levels that could be used to map structured areas. Using ions from both series allowed nearly complete sequence coverage (~92%) for the larger peptide ion. The ability to combine use of the c and a ions and other high-energy fragment ions (FIGS. 44A-44B) is an attractive feature of He-CTD.

FIG. 49B shows the c ions resulting from HDX-CTD-MS of labeled [VKTLTGKTITL+3H]$^{3+}$ ions. A very similar trend to that observed for ETD is noted for these ions. Fragment ions containing a final $L^8$ residue retain ~1 deuterium, which may be expected given the second peptic cleavage event between residues $F^4$ and $V^5$. As mentioned above, digestion converts the backbone amide to a primary amine that subsequently allows $K^6$ to be accessible to exchange. Reduced deuterium content has been reported in other deuterated peptides using pepsin digestion in HDX-MS experiments.[49] The deuterium content level is unchanged across the unstructured region ($L^8$-$K^{11}$) and appears to increase from $K^1$—$I^{13}$. Fragment ions up to residue $K^{11}$ have a slightly lower deuterium content level obtained from [MQIFVKTLTGKTITL+3H]$^{3+}$ product ions. Because this residue is located at the edge of the second beta-sheet, decreased protection may be expected.[8] It is also possible that very limited HD scrambling results in a slightly higher fragment ion deuterium content at residue $L^8$ although, as noted above, no scrambling was detected with the analysis of the model peptide. That said, other consistencies are noted. For example, the fragment ion deuterium content increases at $T^{12}$ and is comparable with ETD data (FIG. 49B) as well as both experiments for [MQIFVKTLTGKTITL+3H]$^{3+}$ ions (FIG. 49A). Another consistency between ETD and He-CTD is the lower deuterium content level across the unstructured region, before the second beta-sheet, which was noted in FIG. 49A.

Evaluation of both peptide ions reveals that He-CTD results in sequence coverage across residues $M^1$-$L^{15}$ and allows for a qualitative view of secondary structure across the N-terminal region. For example, fragment ion deuterium retention for the ion encompassing the $T^{14}$ residue was not observed in the CTD spectrum for [MQIFVKTLTGKTITL+3H]$^{3+}$ ions; however, these fragment ions (FIG. 49B) must exhibit deuterium retention somewhere between that of fragment ions that include the $I^{13}$ and $L^{15}$ residues. Additionally, FIG. 49B shows that fragment ion deuterium content for the $G^{10}$ and $T^{14}$ and $L^{15}$ residues. For the fragment ion terminating in $G^{10}$, the deuterium content must be the same as the flanking fragment ions as no increase in deuterium retention is observed in this region. Although values for $T^{14}$ and $L^{15}$ are not obtained for this peptide ion, deuterium retention is observed in this region for the first peptide using He-CTD results. From the comparison between ETD and the resulting spectral consistencies, these data suggest that HD-scrambling is largely avoided upon CTD.

SUMMARY

Using ETD as the gold standard technique for per-residue HDX studies and a model peptide specifically designed to monitor HD-scrambling, separate experiments show that He-CTD generated c and a ions preserve the solution-phase deuterium label. Additionally this proof-of-principle study reports the first use of He-CTD for the structural interrogation of proteins using an online, continuous-flow device for HDX and protein digestion. Here, c and a ions generated from HDX-PD-CTD-MS of deuterated ubiquitin closely match the deuterium content levels and structural trends reported in separate per-residue studies.[26,4248] One attractive feature of the CTD studies is the ability to use both c and a ions to improve sequence coverage for HDX-MS/MS experiments.

The limited efficiency of CTD, the low-resolution of the QIT, and the complexity of CTD fragmentation limited the number of distinguishable ions in both HD-scrambling and structural studies. Future experiments will tailor the gas flow and emission energy of the cation beam to influence the efficiency and potentially the fragmentation characteristics in a more controlled fashion. As demonstrated in this study, CTD offers the ability to fragment lower charge state ions that would otherwise undergo primarily charge reduction during ETD. The CTD methodology demonstrated herein can be useful in protein structural studies. For bottom-up experiments such as those presented here, the ability to produce site-specific data from low-charge states would increase the achievable protein sequence coverage; a highly desirable condition for successful studies. In top-down approaches used in both solution- and gas-phase HDX experiments, the preservation of solution structure requires ESI from native solutions which favor the formation of low charge states. Here site-specific assessments may find the use of a ions generated from low charge states for structural studies useful as the a ions were here shown to preserve the deuterium label position. Finally, is noted that CTD can increase the charge of biomolecular ions. This capability may be advantageous for gas-phase supercharging allowing CTD to be used in tandem with ETD for site-specific deuterium retention determination.

REFERENCES FOR EXAMPLE 7

(1) Konermann, L.; Pan, J.; Liu, Y.-H. *Chemical Society Reviews* 2011, 40, 1224-1234.
(2) Wales, T. E.; Engen, J. R. *Mass Spectrometry Reviews* 2006, 25, 158-170.
(3) Englander, S. W. *Journal of the American Society for Mass Spectrometry* 2006, 17, 1481-1489.
(4) Zhang, Z. Q.; Smith, D. L. Protein *Science* 1993, 2, 522-531.
(5) Hamuro, Y.; Coales, S. J.; Southern, M. R.; Nemeth-Cawley, J. F.; Stranz, D. D.; Griffin, P. R. *Journal of biomolecular techniques: JBT* 2003, 14, 171-182.
(6) Englander, S. W.; Sosnick, T. R.; Englander, J. J.; Mayne, L. *Current Opinion in Structural Biology* 1996, 6, 18-23.
(7) Engen, J. R. *Analytical Chemistry* 2009, 81, 7870-7875.
(8) Kaltashov, I. A.; Bobst, C. E.; Abzalimov, R. R. *Analytical Chemistry* 2009, 81, 7892-7899.
(9) Kaltashov, I. A.; Bobst, C. E.; Abzalimov, R. R. *Protein Science* 2013, 22, 530-544.
(10) Keppel, T. R.; Weis, D. D. *Analytical Chemistry* 2013, 85, 5161-5168.
(11) Skinner, J. J.; Lim, W. K.; Bedard, S.; Black, B. E.; Englander, S. W. *Protein science: a publication of the Protein Society* 2012, 21, 996-1005.
(12) Katta, V.; Chait, B. T. *Rapid Communications in Mass Spectrometry* 1991, 5, 214-217.
(13) Lee, T.; Hoofnagle, A. N.; Kabuyama, Y.; Stroud, J.; Min, X.; Goldsmith, E. J.; Chen, L.; Resing, K. A.; Ahn, N. G. *Molecular Cell* 2004, 14, 43-55.
(14) Ehring, H. *Analytical Biochemistry* 1999, 267, 252-259.
(15) Sowole, M. A.; Innes, B. T.; Amunugama, M.; Litchfield, D. W.; Brandl, C. J.; Shilton, B. H.; Konermann, L. *Canadian Journal of Chemistry* 2014, 93, 44-50.
(16) Sowole, M. A.; Konermann, L. *Analytical Chemistry* 2014, 86, 6715-6722.
(17) Arndt, J. R.; Brown, R. J.; Burke, K. A.; Legleiter, J.; Valentine, S. *J. Journal of Mass Spectrometry* 2015, 50, 117-126.
(18) Weis, D. D.; Wales, T. E.; Engen, J. R.; Hotchko, M.; Ten Eyck, L. F. *Journal of the American Society for Mass Spectrometry* 2006, 17, 1498-1509.
(19) Sivaraman, T.; Robertson, A. In *Protein Structure, Stability, and Folding*, Murphy, K., Ed.; Humana Press, 2001, pp 193-214.
(20) Mayne, L.; Kan, Z.-Y.; Sevugan Chetty, P.; Ricciuti, A.; Walters, B.; Englander, S. W. *Journal of the American Society for Mass Spectrometry* 2011, 22, 1898-1905.
(21) Zhang, H. M.; Bou-Assaf, G. M.; Emmett, M. R.; Marshall, A. G. *Journal of the American Society for Mass Spectrometry* 2009, 20, 520-524.
(22) Ahn, J.; Cao, M. J.; Yu, Y. Q.; Engen, J. R. *Biochimica et biophysica acta* 2013, 1834, 1222-1229.
(23) Ahn, J.; Jung, M. C.; Wyndham, K.; Yu, Y. Q.; Engen, J. R. *Anal Chem* 2012, 84, 7256-7262.
(24) Huang, R. Y. C.; Garai, K.; Frieden, C.; Gross, M. L. *Biochemistry* 2011, 50, 9273-9282.
(25) Pan, J.; Borchers, C. H. *Proteomics* 2013, 13, 974-981.
(26) Pan, J.; Han, J.; Borchers, C. H.; Konermann, L. *Journal of the American Chemical Society* 2008, 130, 11574-11575.
(27) Landgraf, R.; Chalmers, M.; Griffin, P. *Journal of the American Society for Mass Spectrometry* 2012, 23, 301-309.
(28) Rand, K. D.; Zehl, M.; Jensen, O. N.; Jorgensen, T. J. D. *Analytical Chemistry* 2009, 81, 5577-5584.
(29) Deng, Y.; Pan, H.; Smith, D. L. *Journal of the American Chemical Society* 1999, 121, 1966-1967.
(30) Abzalimov, R. R.; Kaltashov, I. A. *Analytical Chemistry* 2010, 82, 942-950.
(31) Shukla, A. K.; Futrell, J. H. *Journal of Mass Spectrometry* 2000, 35, 1069-1090.
(32) Hoerner, J. K.; Xiao, H.; Kaltashov, I. A. *Biochemistry* 2005, 44, 11286-11294.
(33) Wysocki, V. H.; Tsaprailis, G.; Smith, L. L.; Breci, L. A. *Journal of Mass Spectrometry* 2000, 35, 1399-1406.
(34) Abzalimov, R. R.; Kaplan, D. A.; Easterling, M. L.; Kaltashov, I. A. *Journal of the American Society for Mass Spectrometry* 2009, 20, 1514-1517.
(35) Rand, K. D.; Adams, C. M.; Zubarev, R. A.; Jorgensen, T. J. *J Am Chem Soc* 2008, 130, 1341-1349.
(36) Rand, K. D.; Zehl, M.; Jensen, O. N.; Jorgensen, T. *J. Anal Chem* 2009, 81, 5577-5584.
(37) Rand, K. D.; Zehl, M.; Jorgensen, T. J. *Accounts of chemical research* 2014, 47, 3018-3027.
(38) Zehl, M.; Rand, K. D.; Jensen, O. N.; Jorgensen, T. J. D. *Journal of the American Chemical Society* 2008, 130, 17453-17459.
(39) Syka, J. E.; Coon, J. J.; Schroeder, M. J.; Shabanowitz, J.; Hunt, D. F. Proceedings of the National Academy of Sciences of the United States of America 2004, 101, 9528-9533.
(40) Hoffmann, W.; Jackson, G. *Journal of the American Society for Mass Spectrometry* 2014, 25, 1939-1943.
(41) Chingin, K.; Makarov, A.; Denisov, E.; Rebrov, O.; Zubarev, R. A. *Analytical Chemistry* 2014, 86, 372-379.
(42) Donohoe, G. C.; Arndt, J. R.; Valentine, S. J. *Analytical Chemistry* 2015, 87, 5247-5254.
(43) Rand, K. D.; Zehl, M.; Jensen, O. N.; Jorgensen, T. J. D. *Analytical Chemistry* 2010, 82, 9755-9762.
(44) Cook, S. L.; Collin, O. L.; Jackson, G. P. *Journal of Mass Spectrometry* 2009, 44, 1211-1223.

(45) Misharin, A. S.; Silivra, O. A.; Kjeldsen, F.; Zubarev, R. A. *Rapid Communications in Mass Spectrometry* 2005, 19, 2163-2171.

(46) Johnson, E. C.; Lazar, G. A.; Desjarlais, J. R.; Handel, T. M. *Structure* 1999, 7, 967-976.

(47) Bougault, C.; Feng, L.; Glushka, J.; Kupce, E.; Prestegard, J. H. *J Biomol NMR* 2004, 28, 385-390.

(48) Sterling, H. J.; Williams, E. R. *Analytical Chemistry* 2010, 82, 9050-9057.

(49) Percy, A. J.; Rey, M.; Burns, K. M.; Schriemer, D. C. *Analytica chimica acta* 2012, 721, 7-21.

We claim:

1. A method comprising:

generating a high energy beam of noble gas cations;

passing the high energy beam of noble gas cations into an ion reaction device, where the ion reaction device is part of a mass spectrometer;

contacting an analyte precursor ion present in the ion reaction device with the high energy beam of noble gas cations to produce analyte ion fragments via charge transfer dissociation.

2. The method of claim 1, wherein the noble gas cations are cations of helium neon, argon or krypton.

3. The method of claim 1, wherein the energy of high energy beam of noble gas cations ranges from about 0.1 keV to about 15 keV.

4. The method of claim 3, wherein the energy is about 6 keV.

5. The method of claim 1, further comprising the step of ionizing an analyte to form the analyte precursor ion.

6. The method of claim 1, wherein the analyte molecule has a charge of +1, ≥2+, −1 or ≤−2.

7. The method of claim 6, wherein the analyte molecule has a charge of +1.

8. The method of claim 1, further comprising the step of separating the analyte ion fragments based on their mass to charge ratios, collisional cross sections and/or differential mobilites.

9. The method of claim 1, wherein the analyte precursor ions may be selectively reacted with the reagent cation beam on account of their mass to charge ratios, collisional cross sections and/or differential mobilites.

10. The method of claim 1, further comprising additionally activating the analyte ion fragments and/or the analyte precursor ions.

11. The method of claim 10, wherein the step of additionally activating the analyte ion fragments and/or the analyte precursor ions occurs before, after, or simultaneously with the step of contacting an analyte precursor ion present in the ion reaction device with the high energy beam of noble gas cations to produce analyte ion fragments via charge transfer dissociation.

12. The method of claim 1, wherein the step of additionally the activating ion fragments and/or the analyte precursor ions occurs via a collisional, photo, or electron-based activation method.

13. A mass spectrometer comprising:

a reagent ion source, where the reagent ion source is configured to generate a high energy beam of noble gas cations;

an analyte ion source; and an ion reaction device, where the ion reaction device is operatively coupled to the reagent ion source and the analyte ion source, and where the ion reaction device is configured to contain analyte precursor ions, analyte fragment ions, reagent ions, and combinations thereof.

14. The mass spectrometer of claim 13, further comprising an ion selection device, wherein the ion selection device is operatively coupled to the reagent ion source, the analyte ion source, and/or the ion reaction device, and wherein the ion selection device is configured to separate ions based on mass to charge ratios, collision cross sections or differential mobilities.

15. The mass spectrometer of claim 13, further comprising a detector, wherein the detector is operatively coupled to the ion reaction device and/or the ion selection device, and where the detector is configured to detect analyte ion fragments.

16. The mass spectrometer of claim 13, wherein the noble gas cations are helium cations, neon cations, argon cations, xenon cations or krypton cations.

17. The mass spectrometer of claim 13, wherein the high energy beam of ions has an energy of about 0.1 to about 15 keV.

18. The mass spectrometer of claim 13, further comprising an ion focusing device, where the ion focusing device is operatively coupled to the reagent ion source, analyte ion source, and/or the ion reaction device.

19. The mass spectrometer of claim 18, wherein the ion focusing device increases the effective flux of the noble gas cations.

20. The mass spectrometer of claim 18, wherein the ion focusing device increases the efficiency of charge transfer dissociation between the high energy beam of ions and the analyte molecules.

* * * * *